US005865274A

United States Patent [19]

Kiji et al.

[11] Patent Number: 5,865,274

[45] Date of Patent: Feb. 2, 1999

[54] ELEVATOR GROUP MANAGEMENT CONTROL APPARATUS AND ELEVATOR GROUP MANAGEMENT CONTROL METHOD

[75] Inventors: Junichi Kiji, Urayasu; Shoji Nakai, Hachioji; Mitsuyo Yamaura, Machida; Naoki Imasaki, Urayasu; Susumo Kubo, Hino; Tatsuo Yoshitsugu, Tokyo, all of Japan

[73] Assignee: Kabushiki Kaisha Toshiba, Kawasaki, Japan

[21] Appl. No.: 731,977

[22] Filed: Oct. 23, 1996

[30] Foreign Application Priority Data

| | | | |
|---|---|---|---|
| Oct. 24, 1995 | [JP] | Japan | 7-275185 |
| Oct. 25, 1995 | [JP] | Japan | 7-277610 |
| Feb. 9, 1996 | [JP] | Japan | 8-024054 |

[51] Int. Cl.[6] ..... B66B 9/00; B66B 1/06

[52] U.S. Cl. ..... 187/380; 187/247; 187/391; 187/383

[58] Field of Search ..... 187/249, 380, 187/382, 383, 385, 387, 414, 391

[56] References Cited

U.S. PATENT DOCUMENTS

| | | | |
|---|---|---|---|
| 1,939,729 | 12/1933 | Stark | 187/1 |
| 4,793,443 | 12/1988 | MacDonald et al. | 187/127 |
| 4,946,006 | 8/1990 | Kume | 187/25 |
| 5,090,515 | 2/1992 | Takahashi et al. | 187/16 |
| 5,197,570 | 3/1993 | Matsui | 187/16 |
| 5,419,414 | 5/1995 | Sakita | 187/391 |
| 5,447,212 | 9/1995 | Powell | 187/382 |
| 5,480,006 | 1/1996 | Kameli et al. | 187/383 |
| 5,655,625 | 8/1997 | Barker et al. | 187/249 |
| 5,672,852 | 9/1997 | Whitehall et al. | 187/380 |
| 5,773,772 | 6/1998 | McCarthy et al. | 187/289 |

FOREIGN PATENT DOCUMENTS

| | | |
|---|---|---|
| 4 338084 | 11/1992 | Japan . |
| 5 124781 | 5/1993 | Japan . |
| 6-80324 | 3/1994 | Japan . |
| 6 271274 | 9/1994 | Japan . |
| 6 298467 | 10/1994 | Japan . |
| 6 305648 | 11/1994 | Japan . |

*Primary Examiner*—Robert E. Nappi

*Attorney, Agent, or Firm*—Oblon, Spivak, McClelland, Maier & Neustadt, P.C.

[57] ABSTRACT

In a vertically movable elevator group management control apparatus for control of a plurality of transversely shiftable cars among plural shafts, control is done by storing route data with respect to each said car, generating target floor data including a target floor, based on car call data obtained in correspondence with each said car and station call data as obtained correspondingly to each floor, estimating the time taken for said car to reach said target floor, based on at least said route data, said target floor data and said car call data, and assigning a certain car to a certain floor call, based on the estimated arrival time.

77 Claims, 57 Drawing Sheets

Prior Art

ELEVATOR GROUP MANAGEMENT CONTROL APPARATUS AND ELEVATOR GROUP MANAGEMENT CONTROL METHOD

FIELD OF THE INVENTION

The present invention relates generally to elevator control systems, and more particularly to an elevator group management control apparatus and an elevator group management control method for control of a plurality of enclosed platforms or cars in associated vertical passages or "shafts" while permitting transverse traveling of these cars among the shafts.

BACKGROUND OF THE INVENTION

Conventionally, in cable-driven elevator systems with a plurality of lift passages or "shafts," various kinds of so-called "elevator group management" schemes have been provided in order to increase the transportation efficiency. The elevator group management schemes are to manage or control traveling of elevator platforms or cars (referred to as "cars" hereinafter) not by letting these cars respond individually to landing-place or "station" calls in a car-to-shaft correspondence manner but by determining an appropriate car that should respond to a station call by taking account of the actual traveling conditions of individual cars moving in respective shafts associated.

In the recent years advanced elevator systems have been proposed in order to achieve further enhanced transportation efficiency, one of which is a vertical/transversal movable elevator group control system as has been disclosed in, for example, Published Unexamined Japanese Patent Application (PUJPA) No. 62-275987 and PUJPA No. 3-216477. This system disclosed is the one capable of causing a plurality of cars to move or travel in a single shaft by use of linear motors while allowing them to transversely shift among the shafts. Such elevator system is becoming more attractive in practical applications due to its advantage: the allowable transportation amount can be much improved due to the fact that it enables associative transportable cars to increase in number as compared to the prior known cable-driven elevator systems insofar as the shafts in both systems is identical in number.

Furthermore, the elevator group management control apparatus and the elevator group management control method used in this type of vertically- and horizontally-movable elevator system, such as the one disclosed in PUJPA No. 5-9173, are designed on the concept that a car moves in one direction only (upward or downward) in each shaft and that a car moves in a loop.

In the vertical/transversal movable elevator group control system, the system design is established under the assumption that a plurality of cars are moving in one shaft while permitting their crosswise movement among these shafts; this will possibly lead to occurrence of collision between adjacent ones of the cars. To avoid such collision, especially to retain maximized safety for passengers, several transportation management methods have been developed: one approach is to force the cars to decrease in moving speed eliminating collision by use of a car position detector means; and, another approach is to force the individual car to stop at an appropriate position that may exclude the risk of occurrence of collision.

PROBLEMS TO BE SOLVED BY THE INVENTION

However, the elevator group management control apparatus and the elevator group management control method used in the above-mentioned conventional vertically- and horizontally-movable elevator system has the problems described below.

Unfortunately, the advanced elevator system enabling plural cars to simultaneously move within a single shaft while permitting their transverse movement among shafts does not come without accompanying the problem which follows: in addition to the risk of collision, there will possibly take place some factors adversely serving as a serious bar to accomplishment of successful operation of cars, such as accumulation, congestion, dead lock, or the like. Another disadvantage encountered is that upon occurrence of locally crowded conditions such a s cars' accumulation, delay or dead lock, it will no longer possible without the use of special techniques for avoidance to provide satisfactory services as minimally expected to elevator systems: i.e., assuring maximal services for efficient transportation among floors within a limited time duration.

Furthermore, if there is a free car and an other car that is on call operating in the same shaft, it is necessary to issue an operation instruction to the free car to ensure that it does not present any hindrance to the operation of the car on call.

In addition, by positioning free cars at positions where they can respond quickly to station calls that will arise in the future, it will be possible to further improve traffic efficiency.

Furthermore, when a new station call is generated in the conventional elevator group management control method (elevator group management control method) where a car moves only in one direction in each shaft, it is necessary to respond to the station call according to the direction of the shaft in which each car is moving. This means that, when there is no shaft in which a car moves into the requested direction and therefore no car can respond to the call immediately, a free car in a shaft whose direction is opposite to the requested direction, if available, is not assigned. As a result, the user who generated the new station call must wait long.

In FIG. 57, assume that the operation direction of the first and third shafts is upward and that of the second and fourth shafts is downward in an elevator system with four shafts in a 20-story building. Also assume that car 1 is at the fifteenth floor and car 2 is at the seventh floor in the first shaft, car 3 is at the third floor in the second shaft, car 4 is at the eighteenth floor in the third shaft, and that car 5 is at the tenth floor in the fourth shaft. Also assume that cars 1, 2, and 4 each are in the stopped state at the respective floors and are ready to close the doors to start moving and that cars 3 and 5 are moving in the shafts.

Suppose that a new station call (5, DN) is generated in the situation described above. For car 1 at the fifteenth floor in the first shaft to respond to the new station call, it must first go up to the twentieth, move horizontally to the second shaft, and then go down to the fifth floor. That is, for car 1 to respond to the new station call (5, DN), 21 steps are required, where moving up or down one floor in the shaft and moving from one shaft to another each is counted as one step.

Similarly, to respond to the new station call, car 2 requires 29 steps, car 3 requires 39 steps, car 4 requires 18 steps, and car 5 requires 5 steps. In this case, if car 2 in the first shaft may be reversed, the station call is satisfied in 2 steps; similarly, if car 3 in the second shaft may be reversed, the station call is satisfied in 2 steps. Thus, reversing a car in this manner makes it possible to respond to a new station call quickly.

OBJECTS OF THE INVENTION

The present invention has been made to avoid the problems as faced with the prior art, and the first object of this invention is to provide an elevator group management control apparatus and an elevator group management control method capable of eliminating occurrence of any locally crowded conditions due to cars' congestion, delay or deadlock alike in such vertical/transversal movable elevator system.

And the second object of this invention is to provide an elevator group management control apparatus and an elevator group management control method with which it is possible to place free cars that are neither on station call nor on car call at optimal locations within a plurality of shafts.

In addition, the third object of this invention is to provide an elevator group management control apparatus and an elevator group management control method to enable a car to be moved into the direction in response to a station call by changing the direction of a car regardless of the direction of the shaft, even a vertical/transversal movable elevator system.

SUMMARY OF THE INVENTION

To achieve the first object, an invention according to claim 1 is an elevator group management control apparatus for use in an elevator system comprising a plurality of vertically- and horizontally-movable cars each capable of stopping at a plurality of floors, a car operation control means controlling the operation of the cars, one or more station call registration means installed in the station of each floor, and a car data detection means detecting the state of each of said cars, said elevator group management control apparatus comprising: route data storage means for storing therein route data with respect to each said car; a call data storage means for storing call data consisting of car calls from each of said cars and station calls assigned to each car; target floor instruction means for generating target floor data including a target floor based on call data stored in said call data storage means and station call data stored in said station call registration means; arrival time estimation means for estimating a time as taken for said car to reach said target floor based on said route data, said target floor data, said call data and car data detected by said car data detection means; and assignment instruction means for assigning based on the estimated arrival time as obtained by said arrival time estimation means a certain car to a certain floor call.

According to the invention as claimed in claim 1, highly efficient car transportation responsive to any station calls can be achieved and car calls.

Thus, an invention to achieve the first object described in this application is as follows. The route along which each car moves is pre-defined because it moves in each shaft in one direction only and, therefore, it is possible to estimate how long it will take for each car to arrive at a floor requested by a station call or a car call. This estimated time is used to calculate a time to respond to a call (wait time) or a service time (time from when a station call is received to when a car arrives at a requested floor) and, based on these calculated times, a new station call is assigned to a car which will be able to respond to the call first.

To achieve the second object, an invention according to claim 8 is an elevator group management control apparatus employed in an elevator system provided with a plurality of cars that make vertical and horizontal movement to service a plurality of floors, a car operation control device that governs operation of said cars, one or more station call registration devices installed at a station of each of said floors and a car data detection device that detects a state of each of said cars, wherein: a free car, which is on neither station call nor car call, is placed at a floor where said free car will not hinder operation of other cars and also said free car can respond quickly to a new station call that will arise subsequently.

According to the invention as claimed in claim 8, when performing elevator group management control, by positioning free cars at the traverse floors within the shafts where the cars are currently present, even if a free car comes to present a hindrance to the operation of another car that is on call, it can be made to make traverse movement into another shaft achieving an improvement both in operational efficiency and safety.

Thus, an invention to achieve the second object described in this application is as follows. "No call cars", each having neither a station call nor a car call, are arranged at an appropriate position in a plurality of shafts to better control car operation without obstructing the operation of a car having a call, further increasing car operation efficiency.

To achieve the third object, an invention according to claim 54 is an elevator group management control apparatus for use in an elevator system comprising a plurality of vertically- and horizontally-movable cars each capable of stopping at a plurality of floors, a car operation control device controlling the operation of the cars, one or more station call registration devices installed in the station of each floor, and a car data detection device detecting the state of each of said cars, said elevator group management control apparatus comprising: checking, for a target car to be checked if the car is to respond to a new station call, the operation state of the other car in the same shaft of the target car and the operation state of some other car moving horizontally from some other shaft and reversing said target car when it is confirmed that said target car, if reversed, will not collide with any of said other cars and when it is determined that said target car is able to arrive at the floor requested by the new station call first.

According to the invention as claimed in claim 54, when determining a car to be used in response to a new station call during elevator group management control, it is possible, before responding to the new station call, to check whether or not there is a car to be reversed without considering the current direction of each shaft, and, if there is such a car, to change the operation direction of the car as necessary.

Thus, an invention to achieve the third object described in this application is as follows. The direction of a shaft may be changed as necessary to allow a car to be reversed. This makes it possible to assign a station call to a car, which will be able to respond to a new station call first, without being limited by the direction of a shaft.

SYMBOLS

Figure 1:
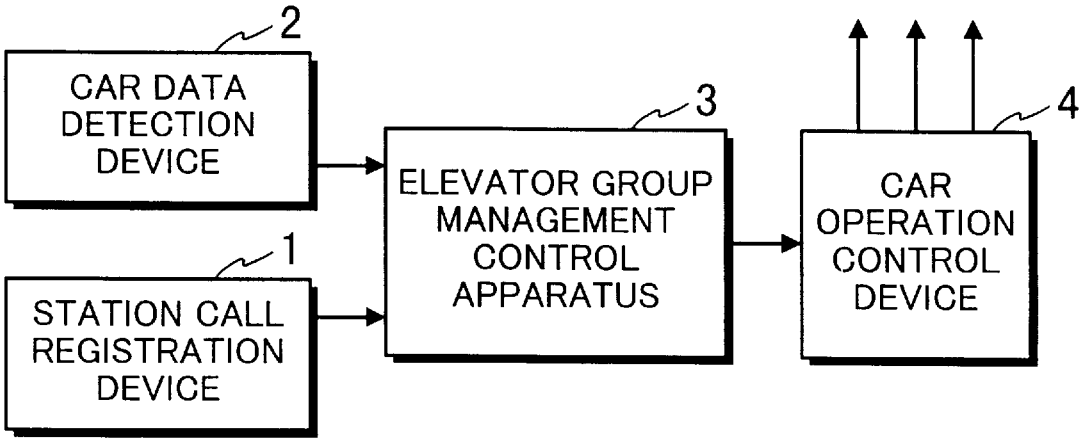
FIG. 1 is a diagram showing a configuration of a vertically/transversal movable elevator group management control apparatus in accordance with one preferred embodiment of the present invention.

1 . . . Station call registration device
2 . . . Car data detection device
3 . . . Elevator group management control apparatus
4 . . . Car operation control device
21 . . . Call data storage device
22 . . . Target floor instruction device
23 . . . Arrival time estimation device
24 . . . Route data storage device
25 . . . Assignment instruction device
26 . . . Operation instruction device
110 . . . Call data storage device
120 . . . Route data storage device
130 . . . Assignment instruction device
140 . . . Free car search device
150 . . . Free car stop position specifying device
160 . . . Operation instruction device
210 . . . Call data storage device
220 . . . Direction data storage device
230 . . . Number-of-shafts detection device
240 . . . Shaft data storage device
250 . . . Horizontal movement destination detection device
260 . . . Reversing car determination device
270 . . . Assignment instruction device
280 . . . Operation instruction device
290 . . . Route data storage device
300 . . . Horizontally-moving floor arrival estimation device
310 . . . Re-assignment instruction device
1510 . . . Next traverse floor detection device
1511 . . . Free car stop position determining device
1520 . . . Succeeding car operation scheduled position detection device
1521 . . . Free car stop position determining device
1530 . . . Preceding car operating floor detection device
1531 . . . Free car stop position determining device
1540 . . . Car separation calculating device
1541 . . . Free car stop position determining device
1550 . . . Preceding and succeeding car operation data detection device
1551 . . . Car separation calculating device
1552 . . . Free car stop position determining device
1560 . . . No station call floor detection device
1561 . . . Free car stop position determining device
1570 . . . No station call floor detection device
1571 . . . Station call frequency calculating device
1572 . . . Free car stop position determining device
1580 . . . Free car inclusion judging device
1581 . . . Free car stop position determining device
1590 . . . Holding area condition judging device
1591 . . . Free car stop position determining device
15100 . . . No station call floor detection device
15101 . . . On-route data storage device
15102 . . . Free car stop position determining device
15110 . . . No station call floor detection device
15111 . . . Station call delete data storage device
15112 . . . Free car stop position determining device
15120 . . . Station call delete data storage device
15121 . . . Free car stop position determining device
15130 . . . Free car stop position review instruction device
15131 . . . Free car stop position determining device
1601 . . . Opposite direction car selection module
1602 . . . Unchecked car selection module
1603 . . . Station call finding module
1604 . . . Car call finding module
1605 . . . Movement direction finding module
1606 . . . Shaft direction finding module
1607 . . . Other-car finding module
1608 . . . Other-car call finding module
1609 . . . Horizontal movement finding module
1610 . . . Reversing car storage module
1611 . . . Check finish confirming module
1612 . . . Reversing car specifying module
1613 . . . Car call position finding module
1614 . . . Other-car direction finding module
1615 . . . Horizontally-moving floor finding module
1616 . . . Route crossing finding module
1617 . . . Horizontally-moving route finding module
1618 . . . Horizontally-moving floor arrival car finding module
1619 . . . After-horizontal-movement direction finding module
1620 . . . Other-car-between-floor finding module

DETAILED DESCRIPTION OF PREFERRED EMBODIMENTS

Referring to the drawings, there are shown some embodiments of this invention.

The first to eighteenth embodiments relate to an invention to achieve the first object described above. In those embodiments, the route along which each car moves is pre-defined because it moves in each shaft in one direction only and, therefore, it is possible to estimate how long it will take for each car to arrive at a floor requested by a station call or a car call. This estimated time is used to calculate a time to respond to a call (wait time) or a service time (time from when a station call is received to when a car arrives at a requested floor) and, based on these calculated times, a new station call is assigned to a car which will be able to respond to the call first.

The nineteenth to thirty-first embodiments relate to an invention to achieve the second object described above. In those embodiments, no call cars, each having neither a station call nor a car call, are arranged at an appropriate position in a plurality of shafts to better control car operation without obstructing the operation of a car having a call, further increasing car operation efficiency.

The thirty-second to thirty-seventh embodiments relate to an invention to achieve the third object described above. In those embodiments, the direction of a shaft may be changed as necessary to allow a car to be reversed. This makes it possible to assign a station call to a car, which will be able to respond to a new station call first, without being limited by the direction of a shaft.

It is to be noted that in the explanation of each of the embodiments presented below, it is assumed that at their current positions, all the cars are in a stationary state. The reason for this is that if a car is not in a stationary state, the indicated current position of the car relative to a call is not always the actual location where the car is being operated. In addition, from the perspective of ensuring operational safety, it is also necessary to take into consideration the position where an immediate stop is possible in response to a stop instruction (sometimes referred to as an advancer position).

Consequently, in regard to a car data detection device 2 in each of the following embodiments, too, it is assumed that it detects an advancer position as a current position based upon the actual current position and the current speed and unless specifically stated otherwise, the current position as referred to in this specification means the advancer position. However, if a car is in a stationary state, the current position equals current position (advancer position).

[A. Embodiments Referring to the Invention for Attaining the First Object]

[1. First Embodiment]

This embodiment relates to an elevator group management control apparatus corresponding to recitation of claim 1 and an elevator group management control method as preferably employed therein.

[1-1. Configuration of the First Embodiment]

FIG. 1 is a diagram showing a configuration of a longitudinal/transverse movable elevator group management control apparatus in accordance with the first embodiment of the present invention. As shown in this drawing, the elevator group control apparatus in accordance with this embodiment is made up of a station call registration device 1 provided at a landing-place or "station" on each floor in the building, a car data detection device 2 for detection of "car data" indicative of each car's position, moving speed, weight and others, an elevator group management control apparatus 3 for acquisition of command data for use in controlling the individual car based on various kinds of information as obtained from the station call registration device 1 and car data detection device 2, and a car operation control device 4 for controlling cars' traveling operation based on the command data.

[1-1-1. Configuration of Elevator group management control apparatus]

Figure 2:
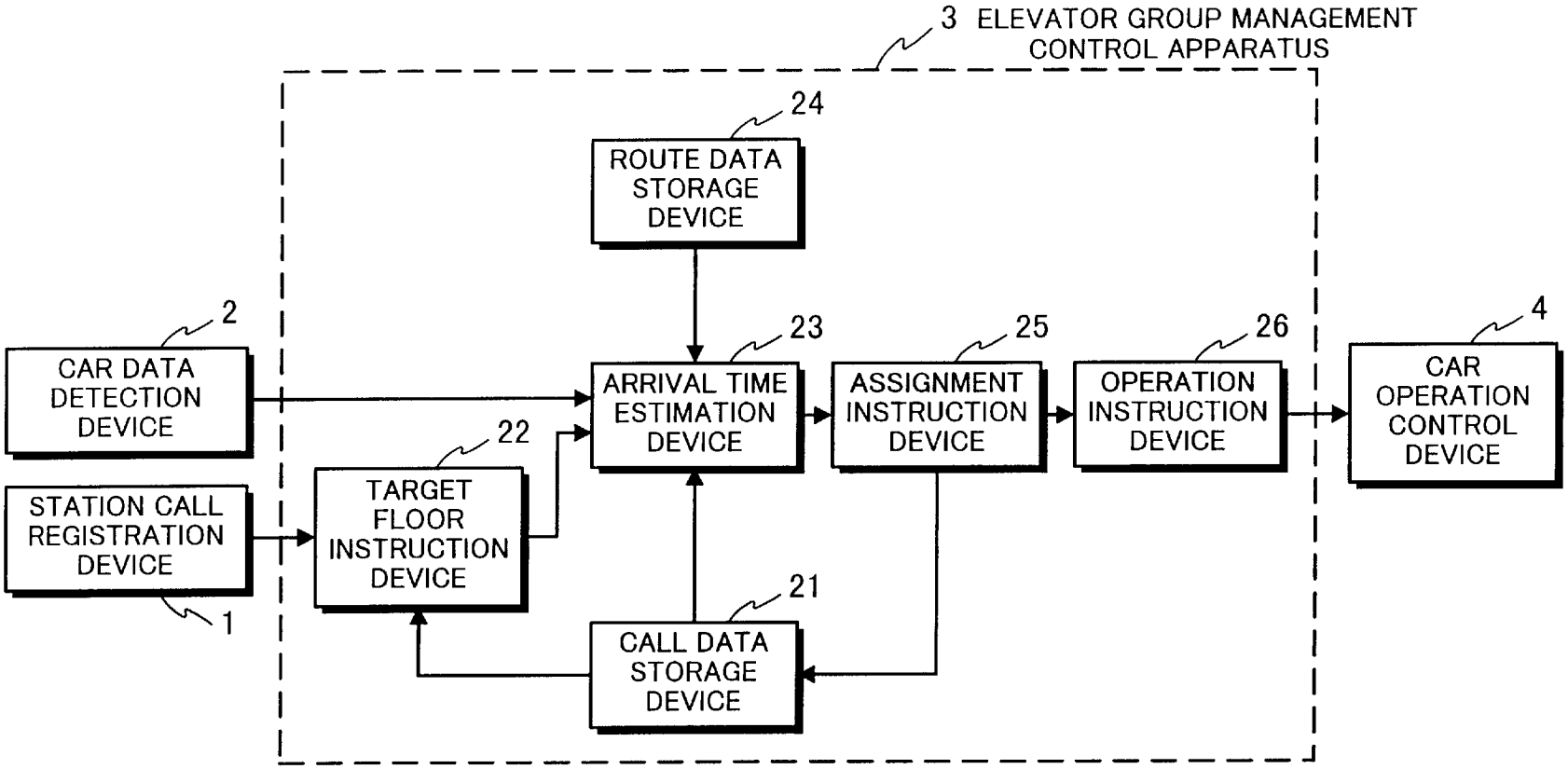
FIG. 2 is a diagram showing a configuration of an elevator group management control apparatus in accordance with the first embodiment of the present invention.

The elevator group management control apparatus 3 is constituted from several devices or modules shown in FIG. 2.

More specifically, it is comprised of a call data storage device 21 for storage of "call data" consisting of car calls each issued by a passenger inside a car to assign his or her desired floor and one or more station calls as presently assigned;

- a target floor instruction device 22 which provides the "target floor data" of each car based on the "station call data (floor and direction)" registered by said station call registration device 1 and "call data" of each car as prestored in the call data storage device 21;
- a route data storage device 24 that stores the route along which each car is to travel, as the "route data";
- an arrival time estimation device 23 which calculates or computes for every car the time taken for each car to reach its target floor based on the "car data" of each car as obtained by said car data detection device 2, the "call data" of each car acquired from the call data storage device 21, the "target floor data" of each car obtained from the target floor instruction device 22, and the "route data" read out of the route data storage device 24, thus generating and issuing at its output the resulting value as an estimated arrival time;
- an assignment instruction device 25 which attempts to assign a call to a certain car based on the estimated arrival time for the target floor as estimated in said arrival time estimation device 23, while updating the "call data" being stored in said call data storage device 21; and,
- an operation instruction device 26 which determines depending upon car's present operating condition whether its expected stop or "landing" position instructed by the assignment instruction device 25 serves newly as a successive stop or landing position, and which issues a command to the car operation control device 4 thereby altering or modifying car's traveling operation on occasions where it becomes the next stop position.

[1-2. Operation of the First Embodiment]

The first embodiment thus arranged operates as follows.

[1-2-1. Call Data Storage Processing]

In the call data storage device 21 shown in FIG. 2, the call type, floor, direction and elapsed time are stored as the "call data" with respect to each car in a specific format shown in Table 1.

TABLE 1

| Car | (Call Type | Floor | Direction | Elapsed Time) |
|---|---|---|---|---|
| E1 | (H | 16 | DN | 5) |
| | (H | 12 | DN | 20) |
| | (C | 4 | DN | 20) |
| E2 | (C | 9 | DN | 22) |
| | (H | 3 | UP | 10) |

Note here that the "call type" is for identification of a call from station "H" or a call from car "C" whereas the "floor"

represents either the floor of a station call as presently assigned or the one being subject to a car call (a floor whereat more than one passenger wants to get off). Also, the "direction" indicates whether the car's moving direction is upward "UP" or downward "DN" whereas the "elapsed time" refers to the actual elapsed time taken from occurrence of such call to a present time.

For example, in Table 1, the "call data" as defined by (H 16 DN 5) for one car E1 represents an event that "a downward station call is generated on the sixteenth floor after elapse of five seconds from call generation"; the "call data" as defined by (C 9 DN 22) for another car E2 indicates an event that "car E2 contains at least one passenger who wants to land on the ninth floor after a downward run with a car call registered 22 seconds before."

Note that said "elapsed time" may be updated by registration, deletion or search of the "call data."

[1-2-2. Target Floor Instruction Processing]

In the target floor instruction device 22 shown in FIG. 2, the "target floor data" is obtained by a preselected method based on the "station call data (floor and direction)" registered by the station call registration device 1 and each car's "call data" as stored in the call data storage device 21. Table 2 below shows one exemplary "target floor data" obtained.

TABLE 2

| Car | (Call Type | Floor | Direction | Elapsed Time | Assignment) |
|---|---|---|---|---|---|
| E1 | (H | 5 | UP | 0 | null) |
| E2 | (H | 5 | UP | 0 | null) |

While Table 2 indicates the case where one or more passengers who want an up-going elevator are on the fifth floor, the both cars are "null" in the "assignment" item because no practical assignment was done yet.

Additionally, these "target floor data" items are arranged so as to be sent forth toward an arrival time estimation device 23 as will be described later.

[1-2-3. Route Data Storage Processing]

The route data storage device 24 shown in FIG. 2 stores therein any possible route along which each car is expected to move or travel, as the "route data."

Figure 3:
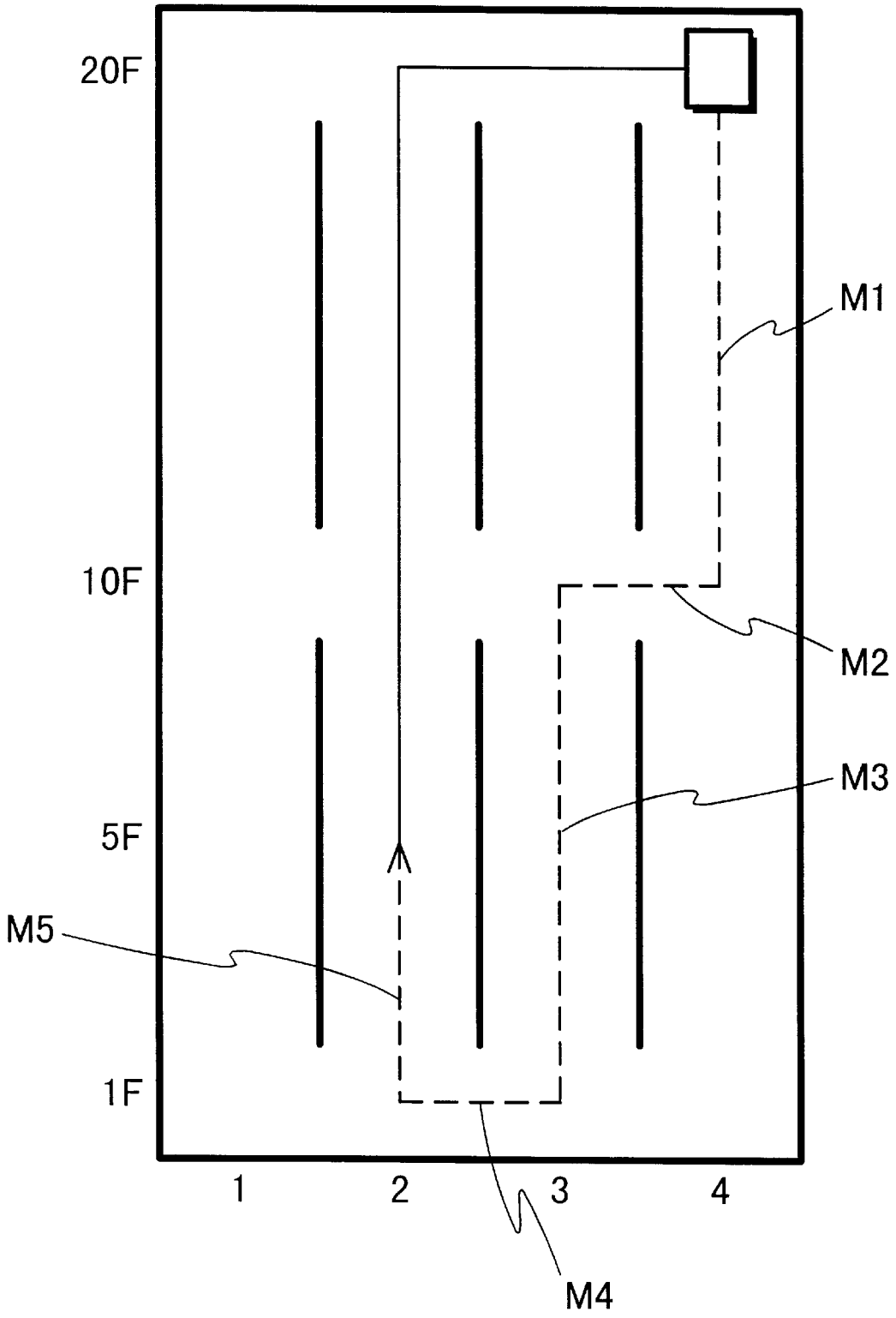
FIG. 3 is a diagram for explanation of one exemplary route along which a car is expected to travel.

FIG. 3 is a diagram for explanation of one route along which each car is required to move. For instance, in a building structure with twenty floors and four associated vertical lift passages or "shafts," one transportation route is illustrated using dotted line, wherein a car that is presently at the level of the twentieth floor in the fourth shaft is expected to respond to an upward station call as generated on the fifth floor. Specifically, one possible route to respond such station call is that the subject car moves down in the fourth shaft to the tenth floor (M1), then transversely moves to shift to the third shaft at the level of the tenth floor (M2), next goes down to the first floor (M3), further moves to the second shaft on the first floor (M4), and finally moves up to the fifth floor in the second shaft.

Where a transportation route is defined with respect to each car, such data is stored as the "route data" in the form shown in Table 3. For example, the "route data" for car E1 means that one route is given to the car E1 as a presently required moving path which follows: the transverse-shifting floor is the first, tenth and twentieth ones; at the first-floor level, the car is required to transversely move thus shifting from the third to the second shaft; on the twentieth floor, it is expected to transversely move shifting from the second to the fourth shaft; at the tenth floor, it transversely shifts from the fourth to the third shaft.

TABLE 3

| Car | (Tranverse Floor | Transverse Shaft) |
|---|---|---|
| E1 | ( 1 | 2 3) |
| | (20 | 4 3 2) |
| | (10 | 3 4) |

[1-2-4. Arrival Time Estimation Processing]

In the arrival time estimation device 23 shown in FIG. 2, the time taken for each car to reach its certain target floor is calculated with respect to every car based on four kinds of data items which follow: the "car data" of each car as obtained from said car data detection device 2, each car's "call data" obtained from the call data storage device 21, each car's "target floor data" obtained from the target floor instruction device 22, and the "route data" read from the route data storage device 24. The resulting values are then output as the estimated arrival time to the assignment instruction device 25.

It should be noted in the illustrative embodiment that the estimation of arrival time for a given car toward its target floor is performed under the assumption that the remaining cars excluding the subject car do not have any newly entered station calls as their target station data. In other words, on occasions where one certain car should respond to a new station call, this means that the other cars will not respond to such station call any more. More specifically, the other cars do not have as the target station data any stop positions excluding the floors relating to the car/station calls which have been already stored in the call data storage device 21.

It is also assumed that in a later described fourth embodiment, when derivative car call estimation is to be done, any stop or "land-on" positions other than the car/station/derivative-car calls are prevented from acting as the target floor data. It is further assumed that the maximum velocity, acceleration, deceleration, door's open/close time durations and the time required for cars to move are all predefined as the specific standardized values.

One preferable arrival time estimation scheme will be described later in the description.

[1-2-5. Assignment Instruction Processing]

In the assignment instruction device 25 shown in FIG. 2, a call is assigned to a certain car based on the resultant estimated arrival time to the target floor as estimated at said arrival time estimation device 23, while allowing the contents of the call data storage device 21 to be updated as necessary.

The following example is drawn to the case where a certain car is assigned by the assignment instruction device 25, updating the "call data" stored in the call data storage device 21.

TABLE 4

| Car | (Call Type | Floor | Direction | Elapsed Time) |
|---|---|---|---|---|
| E1 | (H | 16 | DN | 5) |
| | (H | 12 | DN | 20) |
| | (C | 4 | DN | 20) |
| E2 | (C | 9 | DN | 22) |
| | (H | 3 | UP | 10) |
| | (H | 5 | UP | 0)* |

Table 4 indicates the situation that each car's arrival time is estimated by a later-described method with respect to the "target floor data" shown in Table 2, and, based on resultant estimated arrival time, the car E2 is assigned to the station call "5 UP" while updating the "call data" stored in the call data storage device 21. Specifically, it may be apparent from comparison with the "call data" shown in Table 1 that the last data stream (H 5 UP 0) is added to car E2.

[1-2-6. Operation Instruction Processing]

The operation instruction device 26 shown in FIG. 2 operates to judge or determine whether the presently expected stop position as commanded by said assignment instruction device 25 will possibly become the next stop position by taking account of a car's present operating/traveling condition, and to generate and provide a necessary command(s) to the car operation control device 4 thereby altering or modifying a car's traveling operation, on occasions where the presently expected stop position is judged to become the next stop position.

[1-2-7. Arrival Time Estimation Processing]

A description will now be given of the estimation processing as to each car's arrival time. Note here that the "arrival time estimation" may refer to the procedure of calculating or computing the time required for each car to reach its target floor; for example, when the "target floor data" shown in Table 2 is entered as input data, such estimation is done with the target floor of cars E1, E2 being set at (5 UP).

Figure 4:
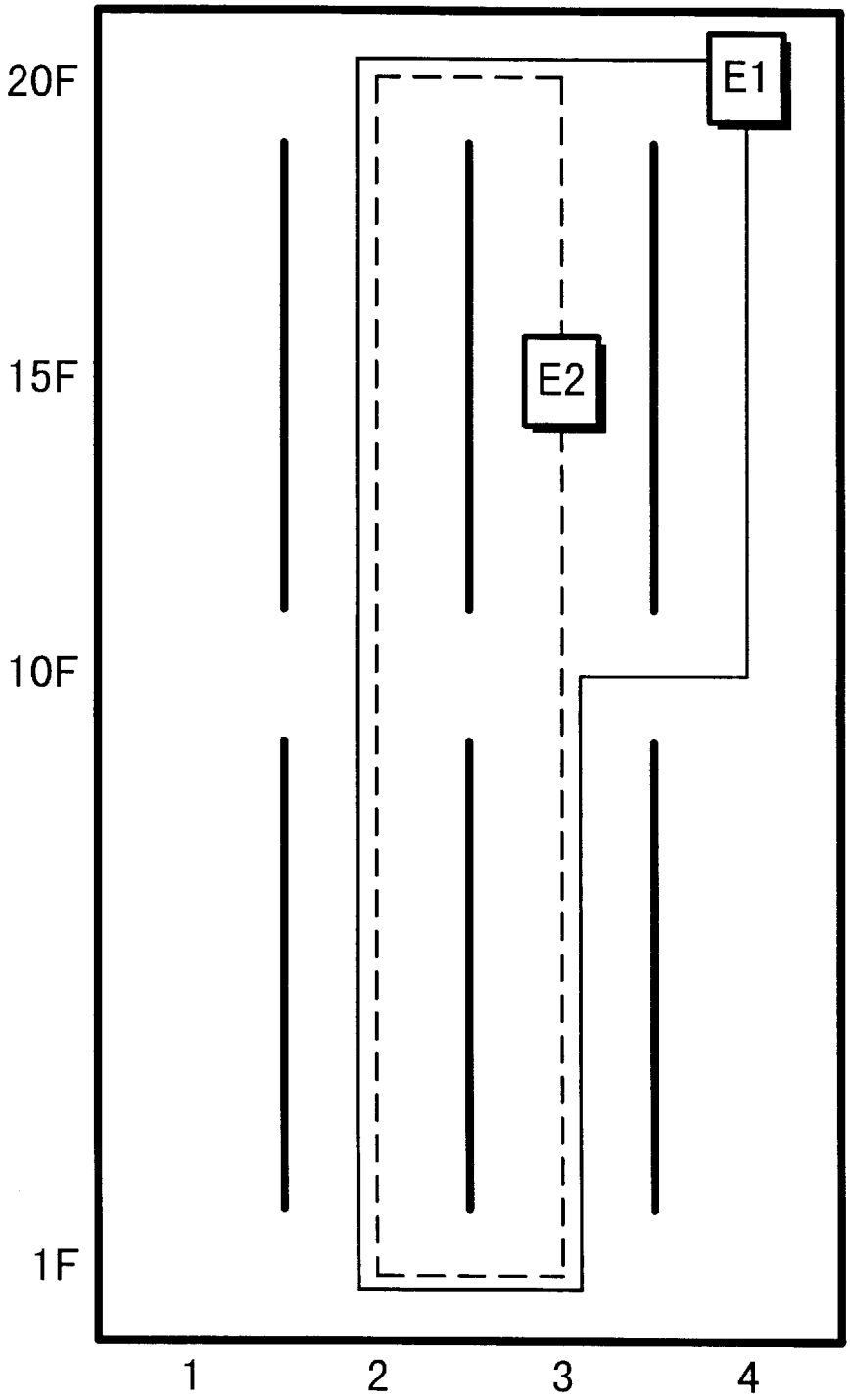
FIG. 4 is a diagram for explanation of one exemplary route along which a car is to travel.

Assume that the 20-floored building structure having four elevator shafts is equipped with cars E1, E2 as shown in FIG. 4. Assume also that car E1 is presently at the twentieth floor in the fourth shaft whereas car E2 stops at the fifteenth floor in the third shaft, wherein each car is in the condition capable of rapidly closing its door for departure. Note that although the departure wait state is assumed for execution of arrival time estimation, this is not any exclusive case and permits employment of any other possible assumptions indicating a given car's state.

Consider that, as station calls, (H 16 DN) and (H 3 UP) are assigned to the cars E1, E2 respectively, and also that, as car calls, (C 12 DN) and (C 4 DN) are similarly assigned to car E1 whereas (C 9 DN) is assigned to car E2 while such data items are stored in the call data storage device 21. Further assume that each car is with the "route data" of FIG. 4 as defined therein.

Under the above setting conditions, there are two possible ways of estimation due to the fact that one specific condition as to "prohibition of inclusion of any new station call in other cars' target floors whenever such station call is assigned to one car."

More specifically, the first situation is that when car E1 is assigned to a new station call namely, car E1 now regards as its target floor the floor whereat such new station call takes place whereas car E2 does not regard such floor as its target floor, estimation is performed to define the time required for car E1 to arrive at (5 UP). Alternatively, the second situation is that when a new station call is assigned to car E2 i.e., car E2 regards the floor concerning occurrence of such new station call as its target floor whereas car E1 does not regard such floor as its target floor, estimation is done to define the time as required for car E2 to reach (5 UP).

Figure 5:
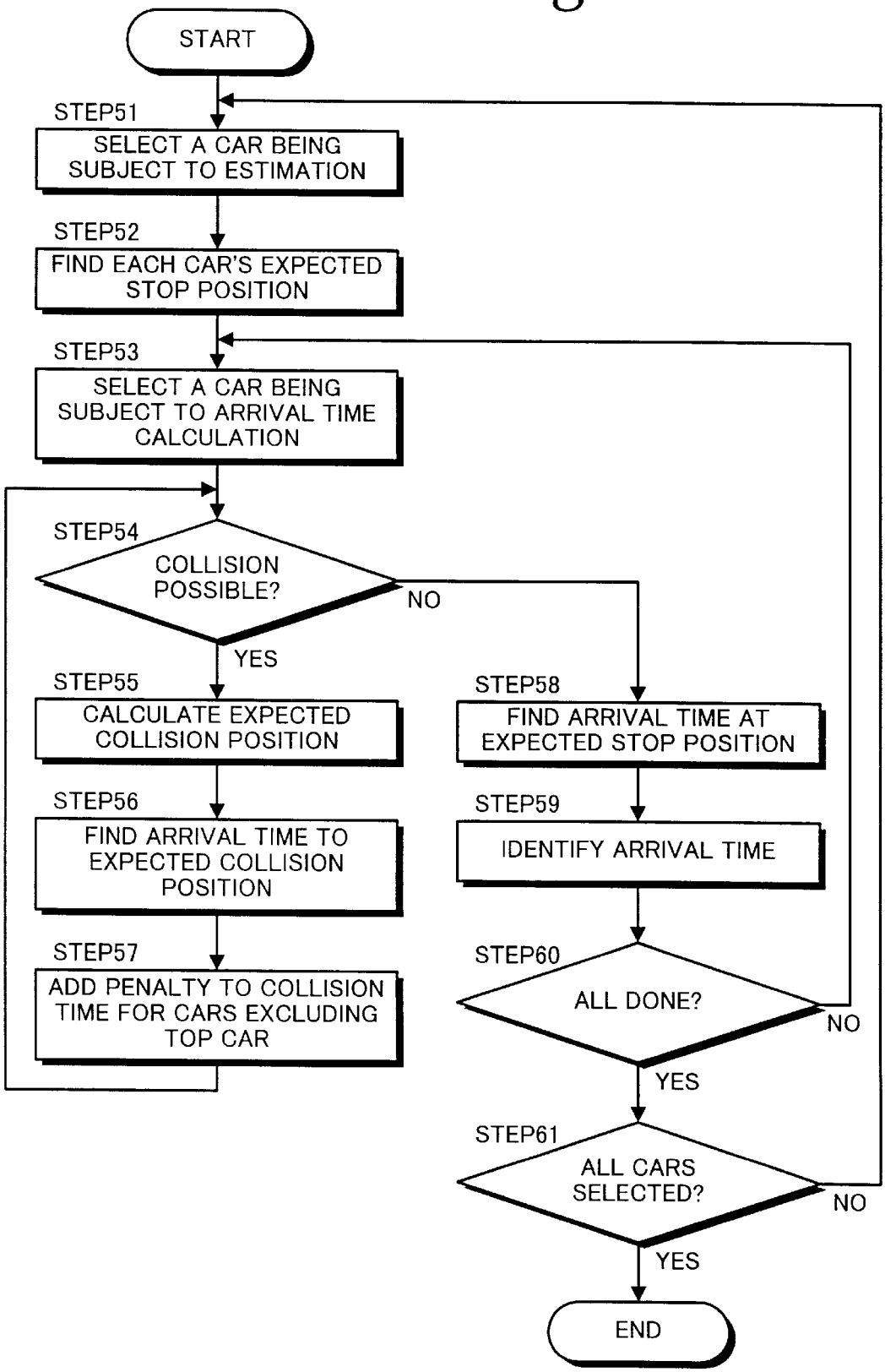
FIG. 5 is a diagram for explanation of operation processing of an arrival time estimation device.

Next, FIG. 5 is a diagram for explanation of the flow of operation processing as executed by the arrival time estimation device 23, wherein the arrival time estimation device 23 operates to estimate the arrival time as pursuant to the task procedure shown in this drawing. The arrival-time calculation scheme will be discussed in the above first situation in connection with the flowchart shown in FIG. 5.

As shown in FIG. 5, the arrival time estimation device 23 first selects a car under estimation (at step 51). In the illustrative embodiment, car E1 will be selected first. Then, the expected stop position is calculated for each car based on the "route data" and "target floor data" as stored in the route data storage device 24 (at step 52). In this embodiment the expected stop positions of cars E1, E2 are as shown in Table 5. Note that in Table 5, "16@4" represents the level of the sixteenth floor in the fourth shaft.

TABLE 5

| |
|---|
| Car E1: 16@4 12@4, 10@4, 10@3, 4@3, 1@3, 1@2, 5@2 |
| Car E2: 9@3, 1@3, 1@2, 3@2 |

Next, a car(s) is selected and extracted which is kept unaware of any arrival time calculated at its all expected stop positions (step 53). Assume here that car E1 is selected for extraction. Subsequently, a check is made to determine if there is the possibility that the selected car will collide against another car (step 54). In this embodiment determination is made to point out that collision will possibly take place between cars E1, E2 due to the fact that such two cars are both required to move in the third shaft, as shown in Table 5.

When decision is made at step 54 to indicate that "collision will possibly happen" in the aforesaid way, an expected collision occurrence position is then calculated (at step 55). This collision occurrence position may be obtained by calculation from a present position of each car and its expected stop position. In this embodiment it will be estimated that collision occurs between cars E1, E2 at the 10@3 position.

Next, the time required for arrival is calculated at step 56 with respect to the individual car being specified as an object of interest (that is, car E1) and any car that can collide therewith (car E2).

More specifically, regarding the car E1, calculation is sequentially carried out as shown in Table 6. Note here that in this embodiment, the time taken for passengers to get on and off is neglected for purposes of simplicity only.

TABLE 6

| |
|---|
| Arrival Time to 16@4: |
| Door Close Time + (20@4→16@4 Transit Time) + Door Open Time |
| Arrival Time to 12@4: |
| Arrival Time to 16@4 + Door Close Time |
| + (16@4→12@4 TransitTime) + Door Open Time |
| Arrival Time to 10@4: |
| Arrival Time to 12@4 + Door Close Time |
| + (12@4→10@4 Transit Time) + Door Open Time |
| Arrival Time to 10@3: |
| Arrival Time to 10@4 + Door Close Time |
| + (10@4→10@3 Transit Time) + Door Open Time |

Now, representing the door open time as "$t_o$" the door close time as "$t_c$," the time required for floor-to-floor movement as "$t_{i,j}^{v}$" (i, j designate floor numbers respectively, where i≠j), and the time required for transverse shift as "$t_{l,m}^{h}$" (l, m denote shaft numbers respectively, where l≠m), the time $t_1$ (20@→10@3) as taken for car E1 to reach the estimated collision occurrence position 10@3 is given as $$t_1 = t_{20,16}^{v} + t_{16,12}^{v} + t_{12,10}^{v} t_{4,3}^{h} + 4\times(t_c + t_o) \qquad \text{[Formula 1]}$$

Note here that $t_{i,j}^{v}$ and $t_{l,m}^{h}$ are given in advance by use of a predetermined equation. For example, in the case of vertical transportation, assuming that the cars are given with specific standards as to the maximum velocity $v_{MAX}$, acceleration a, floor-to-floor distance d, the time may be calculated using the following equation:

$$t_{i,j}^{v} = \frac{(i-j)d}{v_{MAX}} + \frac{v_{MAX}}{2}\left(\frac{1}{a}+\frac{1}{b}\right) \quad \text{[Formula 2]}$$

Note in this embodiment that the transit time and door open/close time are to be determined for purposes of simplicity as follows:

$$t_{i,j}^{v}: (|i-j|+3)sec. \quad (i \neq j) \quad \text{[Formula 3]}$$

$$t_{i,j}^{v}: (10 \times |l-m|)sec.$$

DOOR OPEN TIME: 2*sec.*

DOOR CLOSE TIME: 2*sec.*

Therefore, the time t1 required for car E1 to reach the estimated collision occurrence position 10@3 is given by $$t\mathbf{1}\ (20@4 \rightarrow 10@3) = 7+7+5+10+4\times(2+2) = 45\ [\text{sec.}] \quad \text{[Formula 4]}$$

On the other hand, regarding car E2, the arrival time to its estimated collision occurrence position 10@3 is defined as "door close time+(15@3→10@3 transit time)+door open time"; therefore, we obtain $$t\mathbf{2}\ (15@3 \rightarrow 10@3) = 6+(2+2) = 10\ [\text{sec.}] \quad \text{[Formula 5]}$$

In this way, after completion of calculation of the arrival time to the estimated collision occurrence position, a specific one of the cars is determined which is expected to be the first in the order of arrival at the estimated collision occurrence position 10@3. Namely, in this embodiment, the car with the minimum arrival time that is, the car E2 is identified as the first one in the sequence of arrival at the estimated collision occurrence position. For the other car (here, car E1) other than the determined first-order car, a predefined time tp is added to its 10@3 arrival time as a penalty (at step 57). Note that it can be happen that respective cars are kept unchanged in the expected stop positions thereof; if this is the case, it is then assumed that these cars will not collide with each other because of complete absence of any crossing points between the expected stop positions thereof.

In this way, after completion of predetermined calculation with respect to cars with some possibility to collide (steps 55 to 57), the routine goes back to step 53 for further execution of similar analysis for checking the possibility of collision.

At step 53, if decision is made to confirm that "there is no possibility of collision," further calculation is executed to define the arrival time at certain expected stop position with respect to the car(s) of interest (at step 58). Here, for car E1, the arrival time to each position 4@3, 1@3, 1@2, 5@2 will be obtained. The calculation scheme in this case is the same as the one described above.

TABLE 7

| |
|---|
| Arrival Time to 4@3: |
| Arrival Time to 10@3 + Door Close Time |
| + (10@3→ 4@3 Transit Time) + Door Open Time |
| Arrival Time to 1@3: |
| Arrival Time to 4@3 + Door Close Time |
| + (4@3→ 1@3 Transit Time) + Door Open Time |
| Arrival Time to 1@2: |
| Arrival Time to 1@3 + Door Close Time |
| + (1@3→ 1@2 Transit Time) + Door Open Time |
| Arrival Time to 5@2: |
| Arrival Time to 1@2 + Door Close Time |
| + (1@2→ 5@2 Transit Time) + Door Open Time |

Due to this, it is possible to calculate the expected arrival time of the target floor (at step 59). This can be said because such target floor is included in the expected stop or "landing" position. Consequently, the arrival time t1 of the target floor 5@2 is given by $$t\mathbf{1}\ (20@4 \rightarrow 5@2) = (45+tp)+9+6+10+7+4\times(2+2) = \mathbf{93}+tp = 123\ [\text{sec.}]$$
$$(\text{where, } tp = 30\ \text{sec.}) \quad \text{[Formula 6]}$$

Next, regarding the cars being presently subject to such arrival time calculation, the routine checks for whether the arrival time has been calculated with respect to all the expected stop positions (at step 60). At step 60, when a decision is made such that the arrival time calculation was completed at all the expected stop positions of the subject cars, a decision is then attempted at step 61 to confirm whether the above processing tasks (steps 53 to 60) are completed for all the cars. At step 61, if it is decided that the above processing tasks are not completed yet for all the cars, the routine goes back to step 51 for repeated execution of similar processing tasks.

More specifically, here, the routine goes back at step 51, performing estimation of arrival time in the second situation, as discussed previously. Therefore, the estimation of arrival time of car E2 in the second situation is as follows:

$$t\mathbf{2}(15@3 \rightarrow 5@2) = 9+4+11+10+5+5+5\times(2+2) = 60\ [\text{sec.}] \quad \text{[Formula 7]}$$

In this way, execution of a respective one of the steps 51 to 61 will be repeated appropriately; after completion of calculation of arrival time of all the expected stop positions with respect to every car, the system routine will be terminated.

In this embodiment the arrival time to each car's target floor as estimated by the arrival time estimation device 23 is as follows:

TABLE 8

| Car | (Call Type | Floor | Direction | Elapsed Time | Assignment | Estimated Arrival time) |
|---|---|---|---|---|---|---|
| E1 | (H | 5 | UP | 0 | null | 123) |
| E2 | (H | 5 | UP | 0 | null | 60) |

Accordingly, as has been described above, the car E2 which is lower in estimated arrival time will be assigned to the (5 UP) station call, thereby enabling achievement of highly efficient car transportation responsive to any station calls and car calls.

In this case, all cars will be an assigned car, but it is possible to prepare an unassigned car (for example, crowded car, car for V. I. P.).

[2. Second Embodiment]

This embodiment relates to an elevator group management control apparatus corresponding to recitation of claim 2 and the method therefor.

[2-1. Configuration of the Second Embodiment]

This embodiment is one modification of said first embodiment with the target floor instruction device 22 and assignment instruction device 25 being changed in arrangement. Note that in this embodiment, target floor instruction device 22 generates and issues the "target floor data" shown in Table 2 above, whereas arrival time estimation device 23 is designed to supply assignment instruction device 25 with the "estimated arrival time" shown in Table 8.

More specifically, the target floor instruction device 22 in this embodiment is so arranged as to define as a target floor any floor of station call which is newly registered in the station call registration device 1 in all the associated cars. In other words, unlike the first embodiment, this embodiment intends to estimate the time required to reach a new landing-place's floor with respect to all the cars.

Also, the assignment instruction device 25 is arranged so as to calculate the nonresponse time based on the estimated arrival time as estimated by the arrival time estimation device 23 and to determine a specific car with the minimum non-response time as an assignment car which should be assigned to the nonresponse call.

Note here that the "non-response time" refers to the time duration taken for a car of interest to arrive at its target floor after generation of the target floor call.

[2-2. Operation/Effect of the Second Embodiment]

This embodiment thus arranged operates as follows. The following description is mainly directed to the assignment instruction processing thereof, which is principally different from that of the first embodiment.

When the input data of Table 2 are used to calculate each car's nonresponse time (call elapse time+estimated arrival time) with respect to the nonresponse call (5 UP), the result is as shown in Table 9. Note here that this assumes that the time (call elapse time) from issuance of a station call to determination of assignment by the assignment instruction device 25 is 0 sec.

TABLE 9

| Car | (Target Floor | Direction) | Nonresponse Time |
|---|---|---|---|
| E1 | (5 | UP) | 123 sec |
| E2 | (5 | UP) | 60 sec |

Accordingly, a car having the minimum value of nonresponse time shown in Table 9 that is, car E2 with the nonresponse time of 60 sec. is determined as the one to be assigned to the station call.

With this embodiment, a specific car corresponding to the minimum nonresponse time is assigned to a station call, enabling achievement of more efficient transportation of cars associated.

[3. Third Embodiment]

This embodiment relates to an elevator group management control apparatus which corresponds to the recitation of claim 3 and the control method thereof.

[3-1. Configuration of the Third Embodiment]

This embodiment is another modification of said first embodiment with the target floor instruction device 22 and assignment instruction device 25 being changed in configuration.

More specifically, the target floor instruction device 22 in this embodiment is arranged, with respect to all the cars, to define as the target floor both a floor relating to a station call as newly registered in the station call registration device 1 and all cars+ station calls as stored in the call data storage device 21. Also, the assignment instruction device 25 is arranged so that it calculates the average value of nonresponse time based on the estimated arrival time as estimated by arrival time estimation device 23 to assign an unassigned call to the car which is minimum in average nonresponse time.

[3-2. Operation of the Third Embodiment]

The present embodiment thus arranged operates as follows. The following description is drawn to the target floor instruction processing and assignment instruction processing which constitute main differences from the first embodiment.

[3-2-1. Target Floor Instruction Processing]

In the target floor instruction device 22 of this embodiment, both the floor relating to the station call as newly registered in the station call registration device 1 and all car's station calls being presently stored in the call data storage device 21 are defined to the target floor with respect to all cars associated.

More specifically, unlike the second embodiment, an individual one of all the cars is allowed to contain in its target floor any station call data of the remaining cars; therefore, the resulting "target floor data" is as shown in Table 10.

TABLE 10

| Car | (Call Type | Floor | Direction | Elapsed Time | Assignment) |
|---|---|---|---|---|---|
| E1 | (H | 16 | DN | 5 | 1) |
| | (H | 5 | UP | 0 | null) |
| | (H | 3 | UP | 10 | 2) |
| | (H | 5 | UP | 0 | null) |
| | (H | 16 | DN | 5 | 1) |

Note here that the estimated arrival time to each car's target floor as estimated by the arrival time estimation device 23 using the "target floor data" of Table 10 may be similar to that of the first embodiment, which derives the result shown in Table 11 below.

TABLE 11

| Car | (Call Type | Floor | Direction | Elapsed Time | Assignment | Estimated Arrival time) |
|---|---|---|---|---|---|---|
| E1 | (H | 16 | DN | 5 | 1 | 11) |
| | (H | 5 | UP | 0 | null | 123) |
| | (H | 3 | UP | 10 | 2 | 51) |
| E2 | (H | 3 | UP | 10 | 2 | 51) |
| | (H | 5 | UP | 0 | null | 60) |
| | (H | 16 | DN | 5 | 1 | 11) |

[3-2-2. Assignment Instruction Processing]

In the assignment instruction device 25 of this embodiment, the average value of nonresponse time is calculated based on the estimated arrival time as estimated by the arrival time estimation device 23, then allocating the nonresponse call to a specific car which is minimum in average nonresponse time. Practically, when the input data items shown in Table 11 are used to calculate the nonresponse time for each car's call, the result is as shown in Table 12. For example, the nonresponse time for the call (16 DN) concerning the car E1 is: the elapsed time (5 sec.)+estimated arrival time (11 sec.)=16 sec. Here, the call elapse time after generation of a new station call (5 UP) is 0 sec.

TABLE 12

| Car | (Target Floor | Direction) | Nonresponse Time |
|---|---|---|---|
| E1 | (16 | DN) | 16 sec |
| | (5 | UP) | 123 |
| | (3 | UP) | 61 |
| E2 | (3 | UP) | 61 |
| | (5 | UP) | 60 |
| | (16 | DN) | 16 |

At this time, the average nonresponse time when each car is assigned with the station call (5 UP) is calculated as follows.

(a) Assigning to Car E1

Table 12 involves three station calls in total, one of which is (16 DN 16 sec.) in car E1, another one of which is (5 UP 123 sec.) in car E1, and the other of which is (3 UP 61 sec.) in car E2; accordingly, the average nonresponse time is represented as average nonresponse time=(16+123+61)/3=66.7 sec.

(b) Assigning to Car E2

Table 12 contains three station calls in total, one of which is (16 DN 16 sec.) in car E1, another one of which is (3 UP 61 sec.) in car E2, and the other of which is (5 UP 60 sec.) in car E2; therefore, the average nonresponse time is represented by average nonresponse time=(16+61+60)/3=45.7 sec.

Of those average nonresponse time values thus calculated, the minimum-value car, i.e., car E2 is finally determined as the assignment car to the station call (5 UP).

As has been described above, according to this embodiment, calculating the average values of nonresponse time for respective target floors with respect to every car may enable accomplishment of car transportation with less in variations in wait time.

[4. Fourth Embodiment]

This embodiment relates to an elevator group management control apparatus corresponding to claims 4 and 5 and the method thereof for use therein.

[4-1. Configuration of the Fourth Embodiment]

This embodiment is still another modification of said first embodiment, which employs a derivative car call estimation device 61 with the target floor instruction device 22 and assignment instruction device 25 being changed in arrangement.

More specifically, the target floor instruction device 22 in this embodiment is specifically arranged such that for each car, it defines as the "target floor data" the station call floor being newly registered in the station call registration device 1, the station call floor as stored in the call data storage device 21, and a derivative car call floor as estimated by a derivative car call estimation device 61 to be described later.

Also, the derivative car call estimation device 61 is so arranged as to receive at its input the "station call data" being registered in the station call registration device 1, calculate the passenger generation frequency and the average wait time at any floors relating to such station calls, and estimate a secondary car call(s) as possibly derived from each station call.

Here, the "derivative car call" may relate to estimation of passenger's destination (target floor) on part of the system at a time point of registration of a station call, whereas "car call" is to registration of passenger's destination when the passenger actually gets on that car. The "passenger generation frequency" may here refer to the rate of occurrence as defined by the average time taken from completion or deletion of a station call (that is, at a time point whereat the car responded to such station call) to registration of a new station call in the past.

Further, the assignment instruction device 25 is arranged so that it calculates the service completion time based on the estimated arrival time as estimated by the arrival time estimation device 23, thereby attempting to assign the unassigned call to a specific car which is minimum in service completion time.

Note that the "service completion time" refers to the time interval as taken, upon occurrence of a station call, between a start time when passengers get on a car and a termination time when more than one passenger gets off from the car when his or her target floor is inside the building. In other words, for passengers, their inherent motive (aim) of using the elevator is to make transportation toward their target floor; by taking this into consideration, attaining such aim is regarded as the "service completion."

[4-1-1. Configuration of Derivative Car Call Estimation Device]

Figure 7:
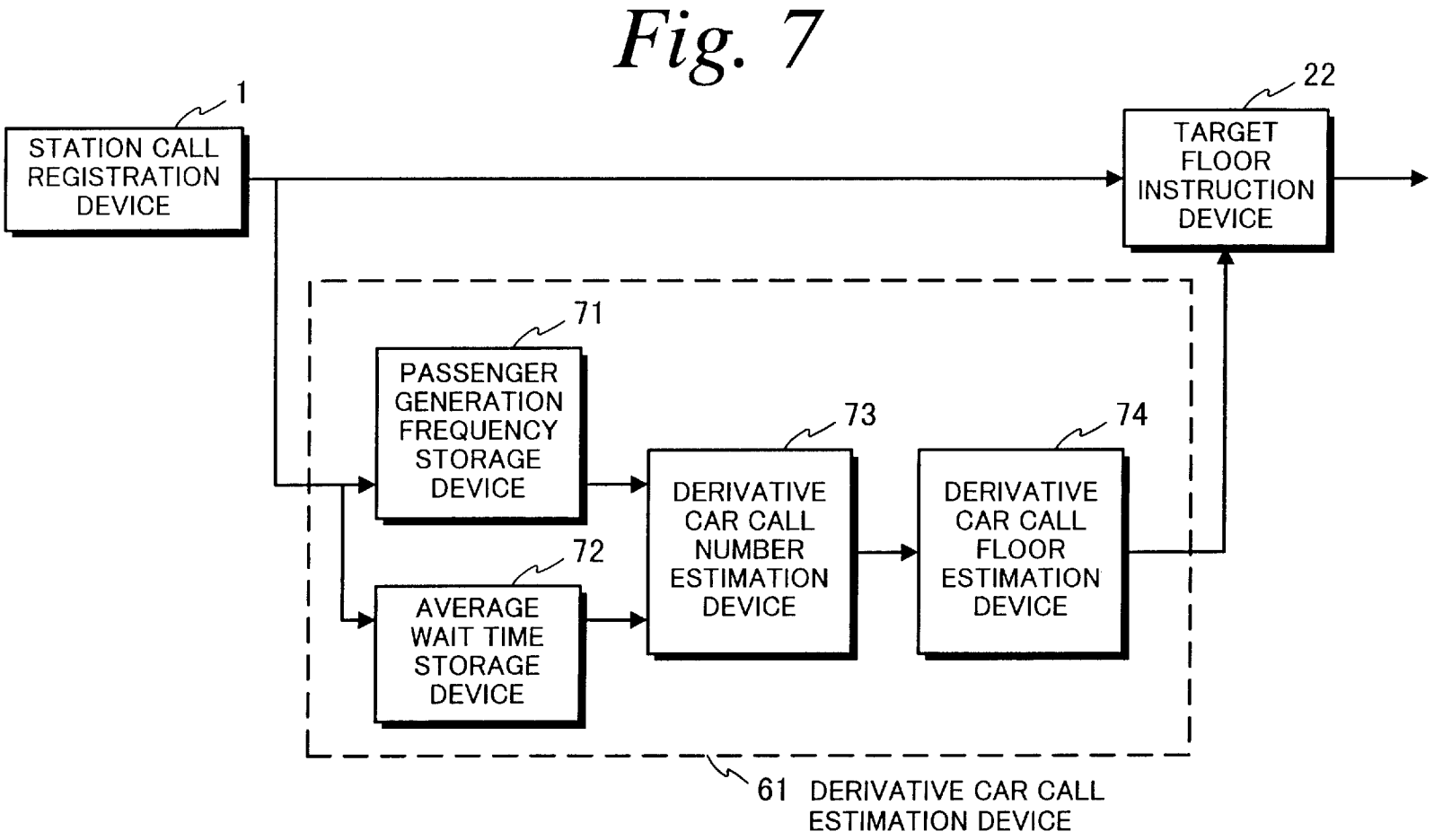
FIG. 7 is a diagram showing a configuration of a derivative car call estimation device.

A detailed description will now be given of a practical arrangement of the derivative car call estimation device 61 as employed in the elevator group management control apparatus, with reference to FIG. 7.

The derivative car call estimation device 61 is constituted from a passenger generation frequency storage device 71, an average wait time storage device 72, a derivative car call number estimation device 73, and a derivative car call floor estimation device 74 as will be described below.

Here, said passenger generation frequency storage device 71 stores therein the rate of occurrence (or frequency) of station calls on respective floors in the past, calculates a new or updated passenger generation frequency based on the past passenger generation frequency and any newly issued station call(s), updates the presently stored passenger generation frequency data, and supplies resultant information to the derivative car call number estimation device 73.

The average wait time storage device 72 is designed to update pursuant to a newly occurred station call data the average wait time being presently stored in response to issuance of each station call in the past, and supplies resulting information to the derivative car call number estimation device 73. Note here that the "average wait time" refers to the average time taken from occurrence of a station call to erasure of registration thereof (i.e., from passenger's activation of a station call button on an arbitrary floor to his or her actual getting on the car responding thereto).

Next, the derivative car call number estimation device 73 is arranged to estimate the number n of derivative calls based on the "passenger generation frequency data" and "average wait time data" as input thereto, by using the following equation:

$$n=1+(\text{average wait time})/(\text{passenger generation frequency}). \quad \text{[Formula 8]}$$

The derivative car call floor estimation device 74 is arranged to estimate the floor on which more than one derivative car call is generated, based on the derivative car call number as estimated by said derivative car call number estimation device 73.

More practically, the derivative car call floor estimation device 74 stores therein a defined distribution or scatter of derivative car calls generated at all the floors (not shown) for separate directions with respect to every floor in such a manner that it does this under the assumption that any derivative car calls occur on a floor corresponding to the accumulated scatter rate as represented by the following equation. Note here that such "derivative car call data" is erased every time when the registration of a corresponding station call is cleared namely, when a car reaches the floor whereat the station call has been issued and then a passenger who gets on it registers his or her desired car call.

$$k/(n+1) \quad \text{[Formula 9]}$$

(where k=1, . . . , n)

[4-2. Operation of the Fourth Embodiment]

The fourth embodiment thus arranged operates as follows.

[4-2-1. Derivative Car Call Estimation Processing]

In the above embodiment, discussion has made under only the assumption that the station call (5 UP) is occurred, and whether a similar station call was issued in the past was withdrawn from consideration. In contrast, this embodiment assumes that such station call (5 UP) occurred in the past, and that the station call (5 UP) was issued at a time point after 30 sec. was elapsed after the system's power-on. This may be reworded such that initiating station call's registration after elapse of 30 sec. after power-on or activation of the system means that passengers were "generated" at the rate of once per 30 sec.

Consequently, at this time, the passenger generation frequency storage device 71 updates its initial value "null" to "30" providing the value "30" as the passenger generation frequency data. Note here that said passenger generation frequency storage device 71 stores therein data for every floor with the initial value therefor being set at "null."

Note also that in this embodiment, no wait time is present because of occurrence of no calls in the past; accordingly, the average wait time storage device 72 updates its initial value "null" to "0" while generating and issuing it at the output thereof. Note here that this assumes that the average wait time data is updated whenever the registration of this station call is erased, that is, when more than one passenger gets on the car.

Next, the derivative car call number estimation device 73 calculates the derivative car call number n based on the average wait time and the passenger generation frequency, by use of the following equation, and supplies the resulting value to the derivative car call floor estimation device 74.

$$n-1+(\text{average wait time})/(\text{passenger generation frequency})=1+0/30=1 \quad \text{[Formula 10]}$$

Now, assume that the derivative car call floor estimation device 74 exhibits a derivative car call generation distribution (accumulated scatter of the density distribution) shown in Table 13.

TABLE 13

| Floor | Accumulated Scatter Rate |
|---|---|
| 19 | 1/14 |
| 18 | 2/14 |
| 17 | 3/14 |
| : | : |
| 13 | 7/14 |
| : | : |
| 7 | 13/14 |
| 6 | 14/14 |

Consequently, the accumulated scatter rate which is to be estimated so that a derivative car call occurs based on the derivative car call number n=1 as estimated by said derivative car call number estimation device 73 is given as $$k/(n+1)=1/(1+1)=1/2 \quad \text{[Formula 11]}$$

(where, k=1, . . . , n).

Accordingly, it may be estimated from Table 13 that a derivative car call will occur on the thirteenth floor. This comes under the assumption that the derivative car calls concerning the already occurred station calls (16 DN), (3 UP) are one for the eleventh floor and the other for the seventh floor, respectively, while their related information is stored in the derivative car call floor estimation device 74.

Figure 6:
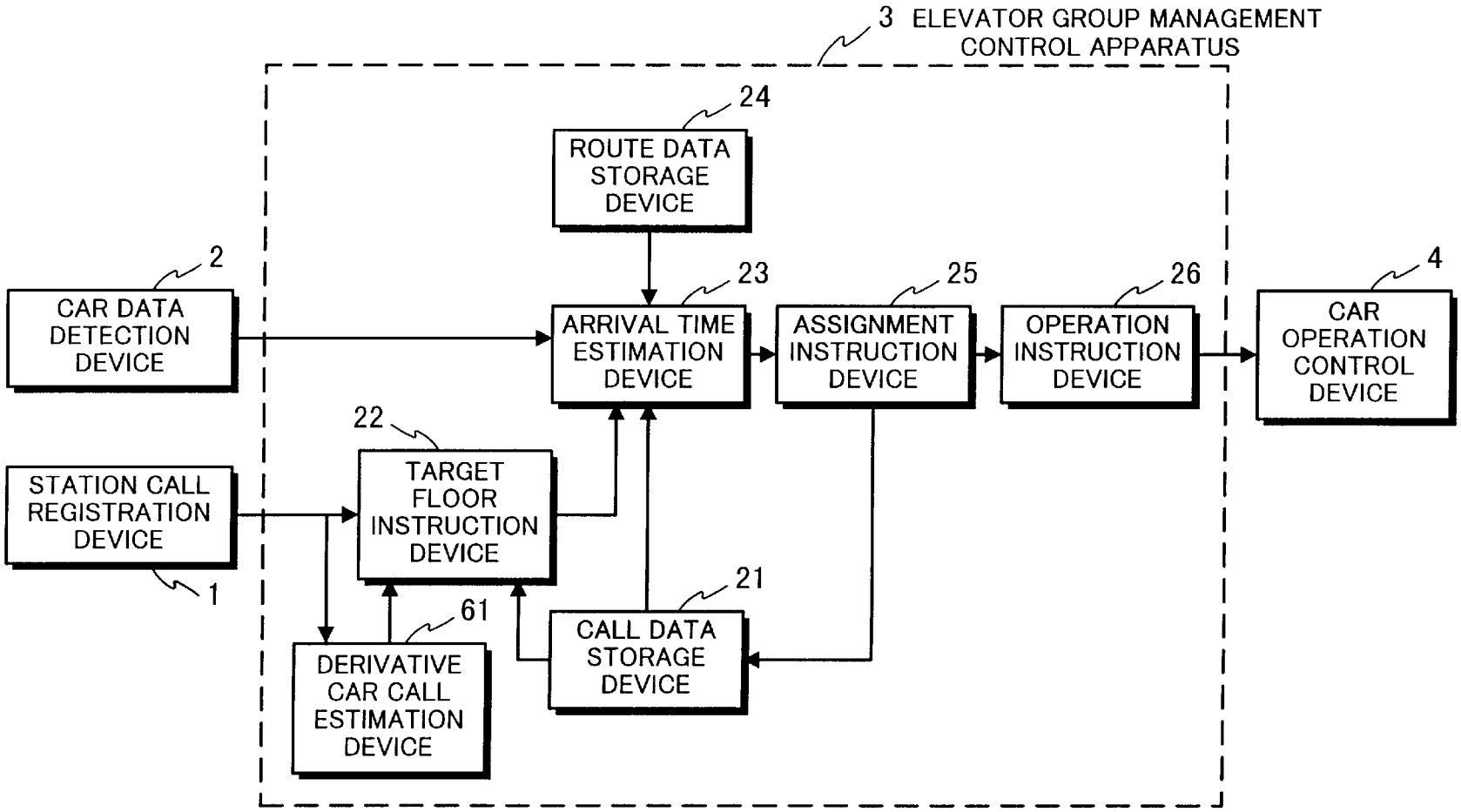
FIG. 6 is a diagram showing a configuration of an elevator group management control apparatus in accordance with the fourth embodiment.

It should be noted that in this embodiment, although the derivative car call is estimated by the derivative car call estimation device 61 shown in FIG. 6, the present invention should not be limited exclusively to this arrangement; it may alternatively be arranged such that the derivative car call estimation device 61 prestores therein the derivative car call occurrence data for every floor, and generates at its output the data as an estimation result with respect to a corresponding floor data.

Furthermore, in an elevator system that passenger can register her/his destination floor at elevator hall before getting on a car, the destination floor can be used as derivative car call data.

With such an arrangement, the data being input to the target floor instruction device 22 is as shown in Table 14. Note here that in this case also, the elapsed time of station call is 0 sec.

TABLE 14

| Car | (Call Type | Floor | Direction | Elapsed Time | Assignment) |
|---|---|---|---|---|---|
| E1 | (H | 16 | DN | 5 | 1) |
| | (C | 12 | DN | 20 | 1) |
| | (D | 11 | DN | 5 | 1) |
| | (C | 4 | DN | 20 | 1) |
| | (H | 5 | UP | 0 | null) |
| | (D | 13 | UP | 0 | null) |
| E2 | (C | 9 | DN | 22 | 2) |
| | (H | 3 | UP | 10 | 2) |
| | (H | 5 | UP | 0 | null) |
| | (D | 7 | UP | 10 | 2) |
| | (D | 13 | UP | 0 | null) |

Here, the call type "D" indicates the derivative car call. The elapsed time of "car call data" is assumed to be updated successively so that it takes over the station call's elapsed time which was erased in registration upon occurrence of a car call. For instance, in the (C 12 DN 20 1), the elapsed time "20 sec." does not intend to mean that the elapsed time from occurrence of a car call is 20 sec., but intends to mean the elapsed time from a time point whereat one passenger who made a car call attempted to register a station call in order to get on that car.

[4-2-2. Target Floor Instruction Processing]

The target floor instruction device 22 in this embodiment defines to the target floor a station call floor as newly registered in the station call registration device 1, a station call floor being stored in the call data storage device 21, and a derivative car call floor as estimated by the derivative car call estimation device 61. Accordingly, the "target floor data" may be as shown in the above Table 14, with respect to every floor.

Also, the time required for each car to reach its target floor as estimated by the arrival time estimation device 23 using the "target floor data" shown in Table 14 is computed using the calculation scheme as presented in the first embodiment, the result of which is as follows (Table 15):

TABLE 15

| Car | (Call Type | Floor | Direction | Elapsed Time | Assignment | Estimated Arrival time) |
|---|---|---|---|---|---|---|
| E1 | (H | 16 | DN | 5 | 1 | 11) |
| | (C | 12 | DN | 20 | 1 | 22) |
| | (D | 11 | DN | 5 | 1 | 30) |
| | (C | 4 | DN | 20 | 1 | 95) |
| | (H | 5 | UP | 0 | null | 130) |
| | (D | 13 | UP | 0 | null | 145) |
| E2 | (C | 9 | DN | 22 | 2 | 13) |
| | (H | 3 | UP | 10 | 2 | 51) |
| | (H | 5 | UP | 0 | null | 60) |
| | (D | 7 | UP | 10 | 2 | 69) |
| | (D | 13 | UP | 0 | null | 82) |

[4-2-3. Assignment Instruction Processing]

The assignment instruction device 25 in this embodiment operates to calculate the service completion time based on the estimated arrival time as estimated by the arrival time estimation device 23, and assign an unassigned call to one specific car which is minimum in service completion time.

More specifically, in the input data shown in Table 15, the calculation result of the service completion time (call elapsed time+estimated arrival time) regarding the derivative car call (13 UP) this is estimated to occur with respect to the unassigned station call (5 UP) that each car regards as its target floor is as follows. Note here that in this case also, the elapsed time of unassigned station call is 0 sec.

TABLE 16

| Car | (Call Type | Target Floor | Direction) | Service Completion time |
|---|---|---|---|---|
| E1 | (D | 13 | UP) | 145 |
| E2 | (D | 13 | UP) | 82 |

As a result, the station call (5 UP) will be assigned to the car E2 which is less in service completion time.

As has been described above, according to this embodiment, since it is specifically arranged to estimate the derivative car call by taking account of the passenger generation frequency and the average wait time, it is possible to attain more precise or careful management of car transportation as pursuant to the actual passengers' conditions.

[5. Fifth Embodiment]

This embodiment relates to an elevator group management control apparatus corresponding to claim 6 and the method thereof.

[5-1. Configuration and Operation of the Fifth Embodiment]

This embodiment is one modification of said fourth embodiment, with the target floor instruction device 22 and assignment instruction device 25 being changed in arrangement. The derivative car call estimation device 61 may be similar to that of the fourth embodiment.

More specifically, the target floor instruction device 22 in this embodiment is arranged so that with respect to all cars, it defines as the "target floor data" the station call floor as newly registered in the station call registration device 1, the station call floor as stored in the call data storage device 21, and the derivative car call floor as estimated by the derivative car call estimation device 61. Accordingly, the target floor instruction device 22 of this embodiment is different from that of the fourth embodiment in that it includes in its target floor the "call data" of other cars, so that the resultant "target floor data" is as shown in Table 17.

Note that in the following Table, data marked with "*" are the "call data" relating to the other cars. Note also that the call elapse time from occurrence of the new station call (5 UP) is assumed to be 0 sec.

TABLE 17

| Car | (Call Type | Floor | Direction | Elapsed Time | Assignment) |
|---|---|---|---|---|---|
| E1 | (H | 16 | DN | 5 | 1) |
| | (C | 12 | DN | 20 | 1) |
| | (D | 11 | DN | 5 | 1) |
| | (C | 4 | DN | 20 | 1) |
| | (H | 5 | UP | 0 | null) |
| | (D | 13 | UP | 0 | null) |
| | (C | 9 | DN | 22 | 2)* |
| | (H | 3 | UP | 10 | 2)* |
| | (D | 7 | UP | 10 | 2)* |
| E2 | (C | 9 | DN | 22 | 2) |
| | (H | 3 | UP | 10 | 2) |
| | (H | 5 | UP | 0 | null) |
| | (D | 7 | UP | 10 | 2) |
| | (D | 13 | UP | 0 | null) |

TABLE 17-continued

| Car | (Call Type | Floor | Direction | Elapsed Time | Assignment) |
|---|---|---|---|---|---|
| | (H | 16 | DN | 5 | 1)* |
| | (C | 12 | DN | 20 | 1)* |
| | (D | 11 | DN | 5 | 1)* |
| | (C | 4 | DN | 20 | 1)* |

As pursuant to this Table 17, the estimated arrival time may be calculated by the arrival time estimation device 23, the result of which is as follows. Note here that the following result assumes that the estimated arrival time is calculated in the same way as in the first embodiment.

TABLE 18

| Car | (Call Type | Floor | Direction | Elapsed Time | Assignment | Estimated Arrival time) |
|---|---|---|---|---|---|---|
| E1 | (H | 16 | DN | 5 | 1 | 11) |
| | (C | 12 | DN | 20 | 1 | 22) |
| | (D | 11 | DN | 5 | 1 | 30) |
| | (C | 4 | DN | 20 | 1 | 95) |
| | (H | 5 | UP | 0 | null | 130) |
| | (D | 13 | UP | 0 | null | 145) |
| | (C | 9 | DN | 22 | 2 | 13) |
| | (H | 3 | UP | 10 | 2 | 51) |
| | (D | 7 | UP | 10 | 2 | 62) |
| E2 | (C | 9 | DN | 22 | 2 | 13) |
| | (H | 3 | UP | 10 | 2 | 51) |
| | (H | 5 | UP | 0 | null | 60) |
| | (D | 7 | UP | 10 | 2 | 69) |
| | (D | 13 | UP | 0 | null | 82) |
| | (H | 16 | DN | 5 | 1 | 11) |
| | (C | 12 | DN | 20 | 1 | 22) |
| | (D | 11 | DN | 5 | 1 | 30) |
| | (C | 4 | DN | 20 | 1 | 95) |

On the other hand, the assignment instruction device 25 in this embodiment is arranged so that it calculates the average value of each service completion time based on the estimated arrival time as estimated by the arrival time estimation device 23, and assigns an unassigned call to a specific car that remains minimum in average service completion time.

Specifically, the service completion time (call elapse time+estimated arrival time) as to the car call/derivative car call of each car's target floor may be calculated based on Table 18, the result of which is as follows:

TABLE 19

| Car | (Call Type | Target Floor | Direction) | Service Completion time |
|---|---|---|---|---|
| E1 | (C | 12 | DN) | 42 sec |
| | (D | 11 | DN) | 35 |
| | (C | 4 | DN) | 115 |
| | (D | 13 | UP) | 145 |
| | (C | 9 | DN) | 45 |
| | (D | 7 | UP) | 72 |
| E2 | (C | 9 | DN) | 45 |
| | (D | 7 | UP) | 72 |
| | (D | 13 | UP) | 82 |
| | (C | 12 | DN) | 42 |
| | (D | 11 | DN) | 35 |
| | (D | 4 | DN) | 115 |

Here, the average value of each service completion time on occasions where car E1 is assigned with the new station call (5 UP) may be calculated as follows.

It can be seen from Table 19 that the car call/derivative car call on such occasions where the car E1 is assigned with the new station call (5 UP) are six: (C 12 DN 42), (D 11 DN 35), (C 4 DN 115), (D 13 UP 145) for car E1; (C 9 DN 45), (D 7 UP 72) for car E2. Therefore, the average value of each service completion time here is (42+35+115+145+45+72)/6=75.6 sec.

On the other hand, the average value of each service completion time in the case where the car E2 is assigned with the new station call (5 UP) may be calculated as follows.

As can be seen from Table 19, the car call/derivative car call in the case where car E2 is assigned with the new station call (5 UP) are six: (C 12 DN 42), (D 11 DN 35), (C 4 DN 115) for car E1; (C 9 DN 45), (D 7 UP 72), (D 13 UP 82) for car E2. Therefore, the average value of each service completion time here is (42+35+115+45+72+82)/6=65.1 sec.

As a result, the station call (5 UP) will be assigned to the car E2 which is less in average value of each service completion time than car E1.

It can be seen from the foregoing discussion that with the present embodiment, it becomes possible to accomplish successful management of car transportation with less variations due to the feature that the average value of individual service completion time is calculated regarding each target floor with respect to every car.

[6. Sixth Embodiment]

This embodiment is one modification of said third embodiment with the assignment instruction device 25 being changed in arrangement, wherein the target floor instruction device 22 is similar to that of the third embodiment while assuming that the arrival time estimation device 23 supplies the assignment instruction device 25 with the estimated arrival time data shown in Table 11.

[6-1. Configuration and Operation of the Sixth Embodiment]

The assignment instruction device 25 in this embodiment is arranged to compare maximal values of nonresponse times as calculated for respective cars and to assign a specific car that is minimum in such value to a new station call.

More specifically, it calculates the nonresponse time data of each car shown in Table 12 based on the input data shown in Table 11, compares the maximal nonresponse time value (123 sec.) of car E1 with that (61 sec.) of car E2, and then assigns to the latter car E2 which is minimal in nonresponse time.

[7. Seventh Embodiment]

This embodiment is one modification of said fourth and fifth embodiments with the assignment instruction device 25 being changed in arrangement. Note that the following explanation of this embodiment will employ the estimated arrival time data shown in Table 18.

[7-1. Configuration and Operation of the Seventh Embodiment]

The assignment instruction device 25 of this embodiment is arranged so that it compares several maximal values of the service completion times as calculated for respective cars, causing one specific car being minimum in such value to be assigned to a new station call.

More specifically, it calculates the service completion time of each car shown in Table 19 based on the input data shown in Table 18, and compares the maximal service completion time value (145 sec.) of car E1 with that (115 sec.) of car E2, letting the car E2 which is minimum in service completion time be assigned.

[8. Eighth Embodiment]

This embodiment is a further modification of said first embodiment with a transportation condition data storage device 81, an additional estimation command device 82, and a route change command device 83 being provided in addition to the basic configuration of the first embodiment.

[8-1. Configuration of the Eighth Embodiment]

Figure 8:
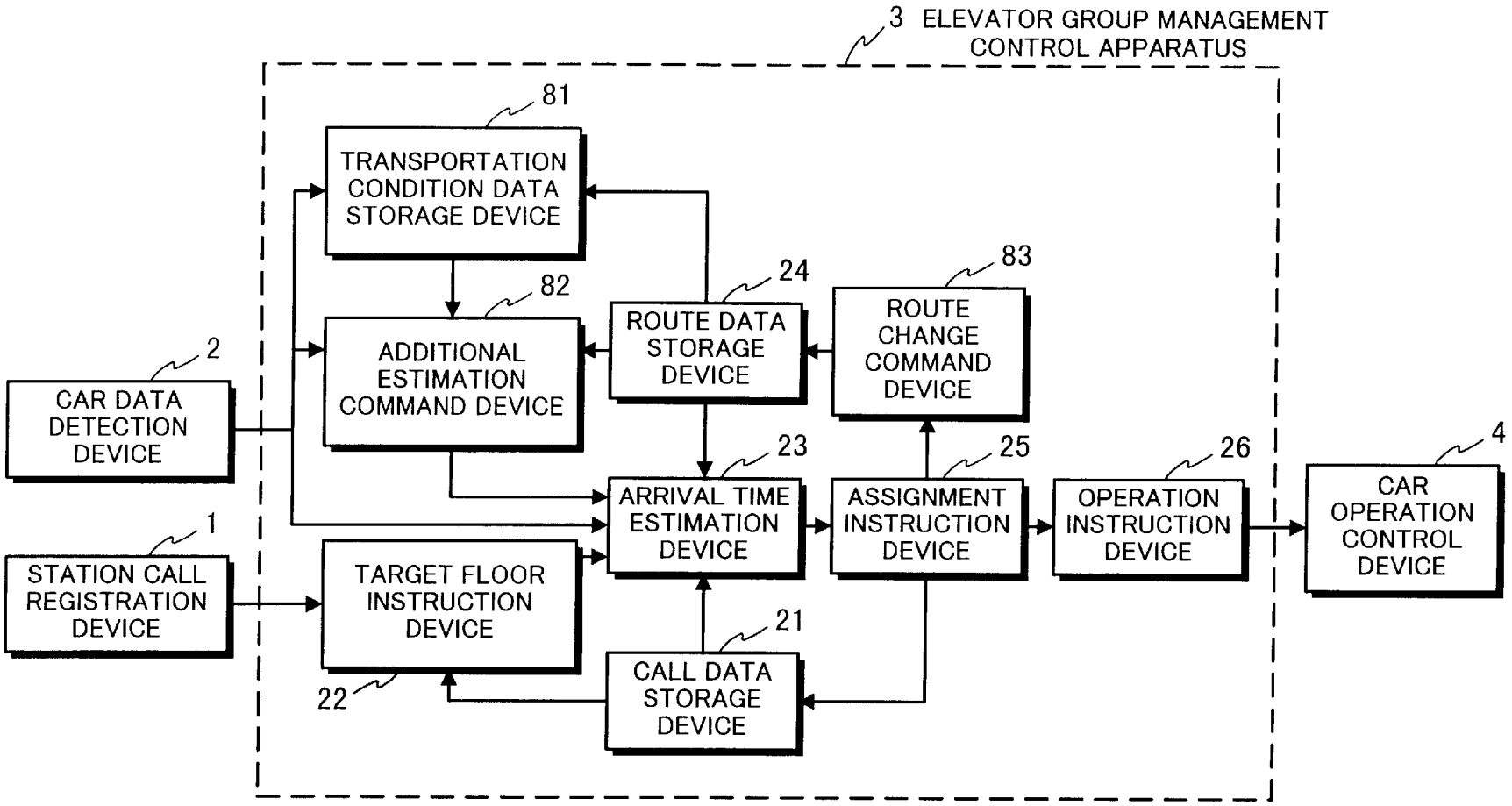
FIG. 8 is a diagram showing a configuration of an elevator group management control apparatus in accordance with the eighth embodiment.

More specifically, as shown in FIG. 8, the transportation condition data storage device 81 in this embodiment is arranged so that it stores therein other car's data as present along a selected route with respect to every car, based on each car's "position data" as obtained from the car data detection device 2 and each car's "route data" being stored in the route data storage device 24.

The additional estimation command device 82 is arranged so that, in responding to a newly occurred station call, it provides other route candidates based on each car's actual operating condition, and generates and issues to the arrival time estimation device 23 a command that forces estimation of the arrival time to get started in the case where the car will move for transportation along such new route.

Further, the route change command device 83 is arranged so that when a new station call is assigned to a certain car moving along the new route, the route change command device 83 issues a command forcing the old "route data" stored in the route data storage device 24 to be replaced with new "route data."

[8-2. Operation of the Eighth Embodiment]

The eighth embodiment thus arranged operates as follows.

[8-2-1. Transportation Condition Data Storage Processing]

In the transportation condition data storage device 81 of this embodiment, other cars' data along a route may be stored therein with respect to every car, based on each car's "position data" and "route data." Note that the following description of this embodiment assumes that the route data storage device 24 stores therein the "route data" as will be indicated in Table 20 below.

TABLE 20

| Car | (Transverse Floor | Transverse Shaft) |
|---|---|---|
| E1 | (1 | 23) |
| | (20 | 432) |
| | (10 | 34) |
| E2 | (1 | 23) |
| | (20 | 32) |

Table 21 below shows the "position data" of each car as detected by the car data detection device 2.

TABLE 21

| Car | (Floor | Shaft) |
|---|---|---|
| E1 | (20 | 4) |
| E2 | (15 | 3) |

From the above tables, the transportation condition data storage device 81 stores therein the other car's data along the route shown in Table 22. As apparent from viewing FIG. 4 also, the both cars are not presently on the route so that each data item is "null."

TABLE 22

| Car | (Other car | Floor | Shaft | Floor | Shaft) |
|---|---|---|---|---|---|
| E1 | (2 | null | null | null | null) |
| E2 | (1 | null | null | null | null) |

Now, assuming that the car E2 is at the level corresponding to the fifth floor in the third shaft, the resulting transportation condition data may be as follows:

TABLE 23

| Car | (Other car | Floor | Shaft | Floor | Shaft) |
|---|---|---|---|---|---|
| E1 | (2 | 10 | 3 | 1 | 3) |
| E2 | (1 | null | null | null | null) |

The above tells that car E2 is present on the E1's route (10@3) to (1@3) as the transportation condition data concerning car E1. By contrast, car E2 remains as "null" because car E1 is not on the route.

[8-2-2. Additional Estimation Command Processing]

The additional estimation command device 82 of this embodiment, is arranged so that, in responding to a newly occurred station call, it provides other route candidates based on each car's actual operating condition, and generates and issues to the arrival time estimation device 23 a command that forces estimation of the arrival time to get started in the case where the car will move for transportation along such new route.

Here, a further description will be given by use of the second embodiment described previously (i.e. the case where the assignment is operated based on the minimum nonresponse time).

At a present, in response to a new station call of (5 UP), each car is controlled to move or travel to satisfy its expected stop position shown in Table 24, based on the "route data" shown in Table 20.

TABLE 24

| Car | (Floor | Shaft) | |
|---|---|---|---|
| E1 | (10 | 4) | |
| | (10 | 3) | |
| | (1 | 3) | |
| | (1 | 2) | |
| | (5 | 2) | |
| E2 | (10 | 3) | (passed) |
| | (1 | 3) | |
| | (1 | 2) | |
| | (5 | 2) | |

However, each car is enabled to move into a different shaft that is out of the predefined route by transversely shifting at a transverse-shift floor of the tenth floor. This may be reworded such that it is possible to set in the cars E1, E2 a new route shown in Table 25.

This can be said because car E1 is enabled to go down to the first floor in the fourth shaft, without transverse movement on the tenth floor of the fourth shaft, then transversely shifting to the second shaft; car E2 is also allowed to transversely shift from the third shaft to the fourth shaft at the tenth floor, then downgoing from the tenth floor to the first floor in the fourth shaft so that it transversely shifts to the second shaft.

TABLE 25

| Car | (Transverse Floor | Transverse Shaft) |
|---|---|---|
| E1 | (1 | 234) |
| | (20 | 432) |
| E2 | (1 | 234) |
| | (20 | 32) |
| | (10 | 43) |

In this way, in the case of transportation along a new route shown in Table 25, the other car is presently absent in either route from the "position data" of respective car shown in Table 21; however, regarding car E2, it results in a detour or "roundabout" route as compared with the presently defined route. Regarding car E2, since no other cars are present even in the defined route, setting of any new route is not carried out; only for the car E1, the "route data" shown in Table 26 is identified as a new route.

TABLE 26

| Car | (Transverse Floor | Transverse Shaft) |
|---|---|---|
| E1 | (1 | 234) |
| | (20 | 432) |

In the second embodiment as mentioned earlier, the "target floor data" shown in Table 2 is supplied to the arrival time estimation device 23; in this embodiment, the "target floor data" of Table 27 is added to the arrival time estimation device 23 as a result of setting of the new route in the additional estimation command device 82.

TABLE 27

| Car | (Call Type | Floor | Direction | Elapsed Time | Assignment) |
|---|---|---|---|---|---|
| E1 | (H | 5 | UP | 0 | null) |
| E2 | (H | 5 | UP | 0 | null) |
| E1a | (H | 5 | UP | 0 | null) |

Next, the arrival time estimation device 23 attempts to estimate the arrival time shown in Table 28 by use of the calculation routine similar to that of the second embodiment. Note that since there is the possibility that the car E1*a* will collide with car E2 at (1@3), the estimated arrival time remains identical to that of car E1.

TABLE 28

| Car | (Call Type | Floor | Direction | Elapsed Time | Assignment | Estimated Arrival time) |
|---|---|---|---|---|---|---|
| E1 | (H | 5 | UP | 0 | null | 123) |
| E2 | (H | 5 | UP | 0 | null | 60) |
| E1a | (H | 5 | UP | 0 | null | 123) |

In this case, the assignment instruction device 25 will assign or allocate the car E2 with the minimum nonresponse time to a new station call of (5 UP).

Now, assume that the car E1*a* is minimized in nonresponse time while car E1*a* is to be assigned to a new station call. In this case, the route change command device 83 issues a command letting the "route data" stored in the route data storage device 24 be modified or updated to the "route data" of car E1*a* (the route data shown in Table 26).

As has been described above, in accordance with this embodiment, it becomes possible to set a new route for each car while enabling selection of one specific car which is minimum in nonresponse time; therefore, more efficient management of car transportation can be accomplished.

[9. Ninth Embodiment]

Figure 9:
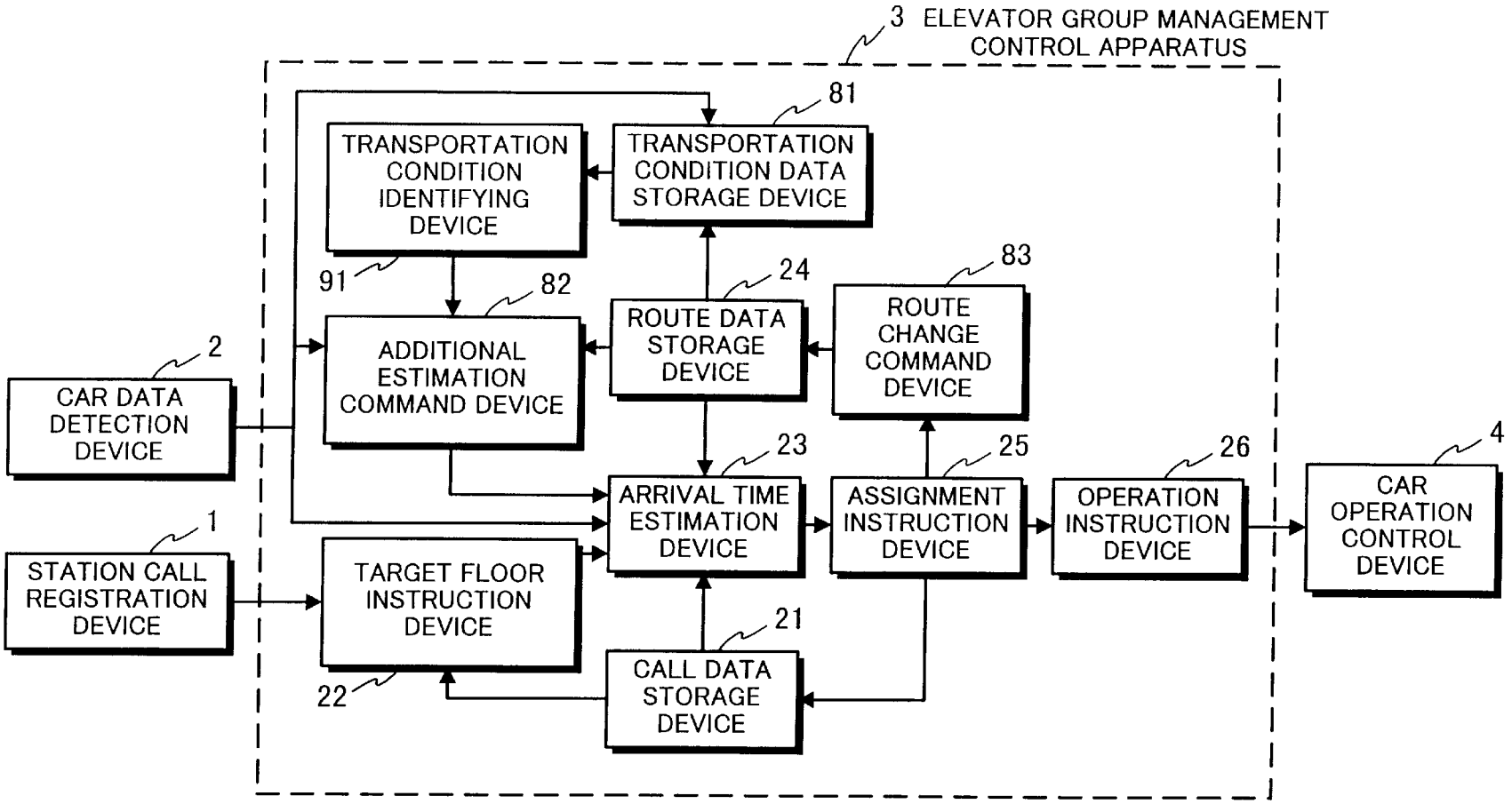
FIG. 9 is a diagram showing a configuration of an elevator group management control apparatus in accordance with the ninth embodiment.

This embodiment is one possible modification of said eighth embodiment with a transportation condition identifying device 91 being added to the basic configuration of the eighth embodiment (see FIG. 9).

It should be noted that in contrast to the situation of the eighth embodiment, a car E3 is assumed to remain stationary 30 seconds before at the level of the seventeenth floor in the fourth shaft. In this case the transportation condition data indicative of cars' actual operating conditions may be as follows.

TABLE 29

| Car | (Car | Floor | Shaft | Floor | Shaft) |
|---|---|---|---|---|---|
| E1 | (3 | 20 | 4 | 10 | 4) |
| E2 | (1 | null | null | null | null) |

[9-1. Configuration of the Ninth Embodiment]

The transportation condition identifying device 91 in this embodiment is arranged so that it identifies whether delay or congestion is happening along the route in the transportation situation as obtained from the transportation condition data storage device 81.

In the building model (FIG. 3) used in the first embodiment, a decision as delay or congestion is to be made in the cases which follow: first, when a car of interest remains stationary for more than 20 seconds; second, when two or more cars are operating in the region between adjacent upper and lower transverse-shift floors of the same shaft (for example, between the tenth and twentieth floors of the third shaft in FIG. 3). The definition of delay and congestion are established according to each building.

Accordingly, the car E3 is determined from Table 29 to be in the locally crowded or congested situation; regarding car E1, the "delay/congestion data" is issued as shown in Table 30.

TABLE 30

| Car | (Floor | Shaft | Floor | Shaft) |
|---|---|---|---|---|
| E1 | (20 | 4 | 10 | 4) |

In addition, the additional estimation command device 82 operates, if a route including such delay/congestion is found in the data obtained from the transportation condition identifying device 91, to set an appropriate route which is modifiable from a present position and has no delay/congestion and issue a command causing the arrival time estimation device 23 to begin estimating a possible arrival time of the car being expected to move along such new or updated route.

In Table 30 above, delay and/or congestion is occurring in the route of car E1. However, since a present position of car E1 is 20@4 while it is in the transverse-shift floor, any rapid route change remains available therefor. In short, a newly set route is as follows:

TABLE 31

| Car | (Transverse Floor | Transverse Shaft) |
|---|---|---|
| E1 | (1 | 23) |
| | (20 | 32) |

Note that while the present position of car E1 is out of such new route at this time, it should be conditioned that the car attempts to move along the new route after movement toward its nearest position on the new route.

Note also that in this embodiment, the estimation of arrival time is not performed in response to receipt of any newly occurred station call; rather, the arrival-time estimation for the presently assigned station call and/or car calls is to be effected with respect to a limited car(s) being subject to the route change.

Note further that evaluation in the assignment instruction device 25 is made based on the minimum nonresponse time as has been employed in the second embodiment discussed previously. Additionally, in view of the fact that such evaluation does not correspond to any new station call, while the "target floor data" is determined by identifying as the target floor the farthest station from car's present position from among those of car E1's "target floor data" as obtained from the target floor instruction device 22, the arrival time estimation device 23 defines the "target floor data" shown in Table 32 with regard to the car E1. This was done under the assumption that the station call on the fifth floor is assigned to car E2.

TABLE 32

| Car | (Call Type | Floor | Direction | Elapsed Time | Assignment) |
|---|---|---|---|---|---|
| E1 | (H | 16 | DN | 5 | 1) |
| E1a | (H | 16 | DN | 5 | 1) |

Assuming that the penalty time due to delay/congestion is 30 sec., the estimated arrival time is as follows:

TABLE 33

| Car | (Call Type | Floor | Direction | Elapsed Time | Assignment | Estimated Arrival time) |
|---|---|---|---|---|---|---|
| E1 | (H | 16 | DN | 5 | 1 | 41) |
| E1a | (H | 16 | DN | 5 | 1 | 25) |

It should be here noted that some practical hardware limitations due to correlation between linear motor's power-on territories or the like are withdrawn from consideration, including a conditional limitation such as "when one car is at fifteenth floor, another car is incapable of approaching its related one-level upper/lower floors", for example.

In this way, with this embodiment, on occasions where the nonresponse time is 30 sec. for car E1*a* as derived from the result of Table 33 which is less than that in the case of car E1, the route change will be done in such a manner that assignment instruction device 25 attempts to set the new route shown in Table 31 while route change command device 83 issues a command changing or modifying the "route data" of route data storage device 24.

[10. Tenth Embodiment]

This embodiment is a further modification of said first embodiment with a specific region identifying device 101 and a pattern transportation command device 102 being added to the basic configuration of the first embodiment.

Figure 10:
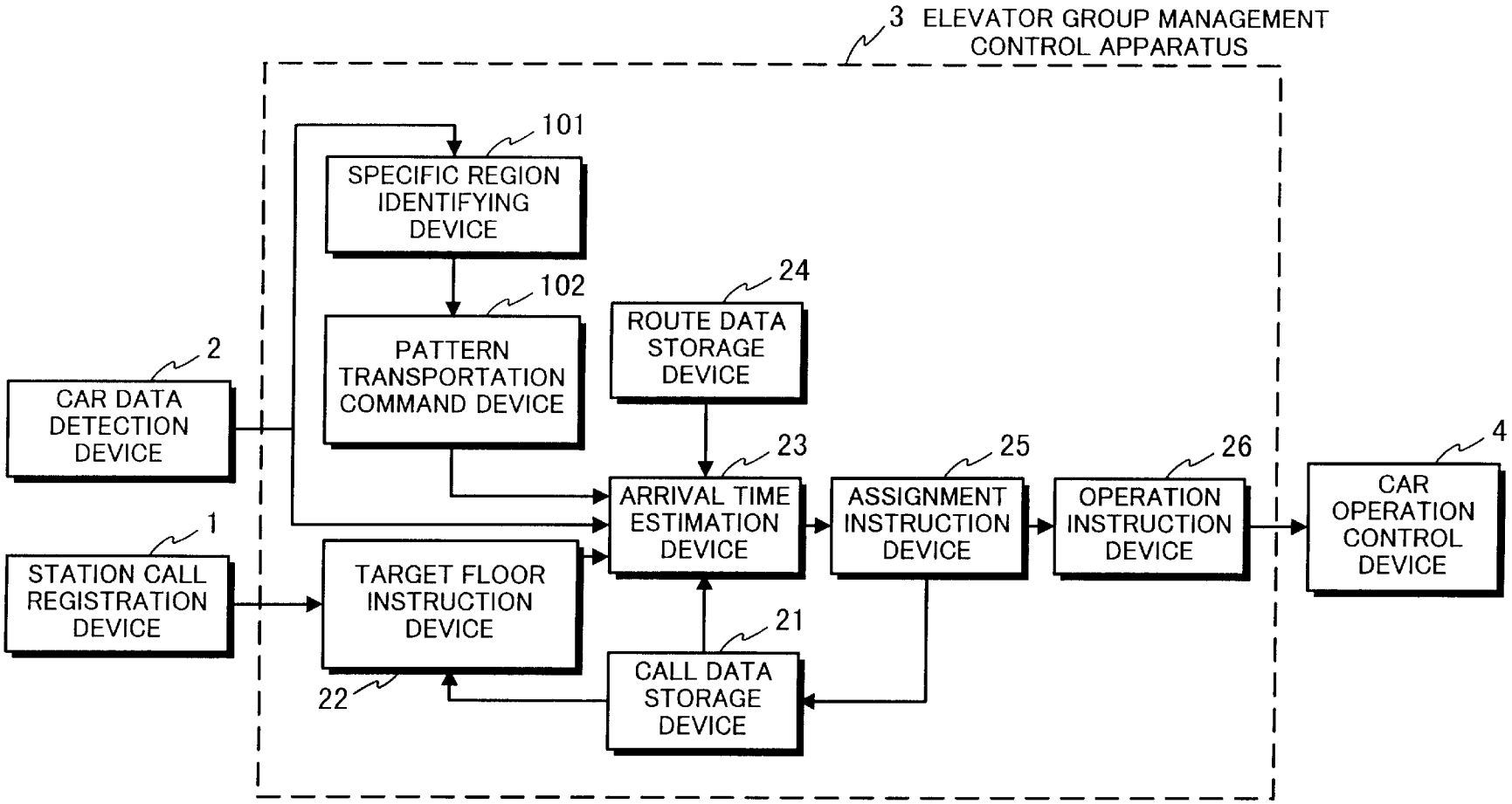
FIG. 10 is a diagram showing a configuration of an elevator group management control apparatus in accordance with the tenth embodiment.

More specifically, as shown in FIG. 10, the specific region identifying device 101 determines if each car is within a predefined region or zone, based on the "position data" thereof as obtained from the car data detection device 2.

Here, the indication (1 3 1 1) refers to (Floor Shaft Floor Shaft), which in turn represents the block of from 1@3 to 1@1 (i.e., from the first floor of the third shaft to the first floor of the first shaft). Accordingly, if (1 3 1 1) is a specific region, the result is that cars E1, E2 are both absent in such specific region at least at present. This can be said because as shown in FIG. 4, cars E1, E2 are at 20@4, 15@3, respectively.

Now imagine that the car E1 is transversely moving in (1 3 1 2). This means that at least one car exists within such specific region; therefore, the pattern shown in Table 34 will be sent forth to the pattern transportation command device 102.

TABLE 34

| Car | (Specific Region) |
|---|---|
| E1 | (1311) |
| E2 | null |

Next, the pattern transportation command device 102 generates and issues at its output one special route as to the car being presently in the specific region, irrespective of the "route data" as stored in the route data storage device 24. For instance, since car E1 is in the specific region in the case of Table 34, the special route is defined as the data indicated in Table 35 while allowing this information to be sent forth to the arrival time estimation device 23.

TABLE 35

| Car | (Transverse Floor | Transverse Shaft) |
|---|---|---|
| E1 | (1 | 123) |
| | (20 | 4321) |
| | (10 | 34) |

Note that the arrival time estimation device 23 is designed such that when the aforesaid special route is set (when car E1 is in the specific region), the arrival time estimation device 23 defines the route shown in Table 35 in the alternative of the "route data" of car E1 as obtained from the route data storage device 24, while excluding execution of any transportation other than the special route.

[11. Eleventh Embodiment]

This embodiment is a yet further modification of said first embodiment with a station call frequency identifying device 111 and a redundant or double-assignment instruction device 112 being added to the basic configuration of the first embodiment.

Figure 11:
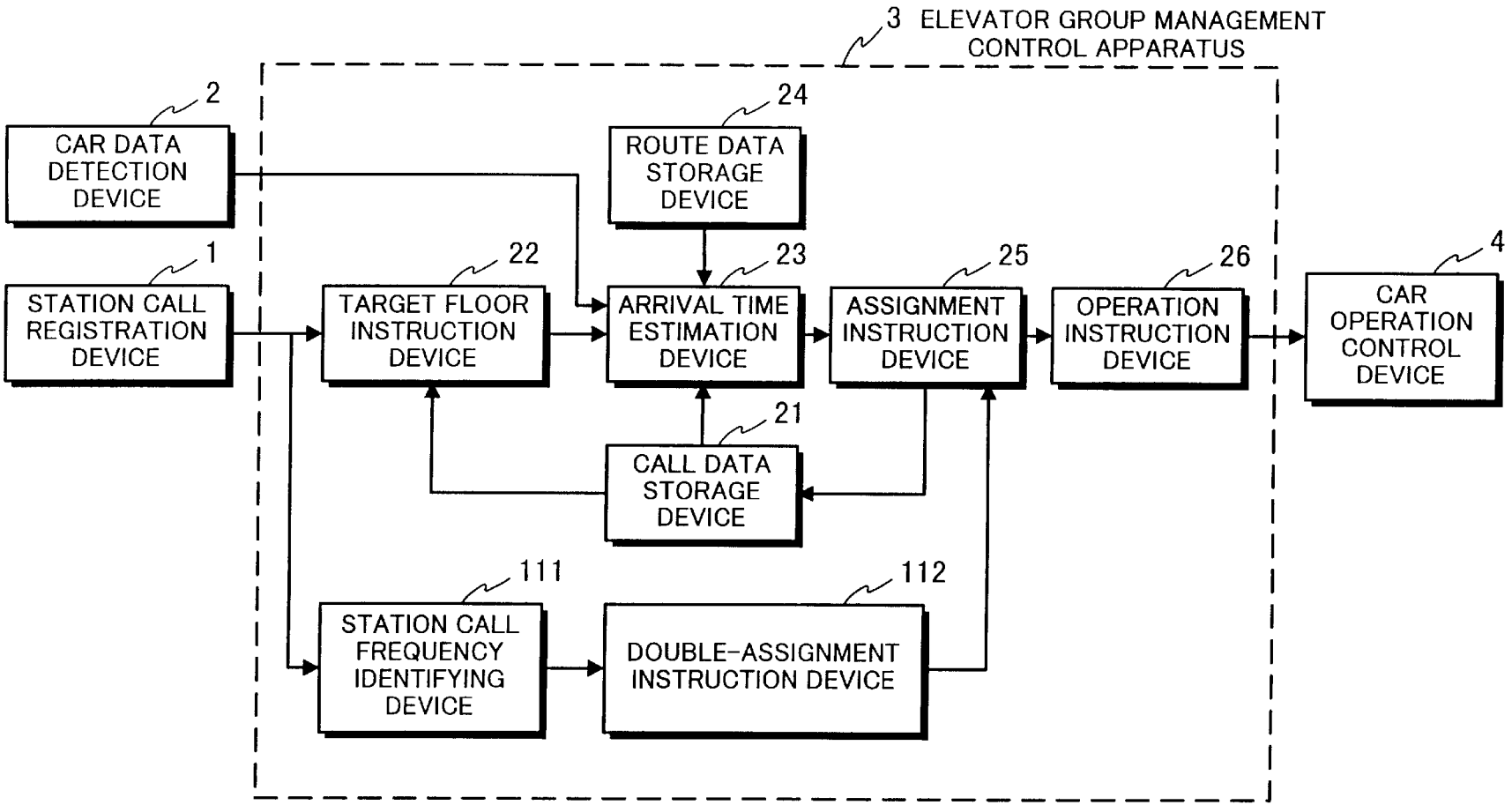
FIG. 11 is a diagram showing a configuration of an elevator group management control apparatus in accordance with the eleventh embodiment.

More specifically, as shown in FIG. 11, the station call frequency identifying device 111 is arranged so that it identifies the frequency when registration and deletion of the same-floor/same-direction station calls are repeated at prescribed intervals in the station call registration device 1, and then calculates it as the "frequency data." One example is that where the (5 UP) station call is registered, if (5 UP) was once registered in the past, and if the registration record was happened to be erased in response to such call, the station call frequency identifying device 111 operates to identify the frequency thereof and calculates it as the "frequency data."

More practically, the station call frequency identifying device 111 attempts to calculate the average value of the time as taken from registration of a station call of the same-floor/same-direction until erasure thereof. Additionally, this embodiment assumes that the repeat time interval (average value) is 30 sec.

The double-assignment instruction device 112 supplies, based on the "frequency data" obtained by said station call frequency identifying device 111, a command to the assignment instruction device 25 to ensure that a certain number of cars shown in Table 36 is assigned to the station call.

TABLE 36

| Repeat Interval | Number of cars |
|---|---|
| ∞ ~ 40 | 1 |
| 40 ~ 20 | 2 |
| . . . | . . . |

In the above example the double-assignment instruction device 112 assigns two specific cars to the station call (5 UP) as pursuant to Table 36 then issuing the command shown in Table 37 below.

TABLE 37

| (Floor Direction) | Number of cars |
|---|---|
| (5 UP) | 2 |
| . . . | . . . |

The assignment instruction device 25 employs the preselected evaluation method as described in connection with the above-mentioned embodiments, for assigning to the station call a corresponding number of cars as instructed from the double-assignment instruction device 112.

[12. Twelfth Embodiment]

This embodiment is a further modification of said first embodiment with a car separation calculating device 121 and a top-car ignorance assignment command device 122 being added to the basic configuration of the first embodiment.

Figure 12:
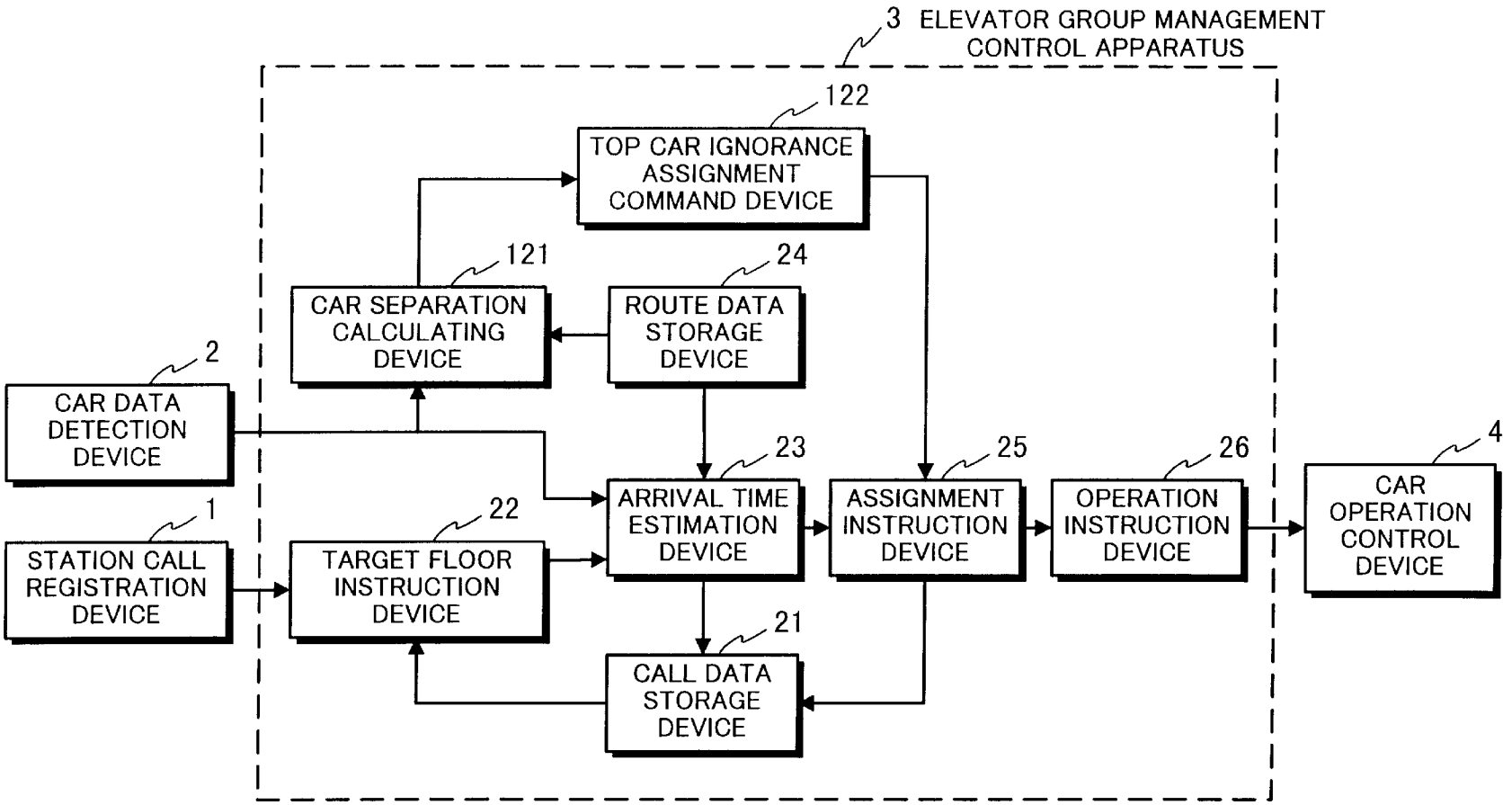
FIG. 12 is a diagram showing a configuration of an elevator group management control apparatus in accordance with the twelfth embodiment.

More specifically, as shown in FIG. 12, the car separation calculating device 121 calculates the distance between cars, based on each car's "position data" as obtained from car data detection device 2. Here, the car-to-car distance may be defined by the floor shift number required to arrive along the route at the floor of interest whereat a car resides. For example, as per the building model shown in FIG. 4, the car-to-car distance is as follows:

TABLE 38

| Car-to-car | Distance |
|---|---|
| E2–E1 | 5 |
| E1–E2 | 35 |

The top-car ignorance assignment command device 122 is designed to determine based on said "car-to-car distance data" whether the car of interest is spaced apart from its successive car by more than a predefined distance; when a decision is made affirmatively (i.e., the cars are spaced apart from each other by more than the predefined distance), the top-car ignorance assignment command device 122 issues a command letting assignment instruction device 25 disable execution of new or additional assignment of a station call to the subject car.

In the case of Table 38, since no cars are in the upgoing shaft, estimation is made to tell the impossibility of any quick reply to future occurrence of an upgoing station call(s). Then, such new station call is assigned not to the car E2 which remains satisfiable to the present call situation, but to the car E1.

Also, in order to render the car E2 quick responsive to any possible occurrence of station calls in future, the embodiment apparatus is arranged so that any station calls will not be assigned to car E2 as spaced far from the top or leading car E1.

[13. Thirteenth Embodiment]

This embodiment is a further modification of said first embodiment with a transportation condition data storage device 131, an assignment exclusion car instruction device 132, and a specific-region identifying device 133 being added to the basic configuration of the first embodiment.

Figure 13:
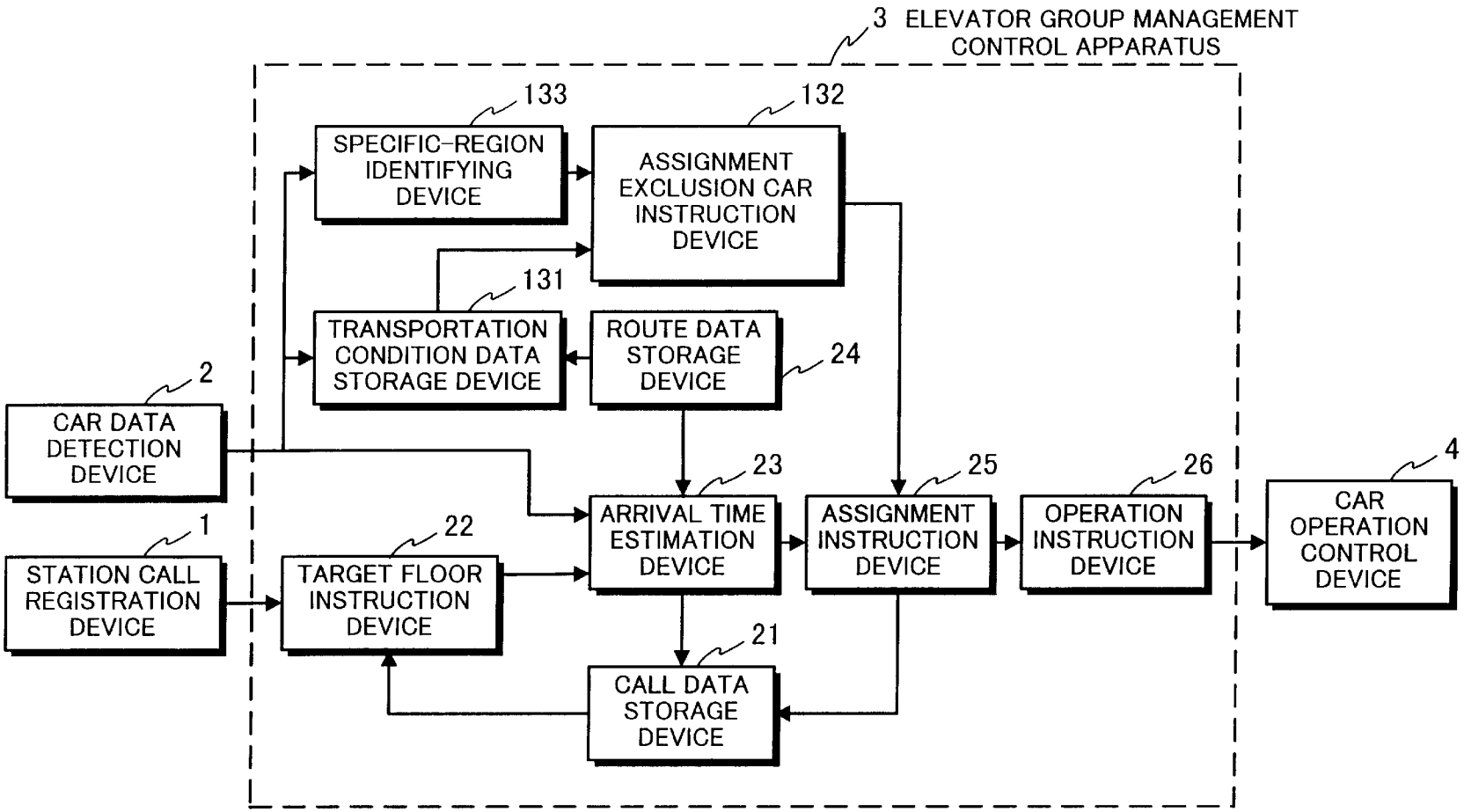
FIG. 13 is a diagram showing a configuration of an elevator group management control apparatus in accordance with the thirteenth embodiment.

More specifically, as shown in FIG. 13, the transportation condition data storage device 131 is arranged such that it stores, in substantially the same way as in the eighth embodiment, the other-car data as present on the route with respect to every car, based on each car's "position data" as obtained from car data detection device 2 and each car's "route data" as stored in route data storage device 24. Here, this embodiment assumes that the "route data" stored in route data storage device 24 is the same as that shown in Table 20, whereas the car positions as detected by car data detection device 2 is the same as that shown in Table 21.

The specific-region identifying device 133 identifies, in substantially the same way as in the tenth embodiment, whether a car is within the predefined range based on each car's "position data" obtained from car data detection device 2. One example is that assuming the specific region is (10 4 1 4), the cars E1, E2 shown in FIG. 3 are identified to be absent in the specific region because these cars are presently at 20@4, 15@3, respectively.

Assume that the car E1 is moving in (10 4 1 4). This means that car E1 is residing within the specific region; accordingly, the specific-region identifying device 133 issues the data shown in Table 39.

TABLE 39

| Car | (Specific Region) |
|---|---|
| E1 | (10 4 1 4) |
| E2 | null |

Further, the assignment exclusion car instruction device 132 operates to determine whether the car being in the specific region is in a prescribed situation of transportation or not; if a car is found which satisfies such condition, the assignment exclusion car instruction device 132 supplies assignment instruction device 25 with a command forcing inhibition of any new assignment of station calls.

Now, consider that the car E1 is traveling in (10 4 1 4) as shown in Table 39 whereas car E2 is moving in (10 3 1 3). In this case, as can be seen from the route of car E1, while this car E1 attempts to transversely shift at the first floor after arrival at 1@4, car E2 is presently moving in (10 3 1 3); therefore, such car E1's transverse movement can be significantly affected due to car E2's operating condition, which will render difficult the estimation of car E1's transportation.

To avoid such difficulty, this embodiment is specifically arranged so that appropriate car identification is made while forcing the assignment instruction device 25 to exclude a car(s) being presently within the region that is locally difficult in executing transportation estimation from a queue of one or more objects being assigned to station calls in this embodiment, car E1 is selected therefor.

[14. Fourteenth Embodiment]

Figure 14:
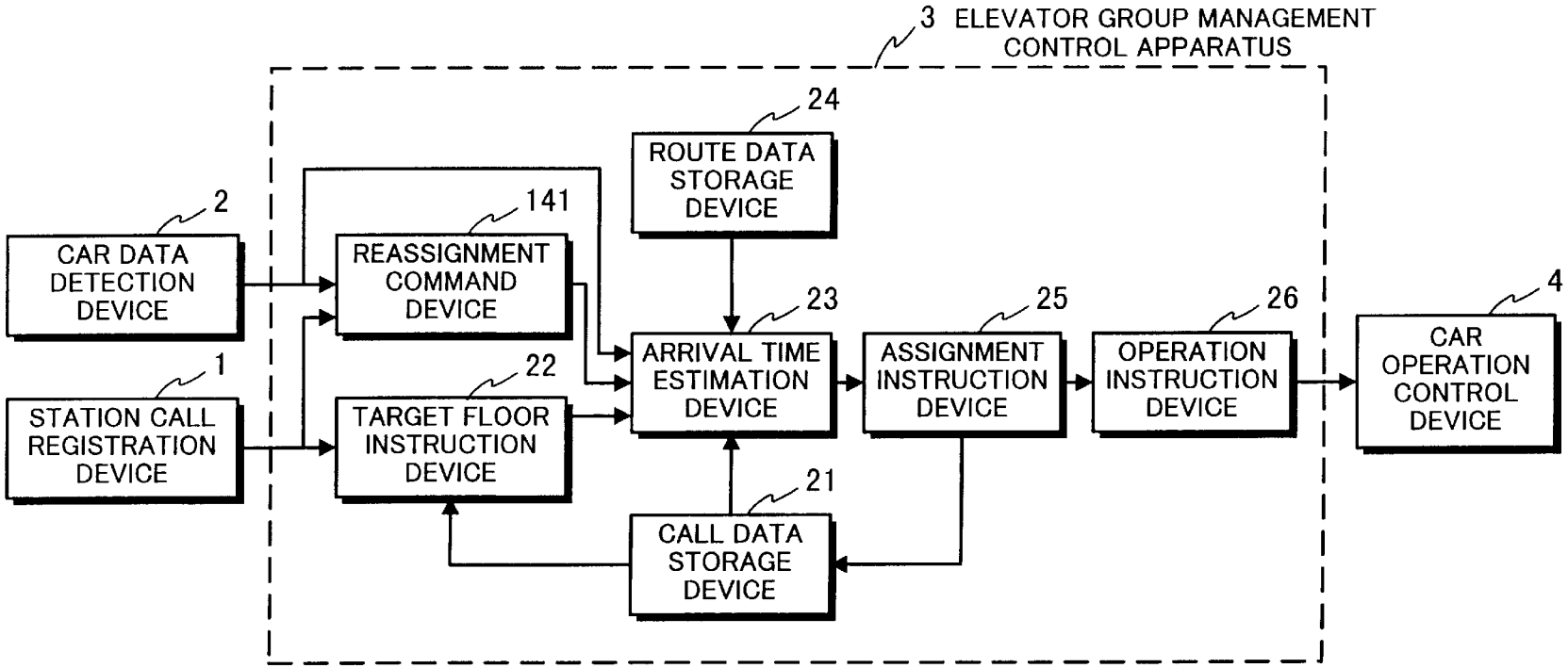
FIG. 14 is a diagram showing a configuration of an elevator group management control apparatus in accordance with the fourteenth embodiment.

This embodiment is a further modification of said first embodiment with a reassignment command device 141 being added to the basic configuration of the first embodiment, as shown in FIG. 14. This embodiment comes with the ability to reassign a car on specific occasions.

More specifically, assume that the car E1 which is presently assigned to the station call (4 DN) is going down in the third shaft in order to reach and land on the seventh floor relating to issuance of a car call. On the other hand, car E2 is downgoing in the fourth shaft, wherein neither station calls nor car calls occur for car E2 till the fourth floor at a time when it has passed the seventh floor. In the situation, the car E2 will be expected to first reach the fourth floor; accordingly, with this embodiment, the call (4 DN) is reassigned to car E2.

On such occasion the reassignment command device 141 operates to detect any car's positional change based on the car's "position data" as detected by the car data detection device 2, to detect any change in the station call's registration/deletion data as obtained from station call registration device 1, and to issue a command letting arrival time estimation device 23 review the assignment as to the station call for which car assignment has already been determined.

In the exemplary case, the reassignment command device 141 attempts first to detect that the positional relation between cars E1, E2 is changed and detected by car data detection device 2; then, the reassignment command device 141 provides a command forcing the arrival time estimation device 23 to begin estimating any possible arrival time concerning the station call (4 DN).

In responding to this, the arrival time estimation device 23 initiates again the estimation of an arrival time with (4 DN) being as a target floor. At this time, assignment instruction device 25 executes reevaluation of the already assigned station call(s) based on the estimation result as given from arrival time estimation device 23, then reallocating an appropriate car. For such reassignment, the evaluation scheme using the minimum nonresponse time may be employed as in the second embodiment. Additionally, in the present embodiment, car E2 will be subject to reassignment.

[15. Fifteenth Embodiment]

Figure 15:
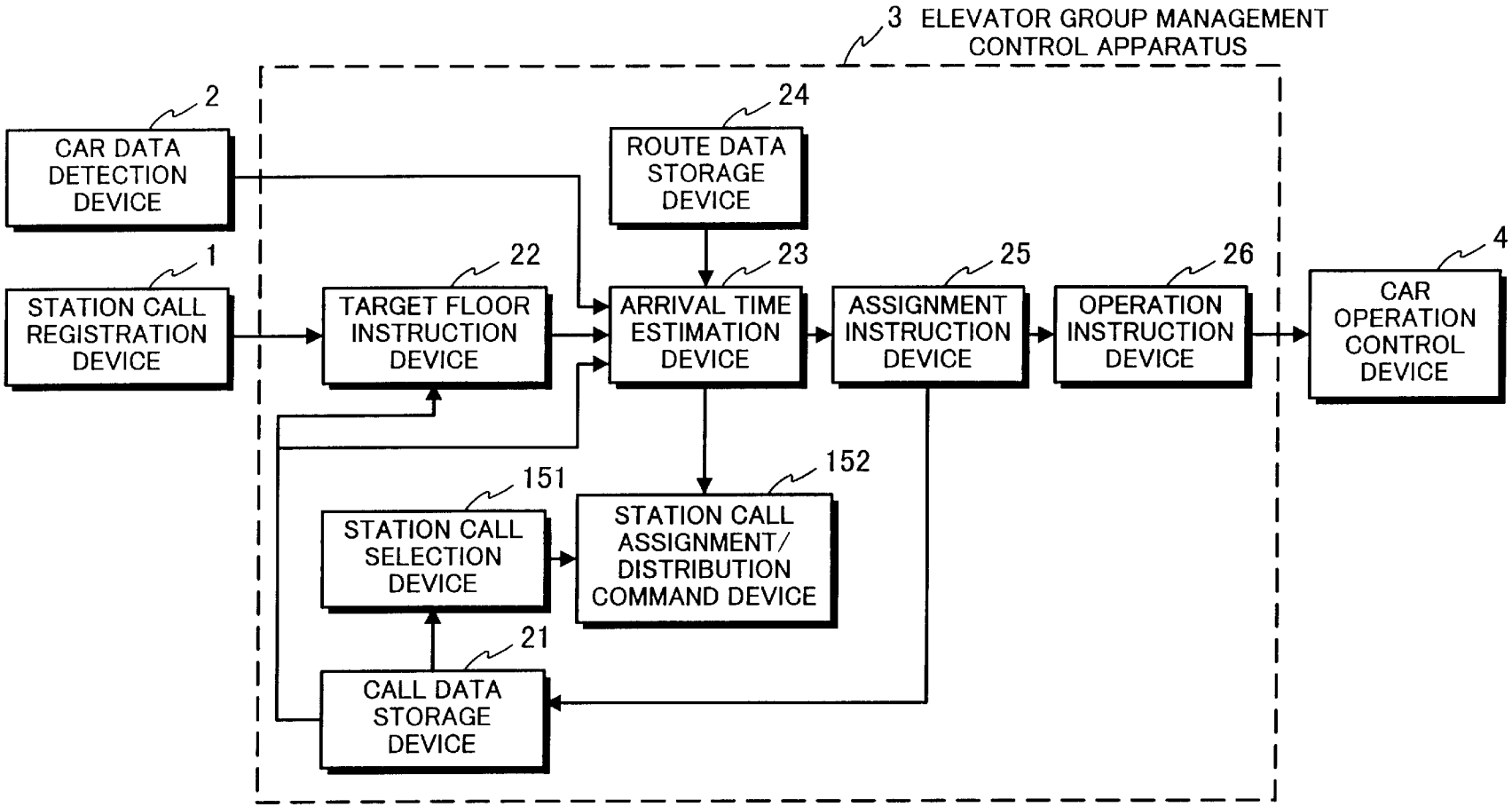
FIG. 15 is a diagram showing a configuration of an elevator group management control apparatus in accordance with the fifteenth embodiment.

This embodiment is a further modification of said first embodiment with a station call selection device 151 and a station call assignment/distribution command device 152 being added to the first embodiment, as shown in FIG. 15. This embodiment has the ability to reassign a specific kind of call to a different car on occasions where a certain one of the cars can adversely affect the transportation of the remaining cars.

By way of example, consider that the cars E1, E2 are downgoing at the ninth and the twelfth floors in the third shaft respectively while car E1 is expected to stop at the eighth floor. Imagine also that car E1 is assigned with several calls (6 DN), (5 DN), (4 DN) and (3 DN).

In such case, car E1's response to a call can adversely affect successful transportation of car E2. To avoid this, two calls for example, (6 DN), (5 DN) of those calls (6 DN), (5 DN), (4 DN) and (3 DN) are reassigned to car E2, enabling achievement of increased transportation efficiency of cars E1, E2 as a whole.

More specifically, in this embodiment, the station call selection device 151 determines, based on the "call data" as obtained from call data storage device 21, whether a car is present upon which the station assignment tasks are locally concentrated; if such car is found, the station call selection device 151 identifies one or several station calls under distribution, thus enabling scatter of certain ones of the concentrated station calls among associative cars including another car(s).

The selection standards or criteria being preferably employed here may be as follows:

(1) Determine the number of those calls to be subject to reassignment rendering the number of calls owned by a presently assigned car equal to that of any newly assigned car.

(2) Regarding a car that will delay issuing its response, suppress or eliminate execution of reassignment if possible. In the above example, the calls (4 DN), (3 DN) are applicable.

(3) Do not change the call indicating car's next stop position. In the above example, there is applicable the case where the transportation is being effected with car El's next stop position being defined as the sixth floor.

The station call assignment/distribution command device 152 operates, when the station call assigned by station call selection device 151 is distributed and moved to another car, to issue a command letting arrival time estimation device 23 perform estimation of arrival time of the other car at its intended floor. In the above example, the arrival time of each car (here, car E2 only) is estimated by arrival time estimation device 23 while recognizing as the target floors the calls (6 DN), (5 DN) selected by station call selection device 151.

The assignment instruction device 25 is responsive to the estimated result of arrival time estimation device 23 for reallocating the already assigned station calls to those cars other than the assigned car as pursuant to a predefined evaluation scheme. The evaluation may be carried out in accordance with the minimum average nonresponse time as discussed previously in connection with the third embodiment.

[16. Sixteenth Embodiment]

This embodiment is a further modification of said first embodiment with a route setting device 161 being added to the basic configuration of the first embodiment.

Figure 16:
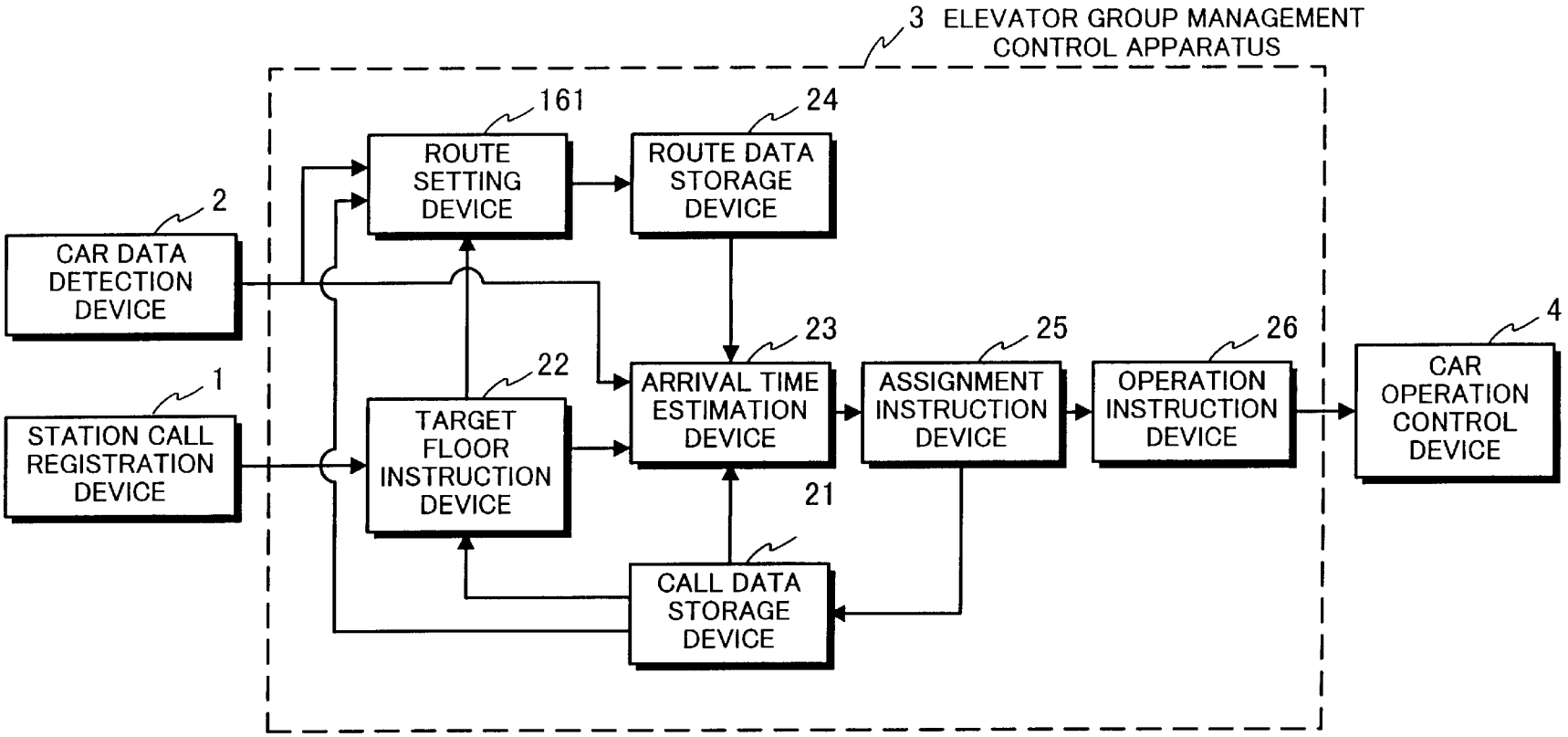
FIG. 16 is a diagram showing a configuration of an elevator group management control apparatus in accordance with the sixteenth embodiment.

More specifically, as shown in FIG. 16, the route setting device 161 holds therein any transportable routes as "candidates" based on the car call situation, and as necessary adds such route candidates to route data storage device 24 as the "route data" also. This data addition may be performed by selecting any possible route(s) every time a call newly occurs.

By way of example, the car E1 having the "call data" shown in Table 1 remains capable of traveling along a different route other than the one shown in Table 3 e.g., the route shown in Table 40 below.

TABLE 40

| Car | (Transverse Floor | Transverse Shaft) |
|---|---|---|
| E1 | ( 1 | 4) |
| | (20 | 4) |

Accordingly, the route setting device 161 updates the "route data" as presently stored in route data storage device 24, based on the route data candidates shown in Table 40. The updated "route data" is as follows:

TABLE 41

| Car | (Transverse Floor | Transverse Shaft) |
|---|---|---|
| E1 | ( 1 | 2 3) |
| | (20 | 4 3 2) |
| | (10 | 3 4) |
| | ( 1 | 4) |
| | (20 | 4) |

Here, the top data item in the "route data" of each car indicates the presently traveling route.

Note that the route data alteration in the above ninth embodiment is the one which attempts to change or modify part of the present route data, which is different from that of this embodiment being arranged to newly add one or several route data items.

[17. Seventeenth Embodiment]

Figure 17:
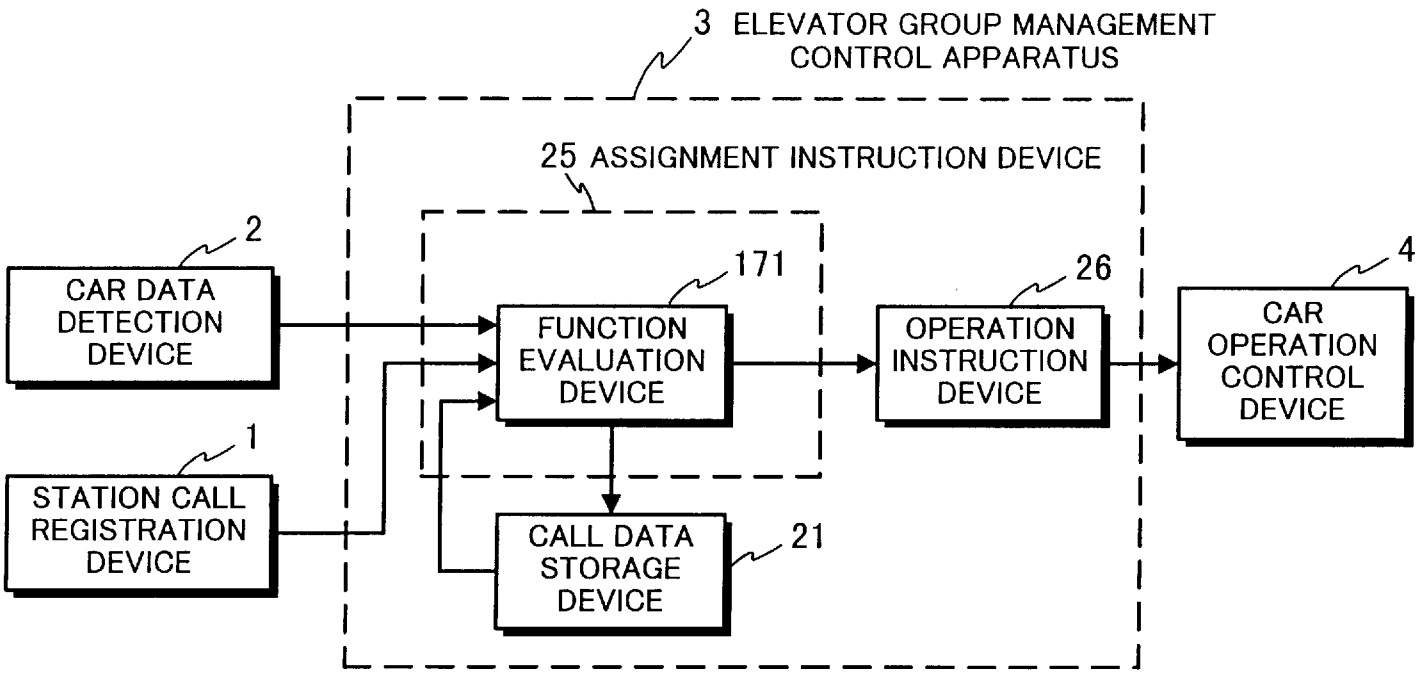
FIG. 17 is a diagram showing a configuration of an elevator group management control apparatus in accordance with the seventeenth embodiment.

As shown in FIG. 17, this embodiment does not have the arrival time estimation device 23, but with a function evaluation device 171 being arranged within the assignment instruction device 25.

Said function evaluation device 171 holds therein the function as expressed by the following Formula 12, which defines a specific function formula for determination of call number's distribution, where "i" is used to indicate that a new station call is to be assigned to car i.

$$\sigma(i) = \sum^{\text{NUMBER OF CARS}} \left( \frac{\text{(NUMBER OF EACH CAR'S STATION CALLS + NUMBER OF CAR CALLS + NUMBER OF DERIVATIVE CAR CALLS} - \sum^{\text{NUMBER OF CARS}} \text{NUMBER OF EACH CAR'S STATION CALLS + NUMBER OF CAR CALLS}}{\text{NUMBER OF CARS}} \right)^2 \quad \text{[Formula 12]}$$

The assignment instruction device 25 executes the car assignment procedure for the target floor in accordance with Formula 13. Formula 13 tells that assignment is to be made to the car j which is minimum in distribution as defined by Formula 12.

$$\sigma(j) = \min_{i=1}^{\text{NUMBER OF CARS}} \sigma(i) \quad \text{[Formula 13]}$$

It should be noted that this embodiment may alternatively be modified to employ the car reassignment scheme as in the aforementioned embodiments namely, the eighth, fourteenth and fifteenth embodiments.

[18. Eighteenth Embodiment]

Figure 18:
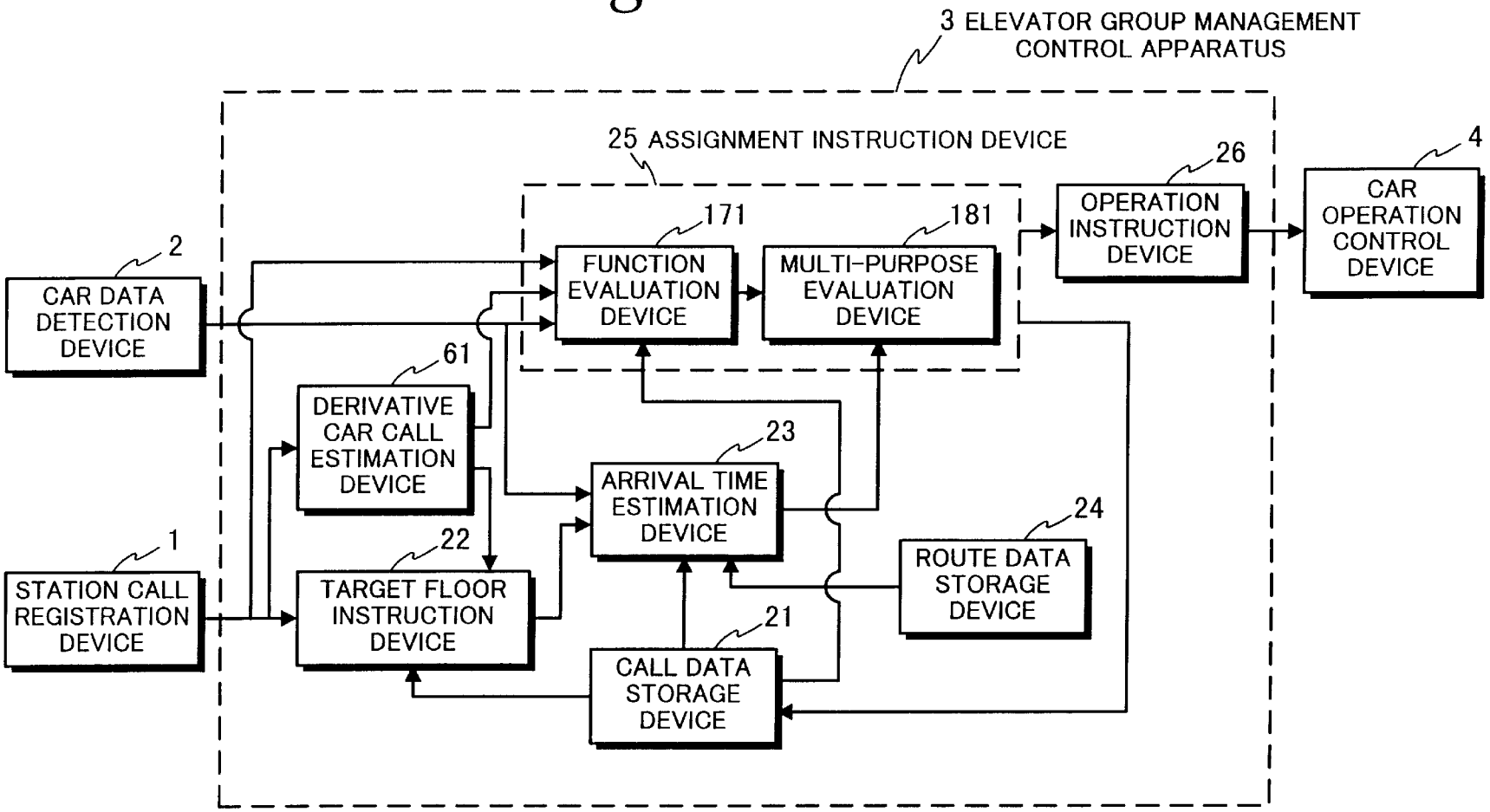
FIG. 18 is a diagram showing a configuration of an elevator group management control apparatus in accordance with the eighteenth embodiment.

As shown in FIG. 18 this embodiment comes with a multi-purpose evaluation device 181, which assigns cars based on a specific evaluation function that may be a combination of the evaluation scheme as employed in the second to seventh embodiments and the evaluation result as provided by the function evaluation device 171 as discussed previously in connection with the seventeenth embodiment.

Said multi-purpose evaluation device 181 makes use of one specific evaluation function as will be given below, where "i" indicates that a new station call is assigned to car i whereas a to e designate the weighting parameters for individual evaluation, which may be zero or positive integers.

$$\sigma(i)=a\times(\text{NONRESPONSE TIME SCATTER})+b\times(\text{AVERAGE NONRESPONSE TIME SCATTER})+c\times(\text{SERVICE COMPLETION TIME SCATTER})+d\times(\text{AVERAGE SERVICE COMPLETION TIME SCATTER})+e\times(\text{CAR'S CALL NUMBER SCATTER}) \quad \text{[Formula 14]}$$

Alternatively, it may be arranged that in the same manner as in the seventeenth embodiment, the following equation $$\sigma(j) = \min_{i=1}^{\text{NUMBER OF CARS}} \sigma(i) \quad \text{[Formula 15]}$$

is established to assign to the car j on the occasions where certain function value is at a minimum.

Note that this embodiment may be so modified as to employ the car reassignment scheme as in the aforementioned embodiments (the eighth, fourteenth and fifteenth ones).

[B. Embodiments Referring to the Invention for Attaining the Second Object]

[19. Nineteenth Embodiment]

This embodiment corresponds to the elevator group management control apparatus described in claims 9 and 10 and the elevator management control method (described in claims 24 and 25) which is implemented in this elevator group management control apparatus.

[19-1. Configuration of the Nineteenth Embodiment]

This embodiment relates to an elevator group management control apparatus 3 that is employed in an elevator system provided with a car operation control device 4 that governs the operations of a plurality of elevator cars that are capable of making vertical and horizontal movement, station call registration devices 1, one or more of which are installed for each station on a floor and a car data detection device 2 that detects or estimates the state of each car (position, speed, load, for instance).

[19-1-1. Configuration of the Elevator Group Management Control Apparatus]

Figure 19:
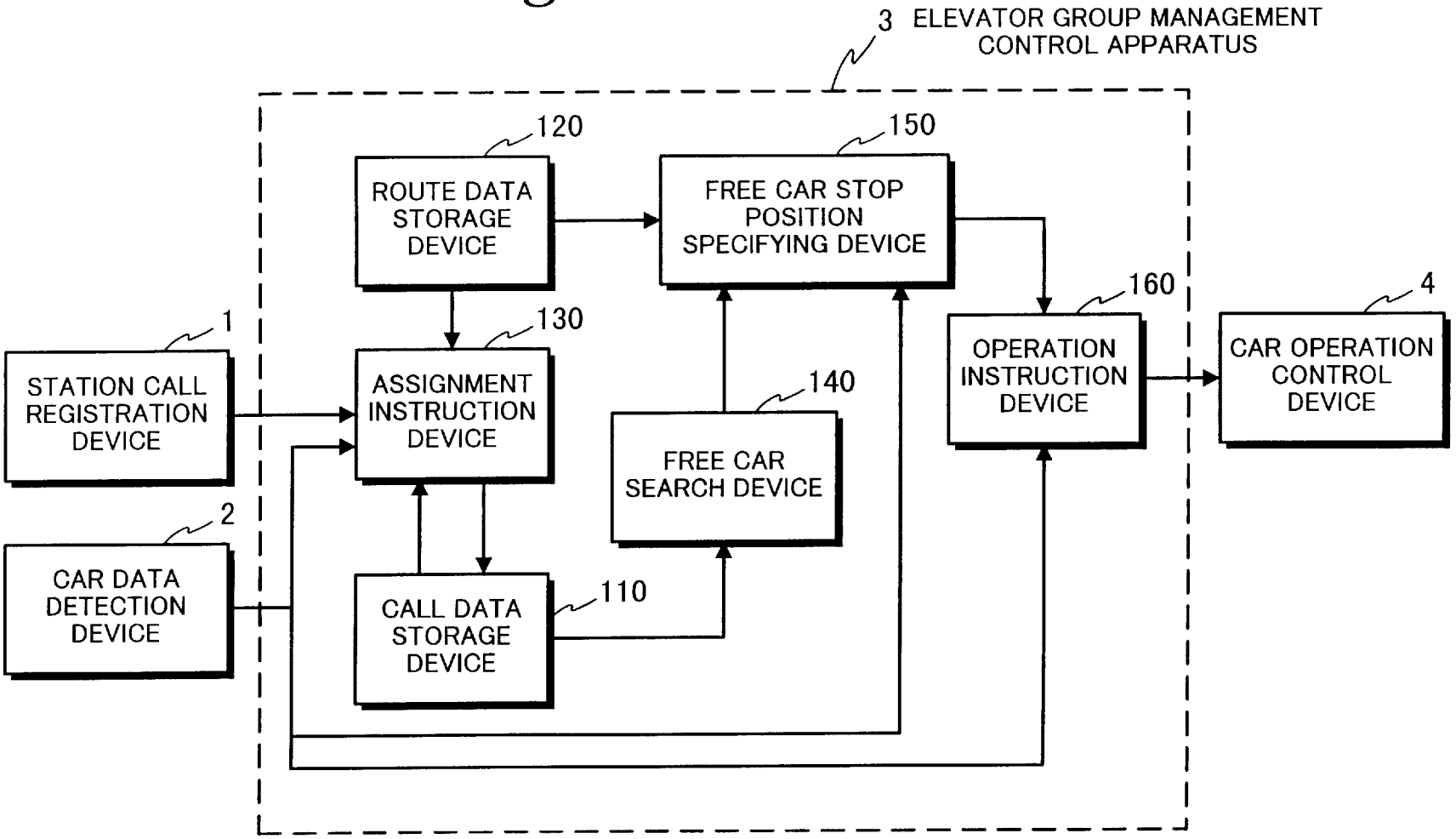
FIG. 19 is a block diagram of the nineteenth embodiment of the elevator group management control apparatus according to the present invention.

The elevator group management control apparatus 3 in this embodiment is constituted with the devices shown in FIG. 19.

In other words, it comprises a call data storage device 110 that stores in memory call data constituted of the floors and directions (settings in regard to whether calls are for the ascending direction or the descending direction) of station calls that are assigned to each car in advance, the floors corresponding to car calls (floors where passengers in the elevator disembark) and the lengths of time elapsing since call generation;

- a route data storage device 120 that stores in memory the route through which each car should be operated;
- an assignment instruction device 130 that, based upon the car data detected by the car data detection device 2, the route data stored in the route data storage device 120 and the call data stored in the call data storage device 110, selects a car to respond to a station call registered in the station call registration device 1 and outputs the assignment status of cars to the call data storage device 110 to have the call data updated and stored in memory;
- a free car search device 140 that inputs call data for each car stored in the call data storage device 110 to search for a free car, that is neither on station call nor on car call;
- a free car stop position specifying device 150 that, using free car data retrieved by the free car search device 140, car data detected by the car data detection device 2 and route data stored in the route data storage device 120, specifies the position where the free car searched by the free car search device 140 should be stopped in conformance to specific criteria; and
- an operation instruction device 160 that outputs an operation instruction when a free car is at a position other than the stop position specified by the free car stop position specifying device 150 so that the free car can be moved to the specified stop position.

It is to be noted that the operation instruction device 160 is involved in the operation of the responding cars that have been selected to respond to individual calls by the assignment instruction device 130 as well as the operation of free cars. In other words, the operation instruction device 160 is configured in such a manner that it outputs an operation instruction to responding cars that are to respond to individual calls based upon the data from the assignment instruction device 130 that are sent via the call data storage device 110, the free car search device 140, and the free car stop position specifying device 150.

[19-1-2. Configuration of the Free Car Stop Position Specifying Device]

Figure 20:
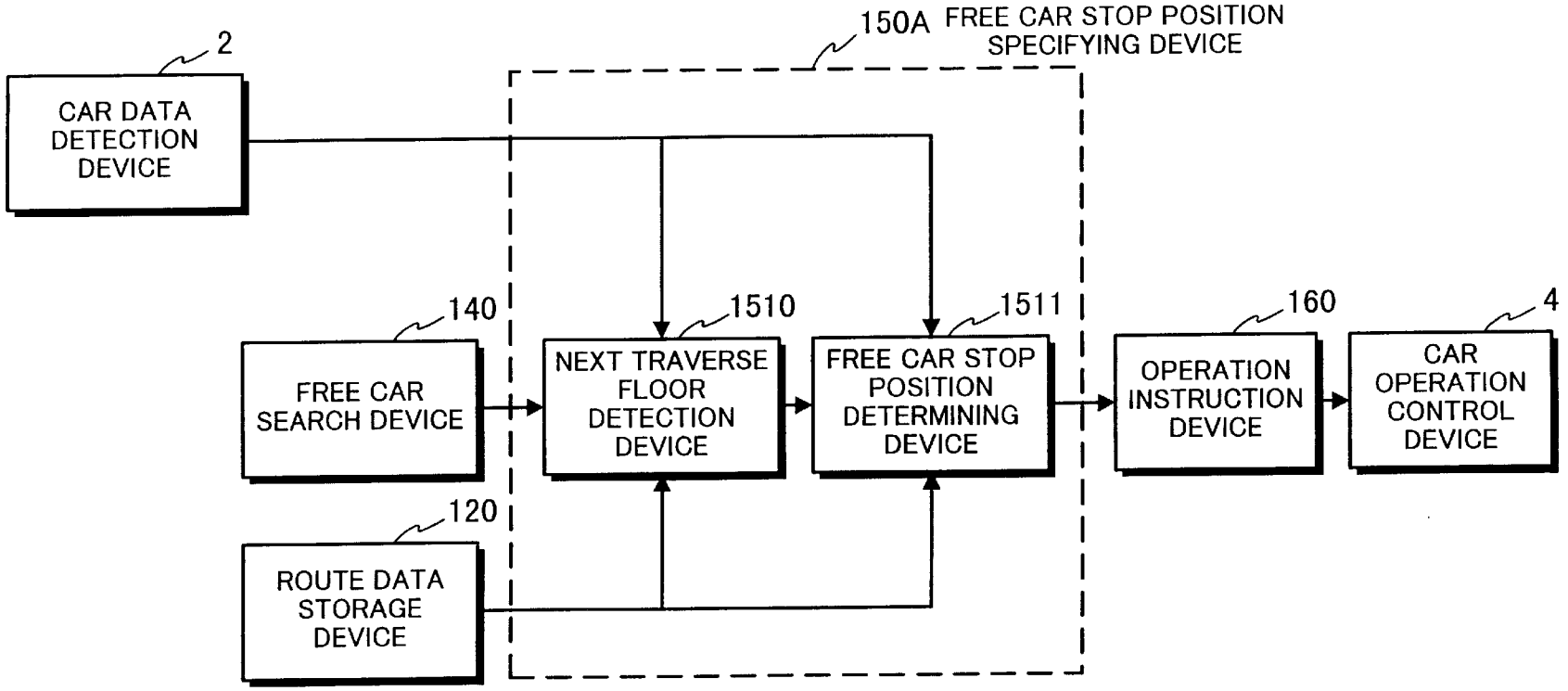
FIG. 20 is a block diagram of the free car stop position specifying device employed in the nineteenth embodiment of the elevator group management control apparatus according to the present invention.

The following is a detailed explanation of the specific structure of a free car stop position specifying device 150A employed in the elevator group management control apparatus 3 in this embodiment, in reference to FIG. 20.

Namely, the free car stop position specifying device 150A comprises a next traverse floor detection device 1510 that, based upon the route data stored in the route data storage device 120 and each set of car data sent from the car data detection device 2, detects the closest traverse floor for each free car in its operating direction, and

- a free car stop position determining device 1511 that determines the traverse floor detected by the next traverse floor detection device 1510 as the stop position for the free car.

[19-2. Operation of the Nineteenth Embodiment]

The nineteenth embodiment structured as described above provides the following functions.

[19-2-1. Call Data Storage Processing]

In the call data storage device 110 shown in FIG. 19, the floors and directions (settings in regard to whether calls are for the ascending direction or the descending direction) of station calls that are assigned to each car in advance, the floors corresponding to car calls (floors where passengers in the elevator disembark) and the lengths of time elapsing since call generation, are stored in memory as call data in the format shown in Table 42.

TABLE 42

| Car | (Call Type | Floor | Direction | Elapsed Time) |
|---|---|---|---|---|
| 1 | (H | 16 | DN | 5) |
| | (C | 12 | DN | 20) |
| | (C | 4 | DN | 20) |
| 2 | (C | 9 | DN | 22) |
| | (H | 3 | UP | 10) |
| 3 | (null) | | | |
| 4 | (null) | | | |
| 5 | (null) | | | |

In this table, H indicates a station call, C indicates a car call, UP indicates the ascending or upward direction and DN indicates the descending or downward direction. For instance, the call data in regard to car 1, i.e., (H, 16, DN, 5) indicate that a station call for the descending direction was generated at the 16th floor 5 seconds earlier. Also the call data for car 2, i.e., ( C, 9, DN, 22) indicate that a passenger in car 2 made a registration 22 seconds earlier of his intention to disembark at the ninth floor through a descending direction operation. It is to be noted that it is assumed that these lengths of elapsed time are automatically updated through registration, deletion, search and the like of call data.

[19-2-2. Route Data Storage Processing]

In the route data storage device 120, the route through which each car should be operated is stored in memory as route data.

Figure 21:
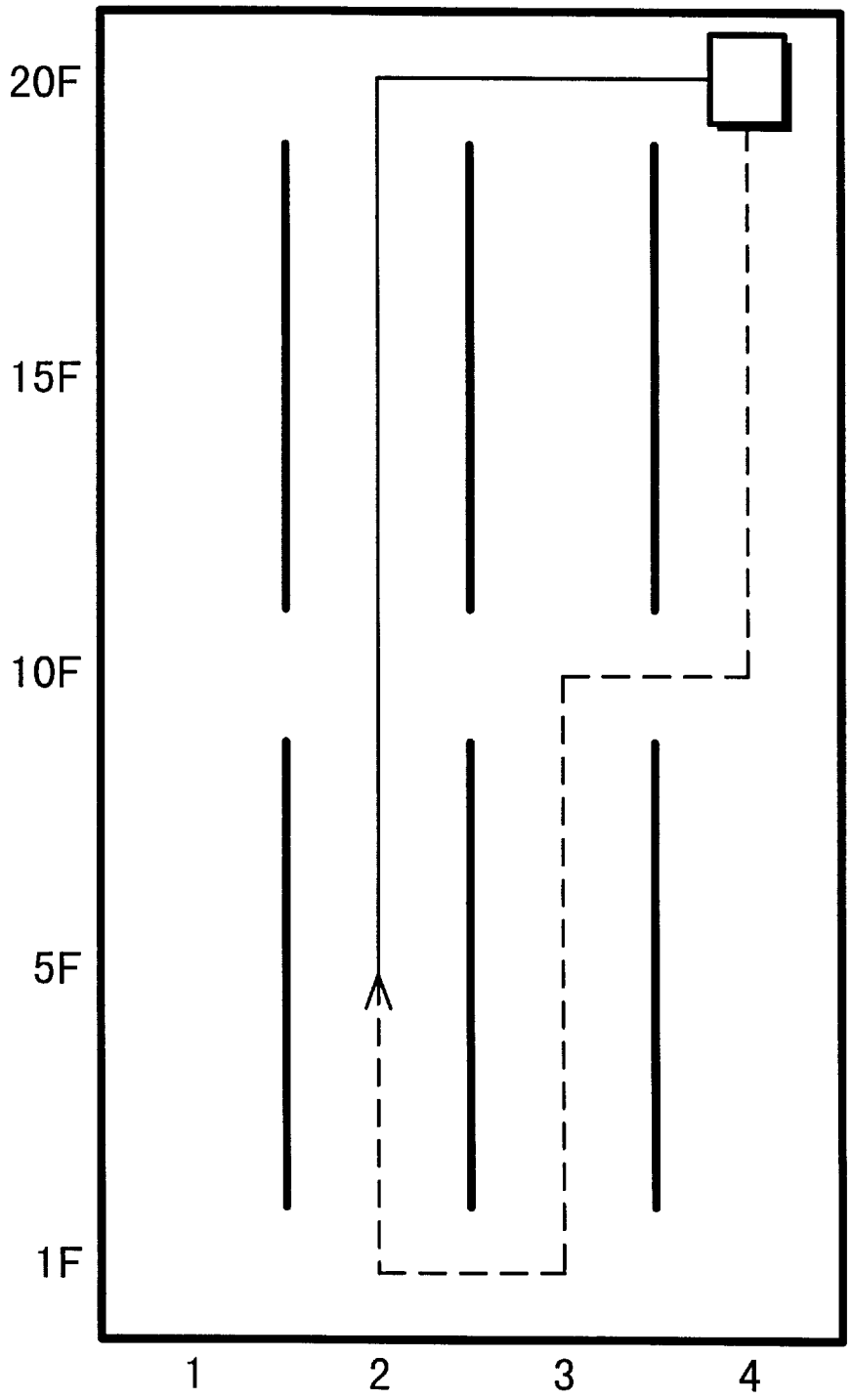
FIG. 21 is an example of route data stored in the route data storage device.

For instance, as shown in FIG. 21, in order for a car currently at the twentieth floor in the fourth shaft in a 20-story building provided with four shafts to respond to a station call for the ascending direction generated at the fifth floor, it may conceivably take a route, as indicated with the broken line arrow, in which it descends to the tenth floor in the fourth shaft, traverses to the third shaft at the tenth floor, descends to the first floor in the third shaft, traverses to the second shaft at the first floor and ascends to the fifth floor in the second shaft to respond to the station call.

Figure 22:
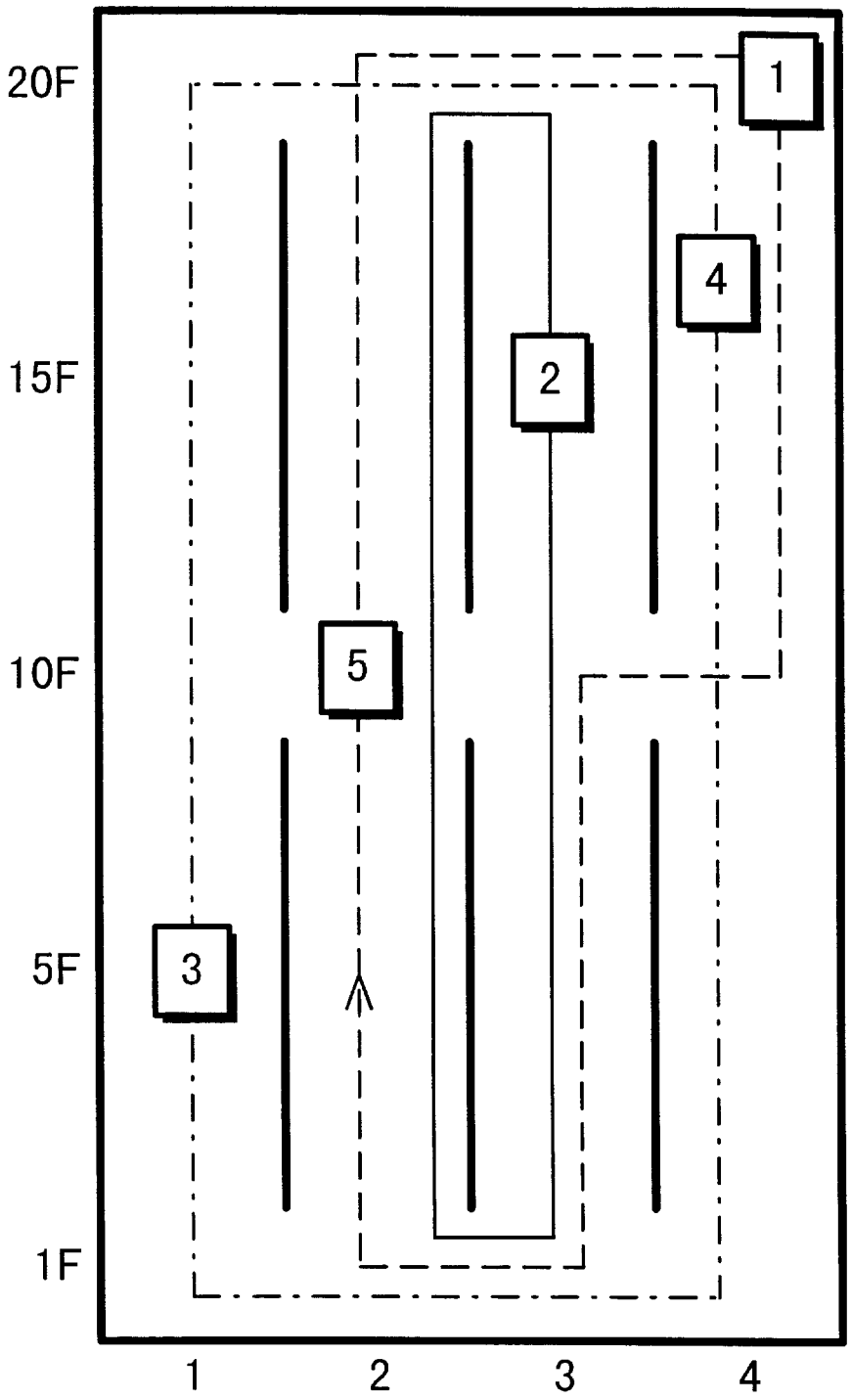
FIG. 22 is a diagram presented to illustrate any of the embodiments of the elevator group management control apparatus according to the present invention, showing the operating states of the individual cars and the operating directions of the shafts.

The route through which a car should be operated is determined in advance for each car in this manner and those routes are stored in memory as route data in the format shown in Table 43. For instance, the route data for car 1 indicate that its traverse floors are the first floor, the tenth floor and the twentieth floor and that the route through which car 1 makes traverse movement from the third shaft to the second shaft at the first floor, makes traverse movement from the second shaft to the fourth shaft at the twentieth floor and makes traverse movement from the fourth shaft to the third shaft at the tenth floor, is determined as the route through which car 1 should operate. Note that FIG. 22 illustrates the route data in Table 43.

TABLE 43

| Car | (Transverse Floor | Transverse Shaft) |
|---|---|---|
| 1 | 1 | 2 3 |
| | 20 | 4 3 2 |
| | 10 | 3 4 |
| 2 | 1 | 2 3 |
| | 20 | 3 2 |
| 3 | 1 | 1 2 3 4 |
| | 20 | 4 3 2 1 |
| 4 | 1 | 1 2 3 4 |
| | 20 | 4 3 2 1 |
| 5 | 1 | 2 3 |
| | 20 | 4 3 2 |
| | 10 | 3 4 |

[19-2-3. Assignment Instruction Processing]

The assignment instruction device 130 shown in FIG. 19, based upon the car data relating to each car detected by the car data detection device 2, the route data relating to each car stored in the route data storage device 120 and the call data constituted of car calls for each car and station calls assigned to each car that are stored in the call data storage device 110, selects a car that is to respond to a station call that has been newly registered and stores the station call assigned to the responding car as new call data in the call data storage device 110 or updates the standing data.

Note that while a number of methods may be adopted by this assignment instruction device 130 for selecting responding cars, it is assumed that, in this embodiment, assignment is made to the car that is located the closest to the floor where the station call is made (a car that is located at a position where it is possible for it to respond along a specific shaft direction).

For instance, when individual cars are at the positions shown in FIG. 22 and a station call is made at the fifteenth floor for the ascending direction, car 5, which is operating in an ascending direction shaft (in the first shaft or the second shaft in FIG. 22) and is located at the position closest to the floor where the station call has been generated (fifteenth floor) is assigned. Then, with an instruction issued by the assignment instruction device 130, the data in the call data storage device 110 are updated as shown in Table 44. In other words, by comparing Table 44 against Table 42, it becomes obvious that new call data in regard to car 5 have been stored in memory.

TABLE 44

| Car | (Call Type | Floor | Direction | Elapsed Time) |
|---|---|---|---|---|
| 1 | H | 16 | DN | 5 |
| | C | 12 | DN | 20 |
| | C | 4 | DN | 20 |
| 2 | C | 9 | DN | 22 |
| | H | 3 | UP | 10 |
| 3 | null | | | |
| 4 | null | | | |
| 5 | H | 15 | UP | 0 |

[19-2-4 Free Car Search Processing]

The free car search device 140 shown in FIG. 19 searches the call data for each car stored in the call data storage device 110 to detect cars that are neither on car call nor on station call. As explained earlier, when the call data shown in Table 42 are stored in the call data storage device 110, cars 3, 4 and 5 are detected as free cars that are on neither car call nor on station call.

[19-2-5. Free Car Stop Position Specifying Processing]

The free car stop position specifying device 150A shown in FIG. 20 sets a new stop position which satisfies specific requirements for each of the free cars detected by the free car search device 140.

(A) Requirements for Determining Stop Position for Free Cars

In the free car stop position specifying device 150A in this embodiment, the position of the traverse floor that each free car is to reach next within its current operating shaft is set as the next stop position for that free car. In addition, if a free car is present at a traverse floor, it is to be left stationary at the current position.

Note that in the free car stop position specifying device 150 in this embodiment, the position of the traverse floor to which each free car is to reach next is set as the next stop position for that free car for the following reason.

Namely, with a free car positioned at the traverse floor, even if this free car presents a hindrance to the operation of a car on call, it is possible for it to make traverse movement to another shaft promptly.

The method for determining the stop position for a free car adopted by the free car stop position specifying device 150 in this embodiment is explained in reference to a specific example. For instance, when individual cars are present at the positions shown in FIG. 22, since the first shaft in which car 3 is present is an ascending direction shaft, the traverse floor that car 3 will reach next is the tenth floor in the first shaft. Consequently, it is determined that car 3 should stop at the tenth floor in the first shaft.

Also, since the fourth shaft in which car 4 is present in a descending direction shaft, the traverse floor that car 4 will reach next is the tenth floor in the fourth shaft. Consequently, it is determined that car 4 is to stop at tenth floor in the fourth shaft.

As for car 5, since car 5 is located at the tenth floor, which is the traverse floor of the second shaft, it is determined that car 5 should remain at the current position. As a result, the positioning of the individual free cars shown in Table 45.

TABLE 45

| Free car | (Floor location | Shaft) |
|---|---|---|
| 3 | 10 | 1 |
| 4 | 10 | 4 |
| 5 | 10 | 2 |

[19-2-6. Operation instruction Processing]

The operation instruction device 160 shown in FIG. 19 outputs operation instructions to the car operation control device 4 in order to move each free car to the stop position specified by the free car stop position specifying device 150.

In addition, the operation instruction device 160 outputs operation instructions to the car operation control device 4 for a responding car which is to respond to a given call, based upon the data from the assignment instruction device 130 that are sent via the call data storage device 110, the free car search device 140, and the free car stop position specifying device 150.

[19-3. Effects of the Nineteenth Embodiment]

The elevator group management control apparatus in the nineteenth embodiment structured as described above and the elevator group management control method that is executed in this elevator group management control apparatus achieve the following advantage:

Namely, when performing elevator group management control, by positioning free cars at the traverse floors within the shafts where the cars are currently present, even if a free car comes to present a hindrance to the operation of another car that is on call, it can be made to make traverse movement into another shaft, achieving an improvement both in operational efficiency and safety.

[20. Twentieth Embodiment]

This embodiment corresponds to the elevator group management control apparatus (disclosed in claims 9 and 11) and the elevator group management control method (disclosed in claims 24 and 26) which is executed in this elevator group management control apparatus.

[20-1. Configuration of the Twentieth Embodiment]

This embodiment is a variation of the nineteenth embodiment, with modifications in the specific structure of the free car stop position specifying device.

[20-1-1. Configuration of the Elevator Group Management Control Apparatus]

The elevator group management control apparatus 3 in this embodiment is structured identically to that in the nineteenth embodiment except for modifications in the structure of the free car stop position specifying device (see FIG. 19).

[20-1-2. Configuration of the Free Car Stop position Specifying Device]

Figure 23:
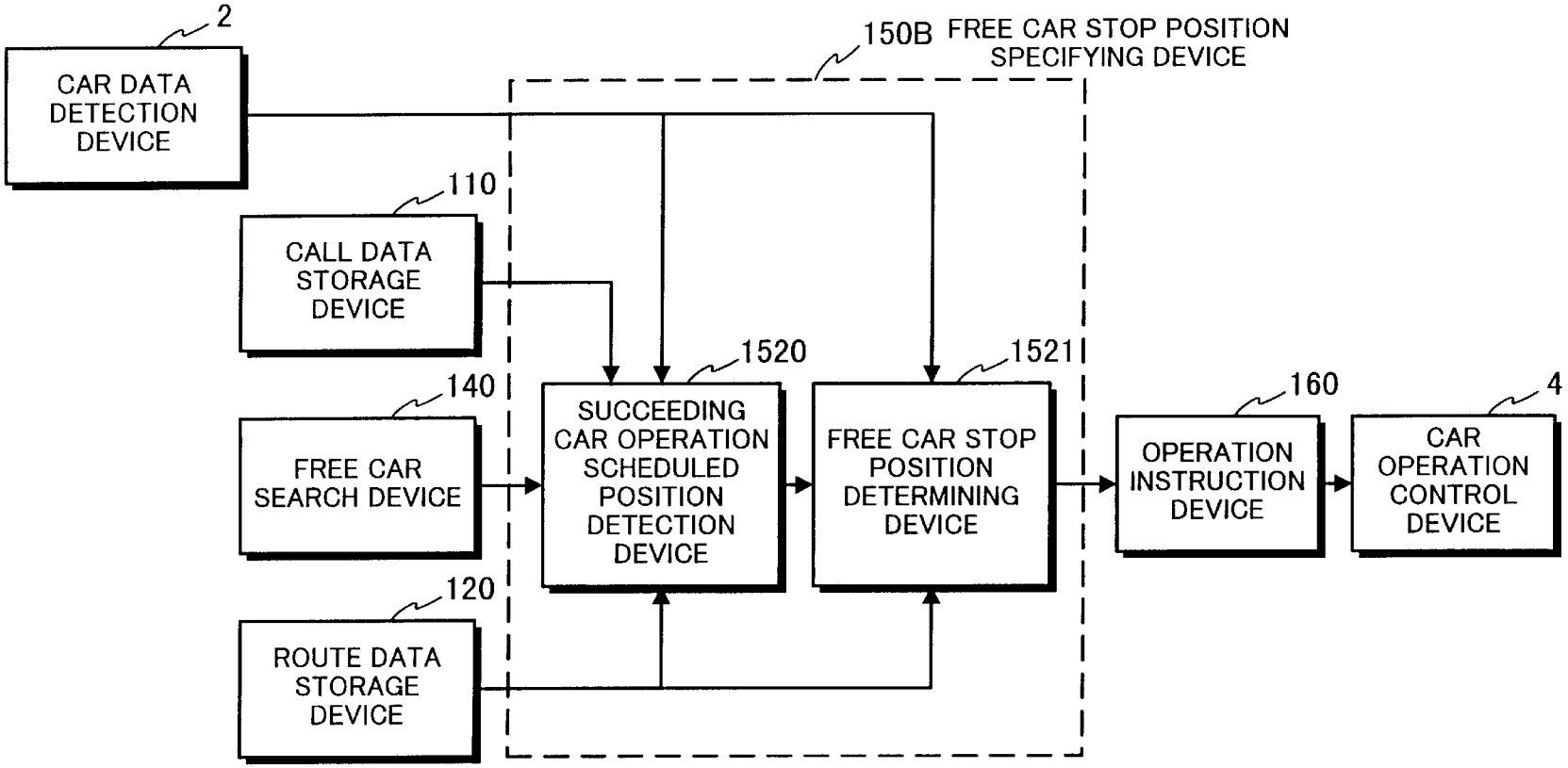
FIG. 23 is a block diagram of the free car stop position specifying device employed in the twentieth embodiment of the elevator group management control apparatus according to the present invention.

The following is a detailed explanation of the specific structure of a free car stop position specifying device 150B employed in the elevator group management control apparatus 3 in this embodiment, in reference to FIG. 23.

Namely, the free car stop position specifying device 150B comprises a succeeding car operation scheduled position detection device 1520 that, when there are cars on call (succeeding cars) present operating behind a given free car, detects the position of a station call assigned to the succeeding car closest to the floor where the free car is present or the location of the car call for that succeeding car, based upon the route data stored in the route data storage device 120 and each set of car data sent from the car data detection device 2, the call data storage device 110 and the free car search device 140, and a free car stop position determining device 1521 that, when the succeeding car is to be operated to the position detected by the succeeding car operation scheduled position detection device 1520 and the presence of the free car presents a hindrance to the operation of the succeeding car, determines a stop position for the free car in order to move it to a position where it does not present any hindrance to the operation of the succeeding car.

Note that "succeeding cars" as referred to in this context refers to cars located behind a given car on the route of the car, which are scheduled to be operated within the same shaft.

[20-2. Operation of the Twentieth Embodiment]

The twentieth embodiment structured as described above provides the following functions. The following is an explanation of the free car stop position specifying processing which differentiates this embodiment from the nineteenth embodiment.

[20-2-1. Free Car Stop position Specifying Processing]

The free car stop position specifying device 150B shown in FIG. 23 determines a new stop position which satisfies specific requirements for each of the free cars detected by the free car search device 140.

(A) Requirements for Determining Stop Positions for Free Cars

The free car stop position specifying device 150B in this embodiment employs the succeeding car operation scheduled position detection device 1520 to detect succeeding car operating behind each of the free cars detected by the free car detection device 140 and determines the next stop position for the succeeding cars. It sets the position of a traverse floor which does not present any hindrance to the operation of the succeeding car to the next stop position as the next stop position for the free car. Note that it is assumed that if a free car does not present any hindrance to the operation of a succeeding car to its next stop position, the free car is left stationary at its current position.

The requirements described above for determining the next stop position for each free car are imposed upon the free car stop position specifying device 150B in this embodiment for the following reasons.

Namely, when there is a succeeding car on call behind a free car and the free car presents a hindrance to the operation of the succeeding car, if the free car is positioned at a traverse floor, it is possible for it to make traverse movement to another shaft immediately.

Now, the method for determining the stop position for a free car employed by the free car stop position specifying device 150B in this embodiment is explained in reference to a specific example.

For instance, let us assume that the free car search device 140 detects cars 3, 4 and 5 as free cars with the individual cars positioned at the locations shown in FIG. 22 (we assume that all cars are in a stationary state).

Next, the succeeding car operation scheduled position detection device 1520 determines a succeeding car for each free car based upon position & speed data for each car detected by the car data detection device 2 and the route data for each free car stored in the route data storage device 120.

When search is performed on the route data presented in Table 43 in reference to FIG. 22, it is ascertained that the succeeding car of car 3 is car 4, the succeeding car of car 4 is car 1 and the succeeding car of car 5 is car 2.

When the next stop positions of the succeeding cars 1 and 2 thus searched are determined based upon the call data shown in Table 42, the next stop position for car 1 is detected as 16@4 and the next stop position for car 2 is detected as 9@3, as shown in Table 46.

It is to be noted that since, as explained earlier, while the succeeding car of car 3 is car 4, car 4 is a free car and does not, therefore, have to be considered. In addition, the 16@4 above indicates a location which is the 16th floor in the fourth shaft.

TABLE 46

| Free car | (Succeeding car | Floor where succeeding car is to stop | Shaft) |
|---|---|---|---|
| 3 | null | | |
| 4 | 1 | 16 | 4 |
| 5 | 2 | 9 | 3 |

In addition, the free car stop position determining device 1521 determines the next stop position for free cars detected by the free car search device 140 (normally, free cars remain at their current positions).

In this embodiment, since cars 3, 4 and 5 are detected as free cars, the next stop position of the corresponding succeeding car is searched sequentially by the succeeding car operation scheduled position detection device 1520 starting with car 3. Then, by referring to the route data stored in the route data storage device 120 and the free car current position detected by the car data detection device 2, if the free car is to present a hindrance to the operation of the succeeding car to its next stop position, it determines the position of a traverse floor that does not present any hindrance as the next stop position of the free car.

In other words, while the succeeding car of car 3 is car 4, since car 4 is a free car, the next stop position set for car 3 is the position 5@1.

Note that, as will be explained later, while the next stop position for car 4 is set immediately after this, carryover of the setting of the free cars is not executed because its effect on car 3 will be reflected in the subsequent free car stop position calculation through changes in the car data.

Next, since the next stop position of car 1 which is the succeeding car of car 4, is 16@4, car 4, which is currently at 17@4 presents a hindrance to the operation of car 1 to its next stop position. Consequently, the next stop position of car 4 is set at 10@4, a traverse floor along the route of car 4. (Note that, as shown in FIG. 22, the first, tenth and twentieth floors are traverse floors.)

Lastly, the next stop position of car 2, which is the succeeding car of car 5, is at 9@3 and as a result, car 5 at 10@2 does not pose any hindrance to the operation of car 2 to its next stop position. Consequently, the next stop position set for car 5 is its current position, 10@2.

As a result, the positioning of individual free cars is as shown in Table 47.

TABLE 47

| Free car | (Floor location | Shaft) |
|---|---|---|
| 3 | 5 | 1 |
| 4 | 10 | 4 |
| 5 | 10 | 2 |

[20-3. Effects of the Twentieth Embodiment]

The elevator group management control apparatus in the twentieth embodiment structured as described above and the elevator group management control method that is executed in this elevator group management control apparatus achieve the following advantage.

Namely, when a free car presents a hindrance to the operation of a car on call operating behind it in elevator group management control, by positioning the free car at a traverse floor, it can be made to move horizontally into another shaft immediately, achieving an improvement in operation efficiency and safety.

[21. Twenty-first Embodiment]

This embodiment corresponds to the elevator group management control apparatus disclosed in claims 9 and 12 and the elevator group management control method (disclosed in claims 24 and 27) which is executed in this elevator group management control apparatus.

[21-1. Configuration of the Twenty-first Embodiment]

This embodiment is a variation of the nineteenth embodiment, with modifications in the specific structure of the free car stop position specifying device.

[21-1-1. Configuration of the Elevator Group Management Control Apparatus]

The elevator group management control apparatus 3 in this embodiment is structured identically to that in the nineteenth embodiment described earlier except for the modifications in the structure of the free car stop position specifying device (see FIG. 19).

[21-1-2. Configuration of the Free Car Stop Position Specifying Device]

Figure 24:
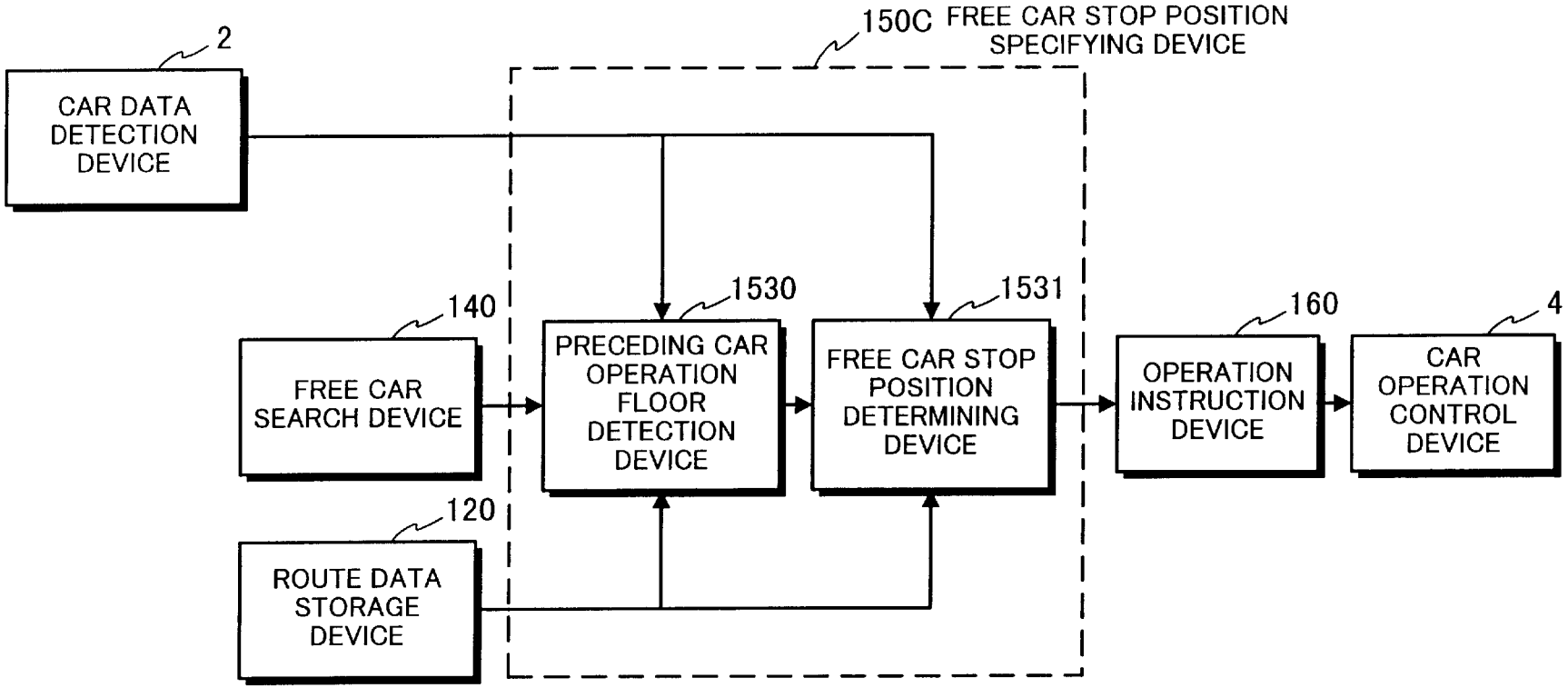
FIG. 24 is a block diagram of the free car stop position specifying device employed in the twenty-first embodiment of the elevator group management control apparatus according to the present invention.

The following is a detailed explanation of the specific structure of a free car stop position specifying device 150C employed in the elevator group management control apparatus 3 in this embodiment, in reference to FIG. 24.

Namely, the free car stop position specifying device 150C comprises a preceding car operating floor detection device 1530 that, when there are cars on call (preceding cars) operating ahead of a given free car, detects the operating floor of the preceding car that is closest to the free car among those preceding cars, based upon the route data stored in the route data storage device 120 and each set of car data sent from the car data detection device 2, the call data storage device 110 and the free car search device 140, and a free car stop position determining device 1531 that, when the floor where the free car is being operated is separated from the position of the preceding car detected by the preceding car operating floor detection device 1530 by a specific distance or more, determines the stop position for the free car in order to make it move to within a specific distance from the preceding car.

It is to be noted that "preceding cars" refer to other cars on the route of a given car, which are positioned ahead of the car.

[21-2. Operation of the Twenty-first Embodiment]

The twenty-first embodiment which is structure as described above provides the following functions. The following is an explanation of the free car stop position direction processing which differentiates this embodiment from the nineteenth embodiment.

[21-2-1. Free Car Stop position Specifying Processing]

The free car stop position specifying device 150C shown in FIG. 24 determines a new stop position which satisfies specific requirements for each of the free cars detected by the free car search device 140.

(A) Requirements for Determining Stop Positions for Free Cars

The free car stop position specifying device 150C in this embodiment employs the preceding car operating floor detection device 1530 to detect a preceding car of a free car detected by the free car search device 140 to ascertain the operating floor of this preceding car. When the distance between the operating floor of the preceding car and the floor position of the free car is at or more than a specific distance, a floor that is within the specific distance from the preceding car is set as the next stop position for the free car.

It is to be noted that if the distance between the operating floor of the preceding car and the floor where the free car is positioned is within the specific distance, the free car remains stationary at its current position.

In addition, the specific distance mentioned above is set as appropriate corresponding to the number of floors and the number of traverse floors in the building where elevators employing the present invention are installed.

In addition, the requirements for determining the next stop position for each free car described above imposed upon the free car stop position specifying device 150C in this embodiment for the following reason.

Namely, if a free car and its preceding car are separated from each other by a specific distance or more, the response to a station call that is expected to be generated between the two cars will be poor.

Now, the method for determining the stop position for a free car employed by the free car stop position specifying device 150C in this embodiment is explained in reference to a specific example.

For instance, let us assume that the free car search device 140 detects cars 3, 4 and 5 as free cars with the individual cars positioned at the locations shown in FIG. 22 (it is assumed in this instance that all cars are in a stationary state).

Next, the preceding car operating floor detection device 1530 determines the preceding car of each free car based upon position & speed data for each car detected by the car data detection device 2 and the route data for each car stored in the route data storage device 120. In this example, when the route data presented in Table 43 are searched in reference to FIG. 22, it is ascertained that the preceding car of car 3 is car 1, the preceding car of car 2 is car 3, and the preceding car of car 5 is car 1.

The current positions (operating floors) of the preceding cars 1 and 3 which have been searched in this manner are detected as 20@4 for car 1 and 5@1 for car 3 in reference to FIG. 22. Note that the preceding car operating floor data thus obtained are as shown in Table 48.

TABLE 48

| Preceding car | (Operating Floor | Shaft) |
|---|---|---|
| 1 | 20 | 4 |
| 3 | 5 | 1 |

In addition, the free car stop position determining device 1531 determines the next stop positions of free cars detected by the free car search device 140 (normally a free car remains in a stationary state at its current position).

Since, in this example, cars 3, 4 and 5 are detected as free cars, search is performed sequentially in regard to the operating floors of their preceding cars by the preceding car operating floor detection device 1530 starting with car 3. Then, by referring to the route data stored in the route data storage device 120 and the free car current position detected by the car data detection device 2, if the floor where the free car in question is separated from the operating floor of its preceding car by a specific distance or more, a floor which is located within the specific distance from the preceding car is determined as the next stop position for the free car.

In other words, the distance between car 3 and its preceding car, i.e., car 1 is a total of 16 floors including the 15 floors to the twentieth floor and the 1 floor that represents the traverse movement. Note that in this example, the horizontal movement at a traverse floor is calculated as movement over one floor. Also, the distance between car 4 and its preceding car, i.e., car 3 is a total of 21 floors, which includes the 16 floors to the first floor, the 1 floor that represents the traverse movement and the 4 floors to the fifth floor. Moreover, the distance between car 5 and its preceding car, i.e., car 1 is a total of 11 floors including the 10 floors to the twentieth floor and the 1 floor representing the traverse movement.

The distance between car 3 and car 4 is 21 floors and this represents a greater distance compared to the distances between the other cars. If the distance between cars 3 and 4 is to be reduced to 14 floors by moving car 4, the position of car 4 must be moved to 10@4. As for cars 3 and 5, they are to be left stationary at their current positions.

As, a result, the positioning of the individual free cars is as shown in Table 49.

TABLE 49

| Free car | (Floor location | Shaft) |
|---|---|---|
| 3 | 5 | 1 |
| 4 | 10 | 4 |
| 5 | 10 | 2 |

[21-3. The Twenty-first Embodiment]

The elevator group management control apparatus in the twenty-first embodiment structured as described above and the elevator management control method that is executed in this elevator group management control apparatus achieve the following advantage.

Namely, when performing elevator group management control, if the distance between the floor where a free car is positioned and the operating floor of its preceding car is at or more than a specific distance, the free car is moved to a floor that is within the specific distance from the preceding car to achieve quick response to a station call that will be generated in the near future between the preceding car and the free car.

[22. Twenty-second Embodiment]

This embodiment corresponds to the elevator group management control apparatus disclosed in claims 9 and 13 and the elevator group management control method (disclosed in claims 24 and 28) which is executed in this elevator group management control apparatus.

[22-1. Configuration of the Twenty-second Embodiment]

This embodiment is a variation of the nineteenth embodiment described earlier, with modifications in the specific structure of its free car stop position specifying device.

[22-1-1. Configuration of the Elevator Group Management Control Apparatus]

The elevator group management control apparatus 3 in this embodiment is structured identically to that in the nineteenth embodiment except for modifications in the structure of the free car stop position specifying device. (See FIG. 19)

[22-1-2. Configuration of the Free Car Stop Position Specifying Device]

Figure 25:
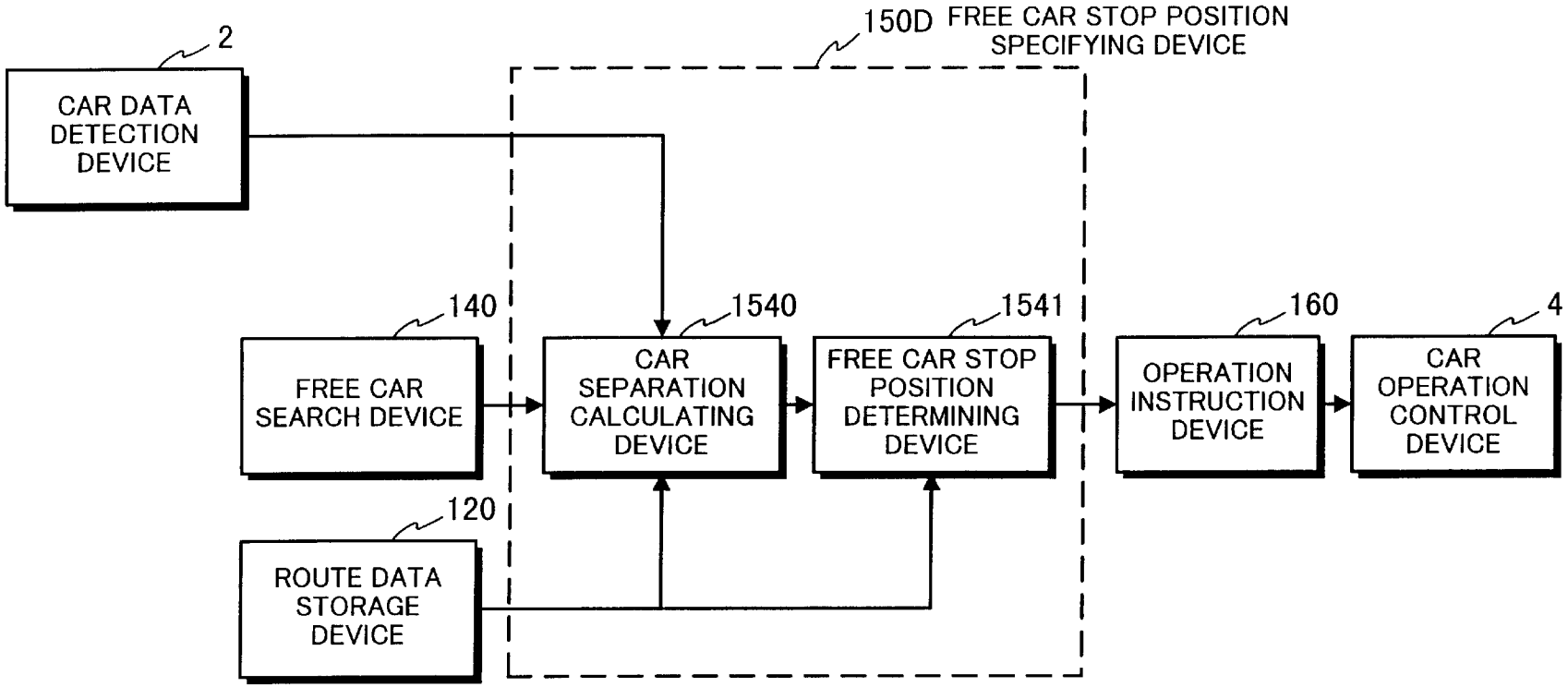
FIG. 25 is a block diagram of the free car stop position specifying device employed in the twenty-second embodiment of the elevator group management control apparatus according to the present invention.

The following is a detailed explanation of the specific structure of the free car stop position specifying device 150D which is employed in the elevator management control apparatus 3 in this embodiment, in reference to FIG. 25.

Namely, the free car stop position specifying device 150D comprises a car separation calculating device 1540 that, based upon the route data stored in the routes data storage device 120 and each set of car data sent from the car data detection device 2, the call data storage device 110 and the free car search device 140, calculates the distances between cars other than free cars (cars on call), and a free car stop position determining device 1541 that determines stop positions for free cars in order to make the distances between cars consistent based upon car separation data obtained by the car separation calculating device 1540.

[22-2. Operation of the Twenty-second Embodiment]

The twenty-second embodiment structured as described above provides the following functions. The following is an explanation of the free car stop position specifying processing which differentiates this embodiment from the nineteenth embodiment.

[22-2-1. Free Car Stop Position Specifying Processing]

The free car stop position specifying device 150D shown in FIG. 25 determines a new stop position which satisfies specific requirements for each of the free cars detected by the free car search device 140.

(A) Requirements for Determining Stop Positions for Free Cars

The free car stop position specifying device 150D in this embodiment employs the car separation calculating device 1540 to calculate the distances between cars (cars on call) other than the cars detected by the free car search device 140 by referring to the current positions of the individual cars detected by the car data detection device 2 and the route data for each car stored in the route data storage device 120. By placing free cars between those cars on call, it ensures that the distances between all the cars can be made consistent.

The requirements for determining the next stop position for each free car described above are imposed upon the free car stop position specifying device 150D in this embodiment for the following reason.

Namely, by calculating the distances between cars on call, placing a free car between cars if the distance between the two cars is large compared to the distances between other cars and making the distances between all the cars consistent regardless of the presence/absence of a call, a quick response can be made to a station call that will be generated subsequently.

Now, the method for determining the stop position for a free car that is employed by the free car stop position specifying device 150D in this embodiment is explained in reference to a specific example.

For instance, let us assume that the free car search device 140 detects cars 3, 4 and 5 as free cars, with the individual cars positioned at the locations shown in FIG. 22 (it is assumed, in this instance, that all cars are in a stationary state).

Next, the car separation calculating device 1540 calculates the car distances between cars other than the free cars (cars on call) based upon the position & speed data for each car detected by the car data detection device 2 and the route data for each car stored in the route data storage device 120.

At this point, as shown in FIG. 22, cars on call are cars 1 and 2, and through the search of the route data shown in Table 43, it is ascertained that car 1 is separated from car 2 by four floors in its advancing direction. In other words, between cars 1 and 2, there are four floors where a free car may be placed.

In addition, car 2 is separated from car 1 in its advancing direction by a total of 35 floors, which includes the 14 floors to the first floor, the 1 floor which represents the shaft movement (traverse movement) at the first floor, the 19 floors from the first floor to the twentieth floor and the 1 floor which represents the shaft movement (traverse movement) at the twentieth floor. It is to be noted that the car distance data thus obtained are as shown in Table 50.

TABLE 50

| Car | (Preceding car | Distance) |
|---|---|---|
| 1 | 2 | 4 |
| 2 | 1 | 35 |

Also, the free car stop position determining device 1541 determines the next stop positions for free cars detected by the free car search device 140, based upon the car distance data calculated by the car separation calculating device 1540 (normally, free cars remain in a stationary state at their current positions).

In this example, as explained earlier, the car distance from car 1 to car 2 is short, at 4 floors and the car distance from car 2 to car 1 is long, at 35 floors. Thus, in order to make consistent the distances between the cars, it is determined that free cars are to be positioned in the range from car 2 to car 1 which extends over 35 floors.

Note that this decision making is performed while satisfying the following formula.

[Formula 16]

$$\min_{i=1,\ldots,\text{NUMBER OF FREE CARS}} = \Sigma\left(\frac{\text{DISTANCE BETWEEN CARS}}{\text{NUMBER OF FREE CAR PLACEMENTS}}\right)^2$$

$$\min_{i=0,\ldots,3}\left(\left(\frac{4}{i+1}\right)^2+\left(\frac{35}{(3-i)+1}\right)^2\right)$$

Note that in the formula given above, i indicates the number of free cars that are to be placed between the cars on call.

In other words, in the formula given above, calculation is performed sequentially with i=0, 1, 2, 3 and the value of i which represents the minimum is determined. In this example, the minimum value is achieved at i=0 and, consequently, it is decided that no free car is to be placed over the range from car 1 to car 2 and that three free cars are to be placed at positions over the range from car 2 to car 1.

Consequently, over the range extending from car 2 to car 1, the distance between the cars is an average of 35/(3+1)= 8.75. As a result, free cars are placed over these intervals from car 2 and their positions are set at 6@ (descending shaft), 4@ (ascending shaft), and 13@ (ascending shaft).

The free cars are cars 3, 4 and 5 in this case, and they are each placed at the closest position determined above. Consequently, the placement positions for the free cars are as shown in Table 51.

Note that, in this case, while the desirable position for car 3 is 4@1, in order to place car 3 at this position, car 3 must move in a reverse shaft direction. Since it is a prerequisite in this embodiment that reverse shaft travel is not performed, car 3 is to remain in a stationary state at its current position in such a case.

TABLE 51

| Free car | (Floor location | Shaft) |
|---|---|---|
| 3 | 5 | 1 |
| 4 | 6 | 4 |
| 5 | 13 | 2 |

[22-3. Effects of the Twenty-second Embodiment]

The elevator group management control apparatus in the twenty-second embodiment structured as described above and the elevator group management control method that is executed in this elevator group management control apparatus achieve the following advantage.

Namely, when performing elevator group management control, by placing free cars between cars on call and making the distances between individual cars as consistent as possible, a quick response can be made to new station calls which will arise in the future.

[23. Twenty-third Embodiment]

This embodiment corresponds to the elevator group management control apparatus disclosed in claims 9 and 14 and the elevator group management control method (disclosed in claims 24 and 29) which is executed in this elevator group management control apparatus.

[23-1. Configuration of the Twenty-third Embodiment]

This embodiment is a variation of the nineteenth embodiment with modifications in specific structure of its free car stop position specifying device.

[23-1-1. Configuration of the Elevator Group Management Control Apparatus]

An elevator group management control device 3 in this embodiment is structured identically to that in the nineteenth embodiment except for the modifications in the structure of the free car stop position specifying device (See FIG. 19).

[23-1-2. Configuration of the Free Car Stop position Specifying Device]

Figure 26:
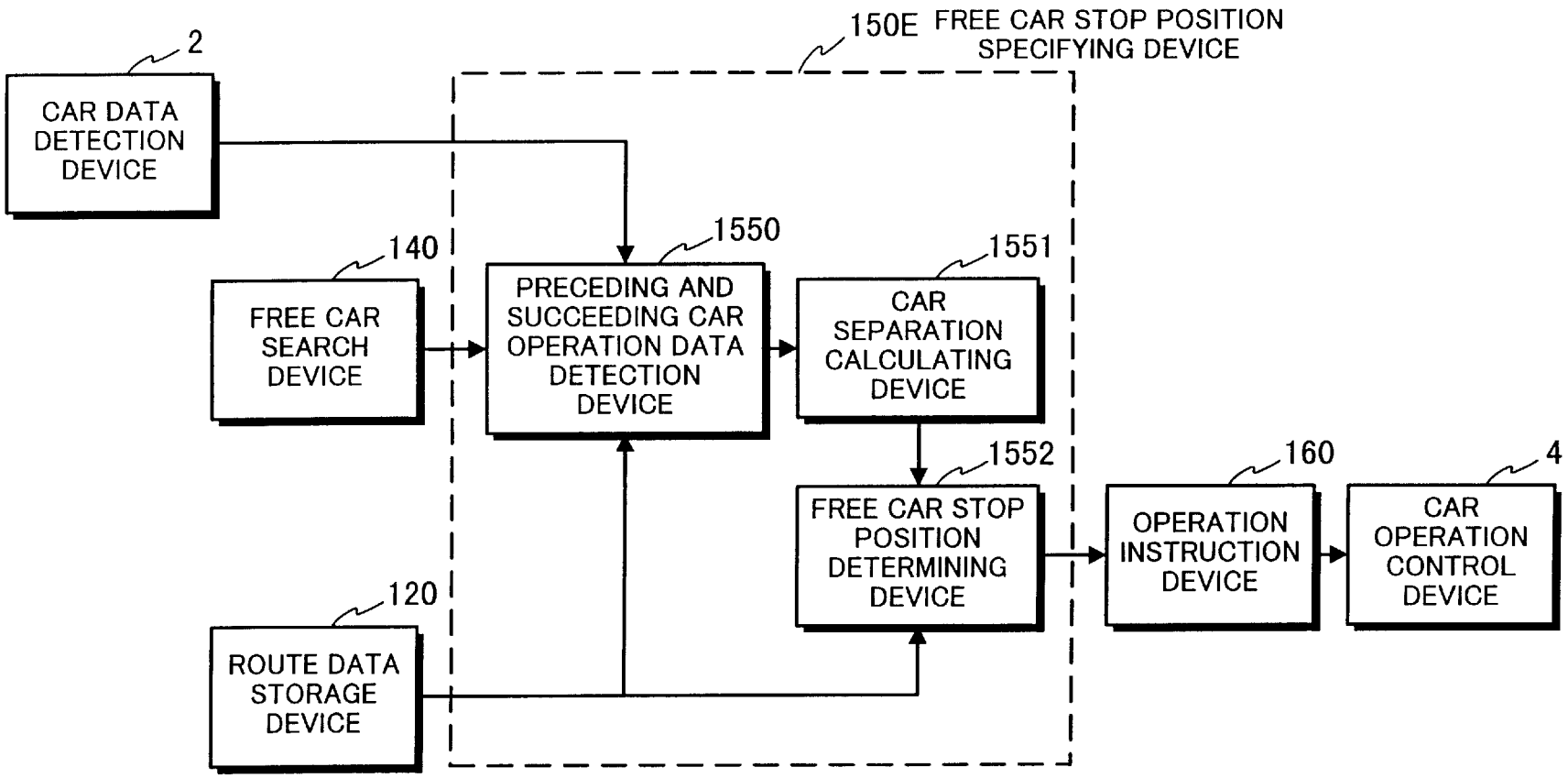
FIG. 26 is a block diagram of the free car stop position specifying device employed in the twenty-third embodiment of the elevator group management control apparatus according to the present invention.

The following is a detailed explanation of a specific structure of a free car stop position specifying device 150E employed in the elevator group management control apparatus 3 in this embodiment in reference to FIG. 26.

Namely, the free car stop position specifying device 150E comprises a preceding and succeeding car operation data detection device 1550, which, based upon the route data stored in the route data storage device 120 and each set of car data sent from the car data detection device 2, the call data storage device 110 and the free car search device 140, detects the preceding car operating ahead of each free car, including its floor and operating direction and detects the succeeding car operating behind each free car including its floors and operating direction from among the cars other than the free cars (cars on call);

- a car separation calculating device 1551 that calculates the distance between the preceding car and the succeeding car; and
- a free car stop position determining device 1552 that determines stop positions for free cars using preceding and succeeding car operation data obtained by the preceding and succeeding car operation data detection device 1550.

[23-2. Operation of the Twenty-third Embodiment]

The twenty-third embodiment, which is structured as described above, provides the following functions. The following is an explanation of the free car stop position specifying processing, which differentiates this embodiment from the nineteenth embodiment.

[23-2-1. Free Car Stop Position Specifying Processing]

The free car stop position specifying device 150E shown in FIG. 26 determines a new stop position which satisfies specific requirement for each of the free cars detected by the free car search device 140.

(A) Requirements for Determining Stop Positions for Free Cars

The free car stop position specifying device 150E in this embodiment employs the preceding and succeeding car operation data detection device 1550 to detect preceding and succeeding cars of free cars detected by the free car search device 140 by referring to the current position of each car detected by the car data detection device 2 and the route data for each car stored in t he route data storage device 120.

In addition, the distance between the preceding car and the succeeding car of a free car is calculated by the car separation calculating device 1551. Then, the free car is placed at appropriate position between the preceding car and the succeeding car. In this example, the position at the middle, i.e., half way between the preceding car and the succeeding car is set as the next stop position for the free car.

The requirements for determining the next stop position for each free car described above are imposed upon the free car stop position specifying device 150E in this embodiment for the following reason.

Namely, by detecting the preceding car and the succeeding car of a free car, calculating the distance between the two cars and placing the free car at a position half way between them, the distances between individual cars can be made consistent, and thus a quick response becomes possible to station calls that will arise subsequently.

Now, the method for determining the stop position for a free car employed by the free car stop position specifying device 150E in this embodiment is explained in reference to a specific example.

For instance, let us assume that the free car search device 140 detects cars 3, 4 and 5 as free cars with the individual cars positioned at the locations shown in FIG. 22 (it is assumed, in this instance, that all cars are in a stationary state).

Next, the preceding and succeeding car operation data detection device 1550 detects the preceding car and the succeeding car for each of the free cars detected by the free car search device 140 by referring to the current position of each car detected by the car data detection device 2 and the route data for each car stored in the route data storage device 120.

In other words, in reference to FIG. 22, when search is performed through the route data shown in Table 43, it is determined that the preceding car and the succeeding car of car 3, are cars 1 and 4 respectively, the preceding car and the succeeding car of car 4 are cars 3 and 1 respectively and the preceding car and the succeeding car of car 5 are cars 1 and 4 respectively. It is to be noted that in this example, car 4 is determined to be the succeeding car of car 5 since, although the route of car 4 is different from the route of car 5 at or below the tenth floor of the fourth shaft, car 4 and car 5 are on the same route from the twentieth floor to the tenth floor in the fourth shaft.

Then, the current positions (operating floors) of cars 1, 3 and 4 which are the preceding and succeeding cars of the free cars that have been searched in the manner described above are detected at 20@4 for car 1, 5@1 for car 3 and 17@4 for car 4. Note that the preceding and succeeding car operating floor data thus obtain are as shown in Table 52.

TABLE 52

| Preceding and Succeeding car | (Operating Floor | Shaft) |
|---|---|---|
| 1 | 20 | 4 |
| 3 | 5 | 1 |
| 4 | 17 | 4 |

In addition, the car separation calculating device 1551 calculates the distance between the preceding car and the succeeding car for each free car. In other words, the car distance between the preceding car 1 and the succeeding car 4 of the free car 3 is calculated to be a total of 41 floors counting from car 4, including the 16 floors to the first floor, the 3 floors representing the traverse movement from the fourth shaft to the first shaft, the 19 floors to the twentieth floor and the 3 floors representing the traverse movement to the first shaft from the fourth shaft at the twentieth floor.

Likewise, the distance between the preceding car 3 and the succeeding car 1 of the free car 4 is calculated to be a total of 26 floors counting from car 1 including the 19 floors to the first floor, the 3 floors representing the traverse movement from the fourth shaft to the first shaft and the 4 floors to the fifth floor.

Furthermore, the distance the preceding car 1 and the succeeding car 4 of the free car 5 is calculated to be a total of 39 floors counting from car 4 including the 16 floors to the first floor, the 2 floors representing the traverse movement from the fourth shaft to the second shaft, the 19 floors to the twentieth floor and the two floors representing the traverse movement from the second shaft to the fourth shaft at the twentieth floor. Note that the car distance data thus obtained are as shown in Table 53.

TABLE 53

| Free car | (Preceding car | Succeeding car | Car distance) |
|---|---|---|---|
| 3 | 1 | 4 | 41 |
| 4 | 3 | 1 | 26 |
| 5 | 1 | 4 | 39 |

In addition, the free car stop position determining device 1552 determines the next stop positions for free cars detected by the free car search device 140 based upon the car distance data calculated by the car separation calculating device 1551 (normally, free cars remain in a stationary state at their current position). It is to be noted that, in this instance, the position half way between the preceding car and the succeeding car is set as the next stop position for each free car.

For instance, for the free car 3, its next stop position is determined in the following manner. Namely, since the distance between the preceding car 1 and the succeeding car 4 of the free car 3 is 41 floors, the position half way through this distance will be a position which is ahead of the preceding car 1 by (41/2=20.5) floors. When determining the position half way between the preceding car and the succeeding car, the decimal point is to be rounded off.

Consequently, when the next stop position for the free car 3 is defined as the Xth floor in the first shaft, X is determined to be 3 through (20−X)+(3 floors representing the traverse movement from the first shaft to the fourth shaft)=20. In other words, the next stop position for the free car 3 is set at 3@1.

Likewise, since the car distance between the preceding car 3 and the succeeding car 1 of the free car 4 is 26 floors, the position half way through this distance is calculated to be a position which is ahead by (26/2=13) floors from the preceding car 3. Consequently, when the next stop position for the free car 4 is defined as the Yth floor in the fourth shaft, the distance from the preceding car 3 is calculated to be Y=7, because the distance from the preceding car 3 is at 4 (from the fifth floor to the first floor in the first shaft)+3 representing the traverse movement+(Y−1)=13. In other words, the next stop position for the free car 4 is determined to be at 7@4.

Also, when the next stop position for the free car 5 is defined as the Zth floor in the second shaft, Z is calculated to be 3 through (20−Z) +(2 floors representing the traverse movement from the second shaft to the fourth shaft)=19. Thus, the next stop position for the free car 5 is determined to be at 3@2.

Note that, in this case, while the desirable placement position for car 3 is at 3@1 and the desirable placement position for car 5 is at 3@2, as explained earlier, in order to place cars 3 and 5 at their respective desirable positions, reverse movement would have to be made along the shaft. Since it is a prerequisite that no reverse shaft movement may be performed in this embodiment, both cars 3 and 5 are left in a stationary state at their current positions in this case. Consequently, the placement locations of free cars are as shown in Table 54.

TABLE 54

| Free car | (Floor location | Shaft) |
|---|---|---|
| 3 | 5 | 1 |
| 4 | 7 | 4 |
| 5 | 10 | 2 |

[23-3. Effects of the Twenty-third Embodiment]

The elevator group management control apparatus in the twenty-third embodiment structured as described above and the elevator group management control method that is executed in this elevator group management control apparatus achieve the following advantage.

Namely, when performing elevator group management control, since the distances between individual cars can be made as consistent as possible by detecting the preceding car and the succeeding car for each free car, calculating the distance between those cars and placing the free car at a position half way between them, it becomes possible to make a quick response to new station calls that will arise in the future.

[24. Twenty-fourth Embodiment]

This embodiment corresponds to the elevator group management control apparatus disclosed in claims 9 and 15 and the elevator group management control method (disclosed in claims 24 and 30) which is executed in this elevator group management control apparatus.

[24-1. Configuration of the Twenty-fourth Embodiment]

This embodiment is a variation of the nineteenth embodiment described earlier, with modifications in the specific structure of its free car stop position specifying device.

[24-1-1. Configuration of the Elevator Group Management Control Apparatus]

The elevator group management control apparatus 3 in this embodiment is structured identically to that in the nineteenth embodiment except for modifications in the structure of the free car stop position specifying device (see FIG. 19).

[24-1-2. Configuration of the Free Car Stop Position Specifying Device]

Figure 27:
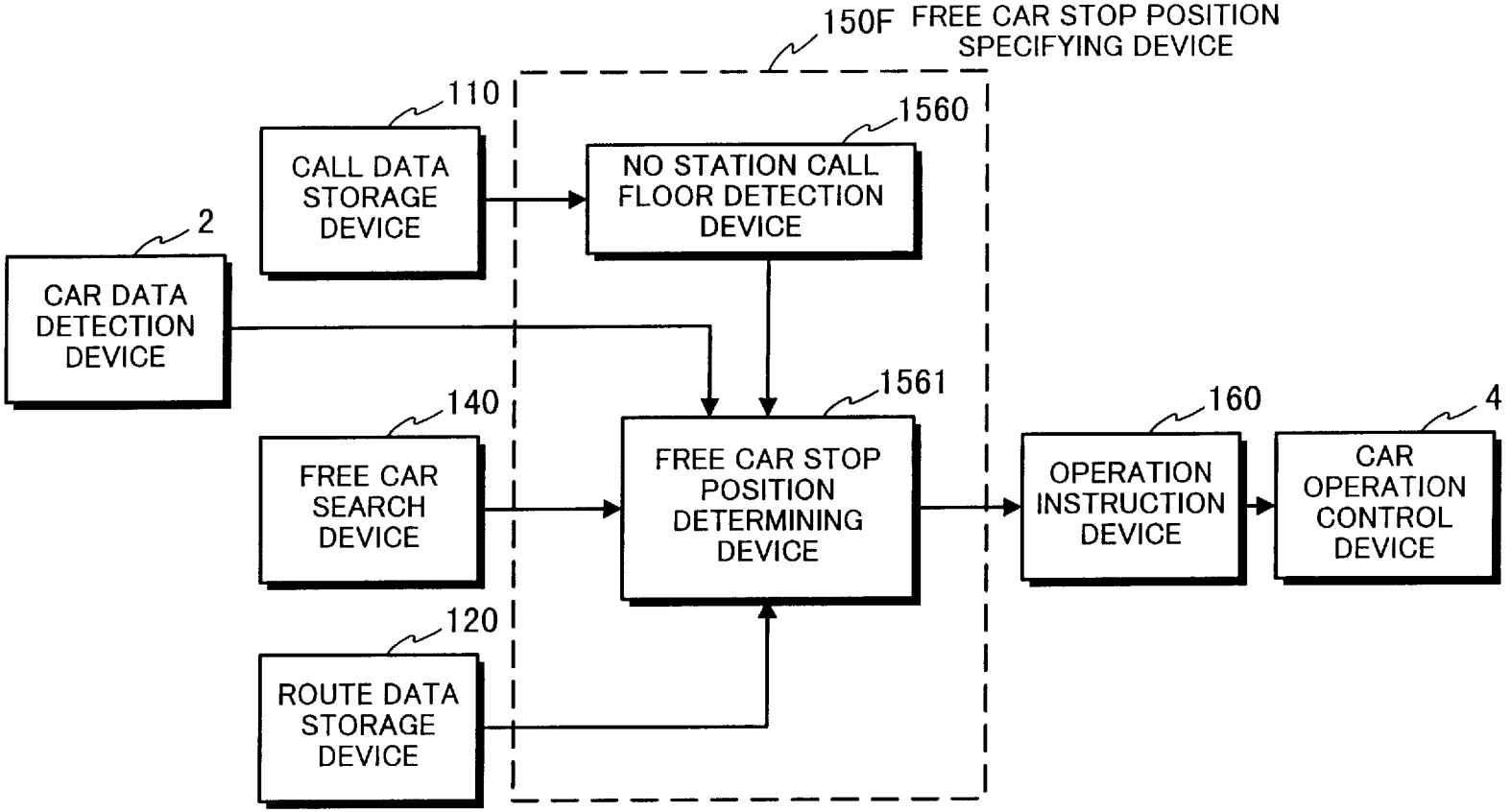
FIG. 27 is a block diagram of the free car stop position specifying device employed in the twenty-fourth embodiment of the elevator group management control apparatus according to the present invention.

The following is a detailed explanation of the specific structure of a free car stop position specifying device 150F employed in the elevator group management control apparatus 3 in this embodiment in reference to FIG. 27.

Namely, the free car stop position specifying device 150F comprises a no station call floor detection device 1560 that detects floors where no station calls have been generated based upon the "call data" sent from the call data storage device 110, and a free car stop position determining device 1561 that, based upon the "route data" stored in the route data storage device 120, the "car data" sent from the car data detection device 2 and the call data storage device 110 and the "free car data" sent from the free car search device 140, ascertains positions where the average length of time that the free cars require to reach their no station call floors detected by the no station call floor detection device 1560 are equal to one another for the number of free cars and determines those positions as stop positions for the free cars.

Namely, by determining the length of time required to reach a floor with no station calls that is present between a pair of free cars and by placing a free car at a position where the average value is at the minimum, it is possible to make the free cars respond with a minimum delay to station calls that will arise in the future.

Now, the method for determining the stop position for a free car employed by the free car stop position specifying device 150F in this embodiment is explained in reference to a specific example.

For instance, let us assume that the free car search device 140 detects cars 3, 4 and 5 as free cars with the individual cars positioned at the locations shown in FIG. 22 (it is assumed, in this instance, that all cars are in a stationary state).

Then, as shown in Table 42, since a station call has been generated at 3@UP and 16@DOWN, the no station call floor detection device 1560 outputs the data shown in Table 55.

TABLE 55

| direction | no station call floor | | | | | | | | | | | | | | | | | |
|---|---|---|---|---|---|---|---|---|---|---|---|---|---|---|---|---|---|---|
| UP | 1 | 2 | 4 | 5 | 6 | 7 | 8 | 9 | 10 | 11 | 12 | 13 | 14 | 15 | 16 | 17 | 18 | 19 |
| DOWN | 20 | 19 | 18 | 17 | 15 | 14 | 13 | 12 | 11 | 10 | 9 | 8 | 7 | 6 | 5 | 4 | 3 | 2 |

[24-2. Operation of the Twenty-fourth Embodiment]

The Twenty-fourth embodiment structured as described above provides the following functions. The following is an explanation of the free car stop position specifying processing which differentiates this embodiment from the nineteenth embodiment.

[24-2-1. Free Car Stop Position Specifying Processing]

The free car stop position specifying device 15OF shown in FIG. 27 determines a new stop position which satisfies specific requirements for each of the free cars detected by the free car search device 140.

(A) Requirements for Determining Stop Positions for Free Cars

The free car stop position specifying device 150F in this embodiment employs the no station call floor detection device 1560 to detect floors where no station calls have been generated based upon the "call data" sent from the call data storage device 110.

In addition, based upon the "route data" stored in the route data storage device 120, the "car data" sent from the car data detection device 2 and the call data storage device 110 and the "free car data" sent from the free car search device 140, the average length of time required by the free cars to reach the no station call floors. Then, the positioning of the free cars is performed by ensuring that this average length of time is minimized.

It is to be noted that in this embodiment, the average value of the length of time required by a given free car to reach each floor with no call when this free car is moved from its current position to the position of the free car immediately ahead of it is calculated and each free car is positioned at a location where this average value is at a minimum.

In addition, the requirements for determining the next stop position for each free car have been set as described above in the free car stop position specifying device 150F in this embodiment for the following reason.

In addition, the free car stop position determining device 1561 determines the next stop positions for free cars detected by the free car search device 140 (normally, free cars remain in a stationary state at their current positions). In other words, the positioning of the free cars is performed while ensuring that, the average time required by the free cars to reach the no station call floors detected by the no station call floor detection device 1560 can be held to a minimum.

In this example, as shown in Table 55, there are a total of 36 floor locations in the ascending and descending directions where no station calls have been generated. Consequently, the time required for free cars to reach each of these floors where no station calls have been generated is determined and the average value of these lengths of time is calculated.

It is assumed that the individual cars are at the positions shown in FIG. 22 (it is assumed, in this instance, that all the cars are in a stationary state). It is also assumed that the response from each free car to a no station call floor is made up to the floor where the preceding free car is present, since the preceding free car present in the forward direction can make response to those floors ahead of the floor.

In other words, when the individual cars are present at the positions shown in FIG. 22, car 3 services the 5 floors with calls for ascending from the fifth floor through the ninth floor, car 5 services the 10 floors with calls for ascending from the tenth floor through the nineteenth floor and the 3 floors with calls for descending from the twentieth floor through the eighteenth floor and car 4 services the 14 floors with calls for descending, i.e. at the seventeenth floor and from the fifteenth floor through the second floor and the 3 floors with calls for ascending, i.e., at the first floor, the second floor and the fourth floor.

When the length of time required for traveling through one floor is 8 seconds and the time required for traveling over two floors or more at once is calculated as $4+4\times N$ seconds (N: the number of floors over which movement is made), the length of time required by each free car to reach each of the no station call floors described above is calculated as below.

First, the total length of time T3 required by car 3 to reach the no station call floors from the fifth floor through the ninth floor is T3=(0+8+12+16+20)=56 seconds. The total length of time T5 required by car 5 to reach the no station call floors from the tenth floor through the nineteenth floor ascending and from the twentieth floor through the eighteenth floor descending is calculated T5=(0+8+12+16+20+24+28+32+36+40+60+68+72)=516 seconds.

Note that the calculation here is performed while assuming that a car making a traverse movement from one shaft to another takes the same length of time (8 seconds) required for moving through one floor. In other words, in the calculation of T5 above, the length of time required by car 5 to respond to a descending call at the twentieth floor is calculated as 4+4×(20−10)+8 (represents the traverse movement from the second shaft to the third shaft)+8 (represents the traverse movement from the third shaft to the fourth shaft) =60 seconds.

Likewise, the total time T4 required by car 4 to reach the no station call floors is calculated as T4=(0+12+16+20+24+28+32+36+40+44+48+52+56+60+64+84+92+100)=808 seconds. Consequently, the average length of wait time until arrival is calculated as (56+516+808)/36=30.3 seconds.

It is to be noted that this average value appears to have room for further improvement since the number of no station call floors that are serviced by cars 4 and 5 is rather large. In other words, for each of the free cars, the average length of time required for arrival to reach each of the no station call floors when its position is moved is calculated and the free car is placed at the position where the average value is at the minimum.

In addition, when the average value is at the minimum, there may be a plurality of placement patterns for free cars and in such a case, the movement of the free cars to respond to a call should be consistent for each car.

Note that in the example presented above, it is judged that when car 5 is moved to 19@2 and car 4 is moved to 9@4, the minimum average value can be achieved. In this case, car 3 services the 14 floors ascending from the fifth floor through the eighteenth floor, car 5 services a total of 11 floors including the nineteenth floor ascending and the 10 floors descending from the twentieth floor to the seventeenth floor and from the fifteenth floor through the tenth floor, and car 4 services a total of 11 floors including the 8 floors descending from the ninth floor through the second floor and the 3 floors ascending at the first, second and fourth floors.

In addition, the average value at this point can be calculated with to the following formula and the positions of the free cars are as shown in Table 56.

$$\frac{0+8+12+16+20+24+28+32+36+40+44+48+52+56}{36}+\frac{0+24+32+36+40+48+52+56+60+64+68}{36}+\frac{0+8+12+16+20+24+28+32+52+60+68}{36}=\frac{416+480+320}{36}=33.8 \quad \text{[Formula 17]}$$

TABLE 56

| Free car | (Floor location | Shaft) |
|---|---|---|
| 3 | 5 | 1 |
| 4 | 9 | 4 |
| 5 | 19 | 2 |

[24-3. The Twenty-fourth Embodiment]

The elevator group management control apparatus in the Twenty-fourth embodiment structured as described above and the elevator group management control method that is executed in this elevator group management control apparatus achieve the following advantage.

Namely, when performing elevator group management control, by detecting floors currently with no station calls, calculating the average length of time elapsing until free cars respond to a call made at each of those floors and placing free cars while ensuring that this average value is at the minimum, a quick response becomes possible to new station calls that will arise in the feature.

[25. Twenty-fifth Embodiment]

This embodiment corresponds to the elevator group management control apparatus disclosed in claims 9 and 16 and the elevator group management control method (disclosed in claims 24 and 31) which executed in this elevator group management control apparatus.

[25-1. Configuration of the Twenty-fifth Embodiment]

This embodiment is a variation of the nineteenth embodiment described earlier, with modifications in the specific structure of its free car stop position specifying device.

[25-1-1. Configuration of the Elevator Group Management Control Apparatus]

The elevator group management control apparatus 3 in this embodiment is structured identically to that in the nineteenth embodiment except for modifications in the structure of the free car stop position specifying device (See FIG. 19).

[25-1-2. Configuration of the Free Car Stop Position Specifying Apparatus]

Figure 28:
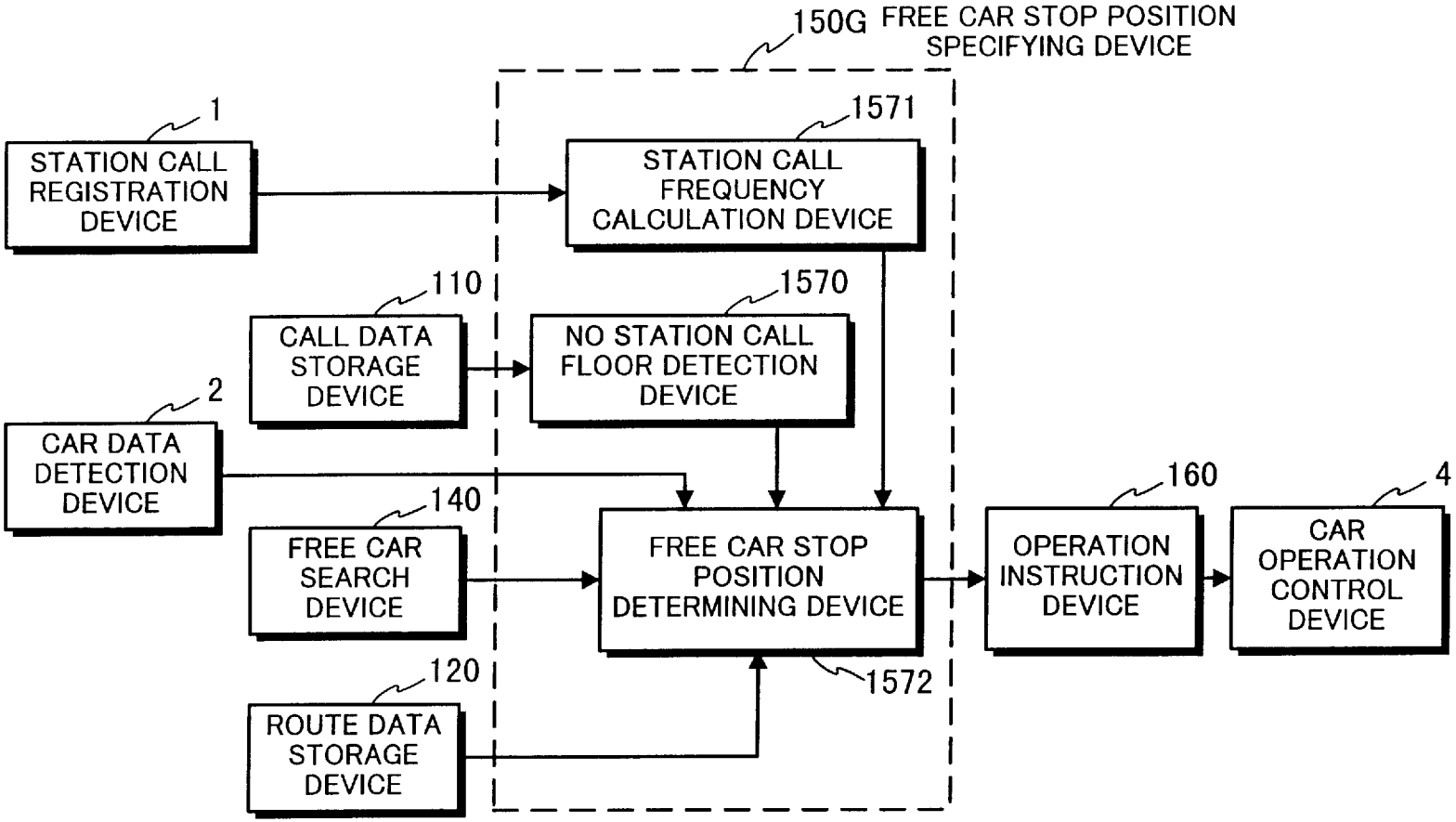
FIG. 28 is a block diagram of the free car stop position specifying device employed in the twenty-fifth embodiment of the elevator group management control apparatus according to the present invention.

The following is a detailed explanation of the specific structure of a free car stop position specifying device 150G employed in the elevator group management control apparatus 3 in this embodiment in reference to FIG. 28.

Namely, the free car stop position specifying device 150G comprises a no station call floor detection device 1570 that detects floors where no station calls have been generated based upon "call data" sent from the call data storage device 110;

a station call frequency calculating device 1571 that, every time a station call is newly registered in the station call registration device 1, stores in memory cumulative data relating to the number of times a station call has been generated for each floor and calculates a relative value for all the floors; and a free car stop position determining device 1572 that, by using "car data" sent from the car data detection device 2 and the call data storage device 110, the "free car data" sent from the free car search device 140 and the "station call frequency data" for each floor obtained from the station call frequency calculating device 1571, selects a floor with a high frequency of generating station calls to set it as the stop position for a free car.

[25-2. Operation of the Twenty-fifth Embodiment]

The twenty-fifth embodiment structured as described above provides the following function. The following is an explanation of the free car stop position specifying processing which differentiates this embodiment from the nineteenth embodiment.

[25-2-1. Free Car Stop Position Specifying Processing]

The free car stop position specifying device 150G shown in FIG. 28 determines a new stop position which satisfies specific requirements for each of the free cars detected by the free car search device 140.

(A) Requirements for Determining Stop Positions for Free Cars

The free car stop position specifying device 150G in this embodiment employs the no station call floor detection device 1570 to detect floors where no station calls have been generated based upon the "call data" sent from the call data storage device 110.

In addition, the station call frequency calculating device 1571 stores in memory cumulative data relating to the number of times a "station call" has been generated for each floor and calculates a relative value for all the floors every time a "station call" is newly registered in the station call registration device 1.

cars positioned at the locations shown in FIG. 22 (it is assumed, in this instance, that all the cars are in a stationary state).

Next, as shown in Table 42, since a station call has been generated at 3@UP and 16@DOWN, the no station call floor detection device 1560 outputs the data shown in Table 55.

Also, the station call frequency calculating device 1571 stores in memory the cumulative data relating to the number of times a station call has been generated at each floor and calculates relative values for all the floors every time a station call is newly registered in the station call registration device 1. In this example, it is assumed that the station call frequency data as shown in Table 57 are stored in memory.

TABLE 57

| direction | number of times a station call | | | | | | | | | | | | | | | | | | |
|---|---|---|---|---|---|---|---|---|---|---|---|---|---|---|---|---|---|---|---|
| UP | 1 | 2 | 3 | 4 | 5 | 6 | 7 | 8 | 9 | 10 | 11 | 12 | 13 | 14 | 15 | 16 | 17 | 18 | 19 |
| | 4 | 30 | 23 | 14 | 5 | 16 | 10 | 7 | 9 | 27 | 11 | 22 | 3 | 8 | 5 | 11 | 7 | 3 | 9 |
| DOWN | 20 | 19 | 18 | 17 | 16 | 15 | 14 | 13 | 12 | 11 | 10 | 9 | 8 | 7 | 6 | 5 | 4 | 3 | 2 |
| | 20 | 29 | 17 | 23 | 18 | 11 | 23 | 12 | 21 | 10 | 29 | 18 | 7 | 5 | 12 | 5 | 4 | 3 | 4 |

Then, based upon the "car data" sent from the car data detection device 2 and the call data storage device 110, the free car data sent from the free car search device 140 and the "station call frequency data" for each floor obtained from the station call frequency calculating device 1571, a floor with a high frequency of station call generation is selected and set as the next stop position for a free car.

The requirements for determining the next stop position for each free car described above are imposed upon the free car stop position specifying device 150G in the twenty-fifth embodiment for the following reason.

Namely, by storing in memory the cumulative data relating to the number of times a station call has been generated for each floor and calculating a relative value for all the floors every time a station call is newly registered in the station call registration device 1, it is possible to place a free car in advance at a floor which is expected to have a high frequency of station call generation in the future. As a result, free cars can be made to respond to station calls that will arise in the future with the least possible delay.

Now the method for determining the stop positions for a free car employed by the free car stop position specifying device 150G in this embodiment is explained in reference to a specific example.

For instance, let us assume that the free car search device 140 detects cars 3, 4 and 5 as free cars with the individual Then, the station call frequency calculation device 1571 outputs the relative values obtained by converting the number of times a station call has been generated at each of the floors where there are currently no station calls (Table 57) which has been searched by the no station call floor detection device 1570 and, in this example, the number of times a station call has been generated is itself output as the relative value. Not that the frequency of station call generation for each floor is as shown in Table 58.

TABLE 58

| direction | number of times a station call | | | | | | | | | | | | | | | | | | |
|---|---|---|---|---|---|---|---|---|---|---|---|---|---|---|---|---|---|---|---|
| UP | 1 | 2 | 3 | 4 | 5 | 6 | 7 | 8 | 9 | 10 | 11 | 12 | 13 | 14 | 15 | 16 | 17 | 18 | 19 |
| | 4 | 30 | 0 | 14 | 5 | 16 | 10 | 7 | 9 | 27 | 11 | 22 | 3 | 8 | 5 | 11 | 7 | 3 | 9 |
| DOWN | 20 | 19 | 18 | 17 | 16 | 15 | 14 | 13 | 12 | 11 | 10 | 9 | 8 | 7 | 6 | 5 | 4 | 3 | 2 |
| | 20 | 29 | 17 | 23 | 0 | 11 | 23 | 12 | 21 | 10 | 29 | 18 | 7 | 5 | 12 | 5 | 4 | 3 | 4 |

Also, the free car stop position determining device 1572 determines the next stop positions of free cars detected by the free car search device 140 (normally, free cars remain in a stationary state at their current positions). In other words, the frequency of station call generation is calculated for each of the no station call floors detected by the no station call floor detection device 1570, and the floors with a high frequency of station calls are selected to position free cars.

That is, by searching for stations with high frequencies of station calls using the station call frequency data for each floor shown in Table 58, it is detected that the frequency of call generation at the second floor ascending is the highest at 30 and that the frequency of call generation at the nineteenth floor and the tenth floor descending are both at 29.

Thus, these floors with high frequencies of station calls (the second floor in the ascending direction and the nineteenth floor and the tenth floor in the descending direction) are determined as stop positions for free cars, and these floors are assigned to the free cars 3, 4 and 5. Note that it is assumed that in this case, there is no reversal of direction along the shaft for any of these cars. As a result, the placement of the free cars are as shown in Table 59.

TABLE 59

| Free car | (Floor location | Shaft) |
|---|---|---|
| 3 | 19 | 4 |
| 4 | 2 | 1 |
| 5 | 10 | 3 |

[25-3. Effects of the Twenty-fifth Embodiment]

The elevator group management control apparatus in the twenty-fifth embodiment structured as described above and the elevator group management control method that is executed in this elevator group management control apparatus achieve the following advantage.

Namely, when performing elevator group management control, by detecting the floors that currently do not have any station calls, determining the frequency of station calls for each of these floors based upon the station call frequency data that have been accumulated and placing free cars at the floors with a high frequency of station calls, a quick response becomes possible to new station calls at the floors which are expected to have a high frequency of calls in the future.

[26. Twenty-sixth Embodiment]

This embodiment corresponds to the elevator group management control apparatus disclosed in claims 9 and 17 and the elevator group management control method (disclosed in claims 24 and 32) which is executed in this elevator group management control apparatus.

[26-1. Configuration of the Twenty-sixth Embodiment]

This embodiment is a variation of the nineteenth embodiment described earlier, with modifications in the specific structure of its free car stop position specifying device.

[26-1-1. Configuration of the Elevator Group Management Control Apparatus]

An elevator group management control apparatus 3 in this embodiment is structured identically to that in the nineteenth embodiment except for the modifications in the structure of the free car stop position specifying device (see FIG. 19).

[26-1-2. Configuration of the Free Car Stop Position Specifying Device]

Figure 29:
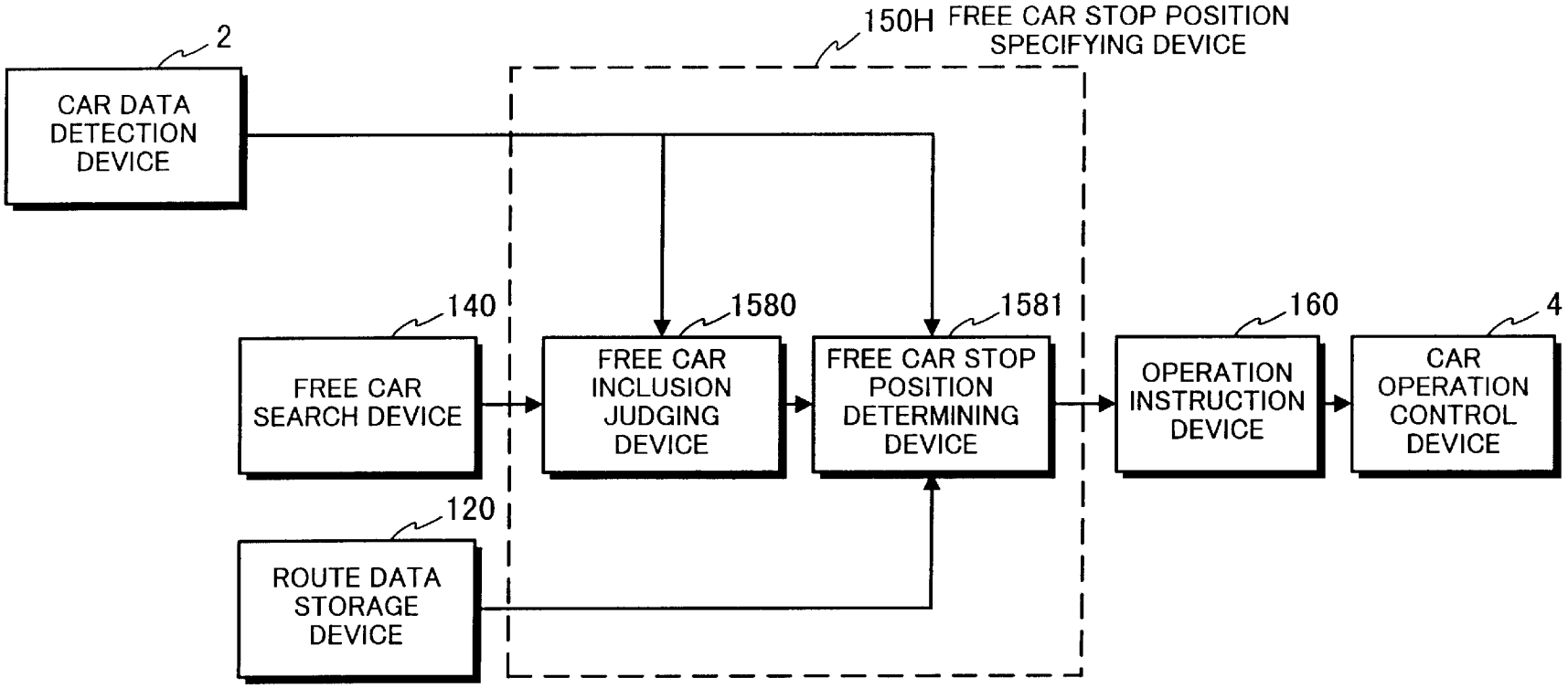
FIG. 29 is a block diagram of the free car stop position specifying device employed in the twenty-sixth embodiment of the elevator group management control apparatus according to the present invention.

The following is a detailed explanation of the specific structure of the free car stop position specifying device 150H employed in the elevator group management control apparatus 3 in this embodiment in reference to FIG. 29.

Namely, the free car stop position specifying device 150H comprises a free car inclusion judging device 1580 that makes a judgment as to whether or not a free car is present within a specific area that is predetermined satisfying specific requirements based upon the "car data" and the "free car data", and a free car stop position determining device 1581 that, using the "car data", the "free car data" and "free car inclusion status data" obtained from the free car inclusion judging device 1580, places a free car within the specific area.

[26-2. Operation of the Twenty-sixth Embodiment]

The twenty-sixth embodiment which is structured as described above provides the following functions. The following is an explanation of the free car stop position specifying processing which differentiates this embodiment from the nineteenth embodiment.

[26-2-1 Free Car Stop Position Specifying Processing]

The free car stop position specifying device 150H shown in FIG. 29 determines a new stop position that satisfies specific requirements for each of the free cars detected by the free car search device 140.

(A) Requirements for Determining Stop Positions for Free Cars

The free car stop position specifying device 150H in this embodiment employs the free car inclusion judging device 1580 to make a judgment as to whether or not there is a free car present within a specific, predetermined area satisfying specific requirements.

It is to be noted that an area that is expected to have a high frequency of station calls is set in advance in correspondence to a number of conditions for the specific area, i.e., the first floor during the morning rush hour and the floor where the restaurants are located during the lunch hour, for instance. In addition, if there are a plurality of specific areas set, a separate setting is made to select which of these specific areas will be given priority as the stop position of free cars by taking into consideration such Functions as the arrangement of the shaft directions, the operating time (morning influx, evening exodus) and the number of cars.

Then, by using the "car data" sent from the car data detection device 2, the "free car data" sent from the free car search device 140 and the "free car inclusion status data" obtained from the free car inclusion judging device 1580, free cars are placed within the specific area.

The requirements described above for determining the next stop position for each free car are imposed upon the free car stop position specifying device 150H in this embodiment for the following reasons.

Namely, by setting a specific area in correspondence to the number of conditions such as morning influx, evening exodus and the like, and marshaling free cars in this area in a standby state, it is possible to greatly improve the efficiency with which response to station calls is made within the specific area which is regarded to have a high frequency of station call generation.

Now, the method of determining the stop position of a free car employed by the free car stop position specifying device 150H in this embodiment is explained in reference to a specific example.

For instance, let us assume that the free car search device 140 detects cars 3, 4 and 5 as free cars with the individual cars positioned at the locations shown in FIG. 22 (it is assumed, in this instance, that all cars are in a stationary state). In addition, specific areas are set in advance at 1@1, 1@2, 20@3 and 20@4.

The free car inclusion judging device 1580 detects that the free cars 3,4 and 5 detected by the free car search device 140 are not stationary within those specific areas based upon the "car data" obtained from the car data detection device 2. Also, it is detected that no stationary car is present in those specific areas except for the area 20@4.

In addition, the free car stop position determining device 1581 determines the next stop position of free cars detected by the free car search device 140 (normally, free cars remain in a stationary state at their current positions). In other words, the specific areas that are judged to have no stationary cars by the free car inclusion judging device 1580 are set as the stop positions for the free cars.

It is to be noted that the decision as to which of these specific areas should be given priority to be set as stop positions for free cars is considered to vary depending upon Functions such as the arrangement of the shaft directions, the operating time of day (morning influx, evening exodus) and the number of cars. In this example, it is hypothetically assumed that the time period is the morning rush hour and that there are many passengers embarking at the first floor. Thus, priority is given in the order of: 1@2, 1@1, 20@3 and 20@4 for placing free cars. In addition, based upon the "car data" obtained from the car data detection device 2, it is detected that there is a car on call (car 1) stopping at 20@4.

Next, the method for placing free cars in conformance to the order of priority described above is explained. Namely, the specific areas 1@2 and 1@1, which are both high in the priority order, are both on the route of the free car 4. Thus, while car 4 may stop at either 1@2 or 1@1, it is placed at 1@2, which is higher in the priority order.

In addition, while car 5 should be placed at 1@1, the remaining specific area that is high in the priority order, since 1@1 is not on the route of car 5, car 5 is placed at 1@2. Then, car 3 is placed at 20@3, which is next in the priority order.

As a result, the placing of the free cars is as shown in Table 60.

TABLE 60

| Free car | (Floor location | Shaft) |
|---|---|---|
| 3 | 20 | 3 |
| 4 | 1 | 2 |
| 5 | 1 | 2 |

[26-3. The Twenty-sixth Embodiment]

The elevator group management control apparatus in the twenty-sixth embodiment structured as described above and the elevator group management control method that is executed in this elevator group management control apparatus achieve the following advantage.

Namely, when performing group elevator management control, by setting specific areas in correspondence to a number of conditions such as the time of day and the like, and marshaling free cars within these areas on standby, it is possible to greatly improve the efficiency with which response is made to station calls within the specific areas which are considered to have a high frequency of station call generation.

[27. Twenty-seventh Embodiment]

This embodiment corresponds to the elevator group management control apparatus disclosed in claims 9 and 18 and the elevator group management control method (disclosed in claims 24 and 33) which is executed in this elevator group management apparatus.

[27-1. Configuration of the Twenty-seventh Embodiment]

This embodiment is a variation of the nineteenth embodiment described earlier with modifications in the specific structure of its free car stop position specifying device.

[27-1-1. Configuration of the Elevator Group Management Control Apparatus]

The elevator group management control apparatus 3 in this embodiment is structured identically to that in the nineteenth embodiment except for the modifications in the structure of the free car stop position specifying device (see FIG. 19).

[27-1-2. Configuration of the Free Car Stop Position Specifying Device]

Figure 30:
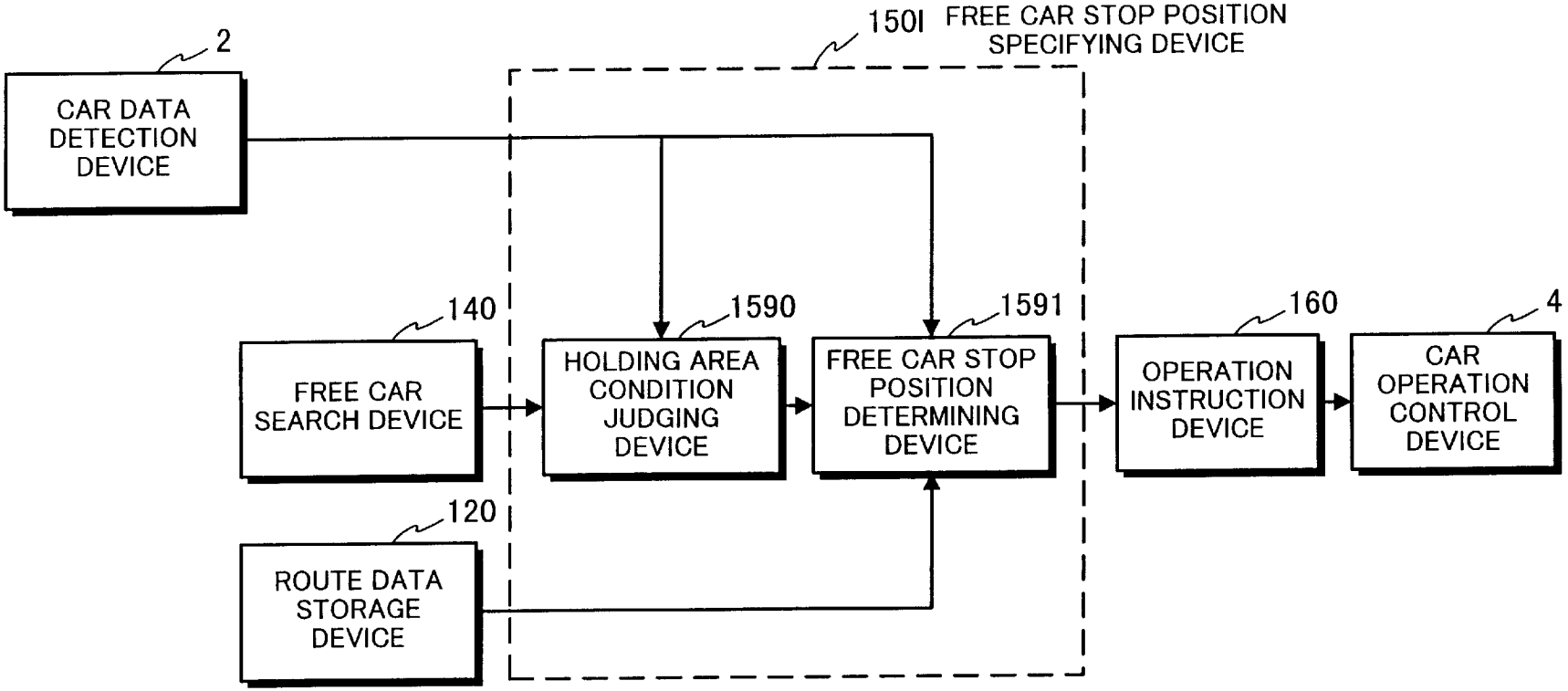
FIG. 30 is a block diagram of the free car stop position specifying device employed in the twenty-seventh embodiment of the elevator group management control apparatus according to the present invention.

The following is a detailed explanation of the specific structure of a free car stop position specifying device 150I employed in the elevator group management control apparatus 3 in this embodiment in reference to FIG. 30.

Namely, the free car stop position specifying device 150I comprises a holding area condition judging device 1590 that makes a judgment as to whether or not a car on call is present within a specific area satisfying specific requirements, based upon the "car data" and the "free car data", and a free car stop position determining device 1591 that places free cars within the specific area which may be utilized as a holding area, by using the "car data", the "free car data" and the "specific area car operation status data" obtained from the holding area condition judging device 1590.

[27-2. Operation of the Twenty-seventh Embodiment]

The twenty-seventh embodiment structured as described above provides the following functions. The following is an explanation of the free car stop position specifying processing which differentiates this embodiment from the nineteenth embodiment.

[27-2-1. Free Car Stop Position Specifying Processing]

The free car stop position specifying device 150I shown in FIG. 30 determines a new stop position which satisfies specific requirements for each of the free cars detected by the free car search device 140.

(A) Requirements for Determining Stop Positions for Free Cars

In the free car stop position specifying device 1501 in this embodiment, a specific area that may be utilized as a holding area is stored in memory and a judgment is made as to whether or not cars other than the free cars detected by the free car search device 140, i.e., cars on call are present within the specific areas satisfying specific requirements.

It is to be noted that the specific areas are set in advance based upon a number of considerations such as the unlikelihood of other cars operating in the area. Also, if there are a plurality of such specific areas set, a separate setting is made to select which of these specific areas should be given priority as a stop position for free cars by taking into consideration Functions such as the arrangement of shaft direction, the operating time of day (morning influx, evening exodus) and the number of cars.

Based upon the "car data" sent from the car data detection device 2, the "free car data" sent from the free car search device 140, the "specific area car operation status data" obtained from the holding area condition judging device 1590, free cars are placed within the specific areas.

The requirements described above for determining the next stop position for each free car are imposed upon the free car stop position specifying device 150I in this embodiment for the following reasons.

Namely, by marshaling free cars on standby in areas which are assumed not to have other cars operating at the present time and are expected to have station calls generated in the near future such as during the morning rush hour, a quick response can be made to new station calls without presenting any hindrance to the operation of other cars.

Now, the method for determining the stop position for a free car employed by the free car stop position specifying device 150I in this embodiment is explained in reference to a specific example.

For instance, let us assume that the free car search device 140 detects cars 3, 4 and 5 as free cars, with the individual cars positioned at the locations shown in FIG. 22 (it is assumed, in this instance, that all cars are in a stationary state). In addition, the specific area which may be utilized as a holding area is set at 1@4~9@4.

In addition, the holding area condition judging device 1590 makes a judgment as to whether or not there are cars on call present within any of the specific areas. In other words, by referring to the "car data" obtained from the car data detection device 2, it is ascertained that the cars on call 1 and 2 are not present in any of the specific areas. Consequently, by considering the shaft direction (the fourth shaft is a descending shaft), it is judged that 9@4~1@4 may be used as a holding area for free cars.

Also, the free car stop position determining device 1591 determines the next stop positions of the free cars detected by the free car search device 140 (normally, free cars remain in a stationary state at their current positions). In other words, the specific areas that have been judged to have no cars on call present within them by the holding area condition judging device 1590 are selected as the stop positions for free cars.

The decision as to which of the specific areas should be given priority to be selected as a stop position for free cars is considered to vary depending upon such factors as the arrangement of the shaft directions, the time of day (morning influx, evening exodus) and the number of cars, and in this example, the operating time of day is hypothetically set during the morning rush hour, i.e., it is assumed that there are many passengers embarking at the first floor and priority is given in order of: 1@4, 9@4.

As a result, the placement of free cars is as shown in Table 61.

TABLE 61

| Free car | (Floor location | Shaft) |
|---|---|---|
| 3 | 5 | 4 |
| 4 | 1 | 4 |
| 5 | 3 | 4 |

As shown in Table 61, the next stop position of car 5 is at 3@4 which is not a stop position on the route of car 5. Consequently, a route change is implemented for car 5 by the operation instruction device 160. The following is an explanation of this route change.

As shown in Table 43, the standing route data for car 5 are (1, 2, 3) (20, 4, 3, 2) (10, 3, 4), and its operation route is changed through the following data operation. Namely, in order for car 5 to include 3@4 in its route, it is necessary for it to directly descend in the fourth shaft without returning to the third shaft from the fourth shaft at the tenth floor. In other words, at the tenth floor, a route going from the fourth shaft→third shaft→fourth shaft is required. Also, it is necessary for it to move from the fourth shaft to the third shaft at the first floor of the fourth shaft.

Consequently, among the route data for car 5, the data relating to the traverse floor, i.e., the first floor, are first changed to the data (1, 2, 3, 4) whose contents indicate movement from the fourth shaft. Also, since it is necessary to travel from the fourth shaft→third shaft→fourth shaft at the traverse floor, i.e., the tenth floor, the route data for the tenth floor are changed to (10, 4, 3, 4). As a result, the route data for car 5 are changed as shown in Table 62.

TABLE 62

| Car | (Transverse Floor | Transverse Shaft) |
|---|---|---|
| 5 | 1 | 234 |
| | 20 | 432 |
| | 10 | 434 |

Note that since there is only reciprocal movement between the fourth shaft and the third shaft at the traverse floor, i.e., the tenth floor in the route data shown in Table 62, if this reciprocal block is deleted, the data for the tenth floor become unnecessary. Consequently, the route data for car 5 become as shown in Table 63 and these data are updated and stored in memory by the route data storage device 120.

TABLE 63

| Car | (Transverse Floor | Transverse Shaft) |
|---|---|---|
| 5 | 1 | 234 |
| | 20 | 432 |

[27-3. Effects of the Twenty-seventh Embodiment]

The elevator group management control apparatus in the twenty-seventh embodiment structured as described above and the elevator group management control method that is executed in this elevator group management control apparatus achieve the following advantage.

Namely, when performing elevator group management control, by setting in advance a specific area which may be utilized as a holding area where free cars are held in standby based upon a number of considerations such as the unlikelihood of other cars operating in the area and the expectation of station calls being generated in the near future, such as during the morning rush hour, and marshaling free cars in standby within the specific area, a quick response to new station calls becomes possible without presenting any hindrance to the operation of other cars.

[28. Twenty-eighth Embodiment]

This embodiment corresponds to the elevator group management control apparatus disclosed in claims 9 and 19 and the elevator group management control method (disclosed in claims 24 and 34) which is executed in this elevator group management control apparatus.

[28-1. Configuration of the Twenty-eighth Embodiment]

This embodiment is a variation of the nineteenth embodiment described earlier with modifications in the specific structure of its free car stop position specifying device.

[28-1-1. Configuration of the Elevator Group Management Control Apparatus]

An elevator group management control apparatus 3 in this embodiment is structured identically to that in the nineteenth embodiment except for the modifications in the structure of the free car stop position specifying device (see FIG. 19).

[28-1-2. Configuration of the Free Car Stop Position Specifying Device]

Figure 31:
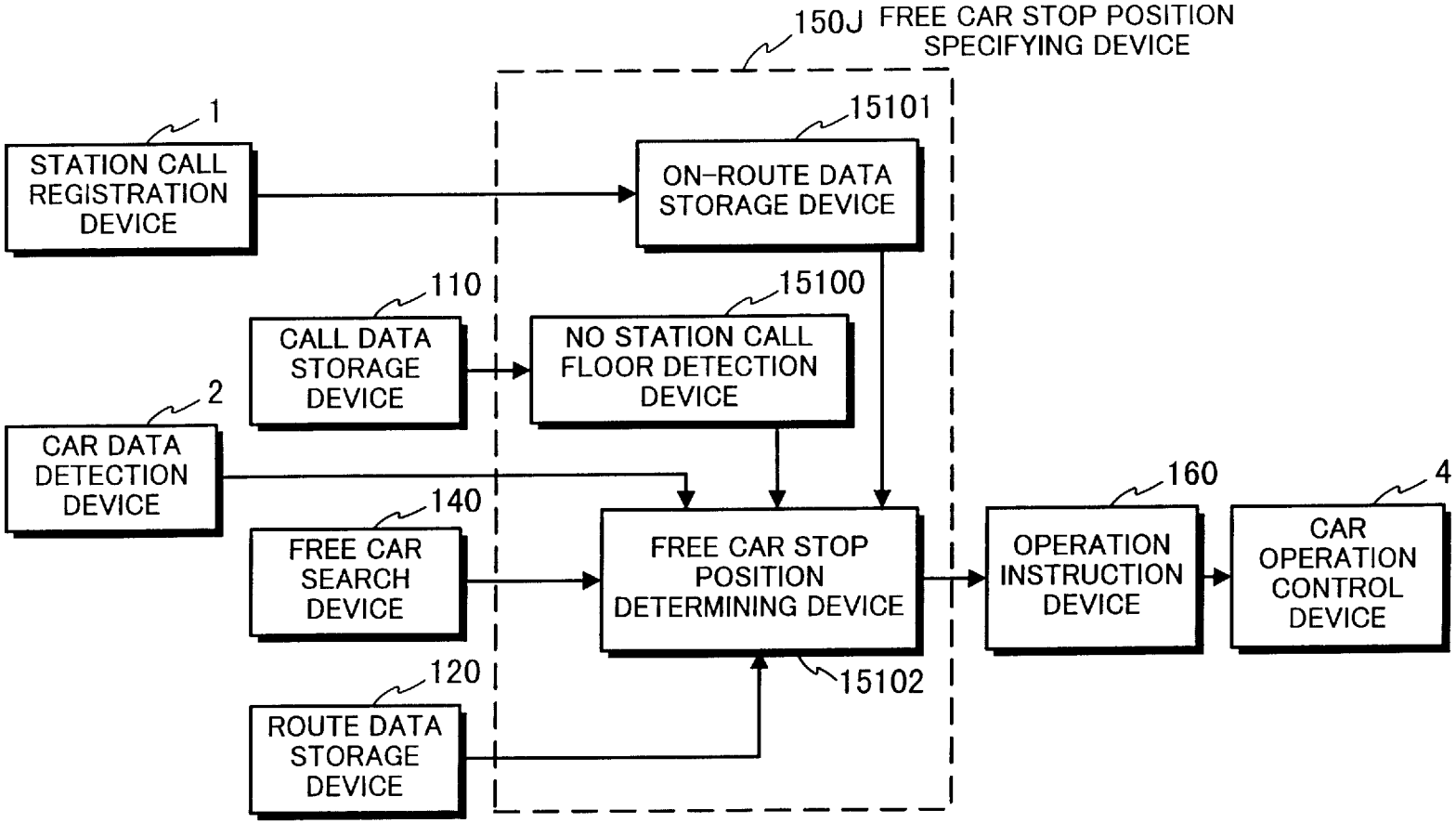
FIG. 31 is a block diagram of the free car stop position specifying device employed in the twenty-eighth embodiment of the elevator group management control apparatus according to the present invention.

The following is a detailed explanation of the specific structure of a free car stop position specifying device 150J employed in the elevator group management control apparatus 3 in this embodiment in reference to FIG. 31.

Namely, the free car stop position specifying device 150J comprises a no station call floor detection device 15100 that detects floors where no station calls have been generated based upon the "call data";

an on-route data storage device 15101 that, when a car has responded to a station call registered in the station call registration device 1 and a passenger who has boarded the car at the floor has registered a desired floor (in other words, a car call registration has been made), stores the car call registration in memory as data; and a free car stop position determining device 15102 that places free cars at floors with a high frequency of passengers by using the "car data", "free car data" and "on-route data" stored in the on-route data storage device.

Note that since, during an initial period of time after the elevator system according to the present invention is installed, there is an insufficient quantity of accumulated "on-route data", "passenger movement data" may be prepared based upon factors such as the number of floors in the building and the structure of the building (the floors where restaurants are located, floors with entrances and so on) as initial settings and free cars may be placed based upon these data.

[28-2. Operation of the Twenty-eighth Embodiment]

The twenty-eighth embodiment structured as described above provides the following functions. The following is an explanation of the free car stop position specifying processing which differentiates this embodiment from the nineteenth embodiment.

[28-2-1. Free Car Stop Position Specifying Processing]

The free car stop position specifying device 150J shown in FIG. 31 determines a new stop position which satisfies specific requirements for each of the free cars detected by the free car search device 140.

(A) Requirements for Determining Stop Positions for Free Cars

With the free car stop position specifying device 150J in this embodiment, when a car has responded to a station call registered in the station call registration device 1 and a passenger who has boarded at that floor has registered a desired floor (in other words, a car call registration has been made), this car call registration is stored in memory as on-route data.

Then, if the numerical value in the table representing these on-route data is large, it is assumed that the large numerical value represents heavy passenger traffic, and the ratio of free car placement is in conformance to that numerical value.

The requirements described above for determining the next stop position for each free car are imposed upon the free car stop position specifying device 150J in this embodiment for the following reasons.

Namely, when a car responds to a station call and a passenger who has boarded the car at that floor registers a desired floor, by storing the car calls in memory as on-route data and by comparing their frequency for each floor, it can be assumed that at the floors with high frequencies, the likelihood of station calls occurring again is high.

Consequently, by keeping free cars on standby at the floors which are expected to have high frequencies of station call generation in the future, a quick response becomes possible to new station calls.

The method for determining the stop position for a free car employed by the free car stop position specifying device 150J in this embodiment is explained in reference to a specific example.

For instance, let us assume that the free car search device 140 detects cars 3, 4 and 5 as free cars, with the individual cars positioned at the locations shown in FIG. 22 (it is assumed, in this instance, that all the cars are in a stationary state).

In addition, the no station call floor detection device 15100 detects floors where no station calls have been generated based upon the "call data" stored in the call data storage device 110. If a car has responded to a station call registered in the station call registration device 1 and a passenger who has boarded the car at that floor has registered a desired floor, the on-route data storage device 15101 stores the car call registration in memory.

For instance, let us assume that in the "call data" shown in Table 42, the car calls (C 12 DOWN) and (C 4 DOWN) made at car 1 have been generated at the twentieth floor and the car call (C 9 DOWN) at car 2 has been generated at the seventeenth floor. The "on-route data" corresponding to these are stored in memory as shown in Table 64.

TABLE 64

| Boarding | Disembarking floor | | | | | | | | | | | | | | | | | | | |
|---|---|---|---|---|---|---|---|---|---|---|---|---|---|---|---|---|---|---|---|---|
| floor | 1 | 2 | 3 | 4 | 5 | 6 | 7 | 8 | 9 | 10 | 11 | 12 | 13 | 14 | 15 | 16 | 17 | 18 | 19 | 20 |
| 1 | — | 0 | 0 | 0 | 0 | 0 | 0 | 0 | 0 | 0 | 0 | 0 | 0 | 0 | 0 | 0 | 0 | 0 | 0 | 0 |
| 2 | 0 | — | 0 | 0 | 0 | 0 | 0 | 0 | 0 | 0 | 0 | 0 | 0 | 0 | 0 | 0 | 0 | 0 | 0 | 0 |
| 3 | 0 | 0 | — | 0 | 0 | 0 | 0 | 0 | 0 | 0 | 0 | 0 | 0 | 0 | 0 | 0 | 0 | 0 | 0 | 0 |
| 4 | 0 | 0 | 0 | — | 0 | 0 | 0 | 0 | 0 | 0 | 0 | 0 | 0 | 0 | 0 | 0 | 0 | 0 | 0 | 0 |
| 5 | 0 | 0 | 0 | 0 | — | 0 | 0 | 0 | 0 | 0 | 0 | 0 | 0 | 0 | 0 | 0 | 0 | 0 | 0 | 0 |
| 6 | 0 | 0 | 0 | 0 | 0 | — | 0 | 0 | 0 | 0 | 0 | 0 | 0 | 0 | 0 | 0 | 0 | 0 | 0 | 0 |
| 7 | 0 | 0 | 0 | 0 | 0 | 0 | — | 0 | 0 | 0 | 0 | 0 | 0 | 0 | 0 | 0 | 0 | 0 | 0 | 0 |
| 8 | 0 | 0 | 0 | 0 | 0 | 0 | 0 | — | 0 | 0 | 0 | 0 | 0 | 0 | 0 | 0 | 0 | 0 | 0 | 0 |
| 9 | 0 | 0 | 0 | 0 | 0 | 0 | 0 | 0 | — | 0 | 0 | 0 | 0 | 0 | 0 | 0 | 0 | 0 | 0 | 0 |
| 10 | 0 | 0 | 0 | 0 | 0 | 0 | 0 | 0 | 0 | — | 0 | 0 | 0 | 0 | 0 | 0 | 0 | 0 | 0 | 0 |
| 11 | 0 | 0 | 0 | 0 | 0 | 0 | 0 | 0 | 0 | 0 | — | 0 | 0 | 0 | 0 | 0 | 0 | 0 | 0 | 0 |
| 12 | 0 | 0 | 0 | 0 | 0 | 0 | 0 | 0 | 0 | 0 | 0 | — | 0 | 0 | 0 | 0 | 0 | 0 | 0 | 0 |
| 13 | 0 | 0 | 0 | 0 | 0 | 0 | 0 | 0 | 0 | 0 | 0 | 0 | — | 0 | 0 | 0 | 0 | 0 | 0 | 0 |
| 14 | 0 | 0 | 0 | 0 | 0 | 0 | 0 | 0 | 0 | 0 | 0 | 0 | 0 | — | 0 | 0 | 0 | 0 | 0 | 0 |
| 15 | 0 | 0 | 0 | 0 | 0 | 0 | 0 | 0 | 0 | 0 | 0 | 0 | 0 | 0 | — | 0 | 0 | 0 | 0 | 0 |
| 16 | 0 | 0 | 0 | 0 | 0 | 0 | 0 | 0 | 0 | 0 | 0 | 0 | 0 | 0 | 0 | — | 0 | 0 | 0 | 0 |
| 17 | 0 | 0 | 0 | 0 | 0 | 0 | 0 | 0 | 1 | 0 | 0 | 0 | 0 | 0 | 0 | 0 | — | 0 | 0 | 0 |
| 18 | 0 | 0 | 0 | 0 | 0 | 0 | 0 | 0 | 0 | 0 | 0 | 0 | 0 | 0 | 0 | 0 | 0 | — | 0 | 0 |
| 19 | 0 | 0 | 0 | 0 | 0 | 0 | 0 | 0 | 0 | 0 | 0 | 0 | 0 | 0 | 0 | 0 | 0 | 0 | — | 0 |
| 20 | 0 | 0 | 0 | 1 | 0 | 0 | 0 | 0 | 0 | 0 | 0 | 1 | 0 | 0 | 0 | 0 | 0 | 0 | 0 | — |

In addition, the free car stop position determining device 15102 determines the next stop positions for free cars based upon the "on-route data" stored in the on-route data storage device 15101. In this example, it is assumed that the greater the numerical values in the Table showing the "on-route data" the higher the frequency of passengers, and the next stop positions for free cars are set in conformance to the ratio of the numerical values.

In other words, in regard to car 1, two car calls occurring at the twentieth floor means that at least two passengers have boarded car 1 at the twentieth floor. As for car 2, one car call occurring at the seventeenth floor means that at least one passenger has boarded car 2 at the seventeenth floor.

Thus, since it is expected that at the twentieth floor there will be many passengers boarding in the future as well, it is decided that free cars should be placed for descending at the twentieth floor and the seventeenth floor at the ratio of 2:1. Note that ascending and descending can be distinguished from each other in the data shown in Table 64 by verifying whether the data are on the left hand side or on the right hand side of "-".

Consequently, in correspondence to the "route data", specifications are made that the next stop position for the free car 4 at 17F@4 and the next stop position for both cars 3 and 5 is at 20F@4.

However, it should be noted that 20F@4 does not directly become the next stop position on the route and in the case of car 3, for instance, it will stop at positions 20F@1~20F@3 and finally will move to 20F@4. In example, cars stop every time they move from one shaft to another at a traverse floor.

As a result, the placement of the free cars is as shown in Table 65.

TABLE 65

| Free car | ( Floor location | Shaft ) |
|---|---|---|
| 3 | 20 | 4 |
| 4 | 17 | 4 |
| 5 | 20 | 4 |

[28-3. Effects of the Twenty-eighth Embodiment]

The elevator group management control apparatus in the twenty-eight embodiment structured as described above and the elevator group management control method which is executed in the elevator group management control apparatus achieve the following advantage.

Namely, in elevator group management control, when a car has responded to a station call and a passenger who has boarded the car at that floor has registered a desired floor, by placing free cars based upon the frequency of generation of car call registration, a quick response becomes possible to new station calls which will arise in the future.

[29. Twenty-ninth Embodiment]

This embodiment corresponds to the elevator group management control apparatus disclosed in claims 9 and 20 and the elevator group management control method (disclosed in claims 24 and 35) which is executed in this elevator group management control apparatus.

[29-1. Configuration of the Twenty-ninth Embodiment]

This embodiment is a variation of the nineteenth embodiment described earlier, with modifications in the specific structure of its free car stop position specifying device.

[29-1-1. Configuration of the Elevator Group Management Control Apparatus]

An elevator group management control apparatus 3 in this embodiment is structured identically to that in the nineteenth embodiment except for the modifications in the structure of its free car stop position specifying device (see FIG. 19).

[29-1-2. Configuration of the Free Car Stop Position Specifying Device]

Figure 32:
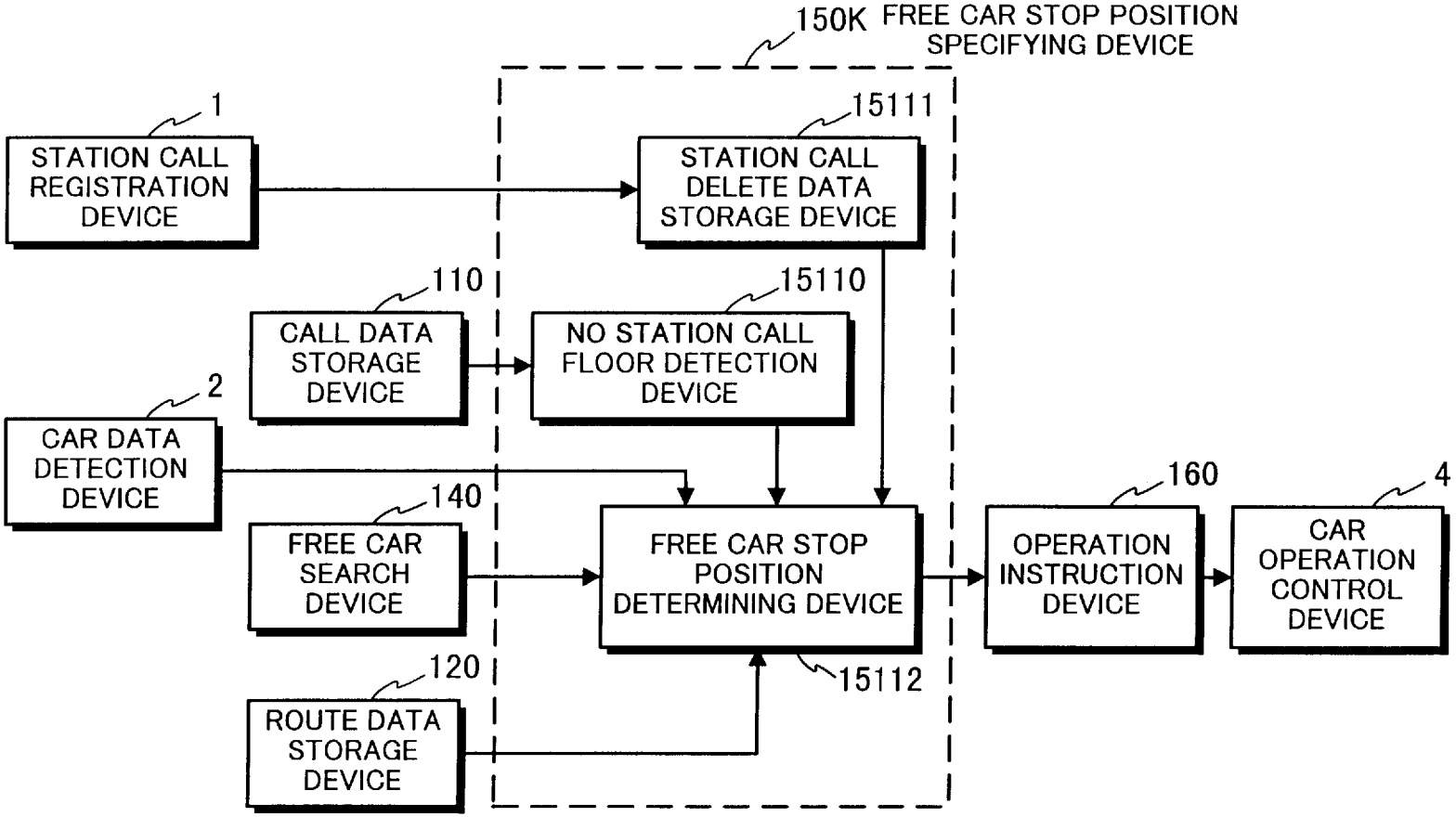
FIG. 32 is a block diagram of the free car stop position specifying device employed in the twenty-ninth embodiment of the elevator group management control apparatus according to the present invention.

The following is a detailed exploration of the specific structure of a free car stop position specifying device 150K employed in the elevator group management control apparatus 3 in this embodiment in reference to FIG. 32.

Namely, the free car stop position specifying device 150K comprises a no station call floor detection device 15110 that detects floors where no station calls have been generated based upon the "call data";

a station call delete data storage device 15111 that stores in memory a specific number of floors (including the directions) whose station calls have been deleted and updates the record in chronological order every time a station call registered in the station call registration device 1 is deleted, (in other words, every time a passenger boards a car at a floor where a station call has been generated); and a free car stop position determining device 15112 that, using the "car data", the "free car data and "station call delete data" stored in the station call delete data storage device 15111, places free cars starting from the floor whose station call was deleted the earliest.

[29-2. Operation of the Twenty-ninth Embodiment]

The twenty-ninth embodiment structured as described above provides the following functions. The following is an explanation of the free car stop position specifying processing which differentiates this embodiment from the nineteenth embodiment.

[29-2-1. Free Car Stop Position Specifying Processing]

The free car stop position specifying device 150K shown in FIG. 32 determines a new stop position which satisfies specific requirements for each of the free cars detected by the free car search device 140.

(A) Requirements for Determining Stop Positions for Free Cars

In the free car stop position specifying device 150K in this embodiment, every time a car has responded to a station call registered in the station call registration device 1 and the station call is deleted, a specific number of floors whose station calls have been deleted are stored in memory in chronological order (including the directions).

Then, free cars are placed, starting with the floor whose station call was deleted the earliest, at the floors where no station calls have been generated that have been detected by the no station call floor detection device 15110.

The requirements described above for determining the next stop position for each free car are imposed upon the free car stop position specifying device 150K in this embodiment for the following reasons.

Namely, of the floors where a car has responded to a station call resulting in the station call being deleted, the floor whose station call was deleted the earliest is considered to have the greatest likelihood of a new station call being generated.

Consequently, by keeping free cars on standby at the floors which are expected to have a high frequency of station call generation in the future, a quick response to new station calls becomes possible.

Now, the method for determining the stop position for a free car employed by the free car stop position specifying device 150K in this embodiment is explained in reference to a specific example.

For instance, let us assume that the free car search device 140 detects cars 3, 4 and 5 as free cars with the individual cars positioned at the locations shown in FIG. 22 (it is assumed, in this instance, that all the cars are in a stationary state).

In addition, the no station call floor detection device 15110 detects floors where no station calls have been generated based upon the "call data" stored in the call data storage device 110. The station call delete data storage device 15111, in turn, stores in memory a specific number of floors (including the directions) whose station calls have been deleted and updates the record in chronological order every time a station call is registered in the station call registration device 1, (in other words, every time a passenger boards a car at a floor where a station call has been generated) at the response of a car.

For instance, if station calls 15F@DN, 12F@UP, 10F@DN, 6F@UP, 17F@DN, 20F@DN have been generated and deleted in that order, the data are stored in the station call delete data storage device 15111, as shown in Table 66.

It is to be noted that in this example, a maximum of 38 sets of data, which equals the number of floors, can be stored in memory (since, in Table 66, the number of station calls generated is smaller than the number of floors, only the data corresponding to the floors where station calls have been generated are stored in memory).

TABLE 66

| ( Floor | Direction ) |
|---|---|
| 20 | DN |
| 17 | DN |
| 6 | UP |
| 10 | DN |
| 12 | UP |
| 15 | DN |

Then, the free car stop position determining device 15112 places free cars, starting from the floor whose station call was deleted the earliest, at the floors where no station calls have been detected by the no station call floor detection device 15110.

In other words, in Table 66, car 5 is placed at the fifteenth floor in the descending direction whose station call was deleted the earliest, car 3 is placed at the twelfth floor in the ascending direction whose station call was deleted the second earliest and car 4 is placed at the tenth floor in the descending direction whose station call was deleted the third earliest.

As a result, the placement of the free cars is as shown in Table 67.

TABLE 67

| Free car | ( Floor location | Shaft ) |
|---|---|---|
| 3 | 12 | 1 |
| 4 | 10 | 4 |
| 5 | 15 | 4 |

[29-3. Effects of the Twenty-ninth Embodiment]

The elevator group management control apparatus in the twenty-ninth embodiment structured as described above and the elevator group management control method which is executed in the elevator group management control apparatus achieve the following advantage.

Namely, when performing elevator group management control, by placing free cars sequentially starting from the floor whose station call was deleted the earliest, at the floors whose station calls have been deleted upon response from a car to a station call, a quick response to a new station call which will rise in the future can be achieved.

[30. Thirtieth Embodiment]

This embodiment corresponds to the elevator group management control apparatus disclosed in claims 9 and 21 and the elevator group management control method (disclosed in claims 24 and 36) which is executed in this elevator group management control apparatus.

[30-1. Configuration of the Thirtieth Embodiment]

This embodiment is a variation of the nineteenth embodiment described earlier, with modifications in the specific structure of its free car stop position specifying device.

[30-1-1. Configuration of the Elevator Group Management Control Apparatus]

An elevator group management control apparatus 3 in this embodiment is structured identically to that in the nineteenth embodiment except for the modifications in the structure of the free car stop position specifying device (see FIG. 19).

[30-1-2. Configuration of the Free Car Stop Position Specifying Device]

Figure 33:
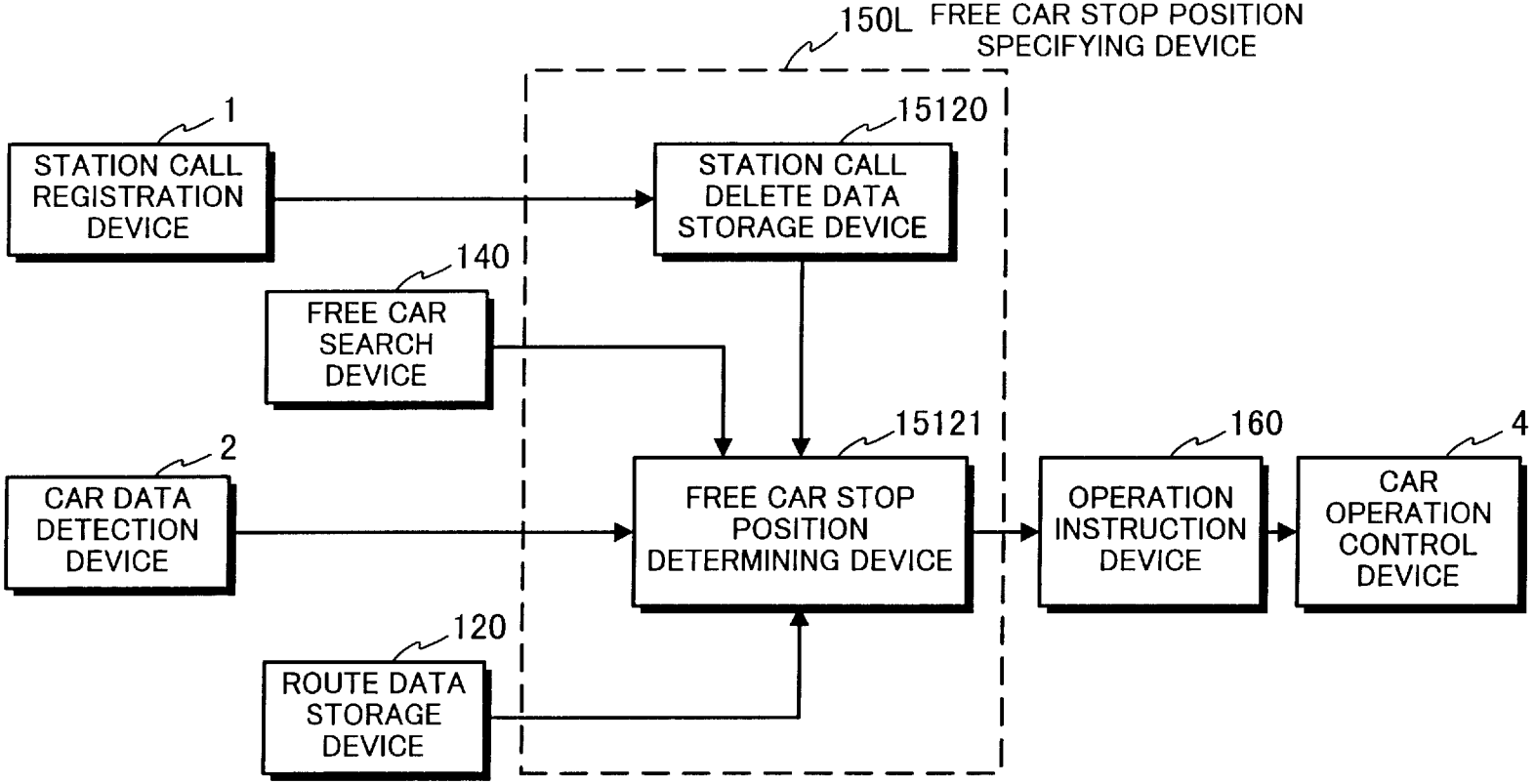
FIG. 33 is a block diagram of the free car stop position specifying device employed in the thirtieth embodiment of the elevator group management control apparatus according to the present invention.

The following is a detailed explanation of the specific structure of a free car stop position specifying device 150L employed in the elevator group management control apparatus 3 in this embodiment in reference to FIG. 33.

Namely, the free car stop position specifying device 150L comprises a station call delete data storage device 15120 that stores in memory a specific number of floors (including the directions) whose station calls have been deleted and updates the record in chronological order every time a station call is registered in the station call registration device 1, (in other words, every time a passenger boards a car at a floor where a station call has been generated); and a free car stop position determining device 15121 that, using the "car data", the "free car data" and "station call delete data" stored in the station call delete data storage device 15120, places free cars sequentially starting from the floor whose station call was deleted most recently.

[30-2. Operation of the Thirtieth Embodiment]

The thirtieth embodiment structured as described above, provides the following functions. The following is an explanation of the free car stop position specifying processing which differentiates this embodiment from the nineteenth embodiment.

[30-2-1. Free Car Stop position Specifying Processing]

The free car stop position specifying device 150L shown in FIG. 33 determines a new stop position which satisfies specific requirements for each of the free cars detected by the free car search device 140.

(A) Requirements for Determining Stop Positions for Free Cars

In the free car stop position specifying device 150L in this embodiment, every time a car has responded to a station call registered in the station call registration device 1 and the station call is deleted, a specific number of floors (including the directions) whose station calls have been deleted that are stored in memory are updated in chronological order. Then, free cars are placed sequentially starting with the floor whose station call was deleted most recently.

The requirements described above for determining the next stop position for each free car are imposed upon the free car stop position specifying device 150L in this embodiment for the following reasons.

Namely, of the floors where a car has responded to a station call resulting in the station call being deleted, the floor whose station call was deleted most recently is considered to have the least likelihood of a new station call being generated.

Consequently, by keeping free cars in standby at the floors which are expected to have a low frequency of station calls in the future, it is ensured that the operation of other cars is not hindered and, as a result, an improvement in operational efficiency is achieved.

Now, the method for determining the stop position for a free car employed by the free car stop position specifying device 150L in this embodiment is explained in reference to a specific example.

For instance, let us assume that the free car search device 140 detects cars 3, 4 and 5 as free cars with the individual cars positioned at the locations shown in FIG. 22 (it is assumed, in this instance, that all the cars are in a stationary state).

The station call delete data storage device 15120 stores in memory a specific number of floors (including the directions) whose station calls have been deleted and updates the record in chronological order every time a station call is registered in the station call registration device 1 upon response by a car. Note that, normally, this "specific number" of floors refers to the number of floors where embarking and disembarking are possible, since the entire number of floors of the building and the number of floors where embarking and disembarking are possible do not always match.

For instance, if station calls 15F@DN, 12F@UP, 10F@DN, 6F@UP, 17F@DN, 20F@DN have been generated and deleted in that order, the data are stored in the station call delete data storage device 15120 as shown in Table 68.

Note that in this example, five calls which corresponds to the number of cars are stored in memory and when a station call has been deleted, the data are deleted starting with the earliest data.

TABLE 68

| ( Floor | Direction ) |
|---|---|
| 20 | DN |
| 17 | DN |
| 6 | UP |
| 10 | DN |
| 12 | UP |

Then, the free car stop position determining device 15121 places free cars starting with the floor whose station call was deleted most recently.

In other words, Table 68 indicates that car 1 is currently present at the twentieth floor in the descending direction in response to a station call. Now car 5 is placed at the eighteenth floor in the descending direction whose station call was most recently deleted, then car 3 is placed at the sixth floor in the ascending direction whose station call was been deleted second most recently and then car 4 is placed at the tenth floor in the descending direction whose station call was been deleted third most recently.

As a result, the placement of the free cars is as shown in Table 69.

TABLE 69

| Free car | ( Floor location | Shaft ) |
|---|---|---|
| 3 | 6 | 1 |
| 4 | 10 | 4 |
| 5 | 18 | 4 |

[30-3. Effects of the Thirtieth Embodiment]

The elevator group management control apparatus in the thirtieth embodiment structured as described above and the elevator group management control method which is executed in the elevator group management control apparatus achieve the following advantage.

Namely, when performing elevator group management control, by placing free cars sequentially starting from the floor whose station call was deleted most recently, at the floors whose station calls have been deleted upon response from a car to a station call, it is possible to keep free cars in standby at the floors that are considered to have less likelihood of station call generation occurring again to prevent a free car from being a hindrance to the operation of other cars and to achieve an improvement in operational efficiency.

[31. Embodiment]

This embodiment corresponds to the elevator group management control apparatus disclosed in claim 22 and the elevator group management control method (disclosed in claim 37) which is executed in this elevator group management control apparatus.

[31-1. Configuration of the Thirty-first Embodiment]

This embodiment is a variation of the first through thirtieth embodiments described earlier with a free car stop position review instruction device added to the free car stop position specifying device.

[31-1-1. Configuration of the Elevator Group Management Control Apparatus]

An elevator group management control apparatus 3 in this embodiment is structured identically to those in the preceding embodiments except for the modifications in the structure of its free car stop position specifying device (see FIG. 19).

[31-1-2. Configuration of the Free Car Stop Position Specifying Device]

Figure 34:
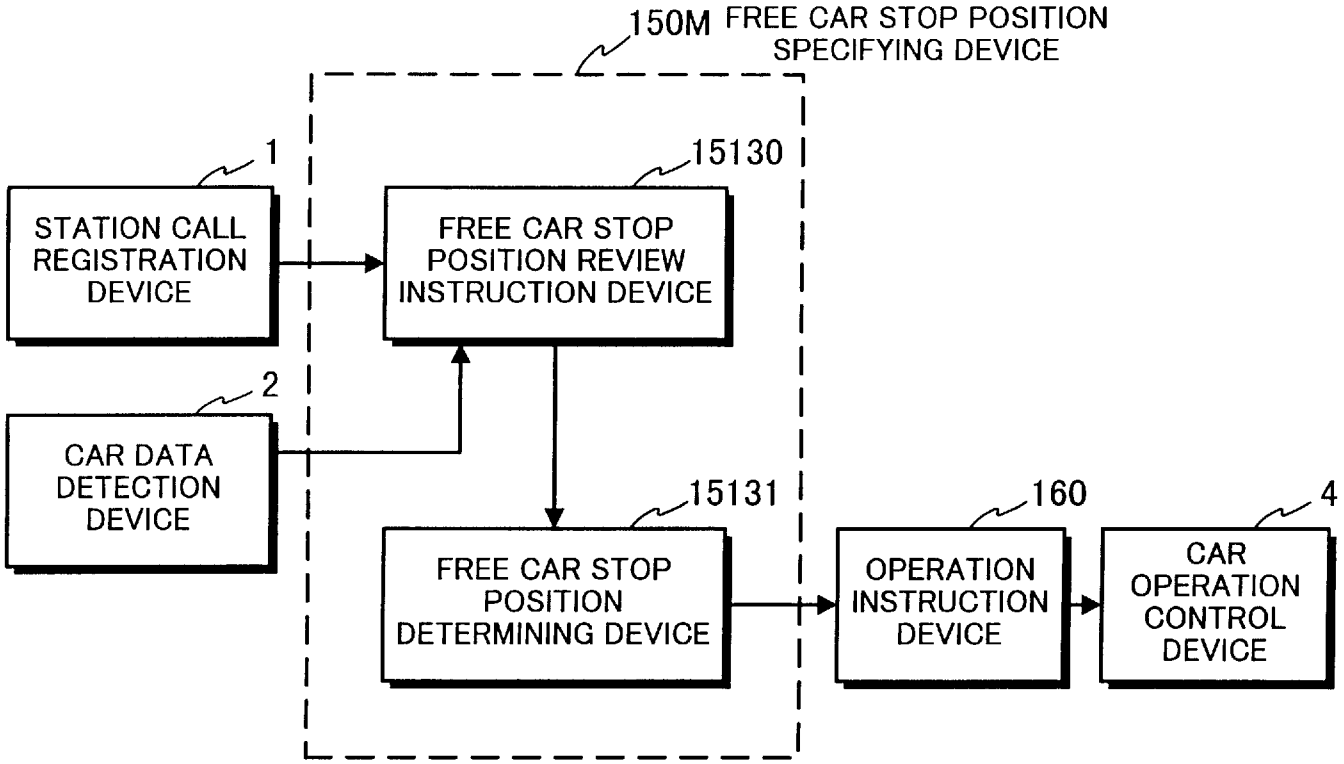
FIG. 34 is a block diagram of the free car stop position specifying device employed in the thirty-first embodiment of the elevator group management control apparatus according to the present invention.

The following is a detailed explanation of the specific structure of a free car stop position specifying device 150M employed in the elevator group management control apparatus 3 in this embodiment in reference to FIG. 34.

Namely, the free car stop position specifying device 150M comprises a free car stop position review instruction device 15130 that searches the "call data" and every time the call status changes, outputs an instruction to review the next stop positions of free cars determined by the free car stop position specifying device 150 disclosed in each of the embodiments described above.

[31-2. Operation of the Thirty-first Embodiment]

The thirty-first embodiment structured as described above provides the following functions. Namely, when a new "station call" has been registered in the station call registration device 1 or when it is decided by the car data detection device 2 that the car status has changed significantly based upon the data relating to each car, the free car stop position review instruction device 15130 outputs an instruction to the free car stop position determining device 15131 for it to perform the calculation of free car stop positions again.

[31-3. Effects of the Thirty-first Embodiment]

The elevator group management control apparatus in the thirty-first embodiment structured as described above and the elevator group management control method that is executed in this elevator group management control apparatus achieve the following advantage.

Namely, when performing elevator group management control, if a new station call has been registered in the station call registration device 1 or if it is decided by the car data detection device 2 that the car status has changed significantly based upon the data relating to each car, the calculation of free car stop positions can be performed again under the new conditions, making it possible to implement group management control for the elevators based upon the latest data at all times.

[C. Embodiments Referring to the Invention for Attaining the Third Object]

[32. Thirty-second Embodiment]

This embodiment relates to an elevator group management control apparatus corresponding to claims 38 and 39 and an elevator group management control method (corresponding to claims 46 and 47) used for the elevator group management control apparatus.

[32-1. Configuration of the Thirty-second Embodiment]

This embodiment relates to the elevator group management control apparatus 3, used for an elevator system, comprising a car operation control device 4 which controls the operation of a plurality of elevator cars moving vertically and horizontally, a car data detection device 2 which detects the status (for example, position, speed, and load) of each car, and one or more station call registration devices 1 each installed at the elevator entrance on each floor.

[32-1-1. Configuration of Elevator Group Management Control Apparatus]

Figure 35:
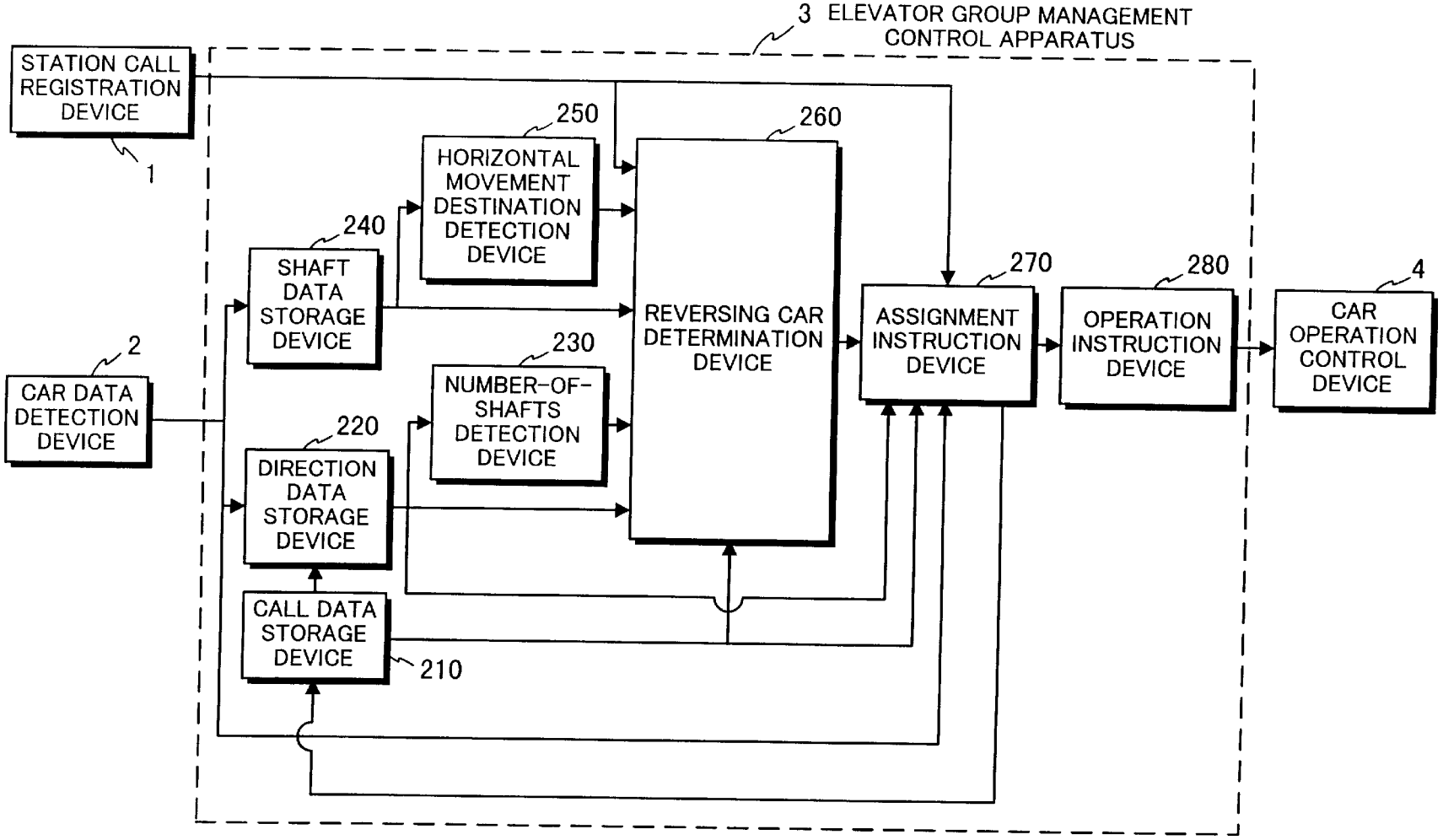
FIG. 35 is a diagram showing the configuration of the thirty-second embodiment of the elevator group management control apparatus according to this invention.

The elevator group management control apparatus 3 used in this embodiment comprises the devices shown in FIG. 35.

That is, the elevator group management control apparatus comprises the call data storage device 210 containing call data consisting of car calls specifying the floors desired by the passengers in each car and station calls assigned to each car;

the direction data storage device 220 estimating the direction of each shaft where each of the cars is moving, based on car data detected by the car data detection device 2 and call data stored in the call data storage device 210, and updating and storing data as direction data;

the number-of-shafts detection device 230 receiving the direction data of the shafts of the cars from the direction data storage device 220 and, for each shaft, finding the number of shafts in the same direction as the direction of the shaft;

the shaft data storage device 240 estimating the floor and the shaft of each of the cars with the use of car data detected by the car data detection device 2, and storing resulting data about estimated floors and shafts as shaft data;

the horizontal movement destination detection device 250 receiving the shaft data of each car from the shaft data storage device 240, checking if there is a car moving horizontally and, if there is, finding the horizontal movement destination shaft of the car;

the reversing car determination device 260 receiving new station call data from the station call registration device 1, call data from the call data storage device 210, direction data of each of the cars from the direction data storage device 220, shaft data of each of the cars from the shaft data storage device 240, the number of shafts whose direction is the same as that of each of the cars detected by the number-of-shafts detection device 230, and the number of a horizontal movement destination shaft detected by the horizontal movement destination detection device 250 to determine a car to be reversed in order to respond to a new station call added to the station call registration device 1;

the assignment instruction device 270 receiving reversing car data determined by the reversing car determination device 260, call data of each of the cars from the call data storage device 210, new station call data added to the station call registration device 1, direction data of each of the cars from the direction data storage device 220, and car data detected by the car data detection device 2 to determine a response car to respond to a new station call and, at the same time, store the information on the call in the call data storage device 210; and the operation instruction device 280 issuing an operation instruction to a response car determined by the assignment instruction device 270 and, if the response car is a reversing car determined by the reversing car determination device 260, issuing another operation instruction to the other car in the shaft where the response car is moving in order to prevent collision.

[32-1-2. Configuration of the Reversing Car Determination Device]

Figure 36:
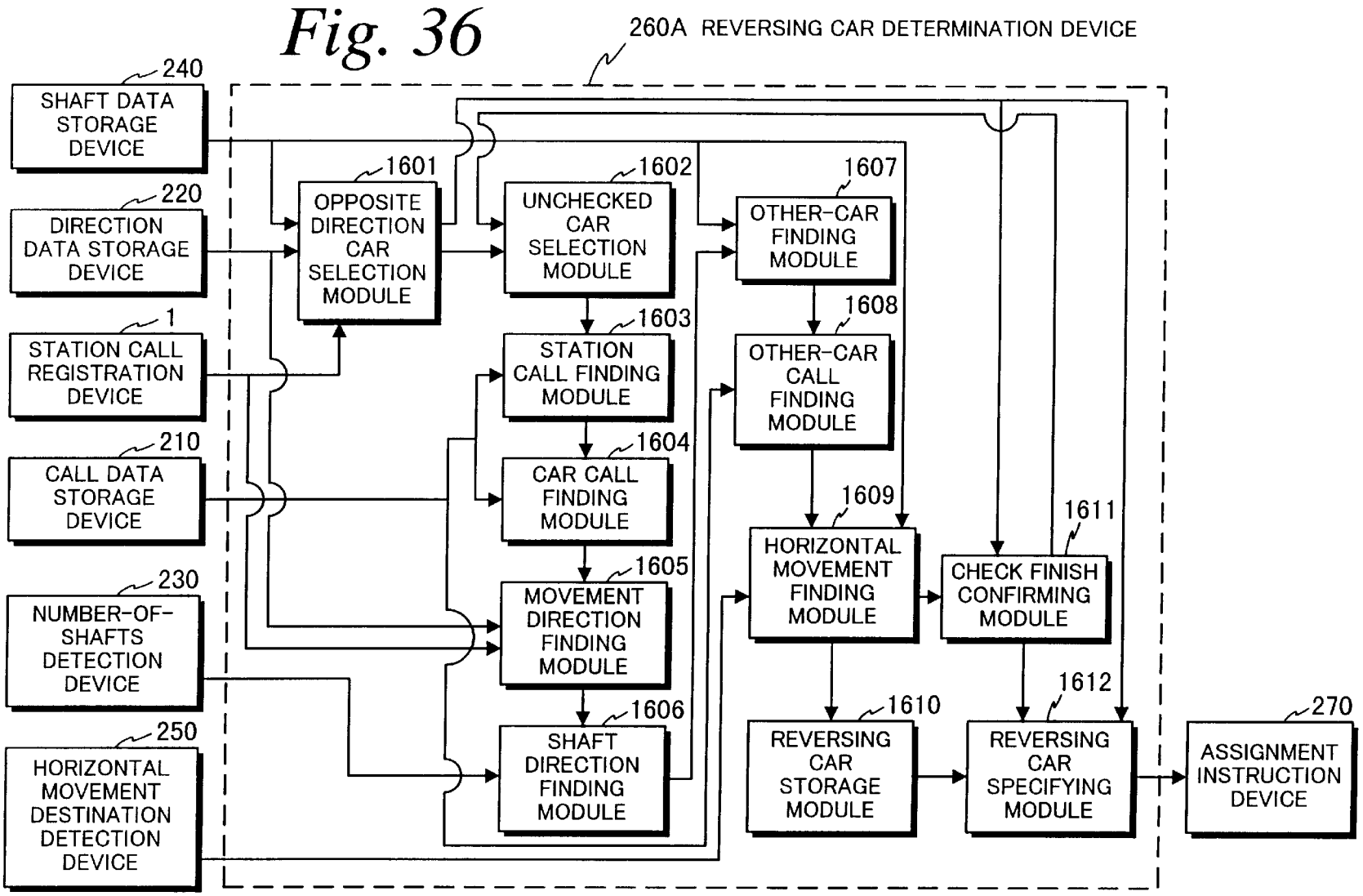
FIG. 36 is a diagram showing the configuration of the reversing car determination device used in the thirty-second embodiment of the elevator group management control apparatus according to this invention.

The configuration of the reversing car determination device 260A of the elevator group management control apparatus 3 will be described in further detail with reference to FIG. 36.

The reversing car determination device 260A comprises:

the opposite direction car selection module 1601 receiving shaft data indicating the shaft of each car from the shaft data storage device 240, direction data of the shaft of each car from the direction data storage device 220, and new station call data added to the station call registration device 1, selecting the cars in the shafts whose direction is opposite to the direction of the new station call, and outputting 0 for a car not selected;

the unchecked car selection module 1602 receiving the number of an opposite-direction car selected by the opposite direction car selection module 1601 and outputting, one at a time, the number of a car not yet checked if it is eligible for a reversing car;

the station call finding module 1603 receiving a car number selected by the unchecked car selection module 1602 and the station call data of each car stored in the call data storage device 210, checking if there is a station call for the car, and outputting 0 if there is a station call or −1 and the car number if there is no station call;

the car call finding module 1604 receiving the value and the car number from the station call finding module 1603 and the car call data of each car from the call data storage device 210, outputting 0 if the value obtained by the station call finding module 1603 is 0 (there is a station call) or finding the car call of the car if the value is −1 (there is no station call), and outputting 0 if there is a car call or −1 and the car number if there is no car call;

the movement direction finding module 1605 receiving the value and the car number from the car call finding module 1604, the new station call data added to the station call registration device 1, and the direction data of the shaft of each car from the direction data storage device 220, outputting 0 if the value obtained by the car call finding module 1604 is 0 (there is a car call) or, if the value is −1 (there is no car call), checking if the direction into which the car will move to respond to the new station call is opposite to the direction of the shaft of the car, and outputting −1 if the direction is opposite or 0 and the car number if the direction is the same;

the shaft direction finding module 1606 receiving the value and the car number from the movement direction finding module 1605 and the number of shafts in the same direction as the direction of each shaft from the number-of-shafts detection device 230, outputting 0 if the value obtained by the movement direction finding module 1605 is 0 (same direction) or, if the value is −1 (opposite direction), checking if there is at least one other shaft moving into the same direction, and outputting 1 if there is at least one other such shaft or 0 and the car number if there is not;

the other-car finding module 1607 receiving the value and the car number from the shaft direction finding module 1606 and the shaft data of each car from the shaft data storage device 240, outputting 0 if the value obtained by the shaft direction finding module 1606 is 0 (there is no shaft in the same direction) or, if the value is −1 (there is another shaft in the same direction), checking if there is another car in the shaft of the car, and outputting the number of the other car if there is or −1 and the car number if there is not;

the other-car call finding module 1608 receiving the value, the car number, and the other car number from the other-car finding module 1607 and the car call data of each car from the call data storage device 210, outputting −1 if the value obtained by the other-car finding module 1607 is −1 (there is no other car) or 0 if the value is 0, checking if there is a station call and/or a car call when the other-car number was received, and outputting −1 if there is neither call or 0 and the car number if there is either call;

the horizontal movement finding module 1609 receiving the value and the car number from the other-car call finding module 1608, the shaft data of each car from the shaft data storage device 240, and the horizontal movement destination of the horizontally-moving car from the horizontal movement destination detection device 250, outputting 0 if the value obtained by the other-car call finding module 1608 is 0 (there is a station call or a car call in the other car) or, if the value is −1 (there is neither a station call nor a car call in the other car), checking if there is a car moving horizontally to the shaft of the car, and outputting 0 if there is such a car or −1 and the car number if there is not.

the reversing car storage module 1610 receiving the value and the car number from the horizontal movement finding module 1609 and, if the value is −1 (there is no car horizontally moving to the shaft), storing and outputting information indicating that the car is reversible;

the check finish confirming module 1611 receiving the value and the car number from the horizontal movement finding module 1609, and the car number selected by the opposite direction car selection module 1601, storing the number, and outputting −1 if all the car numbers selected by the opposite direction car selection module 1601 are stored or, if all the car numbers are not yet checked, issuing an instruction to the unchecked car selection module 1602 to cause it to check whether or not the next car may be reversed; and the reversing car specifying module 1612 receiving the identification value from the check finish confirming module 1611, the selection result from the opposite direction car selection module 1601, and the number of a reversible car from the reversing car storage module 1610, outputting 0 if the selection result is 0 (there is no car moving into the opposite direction), specifying the car as reversible and outputting the car number to the assignment instruction device 270 if the identification value is −1 (all the selected cars are checked) and the number of the reversible car was received or, if not, 0 (there is no reversible car) to the assignment instruction device 270.

In the above discussion, only the cars, each in a shaft whose direction is opposite to the direction to the new station call, are checked. This is because the reversion of a car in order to respond to a new station call is done only once in this embodiment.

[32-2. Operation of the Thirty-second Embodiment]

The thirty-second embodiment having the configuration described above performs operation as follows.

[32-2-1. Call Data Storage Processing]

The call data storage device 210 shown in FIG. 35 contains information on the floors and directions (upward call or downward call) of previously-assigned station calls and information on the floors and directions of car calls (floors at which the passengers in a car will get off), as call data, in the format shown in Table 70.

TABLE 70

| Car | ( Call Type | Floor | Direction ) |
|---|---|---|---|
| 3 | ( H | 2 | DN ) |
| 4 | ( C | 19 | UP ) |
| 5 | ( C | 9 | DN ) |

Where, H indicates a station call, C indicates a car call, UP indicates an upward direction, and DN indicates a downward direction. For example, call data of (H, 2, DN) for car 3 indicates that a downward station call requested at the second floor is assigned to car 3; similarly, call data of (C, 19, UP) for car 4 indicates that there is a passenger in car 4 who wants to get off at the nineteenth floor.

[32-2-2. Direction Data Storage Processing]

The direction data storage device 220 shown in FIG. 35 estimates the direction of the shaft in which each car is to move (upward or downward), updates direction data, and stores it in itself in the format shown in Table 71, based on information on the car positions obtained by the data detection device 2 and on call data stored in the call data storage device 210.

TABLE 71

| Shaft number | Direction |
|---|---|
| 1 | UP |
| 2 | DN |
| 3 | UP |
| 4 | DN |

[32-2-3. Number-of-Shafts Detection Processing]

The number-of-shafts detection device 230 shown in FIG. 35 detects, for each car, the number of shafts in which cars are moving into the same direction as the car, based on the information obtained from the direction data storage device 220.

This processing is performed to prevent the cars in all the shafts from moving into the same direction when there is a car whose direction cannot be reversed. This processing ensures that there is at least one shaft in which a car is moving into the direction opposite to those of cars in other shafts.

[32-2-4. Shaft Data Storage Processing]

The shaft data storage device 240 shown in FIG. 35 contains information on the floor and the shaft where each car is moving, based on the position of each car obtained from the car data detection device 2. The information is stored as shaft data.

Figure 37:
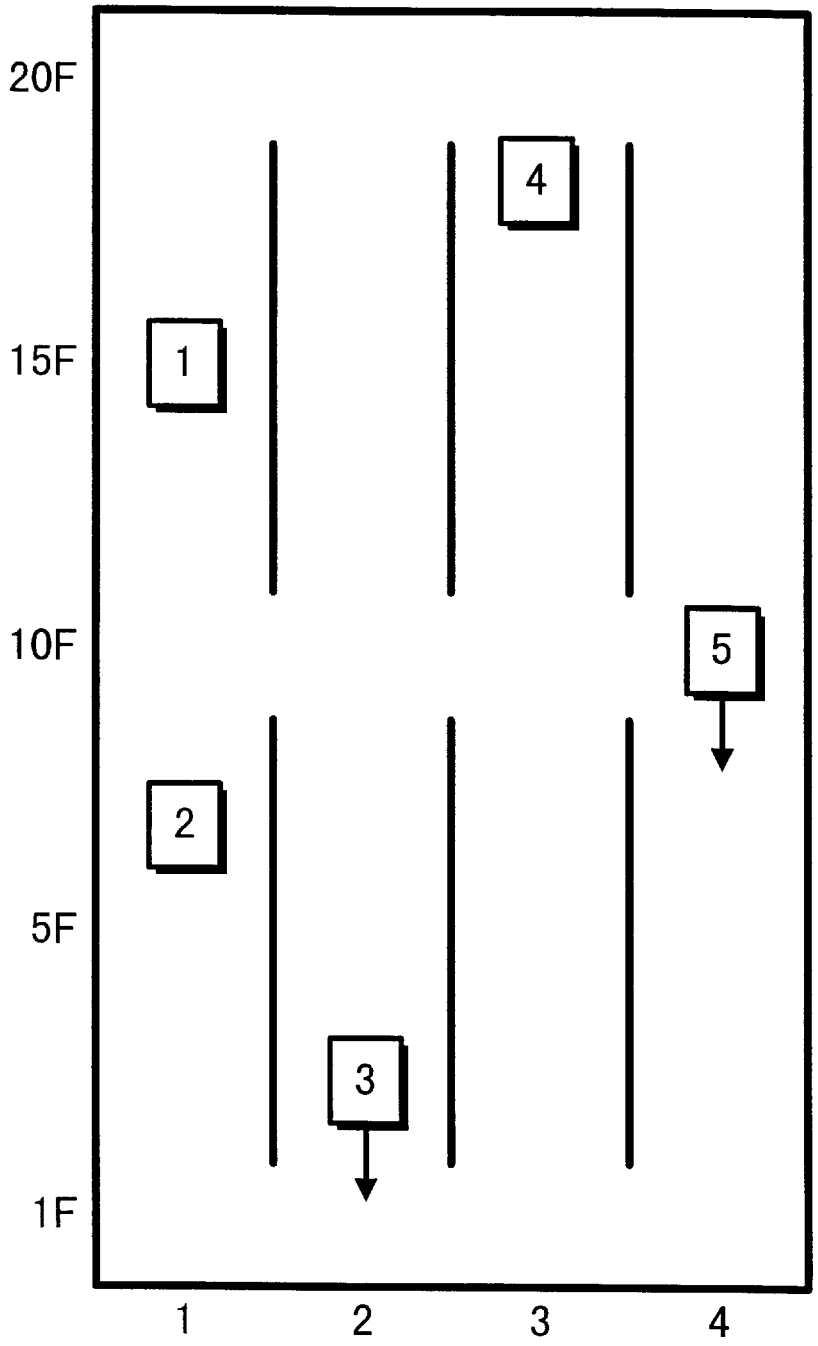
FIG. 37 is a diagram explaining the thirty-second embodiment of the elevator group management control apparatus according to this invention, and shows how each car moves.

For example, FIG. 37 shows an example of a 20-story building with four elevator shafts. This FIG. 1 shows that car 1 is at the fifteen floor and car 2 is at the seventh floor in the first shaft, car 3 is at the third floor in the second shaft, car 4 is at the eighteenth floor in the third shaft, and that car 5 is at the tenth floor in the fourth shaft. In this case, the shaft data storage device 240 contains shaft data in the format shown in Table 72.

TABLE 72

| Car | ( Floor | Shaft number ) |
|---|---|---|
| 1 | ( 15 | 1 ) |
| 2 | ( 7 | 1 ) |
| 3 | ( 3 | 2 ) |
| 4 | ( 18 | 3 ) |
| 5 | ( 10 | 4 ) |

[32-2-5. Horizontal Movement Destination Detection Processing]

For a car which moves horizontally on a horizontal movement floor, the horizontal movement destination detection device 250 shown in FIG. 35 detects the number of the shaft to which the car will move, based on the information on the position and shaft of each car obtained from the shaft data storage device 240.

For example, when car 5 moves horizontally from the fourth shaft to the third shaft, the horizontal movement destination shaft data is stored as shown in Table 73. This table indicates that the horizontal movement destination shaft number is 3. When there is no car which moves horizontally, the table contains null.

TABLE 73

| Car | (Floor | Horizontal movement destination shaft number | Current shaft number) |
|---|---|---|---|
| 5 | (10 | 3 | 4) |

[32-2-6. Reversing Car Determination Processing]

The reversing car determination device 260A shown in FIG. 35 determines a car whose direction is to be reversed in response to the new station call added to the station call registration device 1 according to the conditions shown below and then outputs the data on the determined reversing car to the assignment instruction device 270. To do so, the reversing car determination device 260A uses new station call data added to the station call registration device 1, call data of each car stored in the call data storage device 210, direction data (upward or downward) of the shaft in which each car runs obtained from the direction data storage device 220, the number of shafts in which cars are moving into the same direction as that of each car obtained from the number-of-shafts detection device 230, shaft data of the shaft in which each car runs stored in the shaft data storage device 240, and the car movement destination shaft number obtained from the horizontal movement destination detection device 250.

(A) Conditions Under Which a Reversing Car is Determined (Condition 1) The direction of the shaft of a car to be examined whether to reverse the moving direction (hereafter called a target car) is opposite to the direction of the new station call stored in the station call registration device 1. (The opposite direction car selection module 1601 evaluates this condition).

(Condition 2) The call data storage device 210 does not contain a station call for the target car. (The station call finding module 1603 evaluates this condition).

(Condition 3) The call data storage device 210 does not contain a car call for the target car. (The car call finding module 1604 evaluates this condition).

(Condition 4) The direction into which the target car must move to respond to the new station call added to the station call registration device 1 is opposite to the direction of the shaft in which the target car is moving. (The movement direction finding module 1605 evaluates this condition).

(Condition 5) There is at least one other shaft whose direction is the same as the direction of the shaft in which the target car is moving. (The shaft direction finding module 1606 evaluates this condition).

(Condition 6) There is no other car in the shaft in which the target car is moving. (The other-car finding module 1607 evaluates this condition). Or, for another car in the shaft in which the target car is moving, the call data storage device 210 contains neither station calls nor car calls. (The other-car call finding module 1608 evaluates this condition).

(Condition 7) There is no car which is moving horizontally to the shaft in which the target car is moving. (The horizontal movement finding module 1609 evaluates this condition).

(B) Reversing Car Determination Processing Flow

Figure 38:
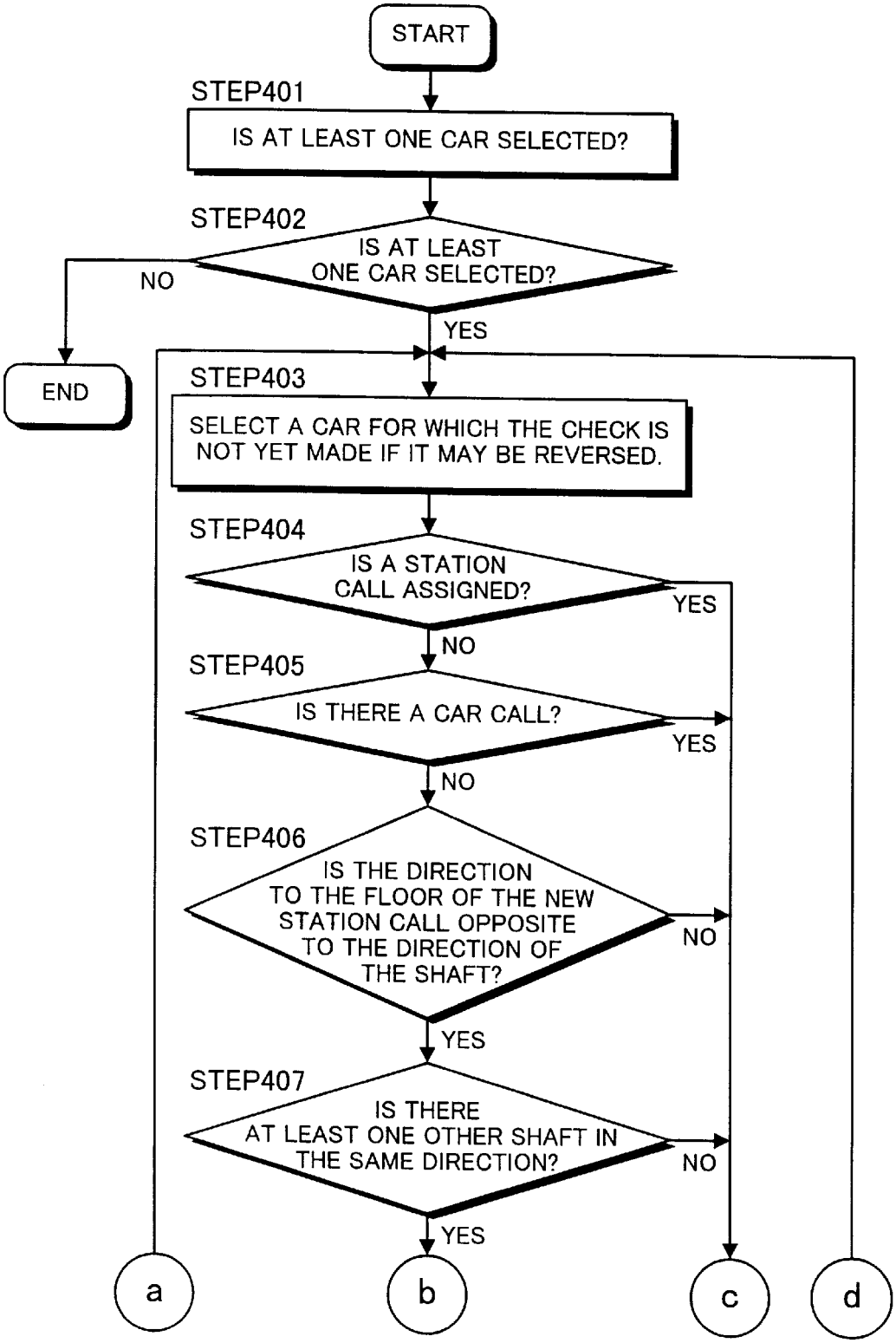
FIG. 38 is the first half of a flowchart showing the operation steps of the reversing car determination device used in the thirty-second embodiment of the elevator group management control apparatus according to this invention.
Figure 39:
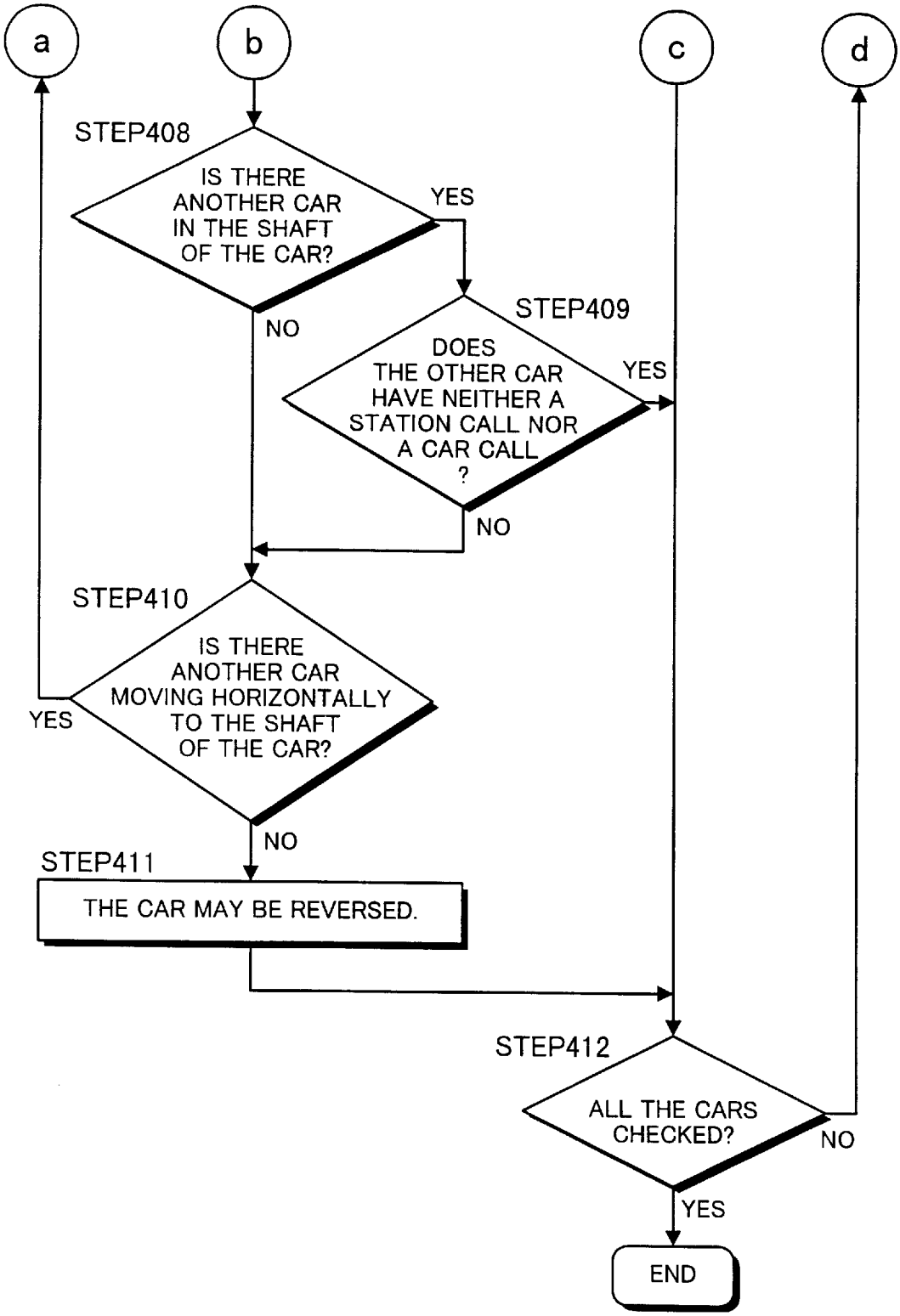
FIG. 39 is the second half of a flowchart showing the operation steps of the reversing car determination device used in the thirty-second embodiment of the elevator group management control apparatus according to this invention.

FIGS. 38 and 39 are the flowcharts showing the processing flow of the reversing car determination device 260A which works based on the conditions described in (A).

The flowcharts in FIGS. 38 and 39 show how an elevator system, such as the one shown in FIG. 37, processes call data (5, DN) added to the station call registration device 1.

That is, as shown in FIG. 37, an elevator system in a 20-story building has four elevator shafts. Assume that car 1 is at the fifteenth floor and car 2 is at the seventh floor in the first shaft, car 3 is at the third floor in the second shaft, car 4 is at the eighteenth floor in the third shaft, and that car 5 is at the tenth floor in the fourth shaft. Also assume that cars 1, 2, and 4, each in the stopped state at the respective floor, are ready to close their doors and start operation and that cars 3 and 5 are moving in their shafts.

Assume that the call data storage device 210 contains station call data (2, DN) for car 3 and car call data (19, UP) for car 4 and (9, DN) for car 5. Also assume that the direction data storage device 220 contains the direction data of the shaft in which each car runs; UP for the first shaft, DN for the second shaft, UP for the third shaft, and DN for the fourth shaft. In addition, the shaft data storage device 240 contains the shaft data which indicates the combination of the floor at which the car is moving and the shaft in which the car is moving; (15@1) for car 1, (7@1) for car 2, (3@2) for car 3, (18@3) for car 4, and (10@4) for car 5.

To determine a car whose direction is to be reversed, it is necessary to select a car satisfying all the seven conditions described above. The conditions will be described in further detail with reference to the flowcharts shown in FIGS. 38 and 39.

In step 401, the reversing car determination device uses direction data of the shafts stored in the direction data storage device 220, shaft data stored in the shaft data storage device 240, and a new station call added to the station call registration device 1 in order to select one or more cars whose direction is opposite to that of the station call added to the station call registration device 1. As a result, the device selects cars 1, 2, and 4 (In this embodiment, the opposite direction car selection module 1601 executes step 401). These cars satisfy (condition 1).

In step 403 (the unchecked car selection module 1602 executes this step), the module selects one of the cars selected in step 401 (here, assume that car 1 is selected). And, in step 404 (the station call finding module 1603 executes this step), the module checks to see if the call data storage device 210 contains station call data for car 1. It is found that there is no such station call data. This satisfies (condition 2).

Then, in step 405 (the car call finding module 1604 executes this step), the module checks the call data storage device 210 to see if there is car call data for car 1 and finds that there is no such car call data. This satisfies (condition 3).

In step 406 (the movement direction finding module 1605 executes this step), the module uses the direction data of the shafts obtained from the direction data storage device 220 and new station call data added to the station call registration device 1 to check if the direction into which car 1 will move to respond to the new station call is opposite to the direction of the shaft in which car 1 is moving and finds that the direction is opposite. This satisfies (condition 4).

Next, in step 407 (the shaft direction finding module 1606 executes this step), the module checks to see if there is at least one other shaft whose direction is the same as that of the shaft in which car 1 is moving. Because there is the third shaft (same direction as that of the first shaft), car 1 satisfies (condition 5).

In step 408 (the other-car finding module 1607 executes this step), the module checks whether or not there is another car in the shaft in which car 1 is moving and finds that there is car 2 in the first shaft. In step 409 (the other-car call finding module 1608 executes this step), the module checks the call data storage device 210 to see if there is station call data and car call data for the other car (in this case, car 2) and finds that there is neither station call nor car call. This satisfies (condition 6).

In step 410 (the horizontal movement finding module 1609 executes this step), the module uses the shaft data of the shaft in which car 1 is moving, stored in the shaft data storage device 240, and the horizontal movement destination shaft number of a car moving horizontally, stored in the horizontal movement destination detection device 250, to check to see if there is another car moving horizontally to the shaft in which car 1 is moving (first shaft) and finds that there is no such car. This satisfies (condition 7).

As a result, the target car, car 1, satisfies all seven conditions described above, and it is determined that car 1 may be reversed. (step 411).

Next, control is passed to step 412 (the check finish confirming module 1611 executes this step) to confirm that all the selected cars, 1, 2, and 4, are checked to see if they may be reversed. Because cars 2 and 4 are not yet checked, control returns to step 403.

The device checks car 2, one of the cars selected in step 403, in the same way it did for car 1. As a result, the device finds that all seven conditions are satisfied and therefore determines that car 2 may also be reversed.

The device also checks car 4, one of the cars selected in step 403, in the same way. It finds that, in step 405, that there is a car call (C, 19, UP) for car 4 and that one of the above conditions (condition 3) is not satisfied.

Therefore, it is determined that cars 1 and 2, which satisfy all seven conditions described above, may be reversed.

[32-2-7. Assignment Instruction Processing]

The assignment instruction device 270 shown in FIG. 35 uses reversing car data determined by the reversing car determination device 260A, call data consisting of the car calls and the assigned station calls of the cars stored in the call data storage device 210, new station call data added to the station call registration device 1, direction data of the shafts in which the cars are moving stored in the direction data storage device 220, and car data detected by the car data detection device 2 to determine a car to be used in response to the new station call, issues an instruction to the operation instruction device 280 to cause it to issue an operation instruction to the determined car and, at the same time, stores the station call in the call data storage device 210.

Figure 40:
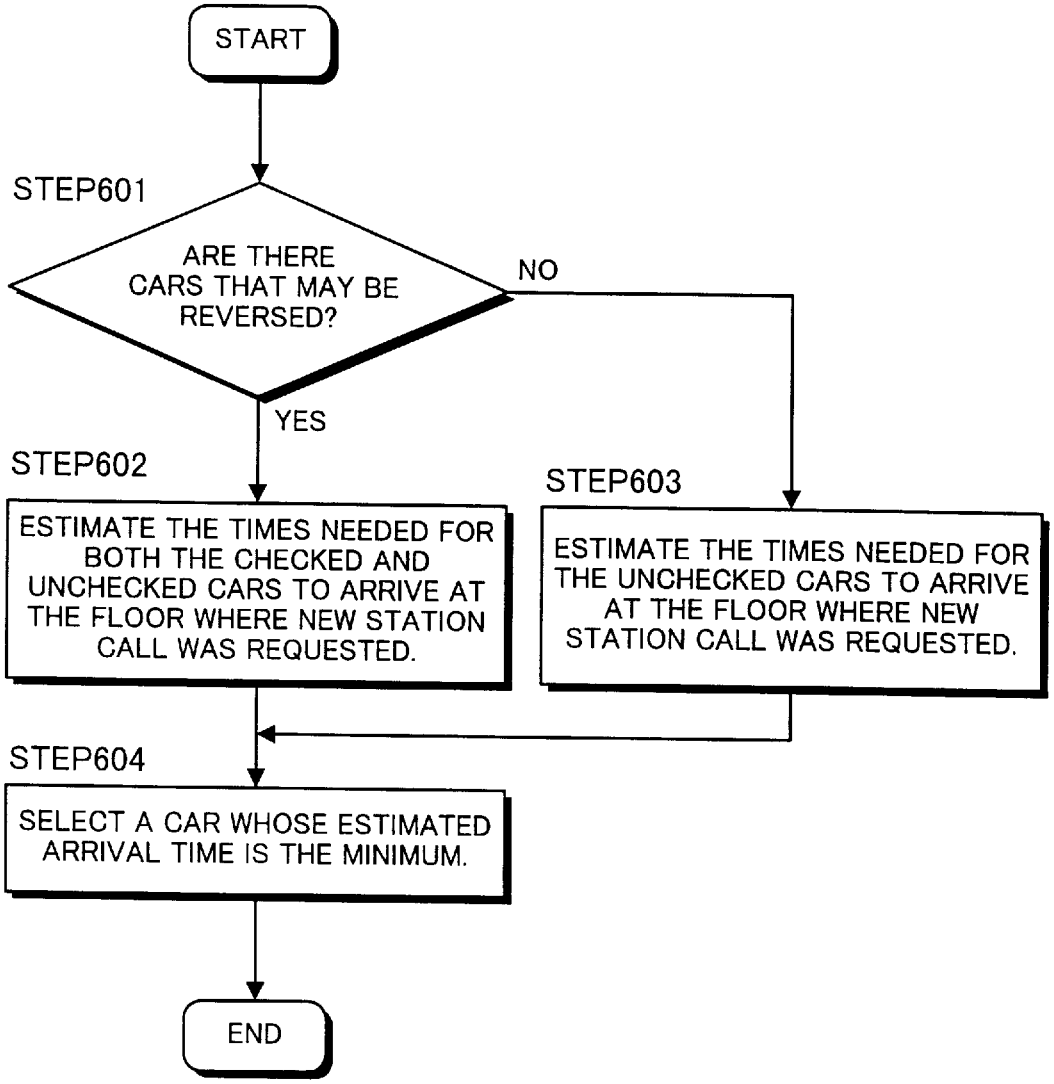
FIG. 40 is a flowchart showing the operation steps of the assignment instruction device which determines a car to respond to a new station call.

The flow of processing in the assignment instruction device 270 will be described with reference to the flowchart in FIG. 40. In step 601, the device checks to see if there are cars that may be reversed. In this embodiment, it is determined that cars 1 and 2 may be reversed. In addition, for cars 3 and 5 which were not selected in step 401 in the flowcharts in FIGS. 38 and 39, the device estimates in step 602 the time needed to respond to the new station call based on data such as call data (that is, the time needed for those cars to reach the fifth floor).

In step 604, the device selects car 2, whose arrival time is the minimum, as the car to respond to the new station call (5, DN) and outputs an instruction to the operation instruction device 280 to cause it to issue an operation instruction to car 2 and, at the same time, sends information to the call data storage device 210 indicating that the new station call (5, DN) is assigned to car 2.

The call data storage device 210 contains information in the format shown in Table 74. When Table 74 is compared with Table 70, it is understood that Table 74 has new call data for car 2.

TABLE 74

| Car | ( Call Type | Floor | Direction ) |
|---|---|---|---|
| 2 | ( H | 5 | DN ) |
| 3 | ( H | 2 | DN ) |
| 4 | ( C | 19 | UP ) |
| 5 | ( C | 9 | DN ) |

[32-2-8. Operation Instruction Processing]

The operation instruction device 280 shown in FIG. 35 outputs an operation instruction to the car which was instructed by the assignment instruction device 270 as the car to respond to the call. And, if, after the station call data of the car to be reversed has been updated to car data, the car to respond to the new station call is the one determined by the reversing car determination device 260, the operation instruction device issues another operation instruction to the car operation control device 4 to prevent the other car in the same shaft from colliding with the car to be reversed.

[32-3. Effects of the Thirty-second Embodiment]

The elevator group management control apparatus and the elevator group management control method used for the elevator group management control apparatus, shown in the thirty-second embodiment with the above configuration, have the following effects:

When determining a car to be used in response to a new station call during elevator group management control, it is possible, before responding to the new station call, to check whether or not there is a car to be reversed without considering the current direction of each shaft, and, if there is such a car, to change the operation direction of the car as necessary.

In addition, because the cars determined to be reversible are also a candidate for the response car in this system, a speedy response is made to the new station call.

[33. Thirty-third Embodiment]

This embodiment relates to an elevator group management control apparatus corresponding to claims 38 and 40 and an elevator group management control method (corresponding to claims 46 and 48) used for the elevator group management control apparatus.

[33-1. Configuration of the Thirty-third Embodiment]

This embodiment is a variation of the thirty-second embodiment with some changes in the configuration of the reversing car determination device.

A car is reversed to move to the floor in response to a new station call in the thirty-second embodiment, while in this embodiment a car arrives at the floor in response to a new station call and then it is reversed.

[33-1-1. Configuration of the Elevator Group Management Control Apparatus]

The elevator group management control apparatus 3 according to this embodiment is configured in the same manner as in the thirty-second embodiment except that the part of the configuration of the reversing car determination device is changed (see FIG. 35).

[33-1-2. Configuration of the Reversing Car Determination Device]

The configuration of the reversing car determination device 260B of the elevator group management control apparatus 3 in this embodiment will be described in further detail with reference to FIG. 41.

The reversing car determination device 260B used in this embodiment is the reversing car determination device 260A with the car call position finding module 1613 added.

That is, the car call finding module 1604 in the reversing car determination device receives the value and the car number from the station call finding module 1603 and the car call data of each car from the call data storage device 210, outputs 0 if the value detected by the station call finding module 1603 is 0 or, if the value is −1, checks if there is a car call for the car, and outputs the car call data of the car if there is a car call or outputs −1 and the car number if there is not.

The car call position finding module 1613 receives the value, the car number, and the car call data from the car call finding module 1604 and new station call data added to the station call registration device 1, outputs −1 if the value obtained by the car call finding module 1604 is −1 or outputs 0 if it is 0, when the car call data is entered, checks if the floor requested by the car call is between the current floor and the floor requested by the new station call, and outputs −1 if the car call is one of the floors to the new station call or 0 and the car number if it is not.

The movement direction finding module 1605 receives the value and the car number from the car call position finding module 1613, new station call data added to the station call registration device 1, and the direction data of the shaft of each car from the direction data storage device 220, outputs 0 if the value obtained by the car call position finding module 1613 is 0 or, if it is −1, checks if the direction to the floor where the new station call was generated is the same as the direction of the shaft of the car, and outputs −1 if the direction to that floor is the same as the direction of the shaft or outputs 0 and the car number if the direction is opposite to the direction of the shaft.

The configuration of each of the other modules, which is the same as that of the reversing car determination device 260A explained in the thirty-second embodiment, is not described here.

[33-2. Operation of the Thirty-third Embodiment]

The thirty-third embodiment having the configuration described above performs operation as described below. The following explains where the thirty-third embodiment differs from the thirty-second embodiment.

[33-2-1. Reversing Car Determination Processing]

Figure 41:
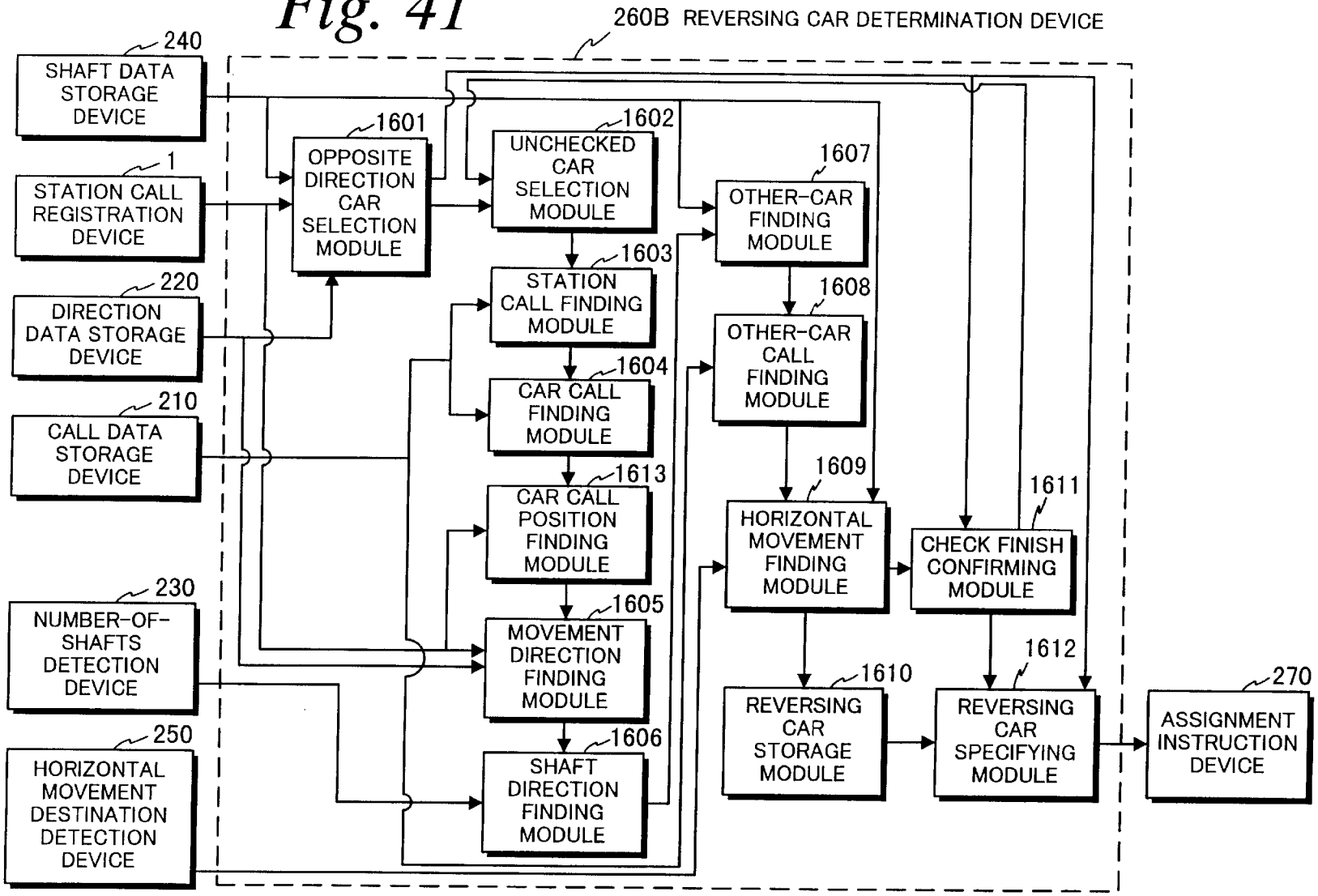
FIG. 41 is a diagram showing the configuration of the reversing car determination device used in the thirty-third embodiment of the elevator group management control apparatus according to this invention.

The reversing car determination device 260B shown in FIG. 41 uses new station call data added to the station call registration device 1, call data of each car stored in the call data storage device 210, direction data (upward and downward) of the shaft of each car obtained by the direction data storage device 220, the number of shafts in the same direction as the direction of the shaft of each car obtained by the number-of-shafts detection device 230, shaft data of each car stored in the shaft data storage device 240, and the car movement destination shaft number of a horizontally-moving car stored in the horizontal movement destination detection device 250 to determine the car to be reversed in response to the new station call added to the station call registration device 1 according to the conditions described below and to output data on the determined reversing car to the assignment instruction device 270.

(A) Conditions Under Which a Reversing Car is Determined (Condition 1) The direction of the shaft of the target car is opposite to the direction of the new station call stored in the station call registration device 1. (The opposite direction car selection module 1601 evaluates this condition). ( Condition 2) The call data storage device 210 does not contain a station call for the target car. (The station call finding module 1603 evaluates this condition).

(Condition 3) The call data storage device 210 does not contain a car call for the target car. (The car call finding module 1604 evaluates this condition). Or, the car call stored in the call data storage device 210 requests a floor on the way to the newly-added station call. (The car call position finding module 1613 evaluates this condition).

(Condition 4) The direction into which the target car must move to respond to the new station call added to the station call registration device 1 is the same as the direction of the shaft in which the target car is moving. (The movement direction finding module 1605 evaluates this condition).

(Condition 5) There is at least one other shaft whose direction is the same as the direction of the shaft in which the target car is moving. (The shaft direction finding module 1606 evaluates this condition).

(Condition 6) There is no other car in the shaft in which the target car is moving. (The other-car finding module 1607 evaluates this condition). Or, for another car in the shaft in which the target car is moving, the call data storage device 210 contains neither station calls nor car calls. (The other-car call finding module 1608 evaluates this condition).

(Condition 7) There is no car which is moving horizontally to the shaft in which the target car is moving. (The horizontal movement finding module 1609 evaluates this condition).

(B) Reversing Car Determination Processing Flow

Figure 42:
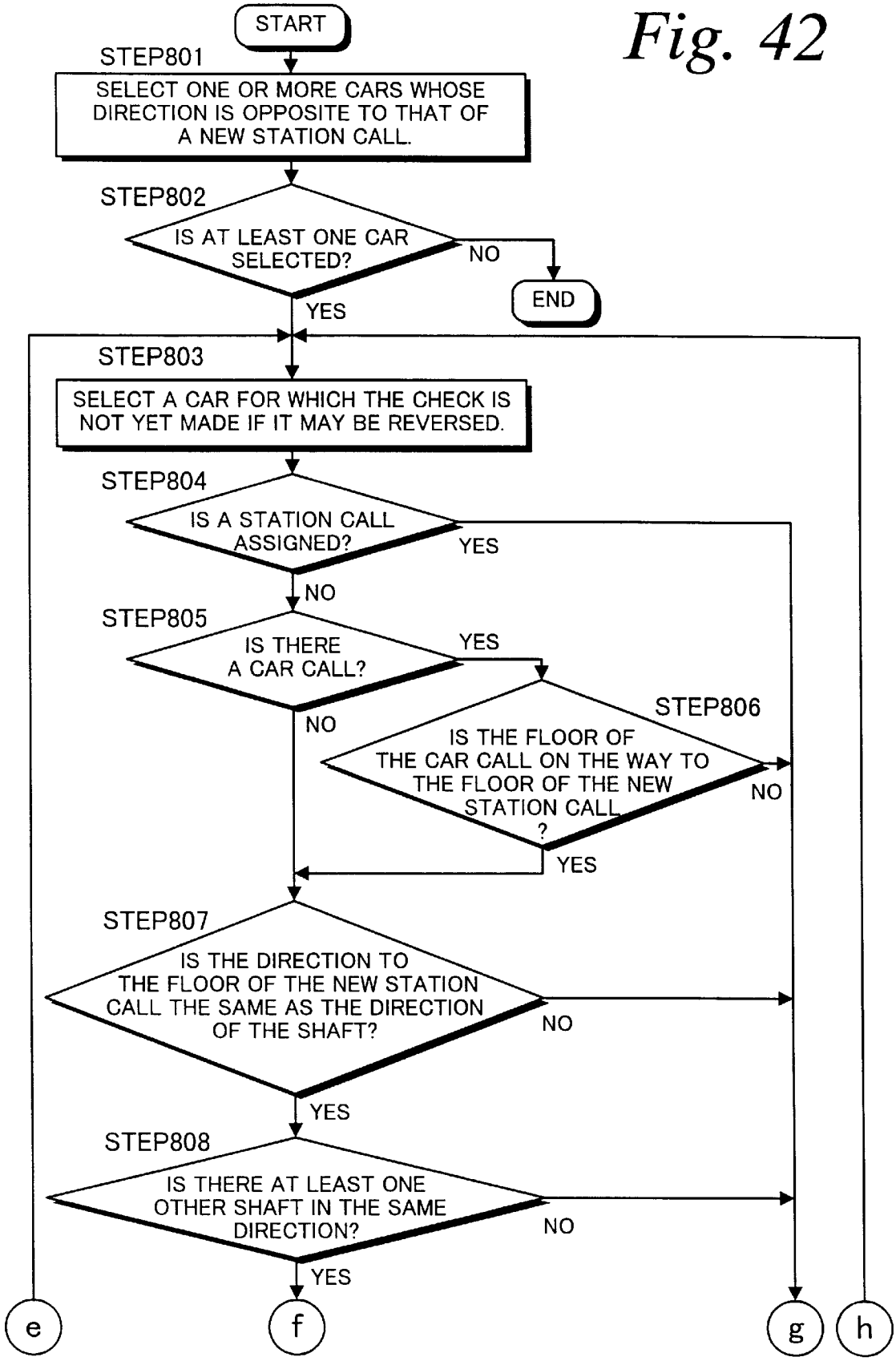
FIG. 42 is the first half of a flowchart showing the operation steps of the reversing car determination device used in the thirty-third embodiment of the elevator group management control apparatus according to this invention.
Figure 43:
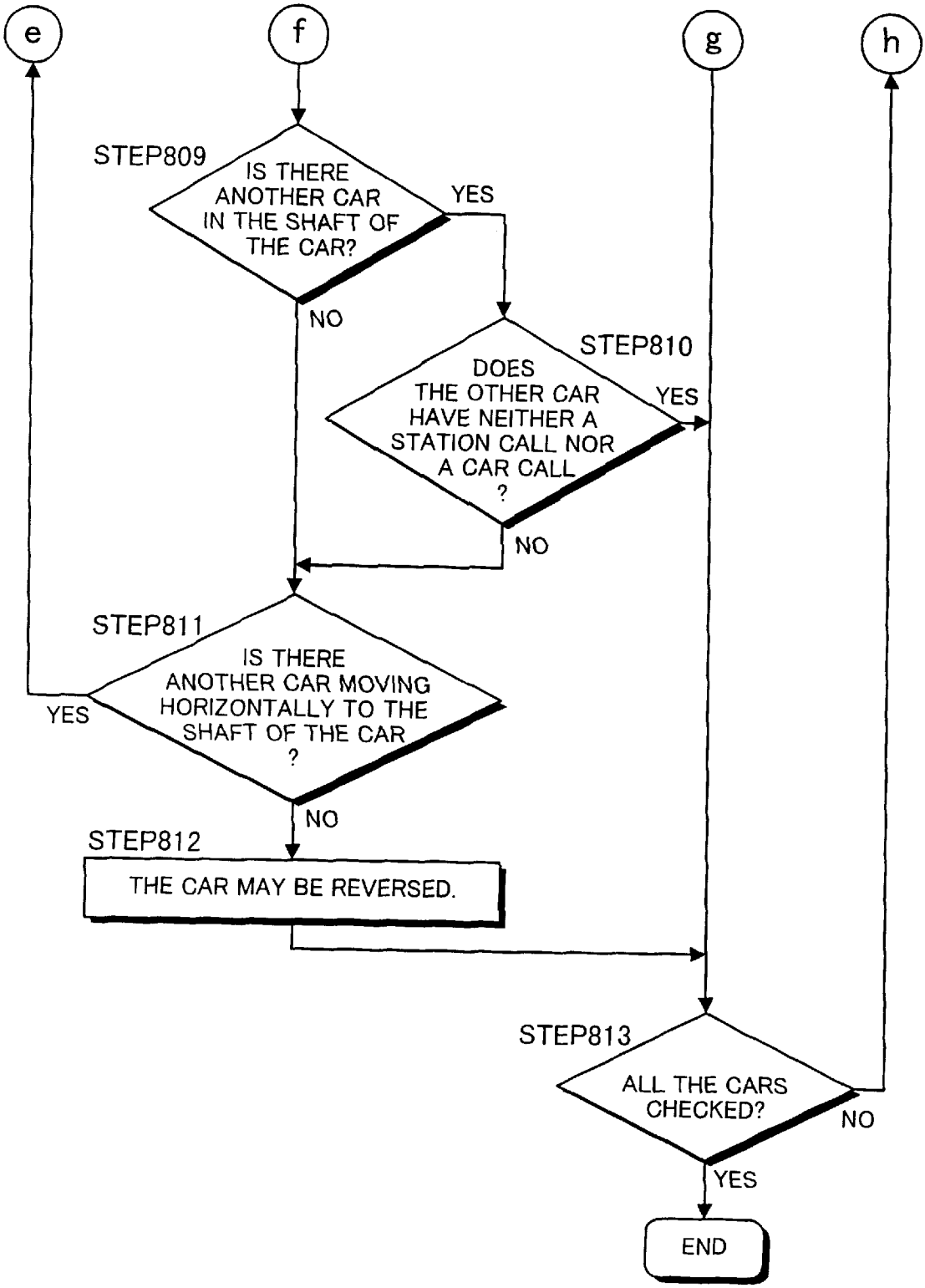
FIG. 43 is the second half of a flowchart showing the operation steps of the reversing car determination device used in the thirty-third embodiment of the elevator group management control apparatus according to this invention.

FIGS. 42 and 43 are the flowcharts showing the processing flow of the reversing car determination device 260B which works based on the conditions described in (A).

The flowcharts in FIGS. 42 and 43 show how an elevator system, such as the one shown in FIG. 37, processes call data (4, UP) added to the station call registration device 1.

That is, as shown in FIG. 37, an elevator system in a 20-story building has four elevator shafts. Assume that car 1 is at the fifteenth floor and car 2 is at the seventh floor in the first shaft, car 3 is at the third floor in the second shaft, car 4 is at the eighteenth floor in the third shaft, and that car 5 is at the tenth floor in the fourth shaft. Also assume that cars 1, 2, and 4, each in the stopped state at the respective floor, are ready to close their doors and start operation and that cars 3 and 5 are moving in their shafts.

Assume that the call data storage device 210 contains station call data (2, DN) for car 3 and car call data (19, UP) for car 4 and (9, DN) for car 5. Also assume that the direction data storage device 220 contains the direction data of the shaft in which each car runs; UP for the first shaft, DN for the second shaft, UP for the third shaft, and DN for the fourth shaft. In addition, the shaft data storage device 240 contains the shaft data which indicates the combination of the floor at which the car is moving and the shaft in which the car is moving; (15@1) for car 1, (7@1) for car 2, (3@2) for car 3, (18@3) for car 4, and (10@4) for car 5.

To determine a car whose direction is to be reversed, it is necessary to select a car satisfying all the seven conditions described above. The conditions will be described in further detail with reference to the flowcharts shown in FIGS. 42 and 43.

In step 801 (the opposite direction car selection module 1601 executes this step), the reversing car determination device uses direction data of the shafts stored in the direction data storage device 220, shaft data stored in the shaft data storage device 240, and a new station call added to the station call registration device 1 in order to select one or more cars whose direction is opposite to that of the station call added to the station call registration device 1. As a result, the device selects cars 3 and 5. These cars satisfy (condition 1).

In step 803 (the unchecked car selection module 1602 executes this step), the module selects one of the cars selected in step 801 (here, assume that car 3 is selected). And, in step 804 (the station call finding module 1603 executes this step), the module checks to see if the call data storage device 210 contains station call data for car 3 and finds that there is station call data (H, 2, DN). This does not satisfy (condition 2). Therefore, it is determined that car 3 may not be reversed.

Next, in step 813 (the check finish confirming module 1611 executes this step), the module checks to see if all the selected cars, 3 and 5, are checked. Because car 5 is not yet checked, control goes back to step 803.

The check is made for car 5, one of the cars selected in step 803, in the same way the check was made for car 3.

In step 804 (the station call finding module 1603 executes this step), the module checks to see if the call data storage device 210 contains station call data for car 5 and finds that there is no station call data. This satisfies (condition 2).

Then, in step 805 (the car call finding module 1604 executes this step), the module checks the call data storage device 210 to see if there is car call data for car 5 and finds that there is car call data (C, 9, DN). In step 806 (the car call position finding module 1613 executes this step), the module finds that the car call requests a floor on the way to the fourth floor requested by the new station call. This satisfies (condition 3).

In step 807 (the movement direction finding module 1605 executes this step), the module uses the direction data of the shafts obtained from the direction data storage device 220 and new station call data added to the station call registration device 1 to check if the direction (downward in this case) into which car 5 will move to respond to the new station call (4, UP) is same as the direction of the shaft in which car 5 is moving and finds that the direction is the same. This satisfies (condition 4).

Next, in step 808 (the shaft direction finding module 1606 executes this step), the module checks to see if there is at least one other shaft whose direction is the same as that of the shaft in which car 5 is moving. Because there is the second shaft (same direction as that of the fourth shaft), car 5 satisfies (condition 5).

In step 809 (the other-car finding module 1607 executes this step), the module checks whether or not there is another car in the shaft in which car 5 is moving and finds that there is no other car in the fourth shaft. This satisfies (condition 6).

In step 811 (the horizontal movement finding module 1609 executes this step), the module uses the shaft data of the shaft in which car 5 is moving, stored in the shaft data storage device 240, and the horizontal movement destination shaft number of a car moving horizontally, stored in the horizontal movement destination detection device 250, to check to see if there is another car moving horizontally to the shaft in which car 5 is moving (fourth shaft), and finds that there is no such car. This satisfies (condition 7).

As a result, the target car, car 5, satisfies all seven conditions described above, and it is determined that car 5 may be reversed. (step 812)

[33-2-2. Assignment Instruction Processing]

The flow of processing in the assignment instruction device 270 will be described with reference to the flowchart in FIG. 40. In step 601, the device checks to see if there are cars that may be reversed. In this embodiment, it is determined that car 5 may be reversed. In addition, for cars 1, 2, and 4 which were not selected in step 801 in the flowcharts in FIGS. 42 and 43, the device estimates in step 602 the time needed to respond to the station call based on data including call data (that is, the time needed for those cars to reach the fourth floor).

In step 604, the device selects car 5, whose arrival time is the minimum, as the car to respond to the new station call (4, UP) and outputs an instruction to the operation instruction device 280 to cause it to issue an operation instruction to car 5 and, at the same time, sends information to the call data storage device 210 indicating that the new station call (4, UP) is assigned to car 5.

The call data storage device 210 contains information in the format shown in Table 75. When Table 75 is compared with Table 70, it is understood that Table 75 has new call data for car 5.

TABLE 75

| Car | ( Call Type | Floor | Direction ) |
|---|---|---|---|
| 3 | ( H | 2 | DN ) |
| 4 | ( C | 19 | UP ) |
| 5 | ( C | 9 | DN ) |
| | ( H | 4 | UP ) |

[33-3. Effects of the Thirty-third Embodiment]

The elevator group management control apparatus and the elevator group management control method used for the elevator group management control apparatus, shown in the thirty-third embodiment with the above configuration, have the following effects:

When determining a car to be used in response to a new station call during elevator group management control, it is possible, after responding to the new station call, to check whether or not there is a car to be reversed without considering the current direction of each shaft and, if there is such a car, to change the operation direction of the car as In addition, because the cars determined to be reversible are also a candidate for the response car in this system, a speedy response is made to a new station call.

[34. Thirty-fourth Embodiment]

This embodiment relates to an elevator group management control apparatus corresponding to claims 41 and 42 and an elevator group management control method (corresponding to claims 49 and 50) used for the elevator group management control apparatus.

[34-1. Configuration of the Thirty-fourth Embodiment]

This embodiment relates to an elevator group management control apparatus 3 for use in an elevator system comprising a car operation control device 4 controlling the operation of a plurality of vertically- and horizontally-movable cars, a car data detection device 2 detecting the state of each of said cars (for example, position, speed, and load), and one or more station call registration devices 1 installed in the station of each floor.

[34-1-1. Configuration of the Elevator Group Management Control Apparatus]

Figure 44:
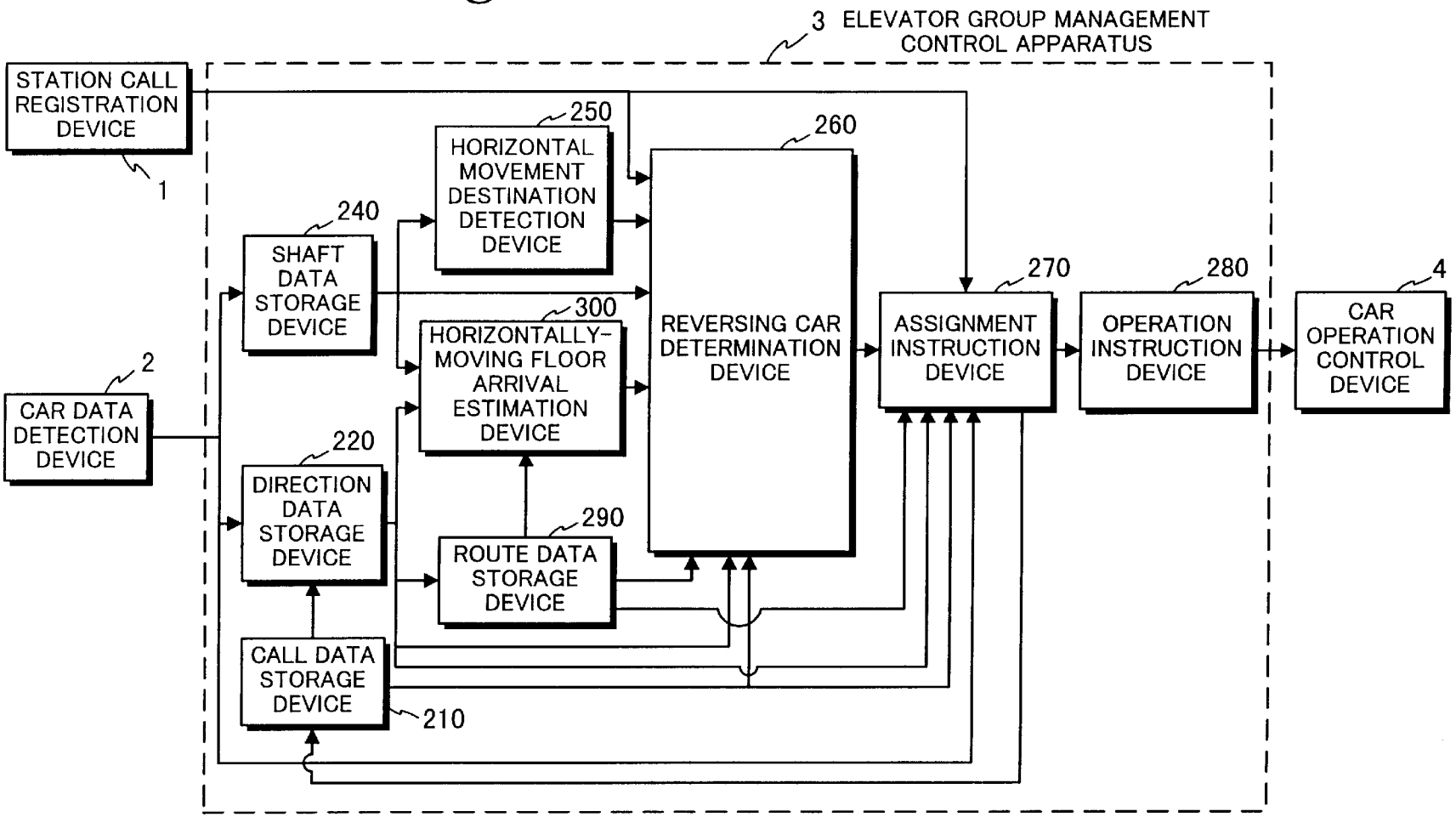
FIG. 44 is a diagram showing the configuration of the thirty-fourth embodiment of the elevator group management control apparatus according to this invention.

The elevator group management control apparatus 3 used in this embodiment comprises the devices shown in FIG. 44.

That is, the elevator group management control apparatus comprises:

the call data storage device 210 containing call data consisting of car calls requested by the passengers in the cars and station calls assigned to each car;

the direction data storage device 220 receiving car data from the car data detection device 2 and call data from the call data storage device 210, estimating the direction of the shaft of each of the cars, and updating and storing resulting data as direction data;

the shaft data storage device 240 receiving car data detected by the car data detection device 2, estimating the floor and the shaft of each of the cars, and storing resulting data about estimated floors and shafts as shaft data;

the route data storage device 290 receiving the direction data of the shaft of each car from the direction data storage device 220 and storing information on a route along which each car should run;

the horizontally-moving floor arrival estimation device 300 receiving the direction data of the shaft of each car from the direction data storage device 220, the shaft data of each car from the shaft data storage device 240, and the route data of a route along which each car should move from the route data storage device 290, estimating a car arriving at the horizontally-moving floor of each shaft first, and outputting the car number;

the horizontal movement destination detection device 250 receiving the shaft data of each car from the shaft data storage device 240, checking if there is a car moving horizontally and, if there is, finding the horizontal movement destination shaft of the car;

the reversing car determination device 260C receiving new station call data from the station call registration device 1, call data from the call data storage device 210, direction data of each of the cars from the direction data storage device 220, shaft data of each of the cars from the shaft data storage device 240, route data representing a route along which each car moves from the route data storage device 290, the number of the car arriving at the horizontally-moving floor first estimated by the horizontally-moving floor arrival estimation device 300, and the number of a car moving horizontally and the number of the shaft to which the car is moving detected by the horizontal movement destination detection device 250, and determining a car to be reversed in order to respond to a new station call added to the station call registration device 1;

the assignment instruction device 270 receiving reversing car data determined by the reversing car determination device 260C, call data of each of the cars from the call data storage device 210, new station call data added to the station call registration device 1, direction data of each of the cars from the direction data storage device 220, car data detected by the car data detection device 2, and route data representing a route along which each car runs from the route data storage device 290, and determining a response car to respond to a new station call and, at the same time, storing information on the call in call data storage device 210; and the operation instruction device 280 issuing an operation instruction to the car determined by the assignment instruction device 270 and, if the car is the one determined by the reversing car determination device 260C, issuing another operation instruction to the other car in the shaft of the response car, in order to prevent collision of each cars;

[34-1-2. Configuration of the Reversing Car Determination Device]

Figure 45:
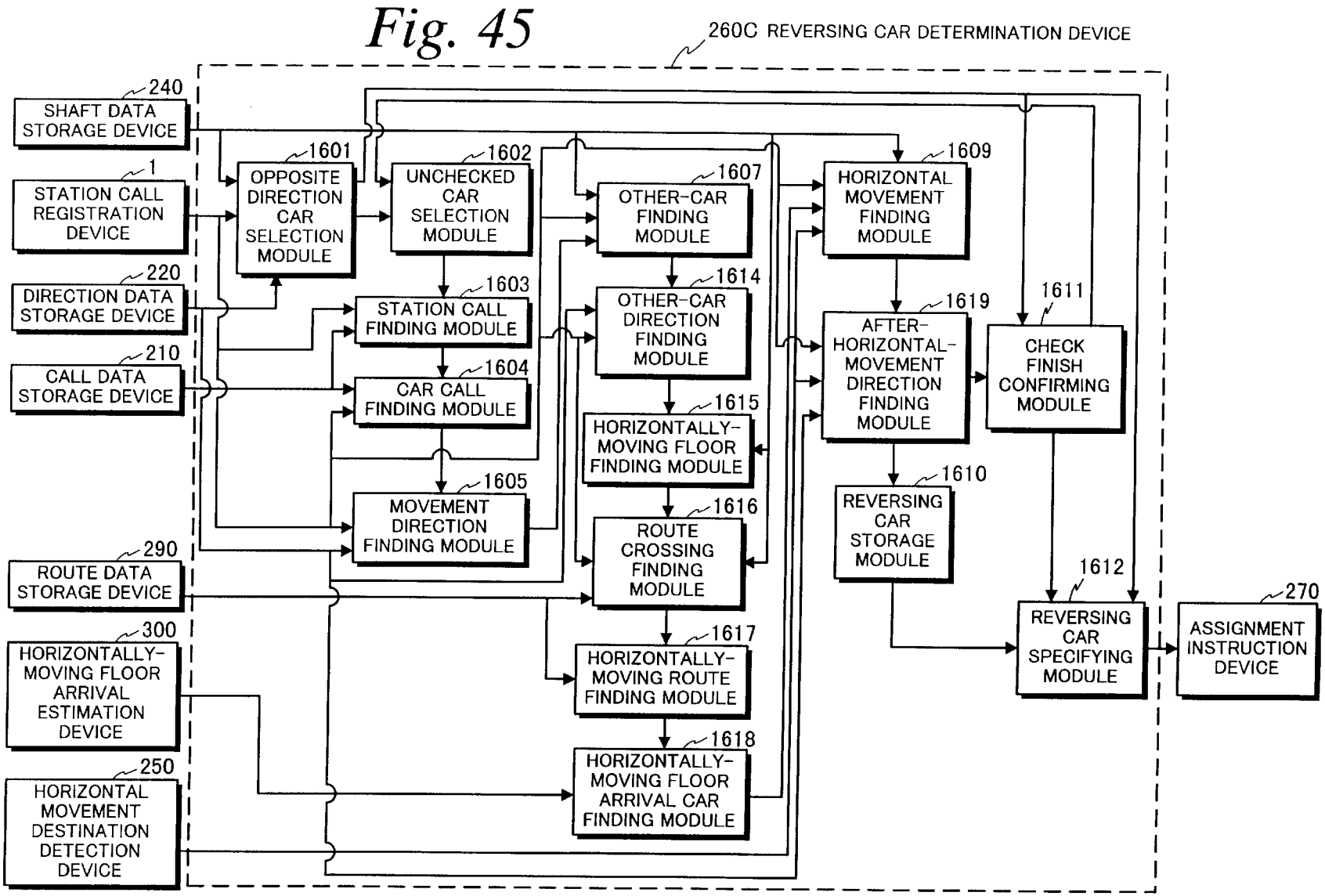
FIG. 45 is a diagram showing the configuration of the reversing car determination device used in the thirty-fourth embodiment of the elevator group management control apparatus according to this invention.
Figure 46:
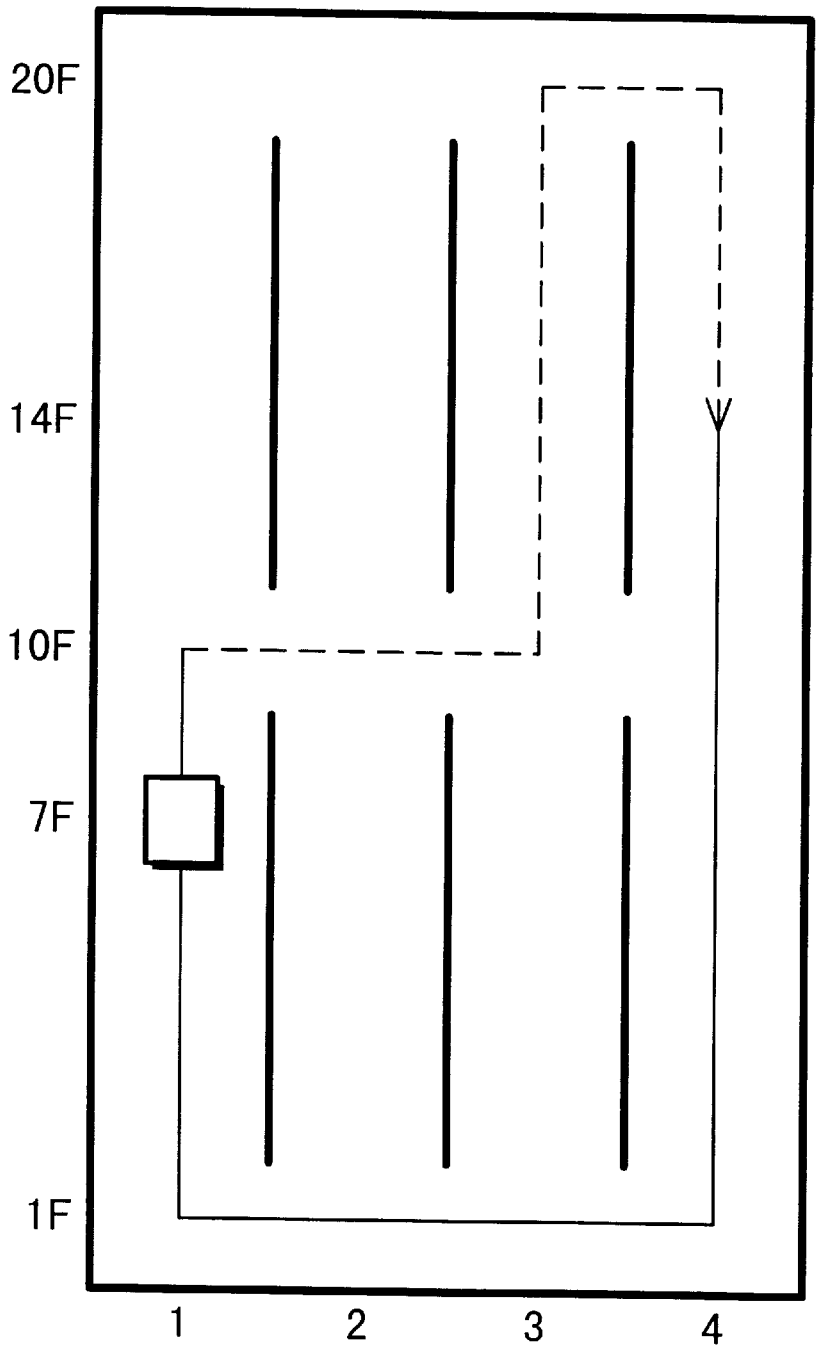
FIG. 46 is a diagram explaining the thirty-fourth embodiment of the elevator group management control apparatus according to this invention, and shows an example of route data stored in the route data storage device.

The configuration of the reversing car determination device 260C of the elevator group management control apparatus 3 will be described in further detail with reference to FIG. 45.

The reversing car determination device 260C comprises:

the opposite direction car selection module 1601 receiving shaft data of each car from the shaft data storage device 240, direction data of the shaft of each car from the direction data storage device 220, and new station call data added to the station call registration device 1, selecting the cars in the shafts moving in the direction opposite to the direction to respond to the new station call and, if there is no such car, outputting 0;

the unchecked car selection module 1602 receiving the number of a car whose direction is opposite to the direction to the floor were the new station call is generated, selecting from the cars selected by said opposite direction car selection module 1601 a car not yet checked if it is eligible for a reversing car, one at a time, and outputting the number of the car;

the station call finding module 1603 receiving the number of the car selected by the unchecked car selection module 1602, the station call data of each car from the call data storage device 210, and new station call data added to the station call registration device 1, checking if there is a station call whose direction is opposite to the direction to the new station call, and outputting 0 if there is such a station call or −1 if there is no such station call;

the car call finding module 1604 receiving the value and the car number from the station call finding module 1603, the car call data of each car from the call data storage device 210, and new station call data added to the station call registration device 1, outputting 0 if the value obtained by the station call finding module 1603 is 0 or, if the value is −1, checking if there is a car call in the direction opposite to the direction to the floor requested by the new station call, and outputting 0 if there is such a car call or −1 and the car number if there is no such car call;

the movement direction finding module 1605 receiving the value and the car number from the car call finding module 1604, new station call data added to the station call registration device 1, and the direction data of the shaft of each car from the direction data storage device 220, outputting 0 if the value obtained by the car call finding module 1604 is 0 or, if the value is −1, checking if the direction into which the car will move to respond to the new station call is opposite to the direction of the shaft of the car, and outputting −1 if the direction is opposite or, if the direction is the same, 0 and the car number;

the other-car finding module 1607 receiving the value and the car number from the movement direction finding module 1605, new station call data added to the station call registration device 1, and the shaft data of each car from the shaft data storage device 240, outputting 0 if the value obtained by the movement direction finding module 1605 is 0 or, if the value is −1, checking if, in the shaft of the car, there is another car at a floor in the direction of the new station call, and outputting the number of the other car if there is such a car or −1 and the number of the car if there is no such car;

the other-car direction finding module 1614 receiving the value or the number of the other car and the number of the car from the other-car finding module 1607, new station call data added to the station call registration device 1, and the direction data of the shaft of each car from the direction data storage device 220, outputting −1 if the value obtained by the other-car finding module 1607 is −1 or outputting 0 if it is 0, checking if, when the number of the other car is entered, the other car is in the direction of the new station call, and outputting −1 if the direction is the same or the number of the other car as well as the number of the car if the direction is opposite;

the horizontally-moving floor finding module 1615 receiving the value or the number of the other car and the number of the car from the other-car direction finding module 1614 and the shaft data of the shaft of each car stored in the shaft data storage device 240, outputting −1 if the value obtained by the other-car direction finding module 1614 is −1 or 0 it is 0, checking if, when the number of the other car is entered, there is a horizontally-moving floor between the car and the other car, and outputting the number of the other car and horizontally-moving floor data if there is such a horizontally-moving floor or 0 and the number of the car if there is no such horizontally-moving floor;

the route crossing finding module 1616 receiving the value or the number of the other car, horizontally-moving floor data, and the number of the car from the horizontally-moving floor finding module 1615, route data representing a route along which the car should move from the route data storage device 290, shaft data from the shaft data storage device 240, and new station call data added to the station call registration device 1, outputting −1 if the value obtained by the horizontally-moving floor finding module 1615 is −1 or outputting 0 if it is 0, checking if, when the number of the other car is entered, the route to the floor where the new station call was generated and the route along which the other car will move cross each other, and outputting the number of the other car and horizontally-moving floor data if they cross or outputting 0 and the number of the car if they do not;

the horizontally-moving route finding module 1617 receiving the value or the number of the other car, horizontally-moving floor data, and the number of the car from the route crossing finding module 1616 and route data representing a route along which the car will move from the route data storage device 290, outputting −1 if the value obtained by the route crossing finding module 1616 is −1 or outputting 0 if it is 0, checking if, when the number of the other car is entered, the other car moves horizontally on the horizontally-moving floor, and outputting the number of the other car and horizontally-moving floor data if the other car moves horizontally on the horizontally-moving floor or outputting 0 and the number of the car if it does not;

the horizontally-moving floor arrival car finding module 1618 receiving the value or the number of the other car, horizontally-moving floor data, and the number of the car from the horizontally-moving route finding module 1617 and the number of the car arriving first at each horizontally-moving floor estimated by the horizontally-moving floor arrival estimation device 300, outputting −1 if the value obtained by the horizontally-moving route finding module 1617 is −1 or outputting 0 if it is 0, finding the car arriving at the horizontally-moving floor first when the number of the other car is entered, and outputting −1 if that car is the other car or outputting 0 and the number of the car if it is not;

the horizontal movement finding module 1609 receiving the value and the number of the car from the horizontally-moving floor arrival car finding module 1618, new station call data added to the station call registration device 1, the shaft data of each car from the shaft data storage device 240, and the destination of a horizontally-moving car detected by the horizontal movement destination detection device 250, outputting 0 if the value obtained by the horizontally-moving floor arrival car finding module 1618 is 0 or, if it is −1, checking if there is another car moving horizontally to the route along which the car will move to respond to the new station call, and, if there is such a horizontally-moving car, outputting the number of the other car or outputting −1 and the number of the car if there is no such horizontally-moving car;

the after-horizontal-movement direction finding module 1619 receiving the value and the number of the car from the horizontal movement finding module 1609, new station call data added to the station call registration device 1, the direction data of the shaft of each car from the direction data storage device 220, and the destination of the horizontally-moving car detected by the horizontal movement destination detection device 250, outputting 0 if the value obtained by the horizontal movement finding module 1609 is 0 or outputting −1 if it is −1, checking if, when the number of the other car is entered, the direction of the other car after horizontal movement is the same as the direction to the floor requested by the new station call, and outputting −1 if the direction is the same or 0 if the direction is opposite;

the reversing car storage module 1610 receiving the value and the number of the car from the after-horizontal-movement direction finding module 1619 and, if the value is −1, determining the car as reversible, and outputting that information;

the check finish confirming module 1611 receiving the value and the number of the car from the after-horizontal-movement direction finding module 1619 and the number of a car selected by the opposite direction car selection module 1601, storing the number of the car, outputting −1 if all the numbers of cars selected by the opposite direction car selection module 1601 are stored or, if all the selected numbers are not yet stored, outputting information to the unchecked car selection module 1602 to cause it to check a car, not yet stored, if it is eligible for a reversing car; and the reversing car specifying module 1612 receiving the identification value from the check finish confirming module 1611, the selection result from the opposite direction car selection module 1601, and the number of a reversible car from the reversing car storage module 1610, outputting 0 if the selection result is 0, and specifying the car as a reversible car and outputting the car number to the assignment instruction device 270 if the identification value is −1 and if the number of a reversible car is stored and, if not, outputting 0 to the assignment instruction device 270.

[34-2. Operation of the Thirty-fourth Embodiment]

The thirty-fourth embodiment having the configuration described above performs operation described below. The following explains direction data storage processing, route data storage processing, horizontally-moving floor arrival estimation processing, and reversing car determination processing which are different from those in the thirty-second embodiment or thirty-third embodiment.

[34-2-1. Direction Data Storage Processing]

The direction data storage device 220 shown in FIG. 44 gets car data from the car data detection device 2, and call data from the call data storage device 210, estimates the direction (upward and downward) of the shaft of each car, updates direction data as necessary, and stores it in the format shown in Table 76.

TABLE 76

| Car | Shaft number | Direction |
|---|---|---|
| 1 | 1 | UP |
| | 2 | DN |
| | 3 | UP |
| | 4 | DN |
| 2 | 1 | UP |
| | 2 | UP |
| | 3 | UP |
| | 4 | DN |
| 3 | 1 | DN |
| | 2 | DN |
| | 3 | UP |
| | 4 | UP |
| 4 | 1 | UP |
| | 2 | DN |
| | 3 | UP |
| | 4 | DN |
| 5 | 1 | DN |
| | 2 | DN |
| | 3 | UP |
| | 4 | DN |

[34-2-2. Route Data Storage Processing]

The route data storage device 290 shown in FIG. 44 contains route data along which each car should move according to the direction of the shaft of each car obtained from the direction data storage device 220.

For example, one way for the car at the seventh floor in the first shaft in a 20-story building with four shafts to respond to a downward station call generated on the fourteenth floor is to go up to the tenth floor in the first shaft, move horizontally to the third shaft on the tenth floor, go up to the twentieth floor in the third shaft, move horizontally to the fourth shaft on the twentieth floor, and then go down to the fourteenth floor in the fourth shaft, as shown by the dotted line.

Figure 47:
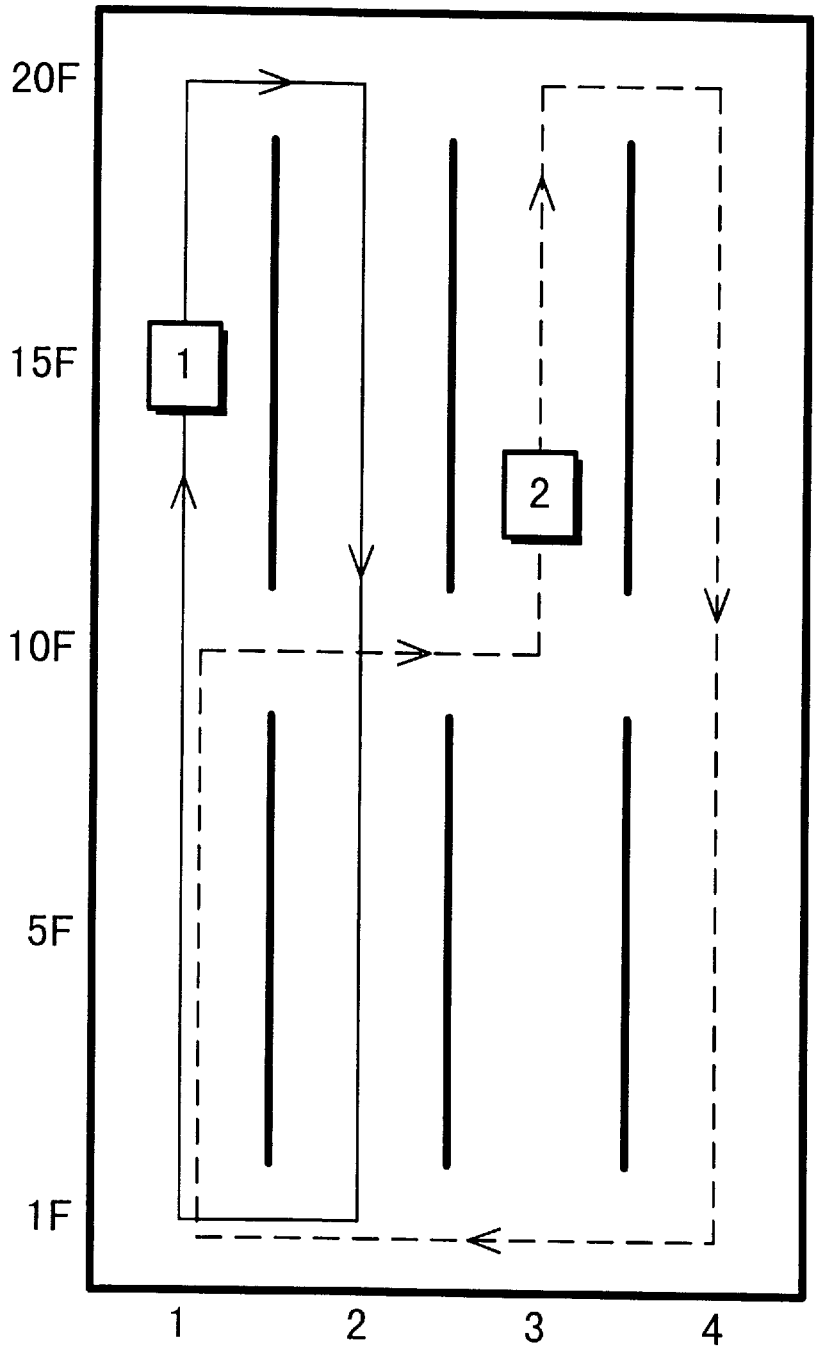
FIG. 47 is a diagram showing an example of route data of car 1 and car 2 stored in the route data storage device.
Figure 48:
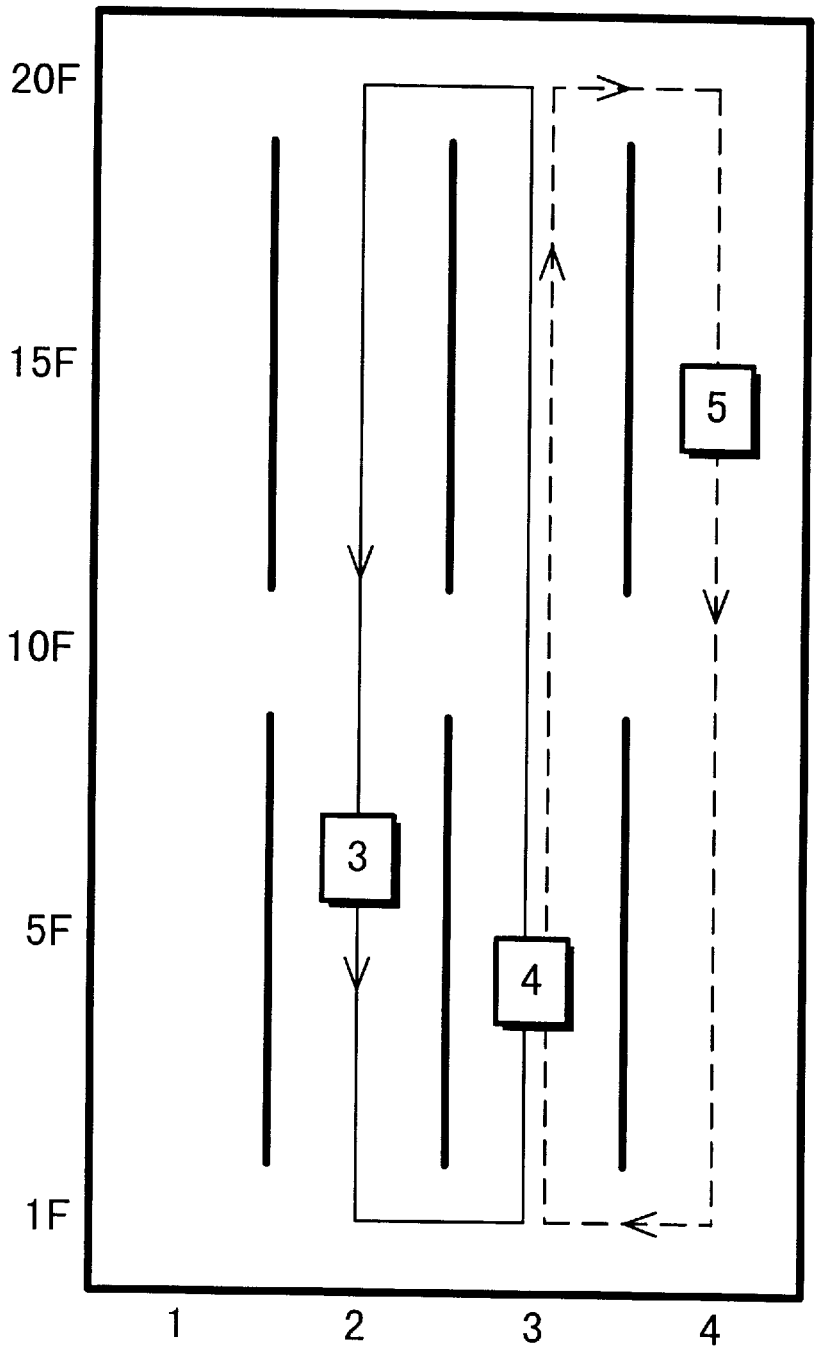
FIG. 48 is a diagram showing an example of route data of car 3, car 4, and car 5 stored in the route data storage device.

A route along which each car should run, pre-defined for each car as in the above example, is stored as route data in the format shown in Table 77. For example, the route data for car 1 indicates that the horizontally-moving floors are the first and twentieth floors: car 1 moves from the second shaft to the first shaft on the first floor, and from the first shaft to the second shaft on the twentieth floor. FIGS. 47 and 48 illustrate the route data shown in Table 77.

TABLE 77

| Car | ( Transverse Floor | Transverse Shaft ) |
|---|---|---|
| 1 | ( 1 | 12 ) |
| | ( 20 | 21 ) |
| 2 | ( 1 | 1234 ) |
| | ( 10 | 321 ) |
| | ( 20 | 43 ) |
| 3 | ( 1 | 32 ) |
| | ( 20 | 23 ) |
| 4 | ( 1 | 34 ) |
| | ( 20 | 43 ) |
| 5 | ( 1 | 34 ) |
| | ( 20 | 43 ) |

[34-2-3. Horizontally-Moving Floor Arrival Estimate Processing]

The horizontally-moving floor arrival estimation device 300 shown in FIG. 44 uses the direction data of the shaft of each car stored in the direction storage device 220, the shaft data of the shaft of each car stored in the shaft data storage device 240, and the route data representing a route along which each car should move stored in the route data storage device 290, estimates a car which arrives the horizontally-moving floor of each shaft first, and outputs the car data to the reversing car determination device 260.

[34-2-4. Reversing Car Determination Processing]

The reversing car determination device 260C shown in FIG. 44 uses new station call data added to the station call registration device 1, the call data of each car stored in the call data storage device 210, direction data (upward or downward) of each of the cars stored in the direction data storage device 220, shaft data of each of the cars stored in the shaft data storage device 240, route data representing a route along which each car should move stored in the route data storage device 290, the car data on the car arriving at the horizontally-moving floor first estimated by the horizontally-moving floor arrival estimation device 300, and the number of the shaft to which a car is moving horizontally detected by the horizontal movement destination detection device 250, determines a car to be reversed, according to the following conditions, in order to respond to a new station call added to the station call registration device 1, and outputs data on the car to be reversed to the assignment instruction device 270.

(A) Conditions Under Which a Reversing Car is Determined (Condition 1) The direction of the shaft of the target car is opposite to the direction of the new station call stored in the station call registration device 1. (The opposite direction car selection module 1601 evaluates this condition).

(Condition 2) The call data storage device 210 does not contain a station call for the target car whose direction is opposite to the direction of the call added to the station call registration device 1.

(The station call finding module 1603 evaluates this condition).

(Condition 3) The call data storage device 210 does not contain a car call for the target car whose direction is opposite to the direction of the call added to the station call registration device 1. (The car call finding module 1604 evaluates this condition). ( Condition 4) The direction into which the target car must move to respond to the new station call added to the station call registration device 1 is opposite to the direction data of the shaft in which the target car is moving. (The movement direction finding module 1605 evaluates this condition).

(Condition 5) One of the following conditions is satisfied, in the shaft in which the target car is moving, for another car on a floor which is in the direction to the new station call with respect to the current floor of the target car:

(a) There is no other car. (The other-car finding module 1607 evaluates this condition).

(b) The other car is moving into the same direction as the direction of the new station call. (The other-car direction finding module 1614 evaluates this condition).

(c) When there is a horizontally-moving floor between the target car and the other car (the horizontally-moving floor finding module 1615 evaluates this condition), when the route of the other car stored in the route data storage device 290 and the route of the target car to the new station call cross each other (the route crossing finding module 1616 evaluates this condition), and when the other car moves horizontally on the horizontally-moving floor (the horizontally-moving route finding module 1617 evaluates this condition), the other car arrives at the horizontally-moving floor first (the horizontally-moving floor arrival car finding module 1618 evaluates this condition).

(Condition 6) There is no other car moving horizontally to the shaft in which the target car will move to respond to the new station call. (The other-car finding module 1609 evaluates this condition). Or, the direction of the other car after horizontal movement is the same as the direction to the new station call. (The after-horizontal-movement direction finding module 1619 evaluates this condition).

(B) Reversing Car Determination Processing Flow

Figure 49:
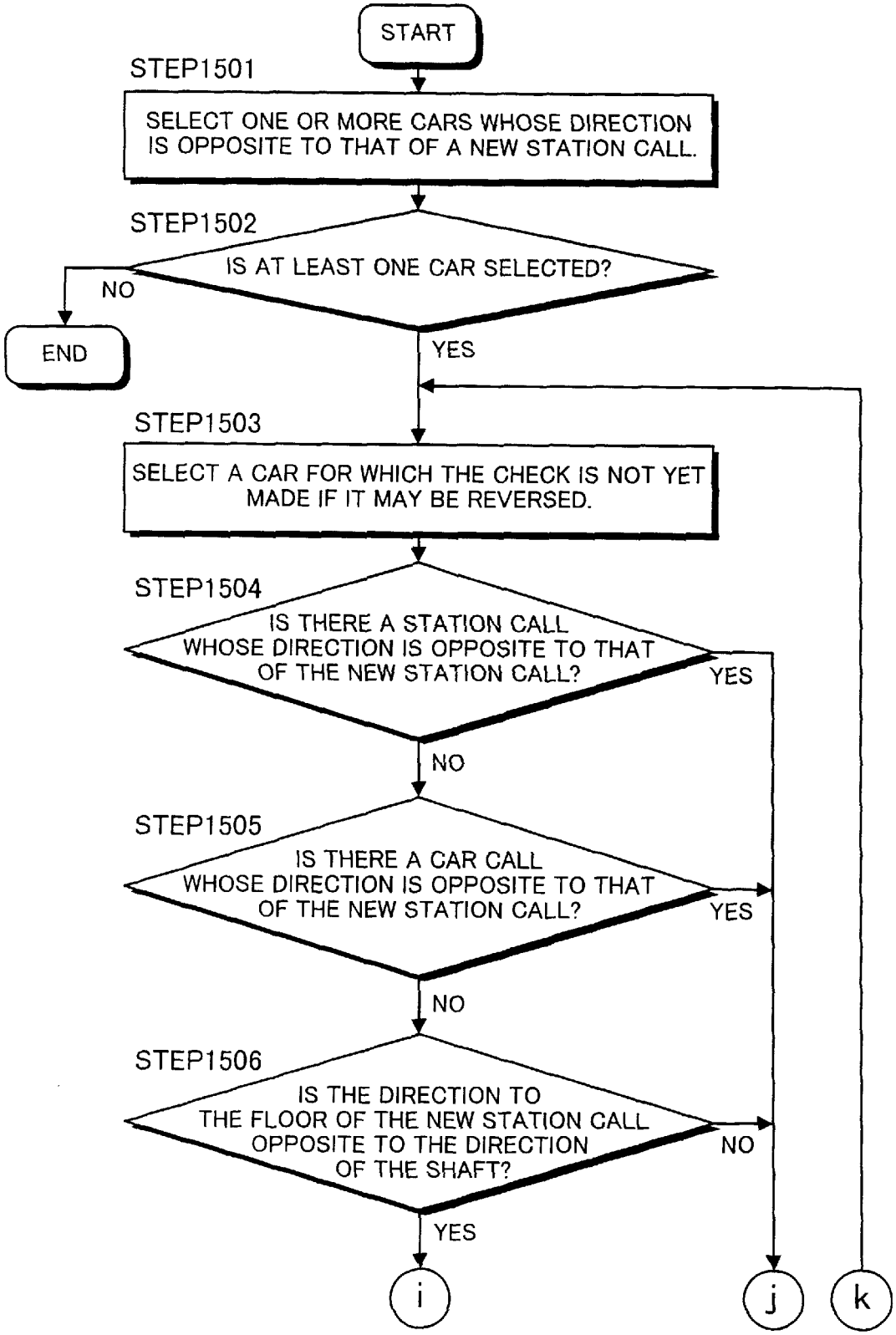
FIG. 49 is the first part of a flowchart showing the operation steps of the reversing car determination device used in the thirty-fourth embodiment of the elevator group management control apparatus according to this invention.
Figure 50:
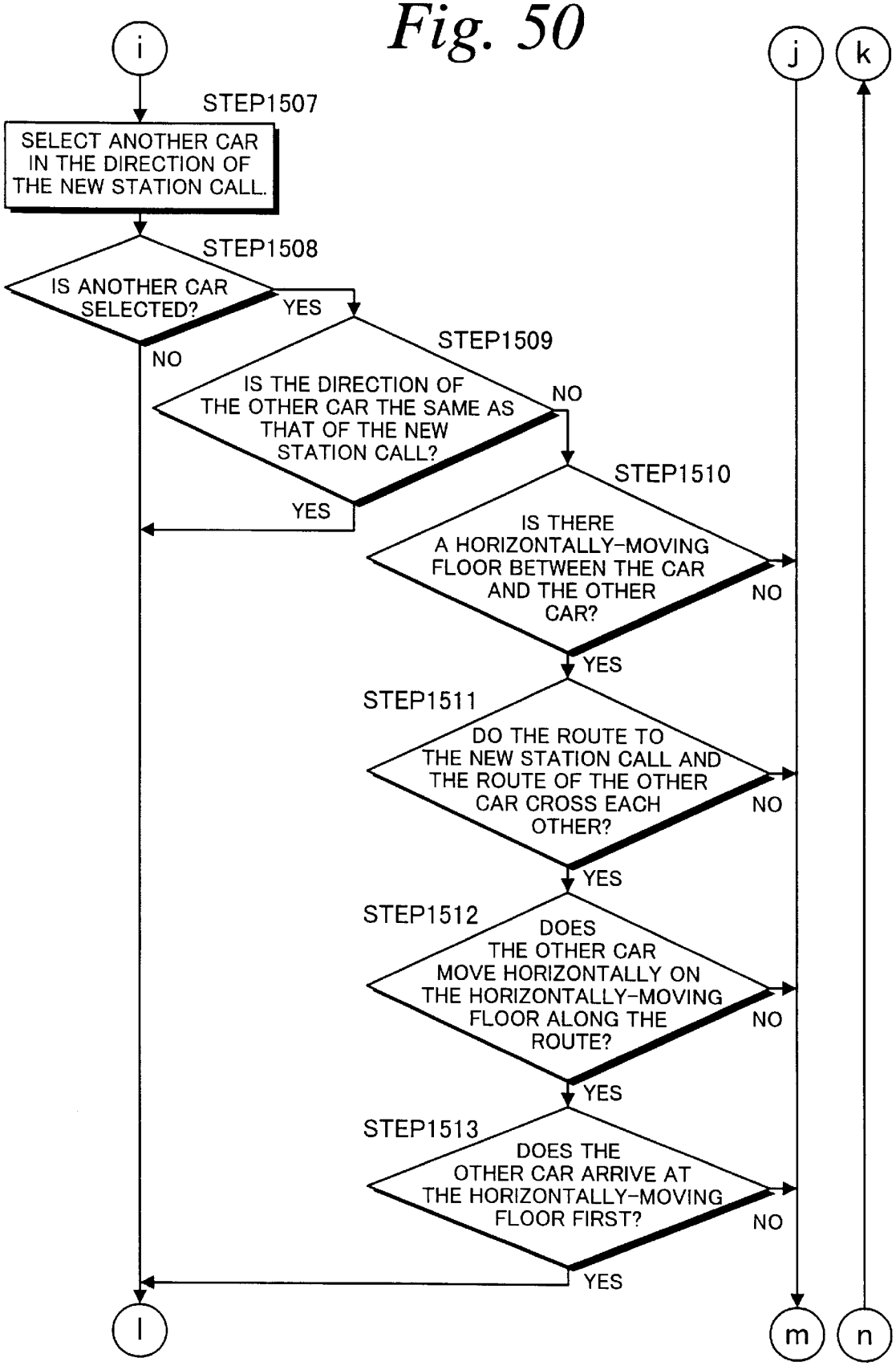
FIG. 50 is the middle part of a flowchart showing the operation steps of the reversing car determination device used in the thirty-fourth embodiment of the elevator group management control apparatus according to this invention.
Figure 51:
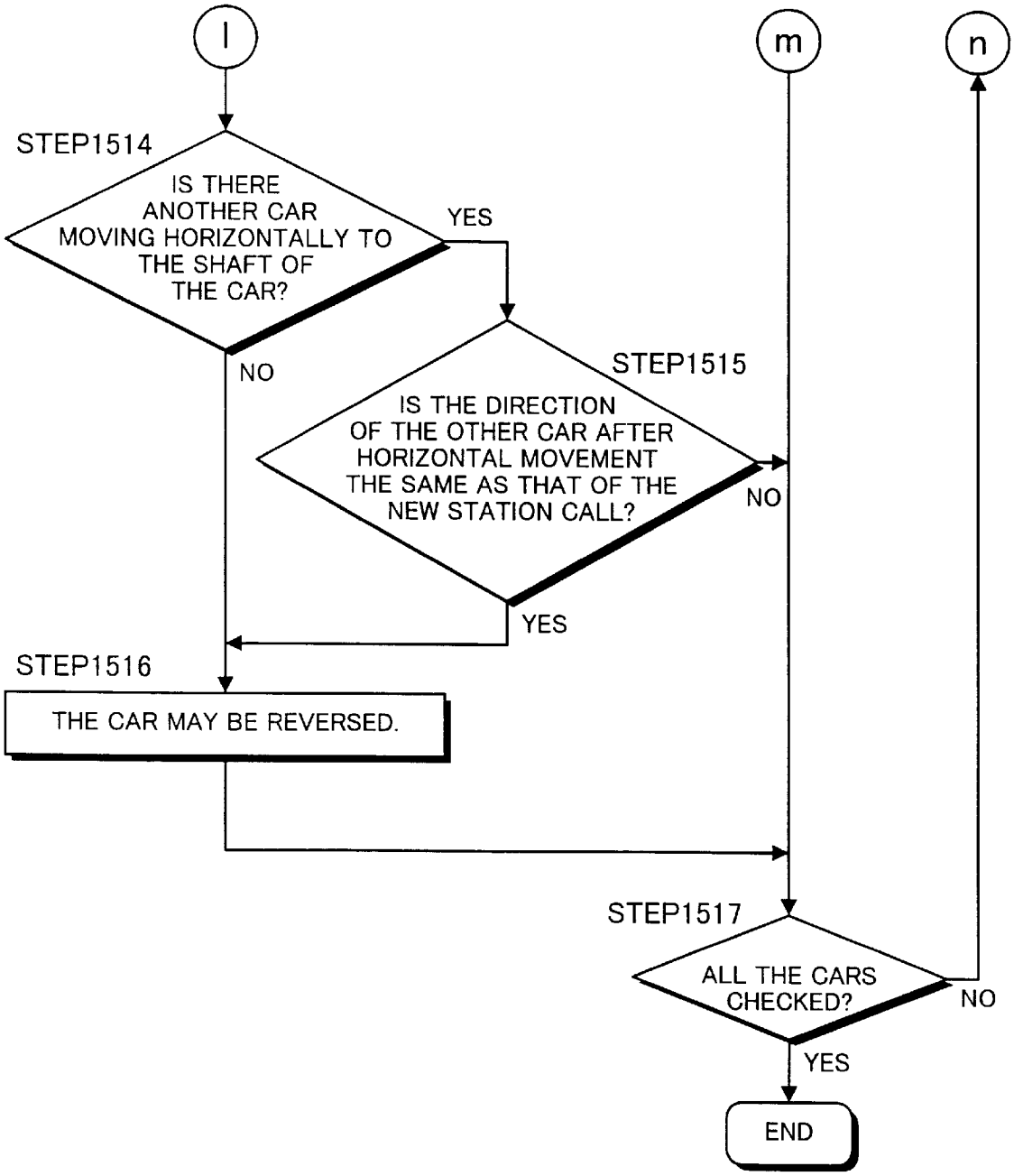
FIG. 51 is the last part of a flowchart showing the operation steps of the reversing car determination device used in the thirty-fourth embodiment of the elevator group management control apparatus according to this invention.

FIGS. 49 to 51 are the flowcharts showing the processing flow of the reversing car determination device 260C which works based on the conditions described in (A).

The flowcharts in FIGS. 49 to 51 show how an elevator system, such as the one shown in FIG. 37, processes call data (5, DN) added to the station call registration device 1.

That is, as shown in FIG. 37, an elevator system in a 20-story building has four elevator shafts. Assume that car 1 is at the fifteenth floor and car 2 is at the seventh floor in the first shaft, car 3 is at the third floor in the second shaft, car 4 is at the eighteenth floor in the third shaft, and that car 5 is at the tenth floor in the fourth shaft. Also assume that cars 1, 2, and 4, each in the stopped state at the respective floor, are ready to close their doors and start operation and that cars 3 and 5 are moving in their shafts.

Assume that the call data storage device 210 contains station call data (2, DN) for car 3 and car call data (19, UP) for car 4 and (9, DN) for car 5. Also assume that the direction data storage device 220 contains the direction data of the shaft in which each car runs; UP for the first shaft, DN for the second shaft, UP for the third shaft, and DN for the fourth shaft. In addition, the shaft data storage device 240 contains the shaft data which indicates the combination of the floor at which the car is moving and the shaft in which the car is moving; (15@1) for car 1, (7@1) for car 2, (3@2) for car 3, (18@3) for car 4, and (10@4) for car 5.

To determine a car whose direction is to be reversed, it is necessary to select a car satisfying all the six conditions described above. The conditions will be described in further detail with reference to the flowcharts shown in FIGS. 49 to 51.

In step 1501 (the opposite direction car selection module 1601 executes this step), the reversing car determination device uses direction data of the shafts stored in the direction data storage device 220, shaft data stored in the shaft data storage device 240, and new station call data added to the station call registration device 1 in order to select one or more cars whose direction is opposite to that of the station call added to the station call registration device 1. As a result, the device selects cars 1, 2, and 4. These cars satisfy (condition 1).

In step 1503 (the unchecked car selection module 1602 executes this step), the module selects one of the cars selected in step 1501 (here, assume that car 1 is selected). And, in step 1504 (the station call finding module 1603 executes this step), the module checks to see if the call data storage device 210 contains station call data for car 1 whose direction is opposite to that of the new station call, (5, DN), and finds that there is no such station call data. This satisfies (condition 2).

Next, in step 1505 (the car call finding module 1604 executes this step), the module checks to see if the call data storage device 210 contains car call data for car 1 whose direction is opposite to that of the new station call, (5, DN), and finds that there is no such car call data. This satisfies (condition 3).

In step 1506 (the movement direction finding module 1605 executes this step), the module uses the direction data of the shaft of car 1 obtained by the direction data storage device 220 and new station call data added to the station call registration device 1 to check to see if the direction of car 1 to respond to the new station call is opposite to the direction of the shaft in which car 1 is moving, and finds that the direction is opposite. This satisfies (condition 4).

Next, in step 1507 (the other-car finding module 1607 executes this step), the module selects, in the shaft in which car 1 is moving, another car at a floor in the direction to the new station call (5, DN) with respect to the current floor and, in step 1508, selects car 2.

In step 1509 (the other-car direction finding module 1614 executes this step), the module checks if car 2, selected in the previous step, is moving into the same direction as the direction of the new station call (5, DN) (downward), and finds that it is not. ( Direction data in Table 76 indicates that car 2 is moving upward in the first shaft).

Next, in step 1510 (the horizontally-moving floor finding module 1615 executes this step), the module checks to see if there is a horizontally-moving floor between car 1 and car 2, and finds that there is a horizontally-moving floor (tenth floor). And, in step 1511 (the route crossing finding module 1616 executes this step), the module checks if the route of car 2 stored in the route data storage device 290 and the route along which car 1 will move to respond to the new station call (5, N) cross each other and finds that they cross.

Then, in step 1512 (the route crossing finding module 1616 executes this module), the module checks if car 2 moves horizontally on the horizontally-moving floor along its route and finds that it does. (As shown in Table 77 and FIG. 47, car 2 moves horizontally to the third shaft on the tenth floor).

Next, in step 1513 (the horizontally-moving floor arrival car finding module 1618 executes this step), the module uses car data estimated by the horizontally-moving floor arrival estimation device 300 to check if car 2 will arrive at the horizontally-moving floor first, and finds that it does. This satisfies (condition 5). This means that, while car 1 is moving in the shaft to respond to the new station call, car 2 will have crossed the horizontally-moving floor, indicating that car 1 and car 2 do not collide.

Next, in step 1514 (the horizontal movement finding module 1609 executes this step), the module uses the shaft data of the shaft in which car 1 is moving stored in the shaft data storage device 240 and the number of the shaft to which a car is moving horizontally obtained by the horizontal movement destination detection device 250, checks if there is another car moving horizontally to the shaft in which car 1 will move to respond to the new station call (5, DN), and finds that there is no such car. This satisfies (condition 6).

Thus, car 1, the target car, satisfies all six conditions described above and, therefore, it is determined that car 1 may be reversed (step 1516).

Then, in step 1517 (the check finish confirming module 1611 executes this step), the module checks if the check is made for all the selected cars, 1, 2 and 4, if they are eligible for a reversing car. Because the check is not yet made for cars 2 and 4, control goes back to step 1503.

And, the reversing car determination device checks car 2, selected in step 1503, if it satisfies the above conditions as for car 1. Because the above six conditions are also satisfied for car 2, it is determined that car 2 may also be reversed.

The reversing car determination device also checks car 4, selected in step 1503, if it satisfies the above conditions. And, in step 1505, the device finds that there is a car call (C, 19, UP) for car 4 and that one of the above conditions (condition 3) is not satisfied.

As a result, the device determines that car 1 and car 2, which satisfy all the six conditions described above, may be reversed.

[34-2-5. Assignment Instruction Processing]

The assignment instruction device 270 shown in FIG. 44 uses reversing car data determined by the reversing car determination device 260C, call data consisting of the car calls and the assigned station calls of the cars stored in the call data storage device 210, new station call data added to the station call registration device 1, direction data of the shafts in which the cars are moving stored in the direction data storage device 220, route data indicating a route along which each car will move stored in the route data storage device 290, and car data detected by the car data detection device 2 to determine a car to be used in response to the new station call, issues an instruction to the operation instruction device 280 to cause it to issue an operation instruction to the determined car and, at the same time, stores the station call in the call data storage device 210.

The flow of processing in the assignment instruction device 270 will be described with reference to the flowchart in FIG. 40. In step 601, the device checks to see if there are cars that may be reversed. In this embodiment, it is determined that cars 1 and 2 may be reversed. In addition, for cars 3 and 5 which were not selected in step 1501 in the flowcharts in FIGS. 49 to 51, the device estimates in step 602 the time needed to respond to the new station call based on data such as call data (that is, the time needed for those cars to reach the fifth floor).

In step 604, the device selects car 2, whose arrival time is the minimum, as the car to respond to the new station call (5, DN) and outputs an instruction to the operation instruction device 280 to cause it to issue an operation instruction to car 2 and, at the same time, sends information to the call data storage device 210 indicating that the new station call (5, DN) is assigned to car 2. The call data storage device 210 contains call data in the format shown in Table 78.

TABLE 78

| Car | ( Call Type | Floor | Direction ) |
|---|---|---|---|
| 2 | ( H | 5 | DN ) |
| 3 | ( H | 2 | DN ) |
| 4 | ( C | 10 | UP ) |
| 5 | ( C | 9 | DN ) |

[34-3. Effects of the Thirty-fourth Embodiment]

The elevator group management control apparatus and the elevator group management control method used for the elevator group management control apparatus, shown in the thirty-fourth embodiment with the above configuration, have the following effects:

When determining a car to be used in response to a new station call during elevator group management control, it is possible, before responding to the new station call, to check whether or not there is a car to be reversed without considering the current direction of each shaft, and, if there is such a car, to change the operation direction of the car as necessary.

If there is a car which will move to respond to a new station call and there is another car in the same shaft, the check is made in this embodiment to see if the other car moves horizontally. This makes it possible to know if there is a possibility that two cars will collide, ensuring safety when the car is reversed.

In addition, because the cars determined to be reversible are also a candidate for the response car in this system, a speedy response is made to the new station call.

[35. Thirty-fifth Embodiment]

This embodiment relates to an elevator group management control apparatus corresponding to claims 41 and 43 and an elevator group management control method (corresponding to claims 49 and 51) used for the elevator group management control apparatus.

[35-1. Configuration of the Thirty-fifth Embodiment]

This embodiment is a variation of the thirty-fourth embodiment with some changes in the configuration of the reversing car determination device.

A car is reversed to move to the floor in response to a new station call in the thirty-fourth embodiment, while in this embodiment a car arrives at the floor in response to a new station call and then it is reversed.

[35-1-1. Configuration of the Elevator Group Management Control Apparatus]

The elevator group management control apparatus 3 according to this embodiment is configured in the same manner as in the thirty-fourth embodiment except that the part of the configuration of the reversing car determination device is changed (see FIG. 44).

[35-1-2. Configuration of the Reversing Car Determination Device]

The configuration of the reversing car determination device 260D of the elevator group management control apparatus 3 will be described in further detail with reference to FIG. 52.

The reversing car determination device 260D used in this embodiment is the reversing car determination device 260C, shown in the thirty-fourth embodiment, with the car call position finding module 1613 and the other-car-between-floor finding module 1620 added.

That is, the configuration of the reversing car determination device 260D used in this embodiment is such that the car call finding module 1604, one of the modules, receives the value and the number of the car from the station call finding module 1603, the car call data of each car from the call data storage device 210, and new station call data added to the station call registration device 1, outputs 0 if the value obtained by the station call finding module 1603 is 0 or, if the value is −1, checks if there is a car call requesting a floor in the direction opposite to the direction of the added station call, and outputs the car call data if there is such a car call or, if there is no such car call, −1 and the number of the car;

a car call position finding module 1613 is added, the module receiving the value, the number of the car, and car call data from the car call finding module 1604 and new station call data added to the station call registration device 1, outputting −1 if the value obtained by the car call finding module 1604 is −1 or outputting 0 if the value is 0, and, when car call data is entered, checking if the car call requests a floor between the current floor and the floor requested by the new station call, and outputting −1 if the car call requests such a floor or, if it does not, outputting 0 and the number of the car.

The movement direction finding module 1605 receives the value and the number of the car from the car call position finding module 1613, new station call from the station call registration device 1, and the direction data of the shaft in which each car is moving from the direction data storage device 220, outputs 0 if the value obtained from the car call position finding module 1613 is 0, or if the value is −1, checks if the direction of the car to respond to the new station call is the same as the direction of the shaft in which the car is moving, and returns −1 if the direction is the same or, if the direction is opposite, 0 and the number of the car.

The after-horizontal-movement direction finding module 1619 receives the value and the number of the car from the horizontal movement finding module 1609, new station call from the station call registration device 1, the direction data of each car from the direction data storage device 220, and the destination of the horizontally-moving car from the horizontal movement destination detection device 250, outputs 0 if the value obtained from the horizontal movement finding module 1609 is 0 or outputs −1 if the value is −1, checks if, when the number of the other car is entered, the direction of the other car after horizontal movement is opposite to the direction to the new station call, and outputs −1 if the direction is opposite, or if the direction is the same, 0 and the number of the car.

An other-car-between-floor finding module 1620 is added, the module receiving the value and the number of the car from the after-horizontal-movement direction finding module 1619, new station call data from the station call registration device 1, and the shaft data of the shaft in which each car is moving from the shaft data storage device 240, outputting 0 if the value obtained from the after-horizontal-movement direction finding module 1619 is 0, or if the value is −1, checking if there is another car at a floor between the current floor and the floor requested by the new station call, and outputting 0 if there is such a car or, if there is not such a floor, −1 and the number of the car.

The description of the other modules is omitted here because they function as in the reversing car determination device 260C in the thirty-fourth embodiment.

[35-2. Operation of the Thirty-fifth Embodiment]

The thirty-fifth embodiment having the configuration described above performs operation as follows.

[35-2-1Reversing Car Determination Processing]

Figure 52:
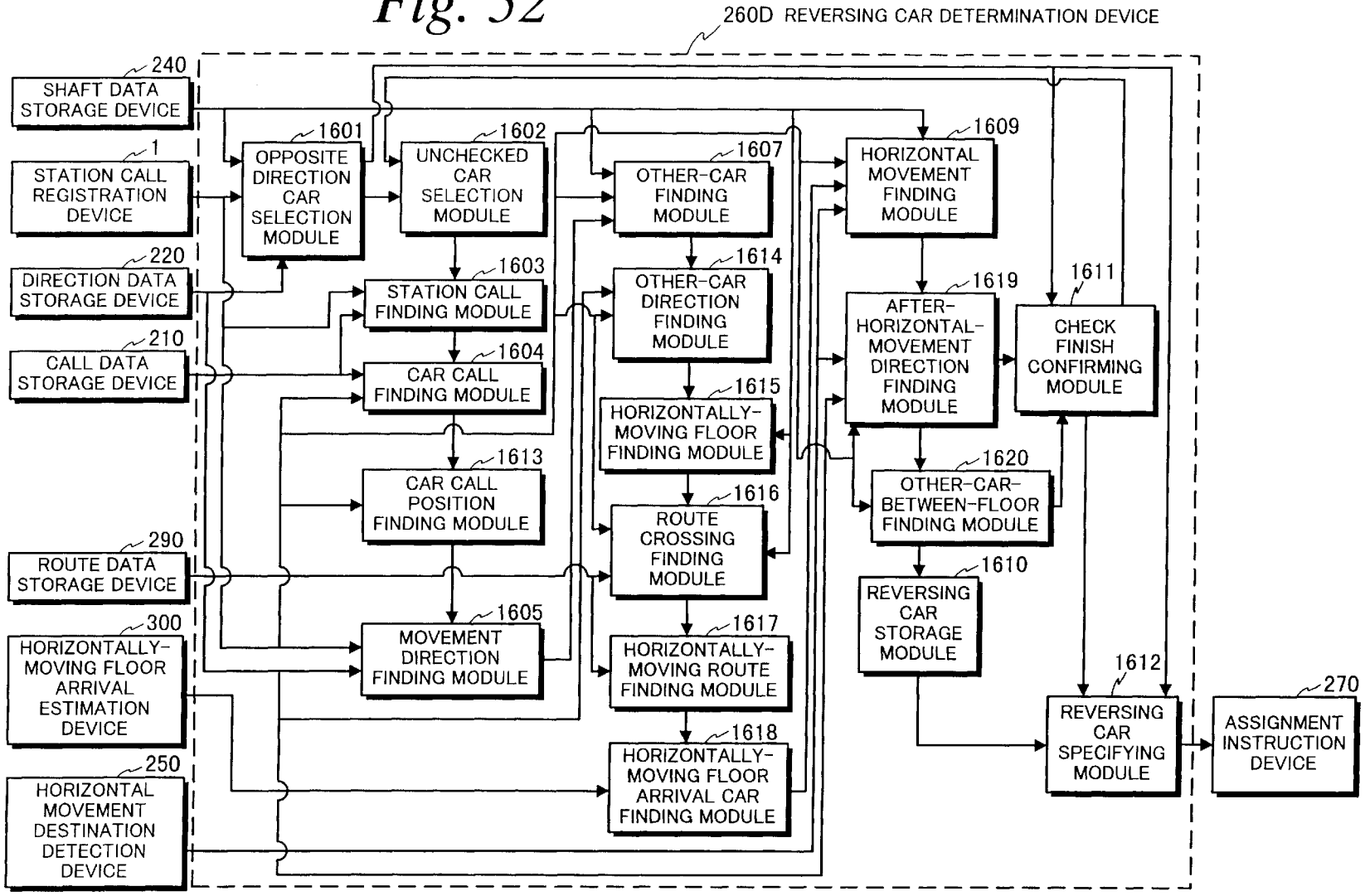
FIG. 52 is a diagram showing the configuration of the reversing car determination device used in the thirty-fifth embodiment of the elevator group management control apparatus according to this invention.

The reversing car determination device 260D shown in FIG. 52 uses new station call data added to the station call registration device 1, the call data of each car stored in the call data storage device 210, direction data (upward or downward) of the shaft in which each car is moving stored in the direction data storage device 220, shaft data of each of the cars stored in the shaft data storage device 240, route data representing a route along which each car should move stored in the route data storage device 290, the car data on the car arriving at the horizontally-moving floor first estimated by the horizontally-moving floor arrival estimation device 300, and the number of the shaft to which a car is moving horizontally detected by the horizontal movement destination detection device 250, determines a car to be reversed, according to the following conditions, in order to respond to a new station call added to the station call registration device 1, and outputs data on the car to be reversed to the assignment instruction device 270.

(A) Conditions Under Which a Reversing Car is Determined (Condition 1) The direction of the shaft of the target car is opposite to the direction of the new station call stored in the station call registration device 1. (The opposite direction car selection module 1601 evaluates this condition).

(Condition 2) The call data storage device 210 does not contain a station call for the target car whose direction is opposite to the direction of the call added to the station call registration device 1. (The station call finding module 1603 evaluates this condition).

(Condition 3) The call data storage device 210 does not contain a car call for the target car whose direction is opposite to the direction of the call added to the station call registration device 1. (The car call finding module 1604 evaluates this condition). Or, there is a car call requesting a floor on the way to the floor requested by the new station call. (The car call position finding module 1613 evaluates this condition).

(Condition 4) The direction into which the target car must move to respond to the new station call added to the station call registration device 1 is the same as the direction data of the shaft in which the target car is moving. (The movement direction finding module 1605 evaluates this condition).

(Condition 5) One of the following conditions is satisfied, in the shaft in which the target car is moving, for another car on a floor which is in the direction to the new station call with respect to the current floor of the target car:

(a) There is no other car. (The other-car finding module 1607 evaluates this condition).

(b) The other car is moving into the same direction as the direction of the new station call. (The other-car direction finding module 1614 evaluates this condition).

(c) When there is a horizontally-moving floor between the target car and the other car (the horizontally-moving floor finding module 1615 evaluates this condition), when the route of the other car stored in the route data storage device 290 and the route of the target car after responding to the new station call cross each other (the route crossing finding module 1616 evaluates this condition), and when the other car moves horizontally on the horizontally-moving floor (the horizontally-moving route finding module 1617 evaluates this condition), the other car arrives the horizontally-moving floor first (the horizontally-moving floor arrival car finding module 1618 evaluates this condition).

(Condition 6) There is a horizontally-moving floor between the floor of the target car and the floor requested by the new station call and there is no other car moving horizontally to the shaft. (The other-car finding module 1609 evaluates this condition). Or, the direction of the other car after horizontal movement is opposite to the direction to the new station call. (The after-horizontal-movement direction finding module 1619 evaluates this condition).

(Condition 7) In the shaft in which the target car is moving, there is no other car on a floor between the current floor of the target car and the floor requested by the new station call. (The other-car-between-2 floor finding module 1620 evaluates this condition).

(B) Reversing Car Determination Processing Flow

Figure 53:
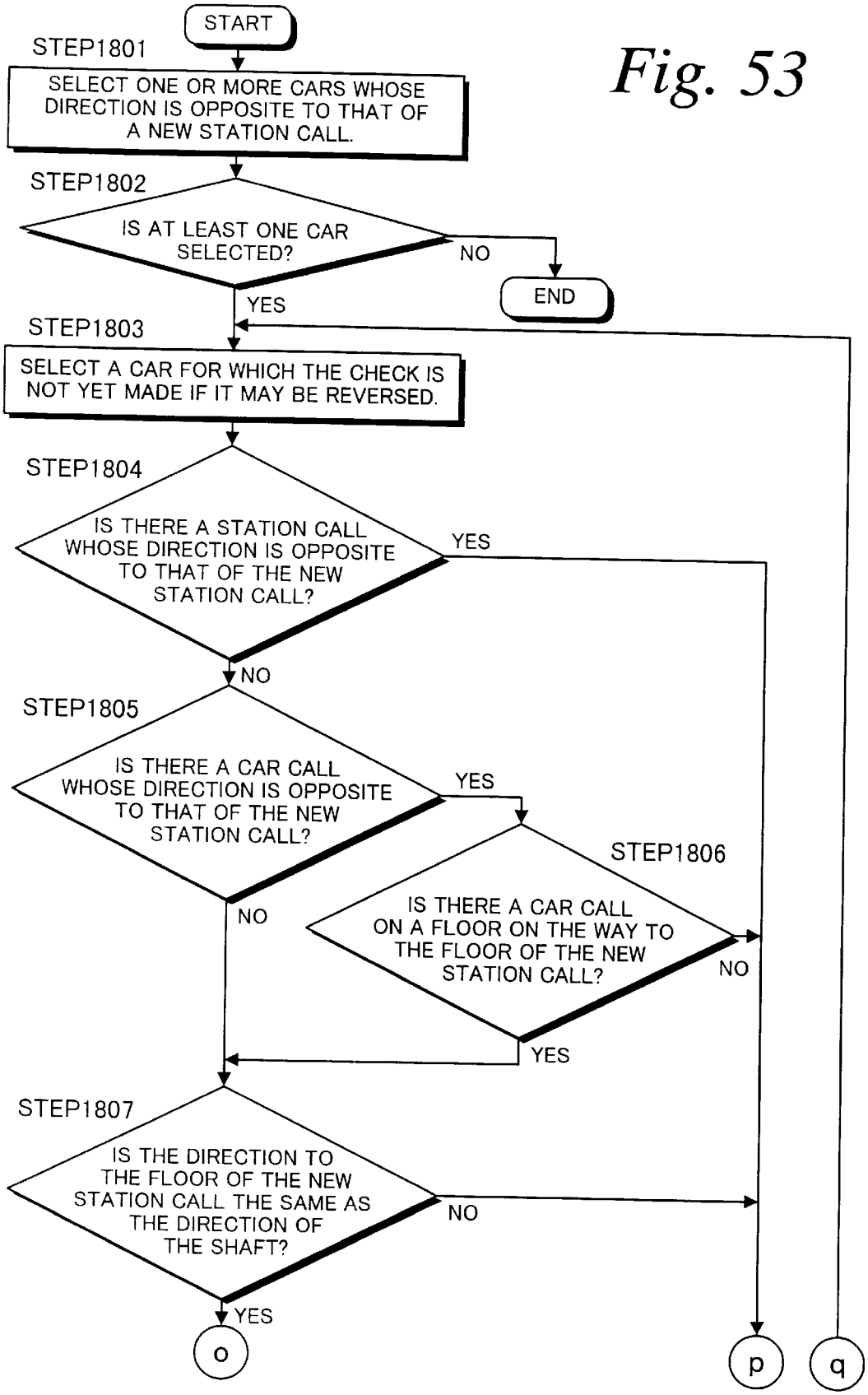
FIG. 53 is the first part of a flowchart showing the operation steps of the reversing car determination device used in the thirty-fourth embodiment of the elevator group management control apparatus according to this invention.
Figure 54:
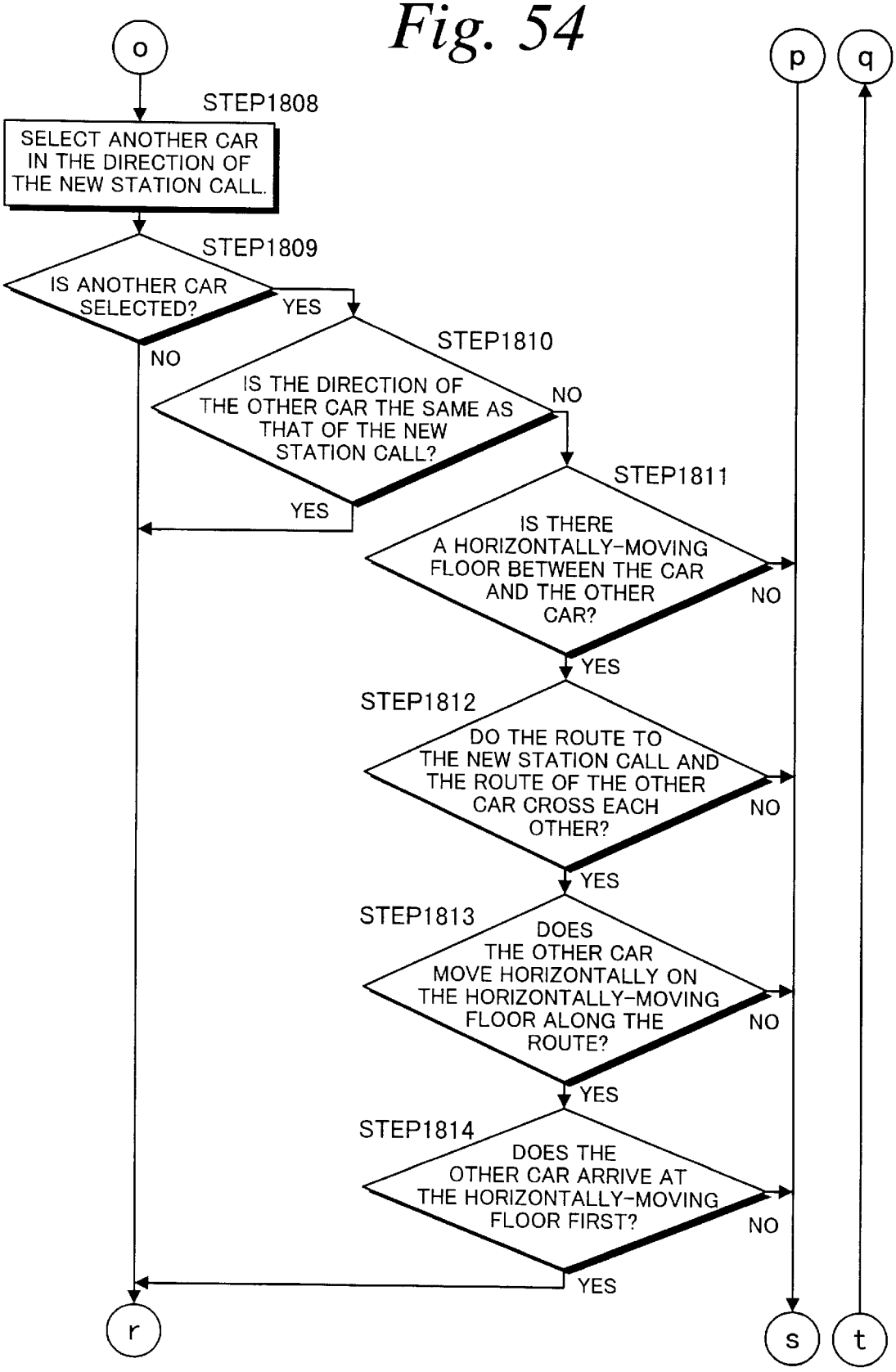
FIG. 54 is the middle part of a flowchart showing the operation steps of the reversing car determination device used in the thirty-fifth embodiment of the elevator group management control apparatus according to this invention.
Figure 55:
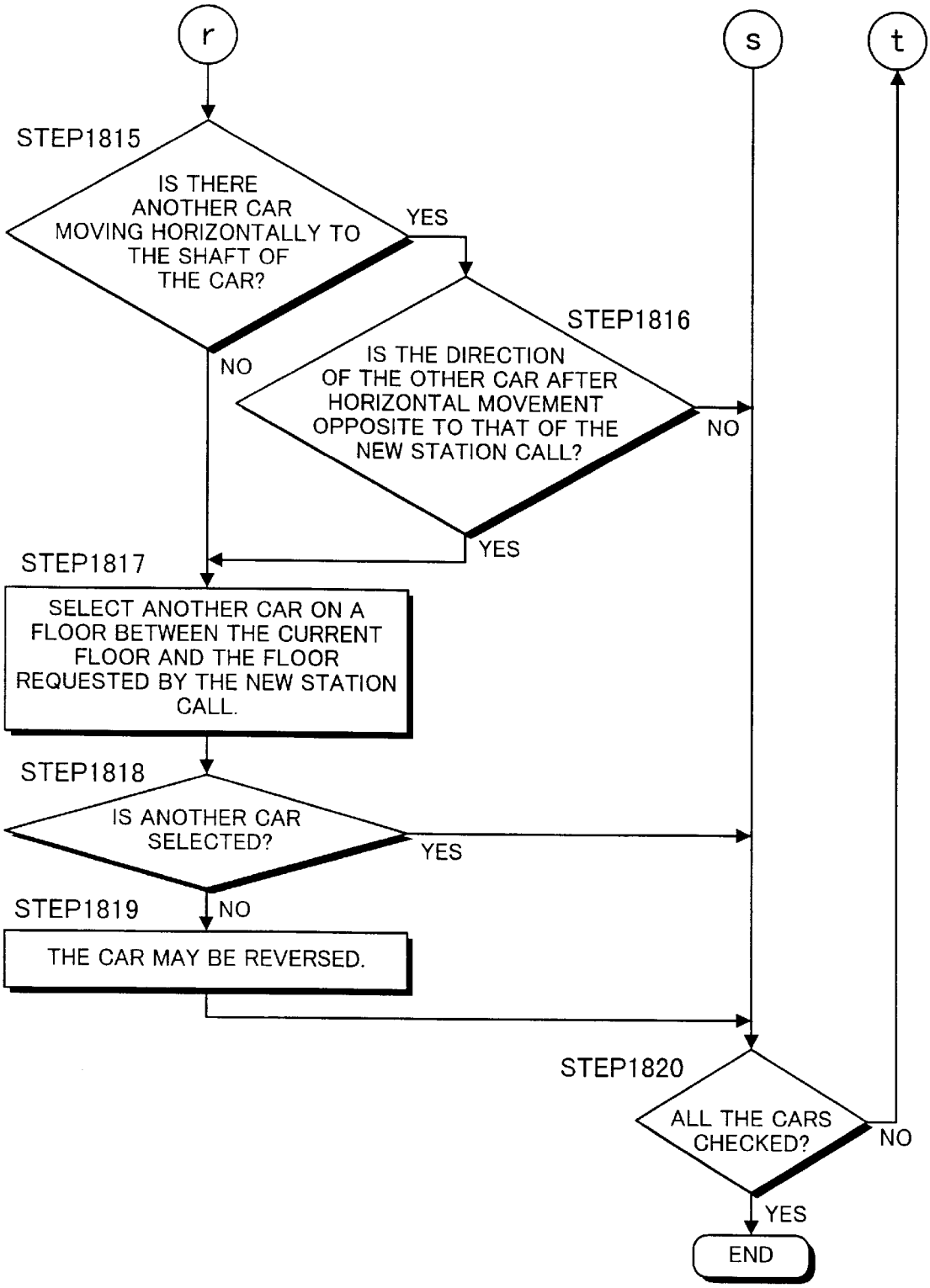
FIG. 55 is the last part of a flowchart showing the operation steps of the reversing car determination device used in the thirty-fifth embodiment of the elevator group management control apparatus according to this invention.

FIGS. 53 to 55 are the flowcharts showing the processing flow of the reversing car determination device 260D which reverses the direction of a car according to the conditions described in (A).

The flowcharts in FIGS. 53 to 55 show how an elevator system, such as the one shown in FIG. 37, processes call data (4, UP) added to the station call registration device 1.

That is, as shown in FIG. 37, an elevator system in a 20-story building has four elevator shafts. Assume that car 1 is at the fifteenth floor and car 2 is at the seventh floor in the first shaft, car 3 is at the third floor in the second shaft, car 4 is at the eighteenth floor in the third shaft, and that car 5 is at the tenth floor in the fourth shaft. Also assume that cars 1, 2, and 4, each in the stopped state at the respective floor, are ready to close their doors and start operation and that cars 3 and 5 are moving in their shafts.

Assume that the call data storage device 210 contains station call data (2, DN) for car 3 and car call data (19, UP) for car 4 and (9, DN) for car 5. Also assume that the direction data storage device 220 contains the direction data of the shaft in which each car runs; UP for the first shaft, DN for the second shaft, UP for the third shaft, and DN for the fourth shaft. In addition, the shaft data storage device 240 contains the shaft data which indicates the combination of the floor at which the car is moving and the shaft in which the car is moving; (15@1) for car 1, (7@1) for car 2, (3@2) for car 3, (18@3) for car 4, and (10@4) for car 5.

To determine a car whose direction is to be reversed, it is necessary to select a car satisfying all the seven conditions described above. The conditions will be described in further detail with reference to the flowcharts shown in FIGS. 53 to 55.

In step 1801 (the opposite direction car selection module 1601 executes this step), the reversing car determination device uses direction data of the shafts stored in the direction data storage device 220, shaft data stored in the shaft data storage device 240, and new station call data added to the station call registration device 1 in order to select one or more cars whose direction is opposite to that of the station call added to the station call registration device 1. As a result, the device selects cars 3 and 5. These cars satisfy (condition 1).

In step 1803 (the unchecked car selection module 1602 executes this step), the module selects one of the cars selected in step 1801 (here, assume that car 3 is selected). And, in step 1804 (the station call finding module 1603 executes this step), the module checks to see if the call data storage device 210 contains station call data for car 3 and finds that there is station call data (H, 2, DN). This does not satisfy (condition 2). Therefore, it is determined that car 3 may not be reversed.

Then, in step 1820 (the check finish confirming module 1611 executes this step), the module checks if the check is made for all the selected cars, 3 and 5, if they are eligible for a reversing car. Because the check is not yet made for car 5, control goes back to step 1803.

So, in step 1803, the above check is made for car 5, selected in step 1803, as for car 3.

In step 1804 (the module station call finding module 1603 executes this step), the module checks the call data storage device 210 if it contains station call data for car 5 and finds that there is no station call data. This satisfies (condition 2).

Then, in step 1805 (the car call finding module 1604 executes this step), the module checks if the call data storage device 210 contains car call data for car 5 and finds that it contains car call data (C, 9, DN). And, in step 1806 (the car call position finding module 1613 executes this step), the module finds that this car call requests a floor on the way to the fourth floor where the new station call was generated. This satisfies (condition 3).

In step 1807 (the movement direction finding module 1605 executes this step), the module receives the direction data of the shafts from the direction data storage device 220 and shaft data from the shaft data storage device 240, checks if the direction into which car 5 will move to respond to the new station call data (4, UP) is the same as the direction of the shaft in which car 5 is moving, and finds that the direction is the same. This satisfies (condition 4).

Next, in step 1808 (the other-car finding module 1607 executes this step), the module selects, in the shaft in which car 5 is moving, an another car in the direction to the new station call (4, UP) with respect to the current floor and, in step 1809, the module finds that no such car is selected. This satisfies (condition 5).

In step 1815 (the horizontal movement finding module 1609 executes this step), the module receives from the shaft data storage device 240 the shaft data of the shaft in which car 5 is moving and, from the horizontal movement destination detection device 250, the number of the shaft to which the car is moving horizontally, checks if there is a car moving horizontally to the shaft in which car 5 will move to respond to the new station call (4, UP), and finds that there is no such car. This satisfies (condition 6).

In step 1817 (the other-car-between-floor finding module 1620 executes this step), the module checks if there is another car at a floor between the current floor of car 5 and the floor requested by the new car call and finds that there is no such car. This satisfies (condition 7).

Because car 5 satisfies all seven conditions described above, it is determined that car 5 may be reversed. (step 1819)

[35-2-2. Assignment Instruction Processing]

The flow of processing in the assignment instruction device 270 will be described with reference to the flowchart in FIG. 40. In step 601, the device checks to see if there are cars that may be reversed. In this embodiments, it is determined that car 5 may be reversed. In addition, for cars 1, 2, and 4 which were not selected in step 1801 in the flowcharts in FIGS. 53 to 55, the device estimates in step 602 the time needed to respond to the new station call based on data such as call data (that is, the time needed for those cars to reach the fourth floor).

In step 604, the device selects car 5, whose arrival time is the minimum, as the car to respond to the new station call (4, UP) and outputs an instruction to the operation instruction device 280 to cause it to issue an operation instruction to car 5 and, at the same time, sends information to the call data storage device 210 indicating that the new station call (4, UP) is assigned to car 5. The call data storage device 210 contains call data in the format shown in Table 79.

TABLE 79

| Car | ( Call Type | Floor | Direction ) |
|---|---|---|---|
| 3 | ( H | 2 | DN ) |
| 4 | ( C | 19 | UP ) |
| 5 | ( C | 9 | DN ) |
| | ( H | 4 | UP ) |

[35-3. Effects of the Thirty-fifth Embodiment]

The elevator group management control apparatus and the elevator group management control method used for the elevator group management control apparatus, shown in the thirty-fifth embodiment with the above configuration, have the following effects:

When determining a car to be used in response to a new station call during elevator group management control, it is possible, after responding to the new station call, to check whether or not there is a car to be reversed without considering the current direction of each shaft, and, if there is such a car, to change the operation direction of the car as necessary.

If there is a car which will move to respond to a new station call and there is another car in the same shaft, the check is made in this embodiment to see if the other car moves horizontally. This makes it possible to know if there is a possibility that two cars will collide, ensuring safety when the car is reversed.

In addition, because the cars determined to be reversible are also a candidate for the response car in this system, a speedy response is made to the new station call.

[36. Thirty-sixth Embodiment]

This embodiment relates to an elevator group management control apparatus corresponding to claim 44 and an elevator group management control method (corresponding to claim 52) used for the elevator group management control apparatus.

[36-1. Configuration of the Thirty-sixth Embodiment]

This embodiment is a variation of the thirty-second to thirty-fifth embodiments with the re-assignment instruction device 310 added to the reversing car determination device shown in each of the embodiments.

[36-1-1. Configuration of the Elevator Group Management Control Apparatus]

Figure 56:
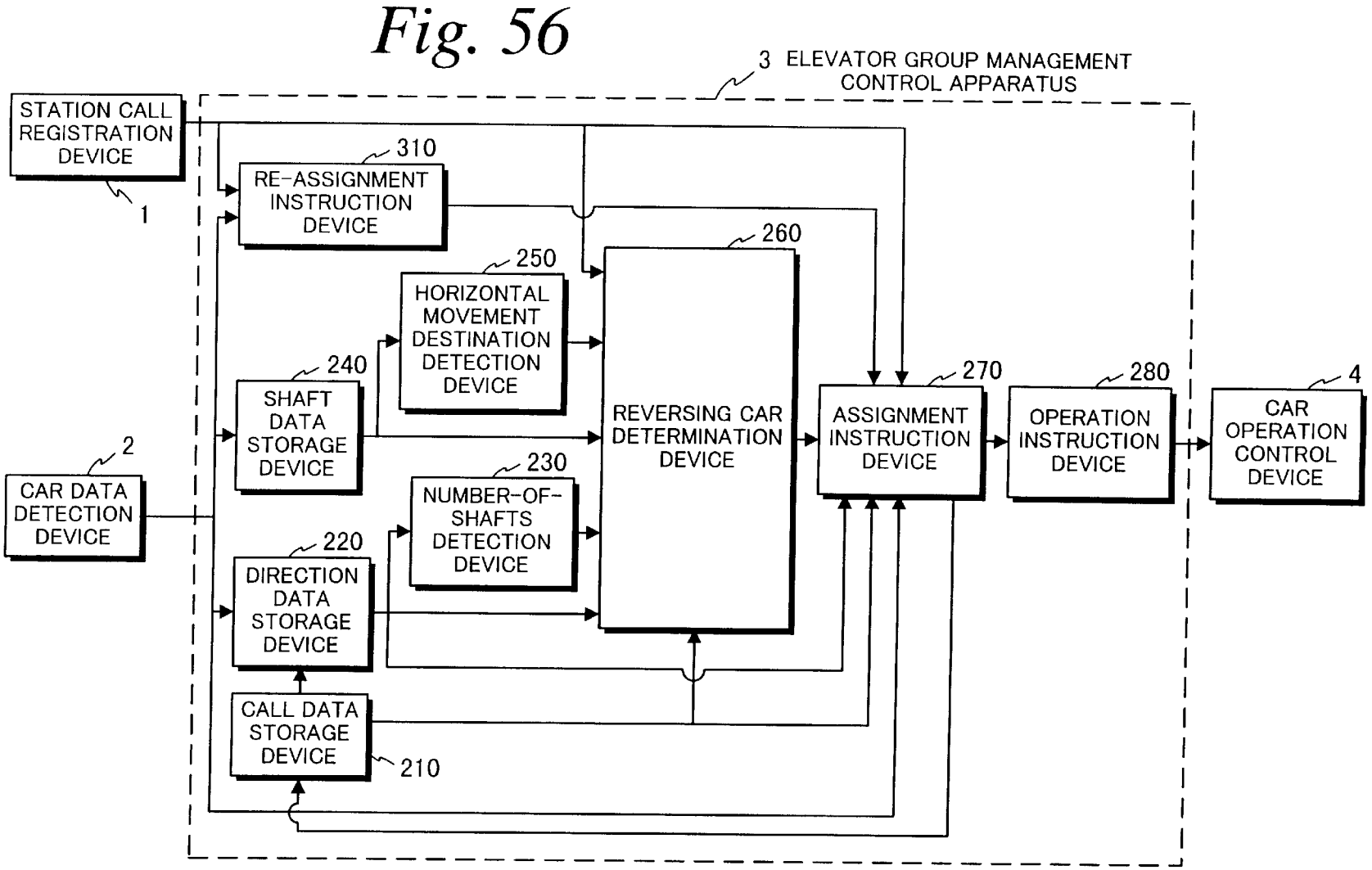
FIG. 56 is a diagram showing the configuration of the thirty-sixth embodiment of the elevator group management control apparatus according to this invention.
Figure 57:
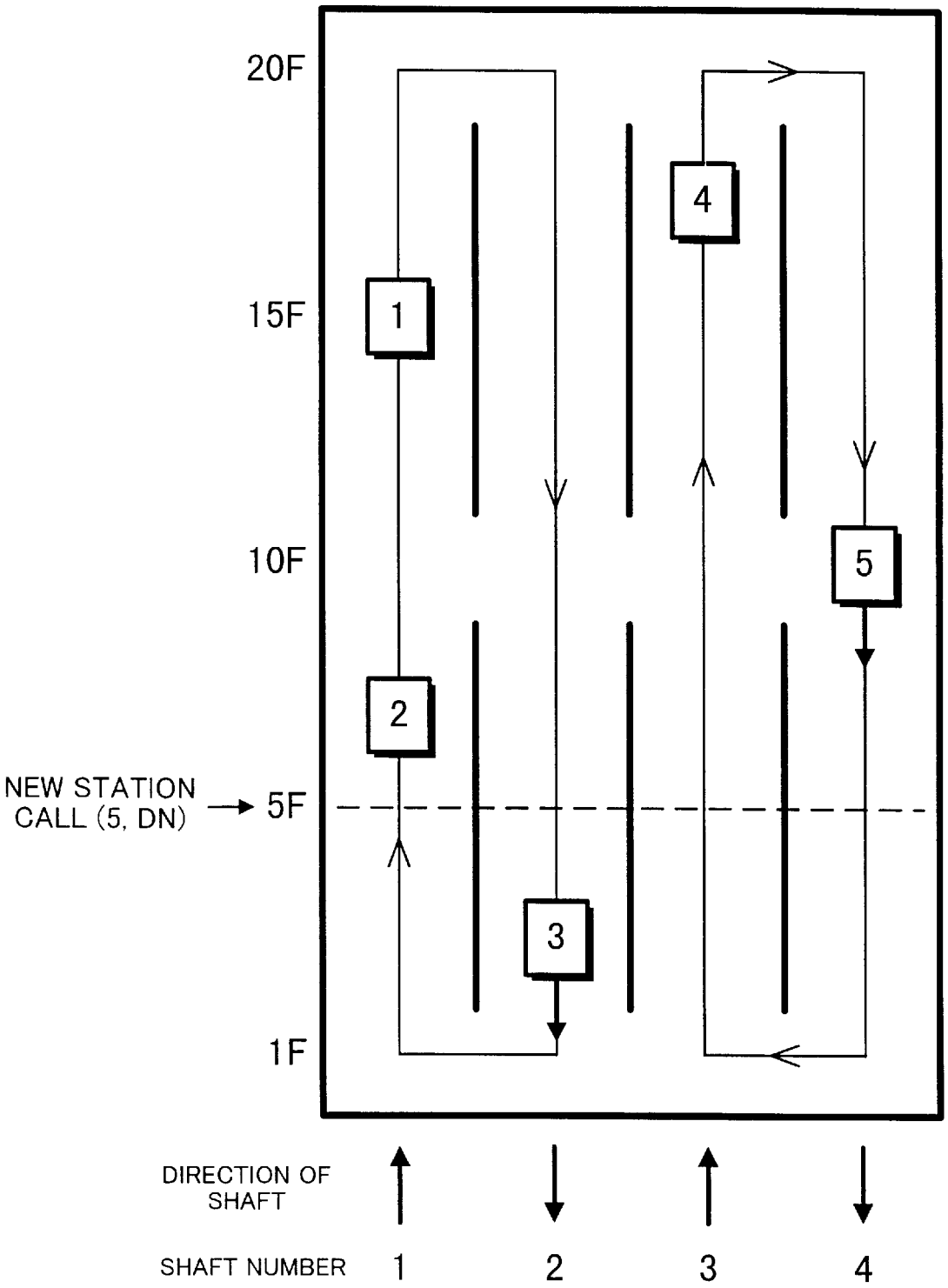
FIG. 57 is a diagram explaining the operation of an conventional elevator group management control apparatus, and shows how each car moves.

The elevator group management control apparatus 3 in this embodiment comprises the devices shown in FIG. 56. Because the devices except the re-assignment instruction device 310 are already described under Configuration of Elevator Group Management Control Apparatus in the thirty-second and thirty-fourth embodiments, the following explains only the re-assignment instruction device 310.

The re-assignment instruction device 310 checks a change in car data obtained from the car data detection device 2 and station call data obtained from the station call registration device 1 and, for a station call to which a car is already assigned, checks if there is another car which will be able to respond to the station call earlier than the assigned car. If there is such a car, the device sends an instruction to the assignment instruction device 270 indicating that the station call should be assigned to that car.

[36-2. Operation of the Thirty-sixth Embodiment]

The thirty-sixth embodiment having the configuration described above performs operation as follows.

[36-2-1. Re-Assignment Instruction Processing]

The re-assignment instruction device 310 shown in FIG. 56 examines a change in car data obtained from the car data detection device 2 and station call data obtained from the station call registration device 1 to find another best response car, and issues an instruction to the assignment instruction device 270 to review the assignment.

For example, assume that car 1 is assigned as the response car in response to a new station call (14, DN) through the processing described in the thirty-second to thirty-fifth embodiments and that car 1 is going down in the first shaft and going to stop at the seventeenth floor. Also assume that car 1 has car calls at sixteenth floor and fifteenth floor.

On the other hand, if car 2, which is going up in the shaft and has just passed the seventeenth floor, satisfies all the reversing-car determination conditions described in the thirty-second to thirty-fifth embodiments, then it is possible that car 2 will be able to respond to the new station call (14, DN) first. In this case, the re-assignment instruction device 310 sends an instruction to the assignment instruction device 270 to review the assignment of the new station call (14, DN)

That is, the re-assignment instruction device 310, which detects a change in the positions of car 1 and car 2 during examination of data stored in the car data detection device 2, sends an instruction to the assignment instruction device 270 to review the assignment of the new station call (14, DN). When there is a car which will be able to respond to the already-assigned station call sooner than the determined car, the assignment instruction device 270 changes the assignment of the station call from the currently-assigned car to the car which will be able to respond sooner. In this example, the device re-assigns the station call to car 2. In addition, the assignment instruction device 270 evaluates the average or the maximum response time and service time based on the time needed to respond the new station call (time needed to arrive at the floor) before determining the assignment.

[36-3. Effects of the Thirty-sixth Embodiment]

The thirty-sixth embodiment with the above configuration has the following effects:

Even after the elevator group management control apparatus or the elevator group management control method shown in the thirty-second to thirty-fifth embodiments has determined a car which will respond to a station call, the elevator group management control apparatus in this embodiment is able to issue an instruction to cause another car to respond to the new station call according to the situation, thus making it possible to perform the best elevator group control.

[37. Thirty-seventh Embodiment]

This embodiment relates to an elevator group management control apparatus corresponding to claim 45 and to an elevator group management control method (corresponding to claim 53) used for the elevator group management control apparatus.

[37-1. Configuration of the Thirty-seventh Embodiment]

This embodiment is a variation of the thirty-second to thirty-sixth embodiments with some changes in the configuration of the operation instruction device 280 of the elevator group management control apparatus 3.

[37-1-1. Configuration of the Operation Instruction Device]

The operation instruction device 280 in this embodiment issues an operation instruction to a car, specified by the assignment instruction device 270 as a car to respond to a new station call, and, if the reversing car determination device 260 has determined that the car is to be reversed, issues a stop instruction to another car in the shaft in which the determined car is moving.

[37-2. Operation of the Thirty-seventh Embodiment]

The thirty-seventh embodiment having the configuration described above performs operation as follows.

[37-2-1. Operation Instruction Processing]

The following discussion assumes that a new station call (5, DN) is added to the station call registration device 1 in an elevator system shown in FIG. 37, as explained in the thirty-second embodiment.

That is, it is assumed that the reversing car determination device 260 has determined that cars 1 and 2 are to be reversed and that the assignment instruction device 270 has determined that car 2 is to respond to the new station call (5, DN).

The operation instruction device 280 issues an operation instruction to car 2, determined by the assignment instruction device 270, and at the same time, if the car is determined by the reversing car determination device 260 as a reversing car, issues a stop instruction to other car (car 1 in this example) in the shaft (shaft 1 in this example) in which the determined car is moving.

[37-3. Effects of the Thirty-seventh Embodiment]

When there is another car in the shaft in which a car to be reversed is moving, the elevator group management control apparatus in the thirty-seventh embodiment with the above configuration and the elevator group management control method issues a stop instruction to the other car to prevent conflict, thereby ensuring the safety of elevator blank control.

[38. Other Embodiments]

This invention is not limited to the above embodiments. It is to be understood that the sequence of the steps in each embodiment may be changed or the steps may be executed concurrently, or the sequence may be changed in each execution, without departing from spirit of the invention.

Each embodiment described above may be implemented on a computer and that each function of the embodiment is implemented by a program controlling this computer.

EFFECTS OF THE INVENTION

As described above, this invention provides an elevator group management control apparatus and an elevator group management control method, capable of eliminating occurrence of any locally crowded conditions due to cars' congestion, delay or deadlock alike in such vertical/transversal movable elevator system.

And this invention provides an elevator group management control apparatus and an elevator group management control method, capable of placing free cars that are neither on station call nor on car call at optimal locations within a plurality of shafts.

In addition, this invention provides an elevator group management control apparatus and an elevator group management control method, capable of controlling the cars, which change the directions of the cars as necessary upon receiving a station call, without being limited by the directions of the shafts. This invention makes it possible to change the direction of a car depending upon the situation and therefore reduces the passenger's waiting time, significantly improving elevator system services.

While a preferred embodiment has been described, variations thereto will occur to those skilled in the art within the scope of the present inventive concepts which are delineated by the following claims.

What is claimed is:

1. An elevator group management control apparatus controlling operations of a plurality of vertically- and horizontally-movable cars, said elevator group management control apparatus comprising:

car data detection means for detecting an operating state of each of said cars; station call registration means for registering a station call;

route data storage means for storing therein with respect to each said car, route data indicating a route in vertical and horizontal directions through which the car should be operated, represented by each floor and shaft forming the route;

a call data storage means for storing call data consisting of car calls from each of said cars and station calls assigned to each car;

target floor instruction means for generating target floor data including a target floor based on call data stored in said call data storage means and station call data stored in said station call registration means; arrival time estimation means for estimating a time taken for said car to reach said target floor, in consideration of said operating states of other cars, based on said route data, said target floor data, said call data and car data detected by said car data detection means; and assignment instruction means for assigning based on the estimated arrival time obtained by said arrival time estimation means a certain car to a certain floor call.

2. The apparatus as recited in claim 1, characterized in that said assignment instruction means computes respective non-response times based on the estimated arrival time of one car and that of another car, and for assigning to a station call a car corresponding to the minimal one of the non-response times.

3. The apparatus as recited in claim 1, characterized in that said target floor instruction means generates and issues based on call data of one car and that of another car a target floor data corresponding to the one car, and that said assignment instruction means computes respective nonresponse time duration based on the estimated arrival time of one car and that of other cars, calculates average values based on the resulting nonresponse time duration, and assigns to the station call a car corresponding to the minimal one of those average values.

4. An elevator group management control apparatus controlling operations of a plurality of vertically- and horizontally-movable cars, said elevator group management control apparatus comprising:

car data detection means for detecting an operating state of each of said cars;

station call registration means for registering a station call;

route data storage means for storing therein route data with respect to each said car;

a call data storage means for storing call data consisting of car calls from each of said cars and station calls assigned to each car;

derivative car call estimation means for estimating a derivative car call based on station call data stored in said station call registration means;

target floor instruction means for generating target floor data including a target floor based on call data, station call data and derivative car call data as estimated by said derivative car estimation means;

arrival time estimation means for estimating a time taken for said car to reach said target floor based on said route data, said target floor data, said call data and car data detected by said car data detection means; and assignment instruction means for assigning based on the estimated arrival time obtained by said arrival time estimation means a certain car to a certain floor call.

5. The apparatus as recited in claim 4, characterized in that said assignment instruction means computes one or more service completion times based on a time duration as elapsed from a time point for generation of a station call until when said derivative car call will be done in response to a station call, and assigns to the station call a car corresponding to the minimal one of those service completion times.

6. The apparatus as recited in claim 4, characterized in that said assignment instruction means computes one or more service completion times based on a time duration elapsed from a time point for generation of a station call until when said derivative car call will be done in response to a station call, and one or more service completion times based on a time duration as elapsed from a time point for generation of a station call until when one of an already-registered car call and derivative car call will be done, calculates average values based on these service completion times, and assigns to the station call a car corresponding to the smaller one of those average values.

7. An elevator group management control method for controlling operations of a plurality of vertically- and horizontally-movable cars, said elevator group management control method comprising:

a car data detection process detecting an operating state of each of said cars;

a station call registration process registering a station call;

a route data storage process storing therein with respect to each said car, route data indicating a route in vertical and horizontal directions through which the car should be operated, represented by each floor and shaft forming the route;

a call data storage process storing call data consisting of car calls from each of said cars and station calls assigned to each car;

a target floor instruction process generating target floor data including a target floor based on call data stored by said call data storage process and station call data stored by said station call registration process;

an arrival time estimation process estimating a time taken for said car to reach said target floor, in consideration of said operating states of other cars, based on said route data, said target floor data, said call data and car data detected by said car data detection process; and an assignment instruction process assigning based on the estimated arrival time obtained by said arrival time estimation process a certain car to a certain floor call.

8. An elevator group management control apparatus controlling operations of a plurality of cars that make vertical and horizontal movement, wherein:

a free car, which is on neither station call nor car call, is controlled to be placed at a floor where said free car will not hinder operation of other cars and also said free car can respond quickly to a new station call that will arise subsequently, based on route data indicating a route in vertical and horizontal directions through which each of said cars should be operated.

9. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified.

10. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a next traverse floor detection device that, based upon said route data stored in said route data storage device and said car data relating to each of said cars, detects a traverse floor closest to each of said free cars in an advancing direction thereof, and a free car stop position determining device that determines said traverse floor detected by said next traverse floor detection device as said stop position for said free car.

11. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a succeeding car operation scheduled position detection device that, based upon said route data stored in said route data storage device and said car data relating to each of said cars, detects the position of a station call or the position of a car call assigned to a succeeding car that is closest to a floor where a free car is present among all cars on call operating behind said free car (succeeding cars), and a free car stop position determining device that, when said succeeding car is to be operated to a position that has been detected by said succeeding car operation scheduled position detection device and, if the presence of said free car presents a hindrance to operation of said succeeding car, determines a stop position for said free car to move said free car to a traverse floor where said free car poses no hindrance to said succeeding car.

12. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a preceding car operating floor detection device that, based upon said route data stored in said route data storage device and said car data relating to each of said cars, when there are cars on call operating ahead of a free car (preceding car), detects the operating floor of a preceding car closest to said free car among said preceding cars, and a free car stop position determining device that, when a floor where said free car is operating is at or more than a specific distance from the position of said preceding car detected by said preceding car operating floor detection device, determines a stop position for said free car to move said free car within said specific distance from said preceding car.

13. An elevator group management control apparatus according to claim 9, wherein said free car stop position specifying device comprises:

a car separation calculating device that calculates car distance between cars on call based upon said route data stored in said route data storage device and said car data relating to each of said cars, and a free car stop position determining device that determines stop positions for free cars in order to make said car distance consistent based upon car separation data obtained from said car separation calculating device.

14. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a preceding and succeeding car operation data detection device that, based upon said route data stored in said route data storage device and said car data relating to each of said cars, detects a preceding car operating ahead of each free car including an operating floor and direction thereof and detects a succeeding car operating behind each free car including an operating floor and direction thereof, a car separation calculating device that calculates distances between said preceding cars and said succeeding cars, and a free car stop position determining device that, using preceding and succeeding car operation data obtained from said succeeding and preceding car operation data detection device, sets a position half way between said preceding car and said succeeding car as a stop position for each said free car.

15. An elevator group management control apparatus according to claim 9, wherein said free car stop position specifying device comprises:

a no station call floor detection device that detects floors where no station calls have been generated, based upon said call data sent from said call data storage device, and a free car stop position determining device that, using said route data stored in said route data storage device, said car data relating to each of said cars and said free car data sent from said free car search device, sets positions where the average time required by each free car to reach a no station call floor is consistent for each said free car, as stop positions for said free cars.

16. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a no station call floor detection device that detects floors where no station calls have been generated, based upon said call data sent from said call data storage device, a station call frequency calculating device that stores in memory cumulative data of the number of times station calls have been generated for each floor every time a station call is newly registered in said station call registration device to calculate a relative value for each floor, and a free car stop position determining device that, using said car data relating to each of said cars, said free car data sent from said free car search device and station call frequency data for each floor obtained from said station call frequency calculating device, selects floors with a high frequency of station call generation to set as stop positions for free cars.

17. An elevator group management control apparatus according to claim 9, wherein said free car stop position specifying device comprises:

a free car inclusion judging device that makes a judgment as to whether or not a free car is present within a preset specific area satisfying specific requirements based upon said car data and said free car data, and a free car stop position specifying device which, using said car data, said free car data and free car inclusion status data obtained from said free car inclusion judging device, places said free car within said specific area.

18. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a holding area condition judging device that makes a judgment as to whether or not a car on call is present within a specific area satisfying specific requirements based upon said car data and said free car data, and a free car stop position determining device that, using said car data, said free car data and specific area car operation status data obtained from said holding area condition judging device, places free cars within said specific area which may be utilized as said holding area.

19. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a no station call floor detection device that detects floors where no station calls have been generated based upon said call data sent from said call data storage device, an on-route data storage device that, when a car responds to a station call registered in said station call registration device and a car call registration is made by a passenger who has boarded said car at a floor, stores in memory said car call registration as data, and a free car stop position determining device that, using said car data, said free car data and on-route data stored in said on-route data storage device, places free cars at floors with heavy passenger traffic.

20. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises;

a no station call floor detection device that detects floors where no station calls have been generated based upon said call data sent from said call data storage device, a station call delete data storage device that, every time a station call registered in said station call registration device is deleted, stores in memory floors whose station calls have been deleted in chronological order, and a free car stop position determining device that, using car data, said free car data and station call delete data stored in said station call delete data storage device, places free cars sequentially starting with a floor whose station call was deleted earliest.

21. An elevator group management control apparatus controlling operations of a plurality of cars that make vertical and horizontal movement, comprising:

a car data detection device that detects an operating state of each of said cars;

a station call registration device that registers a station call;

a call data storage device that stores in memory call data constituted of car calls made from each of said cars and station calls assigned to each of said cars;

a route data storage device that stores therein with respect each said car, route data indicating a route in vertical and horizontal directions through which the car should be operated, represented by each floor and shaft forming the route;

an assignment instruction device that, based upon car data detected by said car data detection device, route data stored in said route data storage device and said call data stored in said call data storage device, selects a car to respond to a station call registered in said station call registration device, outputs an assignment state for cars to said call data storage device to have said call data updated and stored in memory;

a free car search device that, by inputting said call data for each of said cars stored in said call data storage device, searches for a free car, which is on neither station call nor car call;

a free car stop position specifying device that, using free car data retrieved by said free car search device, said car data relating to each of said cars and said route data stored in said route data storage device, specifies a position where said free car should be stopped in conformance to specific criteria; and an operation instruction device that outputs an operation instruction in order to cause said free car to move to a stop position thus specified;

wherein said free car stop position specifying device comprises:

a station call delete data storage device that stores in memory a specific number of floors, including direction, whose station calls have been deleted and updates said memory in chronological order every time a station call is registered in said station call registration device, and a free car stop position determining device that, using said car data, said free car data and station call delete data stored in said station call delete data storage device, places free cars sequentially starting with a floor whose station call was deleted most recently.

22. An elevator group management control apparatus according to any one of claims 9 through 14, wherein said free car stop position specifying device comprises:

a free car stop position review instruction device that searches said call data and outputs an instruction for a review of next stop positions for free cars every time a call status changes.

23. An elevator group management control method for controlling operations of a plurality of cars that make vertical and horizontal movement, wherein:

a free car, which is on neither station call nor car call, is controlled to be placed at a floor where said free car will not hinder operation of other cars and also said free car can respond quickly to a new station call that will arise subsequently, based on route data indicating each route in vertical and horizontal directions through which each of said cars should be operated.

24. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected through said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified.

25. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected through said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a next traverse floor detection step in which, based upon said route data stored in memory through said route data storage processing and said car data relating to each of said cars, a traverse floor closest to each free car in the operating direction thereof is detected, and a free car stop position determining step in which a traverse floor detected in said next traverse floor detection step is determined as a stop position for said free car.

26. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

succeeding car operation scheduled position detection step in which, based upon said route data stored in memory through said route data storage processing and said car data relating to each of said cars, the position of a station call or a position of a car call assigned to a succeeding car closest to the floor where a free car is present, is detected among cars on call (succeeding cars) operating behind said free car, and a free car stop position determining step in which, when said succeeding car is to be operated to a position that has been detected in said succeeding car operation scheduled position detection step and, if the presence of said free car presents a hindrance to operation of said succeeding car, a stop position for said free car is determined, to move said free car to a traverse floor where said free car does not prevent any hindrance to said succeeding car.

27. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a preceding car operating floor detection step in which, based upon said route data stored in memory through said route data storage processing and said car data relating to each of said cars, when there are cars (preceding cars) on call operating ahead of a free car, the operating floor of the preceding car closest to said free car among said preceding cars is detected, and a free car stop position determining step in which, when the floor where said free car is operating is at or more than a specific distance from the position of said preceding car detected in said preceding car operating floor detection step, a stop position for said free car is determined to move said free car within said distance from said preceding car.

28. An elevator group management control method according to claim 24, wherein said free car stop position specifying processing includes:

a car separation calculation step in which car distances between cars on call are calculated based upon said route data stored in memory through said route data storage processing and said car data relating to each of said cars, and a free car stop position determining step in which stop positions for free cars are determined in order to make said car distances consistent, based upon car separation data obtained in said car separation calculation step.

29. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a preceding and succeeding car operation data detection step in which, based upon said route data stored in memory through said route data storage processing and said car data relating to each of said cars, a preceding car operating ahead of each free car, including an operating floor and directions thereof, and succeeding cars operating behind each free car, including floors and operating directions thereof, are detected from among cars on call, a car separation calculation step in which distances between said preceding cars and said succeeding cars are calculated, and a free car stop position determining step in which, using preceding and succeeding car operation data obtained in said preceding and succeeding car operation data detection step, a position half way between said preceding car and said succeeding car is set as a stop position for each said free car.

30. An elevator group management control method according to claim 24, wherein said free car stop position specifying processing includes:

a no station call floor detection step in which floors where no station calls have been generated are detected based upon said call data sent through said call data storage processing, and a free car stop position determining step in which, using said route data stored in memory through said route data storage processing, said car data relating to each of said cars and said free car data sent through said free car search processing, positions where the average time required by each free car to reach a no station call floor is consistent for each of said free cars are set as stop positions for said free cars.

31. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a no station call floor detection step in which floors where no station calls have been generated are detected, based upon said call data sent through said call data storage processing, a station call frequency calculation step in which, every time a station call is newly registered through station call registration processing, cumulative data of the number of times station calls have been generated for each floor are stored in memory and relative values for all floors are determined, and a free car stop position determining step in which, using said car data relating to each of said cars, said free car data sent obtained through said free car search processing and station call frequency data for each floor obtained through said station call frequency calculation step, floors with a high frequency of station call generation are selected to set as stop positions for said free cars.

32. An elevator group management control method according to claim 24, wherein said free car stop position specifying processing includes:

a free car inclusion judging step in which a judgment is made as to whether or not a free car is present within a preset specific area satisfying specific requirements, based upon said car data and said free car data, and a free car stop position determining step in which, using said car data, said free car data and free car inclusion status data obtained in said free car inclusion judging step, said free car is placed within said specific areas.

33. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a holding area condition judging step in which a judgment is made as to whether or not a car on call is present within a specific area satisfying specific requirements based upon said car data and said free car data, and a free car stop position determining step in which, using said car data, said free car data and specific area car operation status data obtained through said holding area condition judging step, free cars are placed within said specific area which may be utilized as said holding area.

34. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a no station call floor detecting step in which floors where no station calls have been generated are detected based upon call data sent through said call data storage processing, an on-route data storage step in which, when a car responds to a station call registered in said station call registration processing and a car call registration is made by a passenger who has boarded said car at a floor where said station call has been generated, said car call registration is stored in memory as data, and a free car stop position determining step in which, using said car data, said free car data and on-route data stored in memory in said on route data storage step, free cars are placed at floors with heavy passenger traffic.

35. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a no station call floor detection step in which floors where no station calls have been generated are detected based upon said call data sent through said call data storage processing, a station call delete data storage step in which, every time a station call registered through said station call registration processing is deleted, floors whose station calls have been deleted are stored in memory in chronological order, and a free car stop position determining step in which, using said car data, said free car data and station call delete data stored in memory in said station call delete data storage step, free cars are placed sequentially starting with a floor whose station call was deleted earliest.

36. An elevator group management control method for controlling operations of a plurality of cars that make vertical and horizontal movement, comprising:

car data detection processing in which an operating state of each of said cars is detected;

station call registration processing in which a station call is registered;

call data storage processing in which call data constituted of car calls made from each of said cars and station calls assigned to each of said cars are stored in memory;

route data storage processing in which, with respect to each said car, route data indicating a route in vertical and horizontal directions through which the car should be operated, represented by each floor and shaft forming the route is stored in memory;

assignment instruction processing in which, based upon car data detected by said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search processing in which, by inputting said call data relating to each of said cars stored in memory through said call data storage processing, a free car which is on neither station call nor car call is searched;

free car stop position specifying processing in which using free car data retrieved through said free car search processing, said car data relating to each of said cars and said route data stored in memory through said route data storage processing, positions where said free cars should be stopped are specified in conformance to specific criteria; and operation instruction processing in which an operation instruction is output in order to cause said free car to move to a stop position thus specified;

wherein said free car stop position specifying processing includes:

a station call delete data storage step in which, every time a station call registered through said station call registration processing is deleted, floors whose station calls have been deleted (including the directions thereof) are stored in memory in chronological order, and a free car stop position determining step in which, using said car data, said free car data and station call delete data stored in said station call delete data storage step, free cars are placed sequentially starting with the floor whose station call was deleted most recently.

37. An elevator group management control method according to any one of claims 24 through 29, wherein said free car stop position specifying processing includes:

a free car stop position review instruction step in which said call data are searched and an instruction for a review of next stop positions for free cars is output every time a call status changes.

38. An elevator group management control apparatus for use in an elevator system comprising a plurality of vertically- and horizontally-movable cars each capable of stopping at a plurality of floors, a car operation control device controlling the operation of the cars, one or more station call registration devices installed in the station of each floor, and a car data detection device detecting the state of each of said cars, said elevator group management control apparatus comprising:

a call data storage device storing call data consisting of car calls from each of said cars and station calls assigned to each car;

a direction data storage device receiving car data detected by said car data detection device and call data stored in said call data storage device, estimating the direction of a shaft associated with each of said cars, and updating and storing resulting data as direction data;

a number-of-shafts detection device receiving direction data stored in said direction data storage device and, for each shaft, finding the number of shafts in the same direction as the direction of the shaft;

a shaft data storage device receiving car data detected by said car data detection device, estimating the floor and the shaft of each of said cars, and storing resulting data about estimated floors and shafts as shaft data;

a horizontal movement destination detection device receiving shaft data stored in said shaft data storage device, checking the presence of a car moving horizontally, and finding the horizontal movement destination shaft of the car;

a reversing car determination device receiving new station call data stored in said station call registration device, call data stored in said call data storage device, direction data of each of said cars stored in said direction data storage device, shaft data of each of said cars stored in said shaft data storage device, the number of shafts in the same direction as the direction of each of said cars detected by said number-of-shafts detection device, and the number of a horizontal movement destination shaft detected by said horizontal movement destination detection device and determining a car to be reversed in order to respond to the new station call added to said station call registration device;

an assignment instruction device receiving reversing car data determined by said reversing car determination device, call data of each of said cars stored in said call data storage device, new station call data added to said station call registration device, direction data of each of the cars stored in said direction data storage device, and car data detected by said car data detection device, determining a car to respond to the new station call and, at the same time, issuing an instruction to cause said call data storage process to store information on the car; and an operation instruction device issuing an operation instruction to a car determined by said assignment instruction device and, if the car is the one determined by said reversing car determination device, issuing another operation instruction to the other car in the shaft of the determined car.

39. An elevator group management control apparatus as claimed in claim 38 wherein said reversing car determination device comprises:

an opposite direction car selection module selecting the cars in the shafts moving in the direction opposite to the direction to respond to a new station call;

an unchecked car selection module selecting from the cars selected by said opposite direction car selection module a car not yet checked if it is eligible for a reversing car and outputting the number of the car;

a station call finding module checking if there is a station call for the car selected by said unchecked car selection module;

a car call finding module checking if there is a car call for the car determined by said station call finding module that there is no station call;

a movement direction finding module checking if the direction into which the car, determined by said car call finding module that there is no car call, will move to respond to the new station call is opposite to the direction of the shaft of the car;

a shaft direction finding module checking if, for the car determined by said movement direction finding module that the direction into which the car will move to respond to the new station call is opposite to the direction of the shaft, there is at least one other shaft moving into the same direction;

an other-car finding module checking if, for the car determined by said shaft direction finding module that there is at least one other shaft in the same direction as the direction of the car, there is another car in the shaft of the car;

an other-car call finding module checking, when said other-car finding module found that there is another car in the shaft of the car, that there is neither a station call nor a car call for the other car;

a horizontal movement finding module checking if there is a car moving horizontally to the shaft of the car;

a reversing car storage module storing and outputting information indicating that the car may be reversed when said horizontal movement finding module found that there is no car moving to the shaft of the car;

a check finish confirming module outputting to the unchecked car selection module the number of a car selected by said opposite direction car selection module but not yet checked if the car is eligible for a reversing car; and a reversing car specifying module receiving the number of a reversible car stored in said reversing car storage module, and outputting the number to said assignment instruction device.

40. An elevator group management control apparatus as claimed in claim 38 wherein said reversing car determination device comprises:

an opposite direction car selection module selecting the cars in the shafts moving in the direction opposite to the direction to respond to a new station call;

an unchecked car selection module selecting from the cars selected by said opposite direction car selection module a car not yet checked if it is eligible for a reversing car and outputting the number of the car;

a station call finding module checking if there is a station call for the car selected by said unchecked car selection module;

a car call finding module checking if there is a car call for the car determined by said station call finding module that there is no station call;

a car call position finding module checking if, for the car determined by said car call finding module that there is a car call, the car call is requested for a floor on the way to the floor requested by the new station call;

a movement direction finding module checking if the direction into which the car, determined by said car call finding module that there is no car call, will move to respond to the new station call is the same direction as the direction of the shaft of the car;

a shaft direction finding module checking if, for the car determined by said movement direction finding module that the direction into which the car will move to respond to the new station call is the same as the direction of the shaft, there is at least one other shaft moving into the same direction;

an other-car finding module checking if, for the car determined by said shaft direction finding module that there is at least one other shaft in the same direction as the direction of the car, there is another car in the shaft of the car;

an other-car call finding module checking, when said other-car finding module found that there is another car in the shaft of the car, that there is neither a station call nor a car call for the other car;

a horizontal movement finding module checking if there is a car moving horizontally to the shaft of the car;

a reversing car storage module storing and outputting information indicating that the car may be reversed when said horizontal movement finding module found that there is no car moving to the shaft of the car;

a check finish confirming module outputting to the unchecked car selection module the number of a car selected by said opposite direction car selection module but not yet checked if the car is eligible for a reversing car; and a reversing car specifying module receiving the number of a reversible car stored in said reversing car storage module, and outputting the number to said assignment instruction device.

41. An elevator group management control apparatus controlling operations of a plurality of vertically- and horizontally-movable cars, said elevator group management control apparatus comprising:

a car data detection device detecting an operating state of each of said cars;

a station call registration device registering a station call;

a call data storage device storing call data consisting of car calls from each of said cars and station calls assigned to each car;

a direction data storage device receiving car data detected by said car data detection device and call data stored in said call data storage device, estimating the direction of the shaft of each of said cars, and updating and storing resulting data as direction data;

a shaft data storage device receiving car data detected by said car data detection device, estimating the floor and the shaft of each of said cars, and storing resulting data about estimated floors and shafts as shaft data;

a route data storage device storing a route along which each car should run;

a horizontally-moving floor arrival estimation device receiving direction data of the shaft of each car stored in said direction data storage device, shaft data of the shaft of each car stored in said shaft data storage device, and route data of a route along which each car should move stored in said route data storage device and, for each shaft, estimating a car arriving at each horizontally-moving floor of each shaft first;

a horizontal movement destination detection device receiving shaft data stored in said shaft data storage device, checking the presence of a car moving horizontally, and finding the horizontal movement destination shaft of the car;

a reversing car determination device receiving new station call data stored in said station call registration device, call data stored in said call data storage device, direction data of each of said cars stored in said direction data storage device, shaft data of each of said cars stored in said shaft data storage device, route data of each car stored in said route data storage device, the number of a car estimated by said horizontally-moving floor arrival estimation device as a car arriving first at a horizontally-moving floor, and the number of a horizontal movement destination shaft detected by said horizontal movement destination detection device and determining a car to be reversed in order to respond to the new station call added to said station call registration device;

an assignment instruction device receiving reversing car data determined by said reversing car determination device, call data of each of said cars stored in said call data storage device, new station call data added to said station call registration device, direction data of each of the cars stored in said direction data storage device, car data detected by said car data detection device, and route data of each car stored in said route data storage device, determining a car to respond to the new station call and issuing an instruction to cause said call data storage device to store information on the car; and an operation instruction device issuing an operation instruction to a car determined by said assignment instruction device and, if the car is the one determined by said reversing car determination device, issuing another operation instruction to the other car in the shaft of the determined car.

42. An elevator group management control apparatus as claimed in claim 41 wherein said reversing car determination device comprises:

an opposite direction car selection module selecting the cars in the shafts moving in the direction opposite to the direction to respond to a new station call;

an unchecked car selection module selecting from the cars, selected by said opposite direction car selection module, a car not yet checked if it is eligible for a reversing car and outputting the number of the car;

a station call finding module checking if there is a station call for the car selected by said unchecked car selection module;

a car call finding module checking if there is a car call for the car determined by said station call finding module that there is no station call;

a movement direction finding module checking if the direction into which the car, determined by said car call finding module that there is no car call, will move to respond to the new station call is opposite to the direction of the shaft of the car;

an other-car finding module checking if, in the shaft of, and with respect to, said car, there is another car at a floor in the direction to the floor requested by the new station call;

an other-car direction finding module checking if the other car found by said other-car finding module is moving into the direction to the floor requested by the new station call;

a horizontally-moving floor finding module checking if there is a horizontally-moving floor between said car and the other car;

a route crossing finding module checking if, when said horizontally-moving floor finding module finds that there is a horizontally-moving floor between said car and the other car, the route of the car to the floor requested by the new station call and the route of said other car cross each other;

a horizontally-moving route finding module checking if, when said route crossing finding module finds that the route of the car to the floor requested by the new station call and the route of said other car cross each other, the other car moves horizontally on said horizontally-moving floor while moving along the route;

a horizontally-moving floor arrival car finding module receiving the result obtained by said horizontally-moving route finding module and the number of the car arriving first at each horizontally-moving floor estimated by said horizontally-moving floor arrival estimation device, and finding a car arriving at said horizontally-moving floor first;

a horizontal movement finding module checking if there is another car moving horizontally to the shaft of said car moving to respond to the new station call;

an after-horizontal-movement direction finding module checking if the direction of the other car found by the said horizontal movement finding module is the same as the direction to the new station call after horizontal movement;

a reversing car storage module storing and outputting said car as a reversible car when the direction of the other car found by said after-horizontal-movement direction finding module is the same as the direction to the new station call;

a check finish confirming module outputting to the unchecked car selection module the number of a car selected by said opposite direction car selection module but not yet checked if the car is eligible for a reversing car; and a reversing car specifying module receiving the number of a reversible car stored in said reversing car storage module, and outputting the number to said assignment instruction device.

43. An elevator group management control apparatus according to claim 41 wherein said reversing car determination device comprises:

an opposite direction car selection module selecting the cars in the shafts moving in the direction opposite to the direction to respond to a new station call;

an unchecked car selection module selecting from the cars, selected by said opposite direction car selection module, a car not yet checked if it is eligible for a reversing car and outputting the number of the car;

a station call finding module checking if there is a station call for the car selected by said unchecked car selection module;

a car call finding module checking if there is a car call for the car determined by said station call finding module that there is no station call;

a car call position finding module checking if, for the car determined by said car call finding module that there is a car call, the car call is requested for a floor on the way to the floor requested by the new station call;

a movement direction finding module checking if the direction into which the car, determined by said car call finding module that there is no car call, will move to respond to the new station call is the same as the direction of the shaft of the car;

an other-car finding module checking if, in the shaft of, and with respect to, said car, there is another car at a floor in the direction to the new station call;

an other-car direction finding module checking if the other car found by said other-car finding module is moving into the direction to the floor requested by the new station call;

a horizontally-moving floor finding module checking if there is a horizontally-moving floor between said car and the other car;

a route crossing finding module checking if, when said horizontally-moving floor finding module finds that there is a horizontally-moving floor between said car and the other car, the route of the car after responding to the new station call and the route of said other car cross each other;

a horizontally-moving route finding module checking if, when said route crossing finding module finds that the route of the car after responding to the new station call and the route of said other car cross each other, the other car moves horizontally on said horizontally-moving floor while moving along the route;

a horizontally-moving floor arrival car finding module receiving the result obtained by said horizontally-moving route finding module and the number of the car arriving first at each horizontally-moving floor estimated by said horizontally-moving floor arrival estimation device, and finding a car arriving at said horizontally-moving floor first;

a horizontal movement finding module checking if there is another car moving horizontally to the shaft of said car moving to respond to the new station call;

an after-horizontal-movement direction finding module checking if the direction of the other car found by the said horizontal movement finding module is opposite to the direction to the new station call after horizontal movement;

an other-car-between-floor finding module checking if, in the shaft of said car and at a floor between the current floor of said car and the floor requested by the new station call, there is another car;

a reversing car storage module storing and outputting said car as a reversible car when said other-car-between-floor finding module finds that there is no car;

a check finish confirming module outputting to the unchecked car selection module the number of a car selected by said opposite direction car selection module but not yet checked if the car is eligible for a reversing car; and a reversing car specifying module receiving the number of a reversible car stored in said reversing car storage module, and outputting the number to said assignment instruction device.

44. An elevator group management control apparatus as claimed in claims 38 or 41, further comprising:

a re-assignment instruction device finding a car capable of responding to a new station call sooner than a car assigned to respond to the call, as car data obtained by said car data detection device and call data stored in said call data storage device change, and issuing an instruction to change the assignment of the call.

45. An elevator group management control apparatus as claimed in claim 38 or 41 wherein said operation instruction device issues an operation instruction to a car determined by said assignment instruction device and, at the same time if the car is determined by said reversing car determination device as a reversing car, a stop instruction to the other car in the shaft of the car.

46. An elevator group management control method controlling operations of a plurality of vertically- and horizontally-movable cars, said elevator group management control method comprising:

a car data detection process detecting an operating state of each of said cars;

a station call registration process registering a station call;

a call data storage process storing call data consisting of car calls from each of said cars and station calls assigned to each car;

a direction data storage process receiving car data detected by said car data detection device and call data stored in said call data storage device, estimating the direction of a shaft associated with each of said cars, and updating and storing resulting data as direction data;

a number-of-shafts detection process receiving direction data stored by said direction data storage process and, for each shaft, finding the number of shafts in the same direction as the direction of the shaft;

a shaft data storage process receiving car data detected by said car data detection process, estimating the floor and the shaft of each of said cars, and storing resulting data about estimated floors and shafts as shaft data;

a horizontal movement destination detection process receiving shaft data stored by said shaft data storage process, checking the presence of a car moving horizontally, and finding the horizontal movement destination shaft of the car;

a reversing car determination process receiving new station call data stored by said station call registration process, call data stored by said call data storage process, direction data of each of said cars stored by said direction data storage process, shaft data of each of said cars stored by said shaft data storage process, the number of shafts in the same direction as the direction of each said cars detected by said number-of-shafts detection process, and the number of a horizontal movement destination shaft detected by said horizontal movement destination detection process and determining a car to be reversed in order to respond to the new station call added to said station call registration device;

an assignment instruction process receiving reversing car data determined by said reversing car determination process, call data of each of said cars stored by said call data storage process, new station call data added by said station call registration process, direction data of each of the cars stored by said direction data storage process, car data detected by said car data detection process, determining a car to respond to the new station call and issuing an instruction to cause said call data storage device to store information on the car; and an operation instruction process issuing an operation instruction to a car determined by said assignment instruction process and, if the car is the one determined by said reversing car determination process, issuing another operation instruction to the other car in the shaft of the determined car.

47. An elevator group management control method as claimed in claim 46 wherein said reversing car determination process comprises:

an opposite direction car selection step for selecting the cars in the shafts moving in the direction opposite to the direction to respond to a new station call;

an unchecked car selection step for selecting from the cars, selected by said opposite direction car selection step, a car not yet checked if it is eligible for a reversing car and outputting the number of the car;

a station call finding step for checking if there is a station call for the car selected by said unchecked car selection step;

a car call finding step for checking if there is a car call for the car determined by said station call finding step that there is no station call;

a movement direction finding step for checking if the direction into which the car, determined by said car call finding step that there is no car call, will move to respond to the new station call is opposite to the direction of the shaft of the car;

a shaft direction finding step for checking if, for the car determined by said movement direction finding step that the direction into which the car will move to respond to the new station call is opposite to the direction of the shaft, there is at least one other shaft moving into the same direction;

an other-car finding step for checking if, for the car determined by said shaft direction finding step that there is at least one other shaft in the same direction as the direction of the car, there is another car in the shaft of the car;

an other-car call finding step for checking, when said other-car finding step found that there is another car in the shaft of the car, that there is neither a station call nor a car call for the other car;

a horizontal movement finding step for checking if there is a car moving horizontally to the shaft of the car;

a reversing car storage step for storing and outputting information indicating that the car may be reversed when said horizontal movement finding step found that there is no car moving to the shaft of the car;

a check finish confirming step for outputting to the unchecked car selection step the number of a car selected by said opposite direction car selection step but not yet checked if the car is eligible for a reversing car; and a reversing car specifying step for receiving the number of a reversible car stored by said reversing car storage step, and outputting the number to said assignment instruction process.

48. An elevator group management control method as claimed in claim 46 wherein said reversing car determination process comprises:

an opposite direction car selection step for selecting the cars in the shafts moving in the direction opposite to the direction to respond to a new station call;

an unchecked car selection step for selecting from the cars, selected by said opposite direction car selection step, a car not yet checked if it is eligible for a reversing car and outputting the number of the car;

a station call finding step for checking if there is a station call for the car selected by said unchecked car selection step;

a car call finding step for checking if there is a car call for the car determined by said station call finding step that there is no station call;

a car call position finding step for checking if, for the car determined by said car call finding step that there is a car call, the car call is requested for a floor on the way to the floor requested by the new station call;

a movement direction finding step for checking if the direction into which the car, determined by said car call finding step that there is no car call, will move to respond to the new station call is the same direction as the direction of the shaft of the car;

a shaft direction finding step for checking if, for the car determined by said movement direction finding step that the direction into which the car will move to respond to the new station call is the same as the direction of the shaft, there is at least one other shaft moving into the same direction;

an other-car finding step for checking if, for the car determined by said shaft direction finding step that there is at least one other shaft in the same direction as the direction of the car, there is another car in the shaft of the car;

an other-car call finding step for checking, when said other-car finding step found that there is another car in the shaft of the car, that there is neither a station call nor a car call for the other car;

a horizontal movement finding step for checking if there is a car moving horizontally to the shaft of the car;

a reversing car storage step for storing and outputting information indicating that the car may be reversed when said horizontal movement finding step found that there is no car moving to the shaft of the car;

a check finish confirming step for outputting to the unchecked car selection step the number of a car selected by said opposite direction car selection step but not yet checked if the car is eligible for a reversing car; and a reversing car specifying step for receiving the number of a reversible car stored by said reversing car storage step, and outputting the number to said assignment instruction process.

49. An elevator group management control method for controlling operations of a plurality of vertically- and horizontally-movable cars, said elevator group management control method comprising:

a car data detection process detecting an operating state of each of said cars;

a station call registration process registering a station call;

a call data storage process storing call data consisting of car calls from each of said cars and station calls assigned to each car;

a direction data storage process receiving car data detected by said car data detection process and call data stored by said call data storage process, estimating the direction of the shaft of each of said cars, and updating and storing resulting data as direction data;

a shaft data storage process receiving car data detected by said car data detection process, estimating the floor and the shaft of each of said cars, and storing resulting data about estimated floors and shafts as shaft data;

a route data storage process storing a route along which each car should run;

a horizontally-moving floor arrival estimation process receiving direction data of the shaft of each car stored by said direction data storage process, shaft data of the shaft of each car stored by said shaft data storage process, and route data of a route along which each car should move stored by said route data storage process and, for each shaft, estimating a car arriving at each horizontally-moving floor of each shaft first;

a horizontal movement destination detection process receiving shaft data stored by said shaft data storage process, checking the presence of a car moving horizontally, and finding the horizontal movement destination shaft of the car;

a reversing car determination process receiving new station call data stored by said station call registration process, call data stored by said call data storage process, direction data of each of said cars stored by said direction data storage process, shaft data of each of said cars stored by said shaft data storage process, route data of each car stored by said route data storage process, the number of a car estimated by said horizontally-moving floor arrival estimation process as a car arriving first at a horizontally-moving floor, and the number of a horizontal movement destination shaft detected by said horizontal movement destination detection process and determining a car to be reversed in order to respond to the new station call added by said station call registration process;

an assignment instruction process receiving reversing car data determined by said reversing car determination process, call data of each of said cars stored by said call data storage process, new station call data added by said station call registration process, direction data of each of the cars stored by said direction data storage process, car data detected by said car data detection process, and route data of each car stored by said route data storage process, determining a car to respond to the new station call and issuing an instruction to cause said call data storage process to store information on the car; and an operation instruction process issuing an operation instruction to a car determined by said assignment instruction process and, if the car is the one determined by said reversing car determination process, issuing another operation instruction to the other car in the shaft of the determined car.

50. An elevator group management control method as claimed in claim 49 wherein said reversing car determination process comprises:

an opposite direction car selection step for selecting the cars in the shafts moving in the direction opposite to the direction to respond to a new station call;

an unchecked car selection step for selecting from the cars, selected by said opposite direction car selection step, a car not yet checked if it is eligible for a reversing car and outputting the number of the car;

a station call finding step for checking if there is a station call for the car selected by said unchecked car selection step;

a car call finding step for checking if there is a car call for the car determined by said station call finding step that there is no station call;

a movement direction finding step for checking if the direction into which the car, determined by said car call finding step that there is no car call, will move to respond to the new station call is opposite to the direction of the shaft of the car;

an other-car finding step for checking if, in the shaft of, and with respect to, said car, there is another car at a floor in the direction to the floor requested by the new station call;

an other-car direction finding step for checking if the other car found by said other-car finding step is moving into the direction to the floor requested by the new station call;

a horizontally-moving floor finding step for checking if there is a horizontally-moving floor between said car and the other car;

a route crossing finding step for checking if, when said horizontally-moving floor finding step finds that there is a horizontally-moving floor between said car and the other car, the route of the car to the floor requested by the new station call and the route of said other car cross each other;

a horizontally-moving route finding step for checking if, when said route crossing finding step finds that the route of the car to the floor requested by the new station call and the route of said other car cross each other, the other car moves horizontally on said horizontally-moving floor while moving along the route;

a horizontally-moving floor arrival car finding step for receiving the result obtained by said horizontally-moving route finding step and the number of the car arriving first at each horizontally-moving floor estimated by said horizontally-moving floor arrival estimation process, and finding a car arriving at said horizontally-moving floor first;

a horizontal movement finding step for checking if there is another car moving horizontally to the shaft of said car moving to respond to the new station call;

an after-horizontal-movement direction finding step for checking if the direction of the other car found by the said horizontal movement finding step is the same as the direction to the new station call after horizontal movement;

a reversing car storage step for storing and outputting said car as a reversible car when the direction of the other car found by said after-horizontal-movement direction finding step is the same as the direction to the new station call;

a check finish confirming step for outputting to the unchecked car selection step the number of a car selected by said opposite direction car selection step but not yet checked if the car is eligible for a reversing car; and a reversing car specifying step for receiving the number of a reversible car stored by said reversing car storage step, and outputting the number to said assignment instruction process.

51. An elevator group management control method according to claim 49 wherein said reversing car determination process comprises:

an opposite direction car selection step for selecting the cars in the shafts moving in the direction opposite to the direction to respond to a new station call;

an unchecked car selection step for selecting from the cars, selected by said opposite direction car selection step, a car not yet checked if it is eligible for a reversing car and outputting the number of the car;

a station call finding step for checking if there is a station call for the car selected by said unchecked car selection step;

a car call finding step for checking if there is a car call for the car determined by said station call finding step that there is no station call;

a car call position finding step for checking if, for the car determined by said car call finding step that there is a car call, the car call is requested for a floor on the way to the floor requested by the new station call;

a movement direction finding step for checking if the direction into which the car, determined by said car call finding step that there is no car call, will move to respond to the new station call is the same as the direction of the shaft of the car;

an other-car finding step for checking if, in the shaft of, and with respect to, said car, there is another car at a floor in the direction to the floor requested by the new station call;

an other-car direction finding step for checking if the other car found by said other-car finding step is moving into the direction to the floor requested by the new station call;

a horizontally-moving floor finding step checking if there is a horizontally-moving floor between said car and the other car;

a route crossing finding step f or checking if, when said horizontally-moving floor finding step finds that there is a horizontally-moving floor between said car and the other car, the route of the car after responding to the new station call and the route of said other car cross each other;

a horizontally-moving route finding step for checking if, when said route crossing finding step finds that the route of the car after responding to the new station call and the route of said other car cross each other, the other car moves horizontally on said horizontally-moving floor while moving along the route;

a horizontally-moving floor arrival car finding step for receiving the result obtained by said horizontally-moving route finding step and the number of the car arriving first at each horizontally-moving floor estimated by said horizontally-moving floor arrival estimation process, and finding a car arriving at said horizontally-moving floor first;

a horizontal movement finding step for checking if there is another car moving horizontally to the shaft of said car moving to respond to the new station call;

an after-horizontal-movement direction finding step for checking if the direction of the other car found by the said horizontal movement finding step is opposite to the direction to the new station call after horizontal movement;

an other-car-between-floor finding step for checking if, in the shaft of said car and at a floor between the current floor of said car and the floor requested by the new station call, there is another car;

a reversing car storage step for storing and outputting said car as a reversible car when said other-car-between-floor finding step finds that there is no car;

a check finish confirming step for outputting to the unchecked car selection step the number of a car selected by said opposite direction car selection step but not yet checked if the car is eligible for a reversing car; and a reversing car specifying step for receiving the number of a reversible car stored by said reversing car storage step, and outputting the number to said assignment instruction process.

52. An elevator group management control method as claimed in claims 46 or 49, further comprising:

a re-assignment instruction process finding a car capable of responding to a new station call sooner than a car assigned to respond to the call, as car data obtained by said car data detection process and call data stored by said call data storage process change, and issuing an instruction to change the assignment of the call.

53. An elevator group management control method as claimed in claim 46 or 49 wherein said operation instruction process issues an operation instruction to a car determined by said assignment instruction process and, at the same time if the car is determined by said reversing car determination process as a reversing car, a stop instruction to the other car in the shaft of the car.

54. An elevator group management control apparatus controlling operations of a plurality of vertically- and horizontally-movable cars, said elevator group management control apparatus comprising:

means for determining whether a target car is to respond to a new station call;

means for determining the operation state of another car in the same shaft of the target car and the operation state of some other car moving horizontally from some other shaft; and means for reversing said target car when it is confirmed that said target car, if reversed, will not collide with any of said other cars and when it is determined that said target car is able to arrive at the floor requested by the new station call first.

55. An elevator group management control method for controlling operations of a plurality of vertically- and horizontally-movable cars, said elevator group management control method comprising:

determining whether there is a target car for responding to a new station call;

determining the operation state of another car in the same shaft of the target car and the operation state of some other car moving horizontally from some other shaft; and reversing said target car when it is confirmed that said target car, if reversed, will not collide with any of said other cars and when it is determined that said target car is able to arrive at the floor requested by the new station call first.

56. A carriage management control apparatus controlling operations of a plurality of carriages each capable of moving vertically and horizontally across a plurality of shafts, said carriage management control apparatus comprising:

storage means for storing with respect to each said carriage, route data in vertical and horizontal directions describing a route along which a carriage moves; and management means for managing the operation of said carriages, in consideration of operating states of other carriages, according to said route data.

57. A carriage management control apparatus according to claim 56, wherein said management means comprises estimation means for estimating a time, required for said carriage to arrive at a target position, based on said route data.

58. A carriage management control apparatus according to claim 57, wherein said management means further comprises assignment means for assigning a carriage based on said estimated arrival time.

59. A carriage management control apparatus according to claim 58, wherein said assignment means comprises:

non-response time calculation means for calculating a non-response time based on the estimated arrival time of a carriage and the estimated arrival time of another carriage; and selection means for selecting a carriage corresponding to the minimum non-response time.

60. A carriage management control apparatus according to claim 56, wherein said management means further comprises target position data generation means for generating target position data for moving said carriage to a target position based on call data consisting of carriage calls given from said carriage and station calls given to said carriage.

61. A carriage management control apparatus according to claim 58, wherein said assignment means comprising:

non-response time calculation means for calculating a non-response time based on the estimated arrival time of a carriage and the estimated arrival time of another carriage;

average time calculation means for calculating average times based on non-response time; and selection means for selecting a carriage corresponding to the minimum average time.

62. A carriage management control apparatus according to claim 56, further comprising collection means for collecting information on the state of said carriages.

63. A carriage management control apparatus controlling operations of a plurality of carriages each capable of moving vertically and horizontally across a plurality of shafts, said carriage management control apparatus comprising:

storage means for storing with respect to each said carriage, route data in vertical and horizontal directions describing a route along which a carriage moves;

management means for managing the operation of said carriages, in consideration of operating states of other carriages, according to said route data, wherein said management means comprises estimation means for estimating a time, required for said carriage to arrive at a target position, based on said route data and assignment means for assigning a carriage based on said estimated arrival time; and second estimation means for estimating derivative carriage calls based on station call data given at a position where said carriage is to stop.

64. A carriage management control apparatus according to claim 63, wherein said assignment means comprises:

service completion time calculation means for calculating a service time from the time said station call data is given to the time a derivative carriage call estimated by second estimation means is responded; and selection means for selecting a carriage corresponding to the minimum time.

65. A carriage management control apparatus according to claim 63, further comprising:

first calculation means for calculating the first service completion time required from the time said station call data is given to the time a derivative carriage call estimated by said second estimation means is responded;

second calculation means for calculating the second service completion time required to respond an already-given carriage call and derivative carriage call; and selection means for calculating the average times based on said first service completion time and said second service completion time and for selecting a carriage corresponding to the minimum average time.

66. A recording medium containing an elevator group management control program for use in an elevator system comprising a plurality of vertically- and horizontally-movable cars, said elevator group management control program comprising:

a route data storage step for storing therein with respect to each said car, route data indicating a route in vertical and horizontal directions through which the car should be operated, represented by each floor and shaft forming the route;

a call data storage step for storing call data consisting of car calls from each of said cars and station calls assigned to each car;

a target floor instruction step for generating target floor data including a target floor based on call data stored by said call data storage process and station call data stored by said station call registration process;

an arrival time estimation step for estimating a time taken for said car to reach said target floor based on said route data, said target floor data, and said call data; and an assignment instruction step for assigning based on the estimated arrival time obtained by arrival time estimation step a certain car to a certain floor call.

67. A recording medium containing an elevator group management control program for use in an elevator system comprising a plurality of vertically- and horizontally-movable cars each capable of stopping at a plurality of floors, a car operation control process controlling the operation of the cars, a station call registration process executed at the station of each floor, and a car data detection process detecting the state of each of said cars, said elevator group management control program comprising:

call data storage step in which call data constituted of car calls made from each of said cars and station calls assigned to each of said cars are stored in memory;

route data storage step in which a route through which each of said cars should be operated are stored in memory;

assignment instruction step in which, based upon car data detected through said car data detection processing, route data stored in memory through said route data storage processing and said call data stored in memory through said call data storage processing, a car to be made to respond to a station call registered through said station call registration processing is selected and assignment states of cars are output to said call data storage processing to have said call data updated and stored in memory;

free car search step in which, by inputting said call data relating to each of said cars stored in memory through said call data storage processing, a free car which is on neither station call nor car call is searched;

free car stop position specifying step in which using free car data retrieved through said free car search processing, said car data relating to each of said cars and said route data stored in memory through said route data processing, positions where said free cars should be stopped are specified in conformance to specific criteria; and an operation instruction step in which an operation instruction is output in order to cause said free car to move to a stop position thus specified.

68. A recording medium containing an elevator group management control program for use in an elevator system comprising a plurality of vertically- and horizontally-movable cars each capable of stopping at a plurality of floors, a car operation control process controlling the operation of the cars, a station call registration process executed at the station of each floor, and a car data detection process detecting the state of each of said cars, said elevator group management control program comprising:

a call data storage step for storing call data consisting of car calls from each of said cars and station calls assigned to each car;

a direction data storage step for receiving car data detected by said car data detection process and call data stored by said call data storage process, for estimating the direction of the shaft of each of said cars, and for updating and storing resulting data as direction data;

a number-of-shafts detection step for receiving direction data stored by said direction data storage process and, for each shaft, for finding the number of shafts in the same direction as the direction of the shaft;

a shaft data storage step for receiving car data detected by said car data detection process, for estimating the floor and the shaft of each of said cars, and for storing resulting data about estimated floors and shafts as shaft data;

a horizontal movement destination detection step for receiving shaft data stored by said shaft data storage process, for checking the presence of a car moving horizontally, and for finding the horizontal movement destination shaft of the car;

a reversing car determination step for receiving new station call data stored by said station call registration process, call data stored by said call data storage process, direction data of each of said cars stored by said direction data storage process, shaft data of each of said cars stored by said shaft data storage process, the number of shafts in the same direction as the direction of each of said cars detected by said number-of-shafts detection process, and the number of a horizontal movement destination shaft detected by said horizontal movement destination detection process, and for determining a car to be reversed in order to respond to the new station call added by said station call registration process;

an assignment instruction step for receiving reversing car data determined by said reversing car determination process, call data of each of said cars stored by said call data storage process, new station call data added by said station call registration process, direction data of each of the cars stored by said direction data storage process, and car data detected by said car data detection process, for determining a car to respond to the new station call and, at the same time, for issuing an instruction to cause said call data storage process to store information on the car; and an operation instruction step for issuing an operation instruction to a car determined by said assignment instruction process and, if the car is the one determined by said reversing car determination process, for issuing another operation instruction to the other car in the shaft of the determined car.

69. A recording medium containing an elevator group management control program for use in an elevator system comprising a plurality of vertically- and horizontally-movable cars each capable of stopping at a plurality of floors, a car operation control process controlling the operation of the cars, a station call registration process executed at the station of each floor, and a car data detection process detecting the state of each of said cars, said elevator group management control program comprising:

a step for checking, for a target car to be checked if the car is to respond to a new station call, the operation state of the other car in the same shaft of the target car and the operation state of some other car moving horizontally from some other shaft and a step for reversing said target car when it is confirmed that said target car, if reversed, will not collide with any of said other cars and when it is determined that said target car is able to arrive at the floor requested by the new station call first.

70. A carriage management control apparatus controlling operations of a plurality of carriages each capable of moving vertically and horizontally across a plurality of shafts, said carriage management control apparatus comprising:

a storage means for storing therein with respect to each said carriage, route data indicating a route in vertical and horizontal directions through which the carriage should be operated;

a management means for managing operations of said plurality of carriages; and means for changing an operating direction of said shafts at any time based on a mutual operating state of said plurality of carriages.

71. A carriage management control apparatus according to claim 70, further comprising:

a determination means for determining a carriage to be reversed.

72. A carriage management control apparatus according to claim 71, wherein said determination means determines a car to be reversed before it responds to a newly generated station call.

73. A carriage management control apparatus according to claim 71, wherein said determination means determines a car to be reversed after it responds to a newly generated station call.

74. A carriage management control apparatus controlling operations of a plurality of carriages each capable of moving vertically and horizontally across a plurality of shafts, said carriage management control apparatus comprising:

a storage means for storing therein with respect to each said carriage, route data indicating a route in vertical and horizontal directions through which the carriage should be operated;

a management means for managing operations of said plurality of carriages; and means for changing an operating direction of said shafts at any time based on a mutual operating state of said plurality of carriages; and a determination means for determining a carriage to be reversed;

wherein said determination means, when there are a plurality of carriages in a single shaft, judges whether one carriage of the carriages may collide with the other carriages in the single shaft if the one carriage is reversed.

75. A carriage management control apparatus according to claim 71, wherein said management means comprises an assignment means for assigning the most suitable carriage of all carriages including a carriage determined by said determination means to be reversed, for a newly generated station call.

76. A carriage management control apparatus according to claim 75, wherein said management means further comprising a re-assignment means for reassigning the most suitable carriage for a newly generated station call after another carriage was assigned for the call.

77. A carriage management control apparatus controlling operations of a plurality of carriages each capable of moving vertically and horizontally across a plurality of shafts, said carriage management control apparatus comprising:

a storage means for storing therein with respect to each said carriage, route data indicating a route in vertical and horizontal directions through which the carriage should be operated;

a management means for managing operations of said plurality of carriages; and means for changing an operating direction of said shafts at any time based on a mutual operating state of said plurality of carriages; and a determination means for determining a carriage to be reversed;

wherein said management means, when a carriage determined by said determination means to be reversed and a second carriage are located in a single shaft, stops the second carriage.

* * * * *

UNITED STATES PATENT AND TRADEMARK OFFICE

CERTIFICATE OF CORRECTION

PATENT NO. : 5,865,274

DATED : February 2, 1999

INVENTOR(S) : Junichi KIJI et al.

It is certified that error appears in the above-identified patent and that said Letters Patent is hereby corrected as shown below:

On the title page, item [75], the 5th Inventor's first name should be:

--Susumu--

Signed and Sealed this

Twentieth Day of July, 1999

*Attest:*

*Attesting Officer*

Q. TODD DICKINSON

*Acting Commissioner of Patents and Trademarks*